US012808065B2

(12) United States Patent
Manthiram et al.

(10) Patent No.: US 12,808,065 B2
(45) Date of Patent: Nov. 24, 2026

(54) PALLADIUM-PLATINUM OXIDE CATALYST FOR AQUEOUS ELECTROCHEMICAL DIRECT EPOXIDATION

(71) Applicants: California Institute of Technology, Pasadena, CA (US); Massachusetts Institute of Technology, Cambridge, MA (US)

(72) Inventors: Karthish Manthiram, Pasadena, CA (US); Minju Chung, Atlanta, GA (US)

(73) Assignees: California Institute of Technology, Pasadena, CA (US); Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 18/917,743

(22) Filed: Oct. 16, 2024

(65) Prior Publication Data

US 2025/0129488 A1 Apr. 24, 2025

Related U.S. Application Data

(60) Provisional application No. 63/544,664, filed on Oct. 18, 2023.

(51) Int. Cl.
*C25B 3/07* (2021.01)
*C25B 3/23* (2021.01)
(Continued)

(52) U.S. Cl.
CPC ..... *C25B 3/07* (2021.01); *C25B 3/23* (2021.01); *C25B 9/23* (2021.01); *C25B 11/032* (2021.01);
(Continued)

(58) Field of Classification Search
CPC ..... C25B 3/07; C25B 3/23
(Continued)

(56) References Cited

U.S. PATENT DOCUMENTS 3,288,692 A 11/1966 LeDuc
3,427,235 A 2/1969 Adrien et al.
(Continued)

FOREIGN PATENT DOCUMENTS

CN 109821530 1/2022
CN 113968829 1/2022
(Continued)

OTHER PUBLICATIONS

Chung, "Electrochemical Alkene Epoxidation Using Water as the Oxygen Source" PhD diss., Massachusetts Institute of Technology, 2023, pp. 1-183. (Year: 2023).*
(Continued)

*Primary Examiner* — Edna Wong
(74) *Attorney, Agent, or Firm* — Leydig, Voit & Mayer, Ltd.

(57) ABSTRACT

Methods and systems for the electrochemical epoxidation of alkenes to generate an epoxide are described herein. The methods and systems comprise: contacting an anode comprising an oxygen atom transfer electrocatalyst with an alkene in the presence of an electrolyte comprising water; applying a voltage to the anode and a cathode to generate the epoxide; wherein the oxygen atom transfer electrocatalyst comprises an at least partially oxidized palladium-platinum alloy characterized by the formula FX1: $Pd_yPt_zO_x$; wherein y is greater than 0 and less than 1; z is greater than 0 and less than 1; wherein the sum of y and z is equal to 1; and x is selected from the range of 0 to 2. The methods and systems disclosed herein comprise a significant advancement in the electrocatalytic epoxidation of alkenes in aqueous and
(Continued)

mixed electrolytes using water as the oxygen atom transfer source.

23 Claims, 67 Drawing Sheets

(51) Int. Cl.
*C25B 9/23* (2021.01)
*C25B 11/032* (2021.01)
*C25B 11/052* (2021.01)
*C25B 11/065* (2021.01)
*C25B 11/075* (2021.01)

(52) U.S. Cl.
CPC ..... *C25B 11/052* (2021.01); *C25B 11/065* (2021.01); *C25B 11/075* (2021.01)

(58) Field of Classification Search
USPC ..... 205/455, 456
See application file for complete search history.

(56) References Cited

U.S. PATENT DOCUMENTS

| | | | |
|---|---|---|---|
| 4,450,055 | A | 5/1984 | Stafford |
| 6,764,589 | B1 | 7/2004 | Pitter |
| 2007/0093669 | A1 | 4/2007 | Le-Khac et al. |
| 2021/0301411 | A1 | 9/2021 | Manthiram et al. |
| 2021/0371991 | A1 | 12/2021 | Manthiram et al. |
| 2022/0298650 | A1 | 9/2022 | Viswanathan et al. |

FOREIGN PATENT DOCUMENTS

| | | |
|---|---|---|
| WO | WO 2006/006979 | 1/2006 |
| WO | WO 2020/068872 | 4/2020 |
| WO | WO 2021/195229 | 9/2021 |
| WO | WO 2022/040311 | 2/2022 |

OTHER PUBLICATIONS

Zhang et al., "Recent Insights on Catalyst Layers for Anion Exchange Membrane Fuel Cells," Advanced Science (Aug. 2021), vol. 8, No. 15, pp. 1-26. (Year: 2021).*
Horwat et al., "Deep Oxidation of Methane on Particles Derived from YSZ-Supported Pd—Pt—(O) Coatings Synthesized by Pulsed Filtered Cathodic Arc," Catalysis Communications (May 20, 2009), vol. 10, No. 10, pp. 1410-1413. (Year: 2009).*
Aitbekova et al. (Oct. 2022) "Templated encapsulation of platinum-based catalysts promotes high-temperature stability to 1,100 °C," Nat. Mater. 21, 1290-1297.
Allsopp et al. (2012) Ullmann's Encyclopedia of Industrial Chemistry—Wiley Online Library (Wiley-VCH Verlag Gmbh & Co. KGaA, Weinheim, Germany.
Bregante et al. (2017) "Kinetic and spectroscopic evidence for reaction pathways and intermediates for olefin epoxidation on Nb in *BEA," J. Catal. 348, 75-89.
Carrillo et al. (2014) "Trapping of mobile Pt species by PdO nanoparticles under oxidizing conditions," J. Phys. Chem. Lett. 5, 2089-2093.
Chen et al. (1979) "Morphology and composition of Pt$z.sbnd;Pd alloy crystallites on SiO2 in reactive atmospheres," J. Catal. 56, 198-218.
Chianese et al. (2007) "Electrophilic Activation of Alkenes by Platinum(II): So Much More Than a Slow Version of Palladium(II)," Angew. Chemie Int. Ed. 46, 4042-4059.
Chou et al. (1980) "Anodic oxidation of propylene on a screen electrode," Chem. Eng. Sci. 35, 1581-1590.
Chung (Jun. 2023) "Electrochemical Alkene Epoxidation using Water as the Oxygen Source," PhD. Thesis, Massachusetts Institute of Technology, 1-183.
Chung et al. (2020) "Mechanism of Chlorine-Mediated Electrochemical Ethylene Oxidation in Saline Water," ACS Catal. 10, 14015-14023.
Chung et al. (Jan. 2024) "Direct propylene epoxidation via water activation over Pd—Pt electrocatalysts," Science. 383, 6678, 49-55.
Chung et al. (Sep. 2022) "Tuning Single-Atom Dopants on Manganese Oxide for Selective Electrocatalytic Cyclooctene Epoxidation," J. Am. Chem. Soc 144, 17416-17422.
De Vleeschouwe et al. (2007) "Electrophilicity and nucleophilicity index for radicals," Org. Lett. 9, 2720-2724.
Gao et al. (2015) "Size-Dependent Electrocatalytic Reduction of CO2 over Pd Nanoparticles," J. Am. Chem. Soc 137, 4288-4291.
Goodman et al. (2019) "Palladium oxidation leads to methane combustion activity: Effects of particle size and alloying with platinum," J. Chem. Phys. 151, 154703.
He et al. (Jul. 2023) "Asymmetric Epoxidation of Alkenes Catalyzed by a Cobalt Complex," J. Am. Chem. Soc 145, 28, 15611-15618.
Holbrook et al. (1975) "Electrooxidation of olefins at a silver electrode," J. Catal. 38, 294-298.
Hwang et al. (2017) "Perovskites in catalysis and electrocatalysis," Science 358,751-756.
Iguchi et al. (2021) "Direct epoxidation of propylene with water at a PtOx anode using a solid-polymer-electrolyte electrolysis cell," Catal. Sci. Technol. 12, 469-473.
International Search Report and Written Opinion, dated Jan. 31, 2025, corresponding to International Application No. PCT/US2024/051587, (from which the present application claims priority,) 12 pp.
Jin et al. (2019) "Epoxidation of Cyclooctene Using Water as the Oxygen Atom Source at Manganese Oxide Electrocatalysts," J. Am. Chem. Soc 141, 6413-6418.
Jong et al. (Dec. 2022) "Electro-oxidation of propylene by palladium functionalized titanium hollow fibre electrodes," J. Catal. 416, 18-28.
Ke et al. (Feb. 2022) "Facet-dependent electrooxidation of propylene into propylene oxide over Ag3PO4 crystals," Nat. Commun. 2022 131. 13, 1-8.
Khatib et al. (2015) "Direct Oxidation of Propylene to Propylene Oxide with Molecular Oxygen: A Review," Catal. Rev. 57, 306-344.
Kim et al. (1998) "MCPBA epoxidation of alkenes: Reinvestigation of correlation between rate and ionization potential," J. Am. Chem. Soc. 120, 9513-9516.
Koroidov et al. (2021) "Chemisorbed oxygen or surface oxides steer the selectivity in Pd electrocatalytic propene oxidation observed by operando Pd L-edge X-ray absorption spectroscopy," Catal. Sci. Technol. 11, 3347-3352.
Lei et al. (2010) "Increased silver activity for direct propylene epoxidation via subnanometer size effects," Science 328, 224-228.
Leow et al. (2020) "Chloride-mediated selective electrosynthesis of ethylene and propylene oxides at high current density," Science 368, 1228-1233.
Li et al. (Feb. 2022) "Opportunities and Challenges in Electrolytic Propylene Epoxidation," J. Phys. Chem. Lett. 13, 2057-2063.
Lin et al. (Jul. 2022) "Direct Oxygen Transfer from H2O to Cyclooctene over Electron-Rich RuO2 Nanocrystals for Epoxidation and Hydrogen Evolution," Angew. Chemie Int. Ed. 61, e202207108.
Liu et al. (Nov. 2022) "Reaction Mechanism and Selectivity Tuning of Propene Oxidation at the Electrochemical Interface," J. Am. Chem. Soc 144, 45, 20895-20902 doi:10.1021/JACS.2C09105/ASSET/IMAGES/LARGE/JA2C09105_0005.JPEG.
Mccrory et al. (2013) "Benchmarking Heterogeneous Electrocatalysts for the Oxygen Evolution Reaction," 135, 45, 16977-16987 doi:10.1021/ja407115p.
Otsuka et al. (1995) "Electrocatalytic Synthesis of Propylene Oxide During Water Electrolysis," J. Catal. 157, 450-460.
Pal et al. (Apr. 2022) "Electrophilicity index revisited," J. Comput. Chem. 44, 278-297.
Park et al. (2020) "Roll-to-roll production of catalyst coated membranes for low-temperature electrolyzers," J. Power Sources. 479 228819.
Plessow et al. (2016) "Sintering of Pt Nanoparticles via Volatile PtO2: Simulation and Comparison with Experiments," ACS Catal. 6, 7098-7108.

(56) References Cited

OTHER PUBLICATIONS

Qiao et al. (2011) "Single-atom catalysis of CO oxidation using Pt1/FeOx," Nat. Chem. 3, 634-641.
Sams et al. (1995) "Mechanistic Aspects of Vanadium-Catalysed Oxygen Transfer Reactions," Acta Chem. Scand. 49, 839-847.
Williams et al. (Feb. 2022) "Accounting for species' thermodynamic activities changes mechanistic interpretations of electrochemical kinetic data," doi:10.26434/CHEMRXIV-2022-VK5Z9.
Winiwarter et al. (2019) "Towards an atomistic understanding of electrocatalytic partial hydrocarbon oxidation: propene on palladium," Energy Environ. Sci. 12, 1055-1067.
Yamanaka et al. (1999) "Electrolytic Synthesis of Propene Oxide from Propene and Water in the Gas Phase," Electrochem. Solid-State Lett. 2, 131-132.
Yang et al. (2015) "Direct Epoxidation of Propylene over Stabilized Cu+ Surface Sites on Titanium-Modified Cu20," Angew. Chemie Int. Ed. 54, 11946-11951.
Ye et al. (1991) "Selective anodic oxidation of camphor," Tetrahedron 47, 29, 5463-5470.
Yoon et al. (2018) "Suppressing Ion Transfer Enables Versatile Measurements of Electrochemical Surface Area for Intrinsic Activity Comparisons," J. Am. Chem. Soc 140, 2397-2400.
Zanardo et al. (1988) "Kinetic study of the epoxidation of 1-Octene with hydrogen peroxide catalyzed by platinum(II) complexes. Evidence of the involvement of two metal species in the oxygen-transfer step," Inorg. Chem. 27, 1966-1973.

* cited by examiner 40 wt% $Pd_1Pt_1$/C, annealed at 500 °C for 3 h under static air 40 wt% $Pd_1Pt_3$/C, annealed at 500 °C for 3 h under static air 40 wt% $Pd_3Pt_1/C$, annealed at 500 °C for 3 h under static air

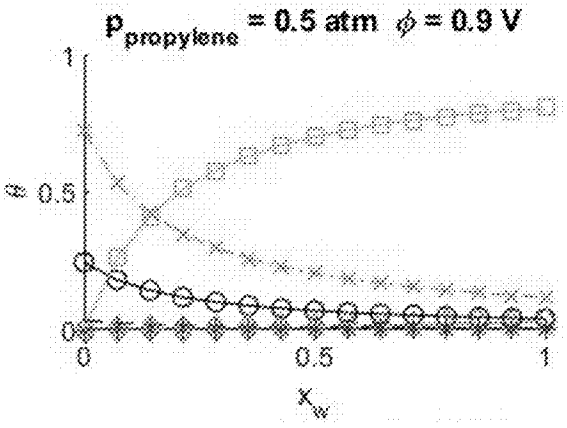
FIG. 32D
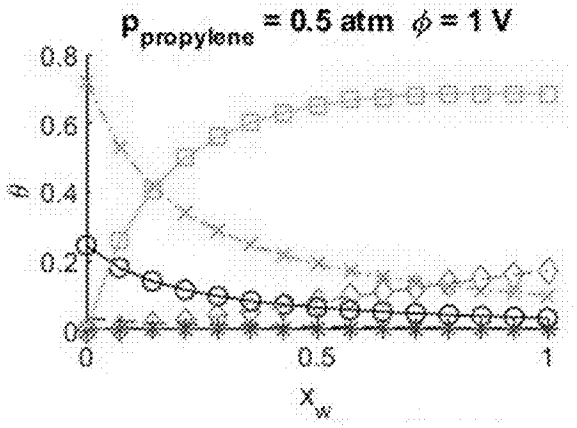
FIG. 32E
FIG. 32F

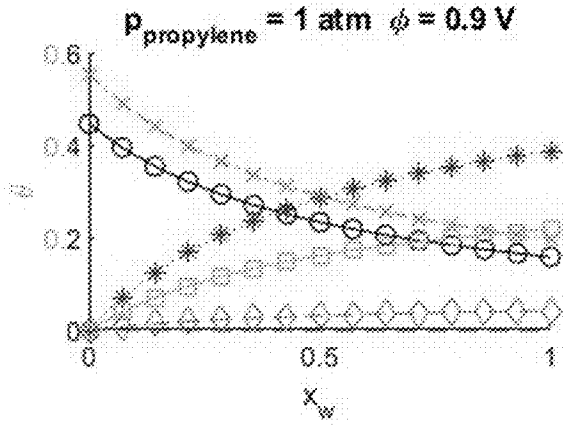
FIG. 36G
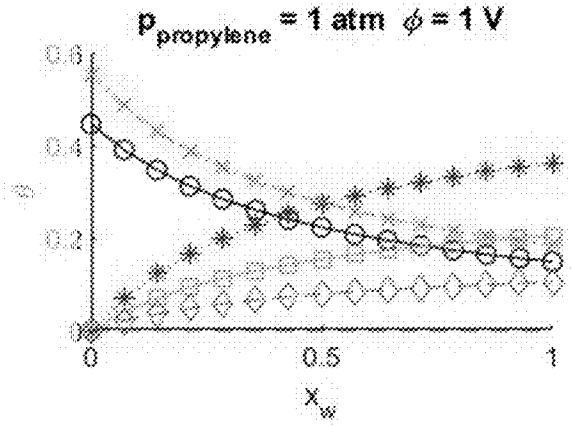
FIG. 36H
FIG. 36I

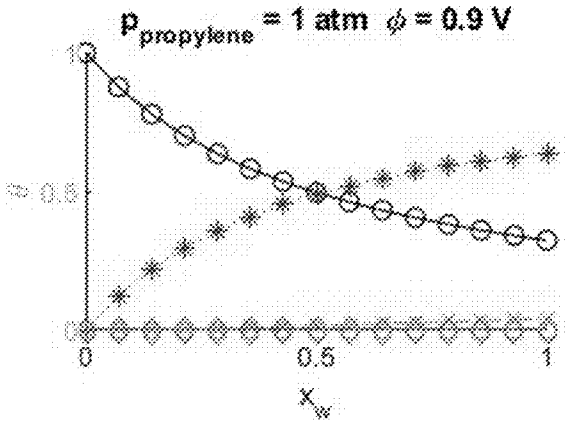
FIG. 37G
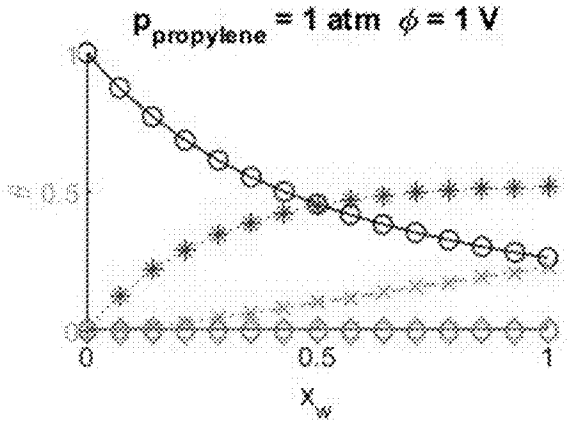
FIG. 37H
FIG. 37I

PALLADIUM-PLATINUM OXIDE CATALYST FOR AQUEOUS ELECTROCHEMICAL DIRECT EPOXIDATION

CROSS-REFERENCE TO RELATED APPLICATIONS

This application claims the benefit of priority to U.S. Provisional Patent Application No. 63/544,664, filed Oct. 18, 2023, which is hereby incorporated by reference in its entirety.

STATEMENT REGARDING FEDERALLY SPONSORED RESEARCH OR DEVELOPMENT

This invention was made with government support under Grant No. DE-SC0023207 awarded by DOE. The government has certain rights in the invention.

BACKGROUND OF INVENTION

Epoxides are an important class of compounds in the chemical, pharmaceutical, and polymer industries. Industrially important epoxides, such as ethylene oxide and propylene oxide, are versatile and in high demand because of their use as chemical building blocks in the industrial synthesis of plastics, adhesives, detergents, solvents, and pharmaceuticals. However, current methods for the epoxidation of alkenes to generate epoxides involve hazardous intermediates, hazardous oxidants, and are inefficient. Thus, current synthetic routes for the epoxidation of alkenes are not environmentally sustainable. For example, the conventional thermal-catalytic production of epoxides, which involves the direct oxidation of an alkene such as ethylene or propylene with $O_2$, consumes large amounts of energy and generates significant carbon emissions. Moreover, hazardous oxidants such as chlorine and peroxides are required.

The highly selective generation of economically desirable products such as propylene oxide and ethylene oxide from the representative alkenes remains a challenge. Electrochemistry offers a promising approach for using water as a sustainable and clean source of oxygen atoms, even at ambient temperatures and pressures. With direct electrochemistry, it is possible to directly transfer reactive intermediates typical of water oxidation to an alkene before the intermediates are fully oxidized into molecular oxygen. While this method provides an environmentally friendly and safe approach, due to the use of water as the oxygen atom source, it typically suffers from low faradaic efficiency and yield. Accordingly, to improve the faradaic efficiency of direct alkene epoxidation using water as the oxygen atom source to industrially relevant levels, new electrocatalysts are needed.

SUMMARY OF THE INVENTION

Provided herein are methods and systems which address the aforementioned and other challenges. In particular, embodiments disclosed herein provide for improved faradaic efficiencies and yields for the production of useful epoxides from direct electrochemical epoxidation of alkenes.

Aspects of the invention include a process for the electrochemical epoxidation of an alkene to generate an epoxide, the process comprising: contacting an anode comprising an oxygen atom transfer electrocatalyst with the alkene in the presence of an electrolyte comprising water; applying a voltage to the anode and a cathode to generate the epoxide; wherein the oxygen atom transfer electrocatalyst comprises an at least partially oxidized palladium-platinum alloy characterized by the formula FX1:

$$Pd_yPt_zO_x \quad \text{(FX1);}$$

wherein y is greater than 0 and less than 1; z is greater than 0 and less than 1; wherein the sum of y and z is equal to 1; and x is selected from the range of 0 to 2.

Aspects of the invention include a process for the electrochemical epoxidation of an alkene to generate an epoxide, the process comprising: contacting an anode comprising an oxygen atom transfer electrocatalyst with the alkene in the presence of an electrolyte comprising water; applying a voltage to the anode and a cathode to generate the epoxide; wherein the oxygen atom transfer electrocatalyst comprises an at least partially oxidized metal-platinum alloy characterized by the formula FX2:

$$M_yPt_zO_x \quad \text{(FX2);}$$

wherein M comprises one or more group 9 metals, one or more group 9 metals, one or more group 10 metals, one or more group 11 metals, or any combination thereof; wherein platinum is characterized by an average metal valency greater than or equal to 0.5; wherein y is greater than 0 and less than 1; z is greater than 0 and less than 1; wherein the sum of y and z is equal to 1; and x is selected from the range of 0 to 2.

Aspects of the invention include a system for generating an epoxide from an alkene and an oxygen atom transfer source, the system comprising: a cathode; an anode comprising an oxygen atom transfer electrocatalyst; an electrolyte in ionic communication with the anode and the cathode; wherein the system is configured for contacting the anode with the alkene in the presence of an electrolyte comprising water; applying a voltage to the anode and the cathode to generate the epoxide; wherein the oxygen atom transfer electrocatalyst comprises an at least partially oxidized palladium-platinum alloy characterized by the formula FX1:

$$Pd_yPt_zO_x \quad \text{(FX1);}$$

wherein y is greater than 0 and less than 1; z is greater than 0 and less than 1; wherein the sum of y and z is equal to 1; and x is selected from the range of 0 to 2.

Aspects of the invention include a system for generating an epoxide from an alkene and an oxygen atom source, the system comprising: a cathode; an anode comprising an oxygen atom transfer electrocatalyst; an electrolyte in ionic communication with the anode and the cathode; wherein the system is configured for contacting the anode with the alkene in the presence of an electrolyte comprising water; applying a voltage to the anode and the cathode to generate the epoxide; wherein the oxygen atom transfer electrocatalyst comprises an at least partially oxidized metal-platinum alloy characterized by the formula FX2:

$$M_yPt_zO_x \quad \text{(FX2);}$$

wherein M comprises one or more group 8 metals, one or more group 9 metals, one or more group 10 metals, one or more group 11 metals, or a combination thereof; wherein platinum is characterized by an average metal valency greater than or equal to 0.5; wherein y is greater than 0 and less than 1; z is greater than 0 and less than 1; wherein the sum of y and z is equal to 1; and x is selected from the range of 0 to 2.

Without wishing to be bound by any particular theory, there may be discussion herein of beliefs or understandings of underlying principles relating to the devices and methods disclosed herein. It is recognized that regardless of the ultimate correctness of any mechanistic explanation or hypothesis, an embodiment of the invention can nonetheless be operative and useful.

BRIEF DESCRIPTION OF THE DRAWINGS

FIG. 1A: Comparison of chlorine-mediated and direct electrochemical propylene epoxidation. FIG. 1B: Compilation of previously reported direct electrochemical propylene epoxidation and our work. FIG. 1C: Effect of annealing on Pt, Pd, and Pd—Pt nanoparticles. FIGS. 1D-1E: Direct electrochemical propylene epoxidation performance with different compositions of Pd—Pt-on-carbon catalysts in (FIG. 1D) water-acetonitrile electrolyte and (FIG. 1E) aqueous electrolyte. Potentials in this figure were 100% iR-compensated (i=current, R=resistance). The vertical error bars represent standard deviations from the mean of multiple replicates (n=3) of the same experiment.

FIG. 2A: Magnified XRD patterns around the peak associated with the oxide and metallic phases of annealed catalysts at 500 °C. (B and C) EXAFS spectra of standards and catalysts at (FIG. 2B) Pd K-edge and (FIG. 2C) Pt $L_3$-edge. FIG. 2D: Cyclic voltammetry traces of the catalysts. The scans were recorded at 50 mV/see scan rate with 85% automatic iR-compensation (i=current, R=resistance). FIG. 2E: High-resolution Pd 3d XPS spectra of annealed Pd/C and PdPt/C catalysts. FIG. 2F: High-resolution Pt 4f XPS spectra of annealed Pt/C and PdPt/C catalysts.

FIG. 3A: Changes of Pt average valency in $PdPtO_x/C$ and $PtO_x/C$ in responses to applied potentials. FIG. 3B: Changes of Pd average valency in $PdPtO_x/C$ and $PdO_x/C$ in responses to applied potentials. Potentials in this figure were 100% iR-compensated (i=current, R=resistance).

FIG. 4A: Anodic potential dependence of current density at 1 atm propylene in a 10 M water, 0.4 M teterabutylammonium tetrafluoroborate ($TBABF_4$) acetonitrile solution. FIG. 4B: Water molar concentration dependences of propylene epoxidation current density at different propylene partial pressures. FIG. 4C: Propylene partial pressure dependences of propylene epoxidation current density at different water concentrations. FIG. 4D: A putative reaction mechanism including the direct anodic epoxidation and oxygen evolution pathways. FIG. 4E: Simulated propylene partial pressure dependences of intermediate species coverage at 10 M water, 1.1 V vs. $Fc/Fc^+$ condition. Potentials in this figure were 100% iR-compensated (i=current, R=resistance). Dotted lines in A-C represent best-fit from kinetic model of proposed mechanism in D (See example 2A, Case 2d for more details). The vertical error bars represent standard deviations from the mean of multiple replicates (n=3) of the same experiment.

FIG. 9A: A schematic of the flow cell for PO production. FIG. 9B: Accumulation of PO in the electrolyte during the process in 0.4 M $TBABF_4$, 10 M water in acetonitrile electrolyte at a constant current density of 50 $mA/cm^2$. Cell performances with (FIG. 9C) water-acetonitrile blended electrolyte and (FIG. 9D) aqueous electrolyte. Uncompensated anode and cathode potentials were measured against Ag/AgCl reference electrode and later converted to SHE-referenced potentials. The resistive voltages between anode-to-reference and reference-to-cathode were determined by potentio electrochemical impedance spectroscopy (PEIS) and combined as electrolyte resistance in the figure. Anode and cathode potentials in the figure are iR-compensated values after subtracting the resistive voltages. 1 atm of room-temperature propylene was flowed at 10 sccm during the measurements.

FIG. 17A: Water concentration dependence of propylene epoxidation current density at different propylene partial pressures. The data set is same as that of FIG. 4B, but linear water concentration dependences were assumed in this plot. FIG. 17B: Water activity dependence of propylene epoxidation current density. Different order dependences were assumed in high and low water contents. FIG. 17C: Water molar concentration dependences of propylene epoxidation current density at different potentials. Water molar ratio of 1 was assumed for aqueous electrolytes (0.25 M sodium phosphate buffer (pH 6), 0.9 M $NaClO_4$ in water). Solid lines represent best-fit from kinetic model of proposed mechanism in FIG. 4D. Model fits for aqueous electrolytes assumed 1.65 V and 1.6 V vs. SHE as 1.09 V and 1.04 V vs. $Fc/Fc^+$, respectively, reflecting the absolute potential values applied with respect to pseudo-reference Ag/AgCl electrode. FIG. 17D: Phosphate concentration dependence of propylene epoxidation current density in aqueous electrolytes. The ratio of $Na_2HPO_4$ and $NaH_2PO_4$ was fixed to 1:9 for making pH 6 solution, and the ionic strength was fixed to 1.2 M using $NaClO_4$ as the balancing salt. Vertical error bars represent standard deviations from the mean of multiple replicates (n≥3) of the same experiment.

FIG. 25A: Cyclooctene oxide dependence on propylene epoxidation rate. Cyclooctene oxide was utilized as a substitute for PO to differentiate between the epoxide produced from the reaction (PO) and the epoxide added at the start of the experiment (cyclooctene oxide). FIG. 25B: Oxygen partial pressure dependence on propylene epoxidation rate. The oxygen partial pressure was adjusted by diluting it with propylene, ensuring the total flow rate of 10 sccm under a total gas pressure of 1 atm. This range for oxygen partial pressure was selected to prevent a reduction in the rate caused by a decrease in propylene partial pressure. 100% iR-compensated potential was applied. Vertical error bars represent standard deviations from the mean of multiple replicates (n=3) of the same experiment.

FIG. 28A: A counter electrode (Pt foil) is placed on top of a current collector (aluminum foil). FIG. 28B: An electrolyte chamber is placed on top of the counter electrode. Only the counter electrode, not the current collector, will be exposed to the electrolyte. FIG. 28C: Another electrolyte chamber with a reference electrode (Ag/AgCl) is placed on top of the chamber contacting the counter electrode. FIG. 28D: A working electrode is placed on top of the electrolyte chamber casing the reference electrode. FIG. 28E: A gas chamber is placed on top of the working electrode. Gas will be introduced to this chamber and flows through the working electrode toward the electrolyte. FIG. 28F: A complete assembly of the electrochemical cell.

FIG. 30A: CV curves at various scan rates over $PdPtO_x/C$ catalyst in aqueous electrolyte. FIG. 30B: Capacitive current densities at different scan rates. DLCs and errors reported from these measurements (FIGS. 10A-10D) are the average and standard deviation of multiple replicates (n=3-18).

FIGS. 31A-31I: show simulated surface coverages of unoccupied sites and sites occupied by propylene OH, O, and OOH as a function of water concentration using the model Case 1 at FIG. 31A: $p_{propylene}$=0.1 atm, applied potential=1.1 V; FIG. 31B: $p_{propylene}$=0.1 atm, applied potential=1.0 V; FIG. 31C: $p_{propylene}$=0.1 atm, applied potential=0.9 V; FIG. 31D: $p_{propylene}$=0.5 atm, applied potential=1.1 V; FIG. 31E: $p_{propylene}$=0.5 atm, applied potential=1.0 V; FIG. 31F: $p_{propylene}$=0.5 atm, applied potential=0.9 V; FIG. 31G: $p_{propylene}$=1 atm, applied potential=1.1 V; FIG. 31H: $p_{propylene}$=1 atm, applied potential=1.0 V; FIG. 31I: $p_{propylene}$=1 atm, applied potential=0.9 V. All potentials were measured vs. $Fc/Fc^+$.

FIGS. 32A-32I: Case 2a: OO catalyzes epoxidation, single site mechanism. FIGS. 32A-32I: show simulated surface coverages of unoccupied sites and sites occupied by propylene, OH, O, OOH, and OO as a function of water concentration using the model Case 2a at FIG. 32A: $p_{propylene}$=0.1 atm, applied potential=1.1 V; FIG. 32B: $p_{propylene}$=0.1 atm, applied potential=1.0 V; FIG. 32C: $p_{propylene}$=0.1 atm, applied potential=0.9 V; FIG. 32D: $p_{propylene}$=0.5 atm, applied potential=1.1 V; FIG. 32E: $p_{propylene}$=0.5 atm, applied potential=1.0 V; FIG. 32F: $p_{propylene}$=0.5 atm, applied potential=0.9 V; FIG. 32G: $p_{propylene}$=1 atm, applied potential=1.1 V; FIG. 32H: $p_{propylene}$=1 atm, applied potential=1.0 V; FIG. 32I: $p_{propylene}$=1 atm, applied potential=0.9 V. All potentials were measured vs. $Fc/Fc^+$.

FIGS. 33A-33I: show simulated surface coverages of unoccupied sites and sites occupied by propylene, OH, O, and OOH using the model Case 2b at FIG. 33A: $p_{propylene}$=0.1 atm, applied potential=1.1 V; FIG. 33B: $p_{propylene}$=0.1 atm, applied potential=1.0 V; FIG. 33C: $p_{propylene}$=0.1 atm, applied potential=0.9 V; FIG. 33D: $p_{propylene}$=0.5 atm, applied potential=1.1 V; FIG. 33E: $p_{propylene}$=0.5 atm, applied potential=1.0 V; FIG. 33F: $p_{propylene}$=0.5 atm, applied potential=0.9 V; FIG. 33G: $p_{propylene}$=1 atm, applied potential=1.1 V; FIG. 33H: $p_{propylene}$=1 atm, applied potential=1.0 V; FIG. 33I: $p_{propylene}$=1 atm, applied potential=0.9 V. All potentials were measured vs. $Fc/Fc^+$.

FIGS. 34A-34I: show simulated surface coverages of unoccupied sites and sites occupied by propylene, OH, O, and OOH using the model Case 2c at FIG. 34A: $p_{propylene}$=0.1 atm, applied potential=1.1 V; FIG. 34B: $p_{propylene}$=0.1 atm, applied potential=1.0 V; FIG. 34C: $p_{propylene}$=0.1 atm, applied potential=0.9 V; FIG. 34D: $p_{propylene}$=0.5 atm, applied potential=1.1 V; FIG. 34E: $p_{propylene}$=0.5 atm, applied potential=1.0 V; FIG. 34F: $p_{propylene}$=0.5 atm, applied potential=0.9 V; FIG. 34G: $p_{propylene}$=1 atm, applied potential=1.1 V; FIG. 34H: $p_{propylene}$=1 atm, applied potential=1.0 V; FIG. 34I: $p_{propylene}$=1 atm, applied potential=0.9 V. All potentials were measured vs. $Fc/Fc^+$.

FIGS. 35A-35I: show simulated surface coverages of unoccupied sites and sites occupied by propylene, OH, O, and OOH using the model Case 2d at FIG. 35A: $p_{propylene}$=0.1 atm, applied potential=1.1 V; FIG. 35B: $p_{propylene}$=0.1 atm, applied potential=1.0 V; FIG. 35C: $p_{propylene}$=0.1 atm, applied potential=0.9 V; FIG. 35D: $p_{propylene}$=0.5 atm, applied potential=1.1 V; FIG. 35E: $p_{propylene}$=0.5 atm, applied potential=1.0 V; FIG. 35F: $p_{propylene}$=0.5 atm, applied potential=0.9 V; FIG. 35G: $p_{propylene}$=1 atm, applied potential=1.1 V; FIG. 35H: $p_{propylene}$=1 atm, applied potential=1.0 V; FIG. 35I: $p_{propylene}$=1 atm, applied potential=0.9 V. All potentials were measured vs. $Fc/Fc^+$.

FIGS. 36A-36I: Case 2e: $\eta_2$—OO catalyzes epoxidation, $\eta_1$—O intermediate. FIGS. 36A-36I: show simulated surface coverages of unoccupied sites and sites occupied by propylene, OH, O, and OOH using the model Case 2e at FIG. 36A: $p_{propylene}$=0.1 atm, applied potential=1.1 V; FIG. 36B: $p_{propylene}$=0.1 atm, applied potential=1.0 V; FIG. 36C: $p_{propylene}$=0.1 atm, applied potential=0.9 V; FIG. 36D: $p_{propylene}$=0.5 atm, applied potential=1.1 V; FIG. 36E: $p_{propylene}$=0.5 atm, applied potential=1.0 V; FIG. 36F: $p_{propylene}$=0.5 atm, applied potential=0.9 V; FIG. 36G: $p_{propylene}$=1 atm, applied potential=1.1 V; FIG. 36H: $p_{propylene}$=1 atm, applied potential=1.0 V; FIG. 36I: $p_{propylene}$=1 atm, applied potential=0.9 V. All potentials were measured vs. $Fc/Fc^+$.

FIGS. 37A-37I: Case 3: O catalyzes epoxidation, single site mechanism. FIGS. 37A-37I: show simulated surface coverages of unoccupied sites and sites occupied by propylene, OH, O, and OOH using the model Case 3 at FIG. 37A: $p_{propylene}$=0.1 atm, applied potential=1.1 V; FIG. 37B: $p_{propylene}$=0.1 atm, applied potential=1.0 V; FIG. 37C: $p_{propylene}$=0.1 atm, applied potential=0.9 V; FIG. 37D: $p_{propylene}$=0.5 atm, applied potential=1.1 V; FIG. 37E: $p_{propylene}$=0.5 atm, applied potential=1.0 V; FIG. 37F: $p_{propylene}$=0.5 atm, applied potential=0.9 V; FIG. 37G: $p_{propylene}$=1 atm, applied potential=1.1 V; FIG. 37H: $p_{propylene}$=1 atm, applied potential=1.0 V; FIG. 37I: $p_{propylene}$=1 atm, applied potential=0.9 V. All potentials were measured vs. $Fc/Fc^+$.

STATEMENTS REGARDING CHEMICAL COMPOUNDS AND NOMENCLATURE

Figure 1A:
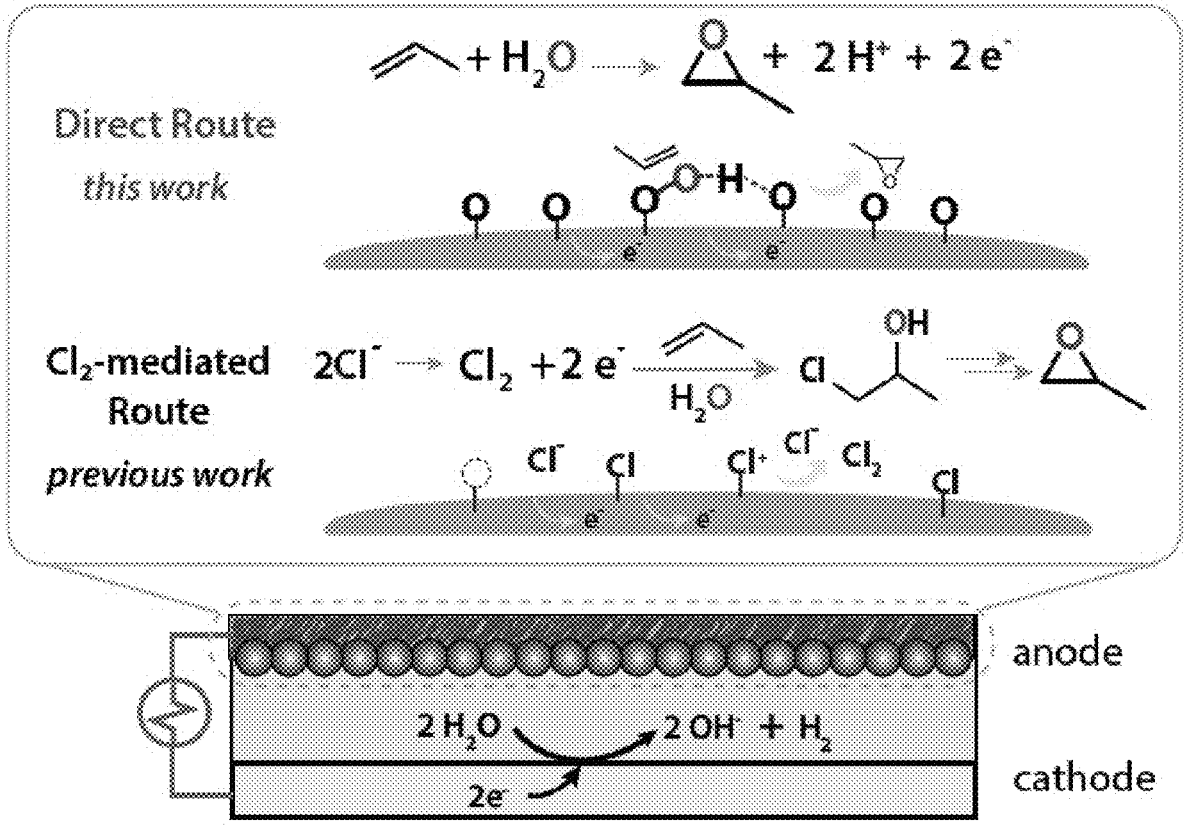
FIGS. 1A-1E: Background and demonstration of direct electrochemical propylene epoxidation.

In general, the terms and phrases used herein have their art-recognized meaning, which can be found by reference to standard texts, journal references and contexts known to those skilled in the art. The following definitions are provided to clarify their specific use in the context of the invention.

The term "oxygen atom transfer source" refers to the transfer of an oxygen atom from a water molecule to an alkene to form an epoxide. For example, when an oxidative potential is applied to the anode, water oxidation intermediates are transferred to the alkene to form an epoxide. For example, water serves as the source of oxygen atoms during the oxygen atom transfer reaction.

The term "ionomer" refers to a polymer or other material that conducts ions and is intended to be consistent with this term as would be recognized by one of skill in the field of chemistry. The term "ionomer" refers to a polymer that comprises repeat units of both electrically neutral repeating units and a fraction of ionized units and may include a cation exchange membrane or an anion exchange membrane. As used herein, an ionomer may comprise a cation exchange membrane, an example of which includes a poly(perfluorosulfonic acid) (trade name: Nafion) having a hydrophobic polytetrafluoroethylene backbone and a sulfone group-containing functional group that is a hydrophilic side chain. An anion exchange membrane may comprise, for example, a hydrocarbon backbone having quaternary ammonium groups exhibiting a compact arrangement of their structure (trade name: Tokuyama A201). Additional examples of an anion exchange membrane comprise a partially fluorinated anion exchange membrane (trade name: Fumasep FAP-450), an imidazolim-functoinalized polystyrene (trade name: Sustainion X37-50), a quaternary ammonium ion anion exchange membrane (trade name: Selemion AMV), a poly (aryl piperidinium) resin (trade name: PiperION), a sulfonated poly(ether-ether ketone) (trade name: PEEK), a sulfonated polylmide (trade name: SPI), or a polybenzimidazole (trade name: PBI).

The term "anion exchange membrane" refers to a positively charged membrane, which allows negatively charged ions (anions) to pass through.

The term "cation exchange membrane" refers to a negatively charged membrane, which allows positively charged ions (cations) to pass through.

The term "electrocatalyst" refers to a catalyst that participates in or facilitates an electrochemical process or reaction. The term "electrocatalytic" refers to a material or item that is or is capable of being an electrocatalyst. For example, an electrocatalytic layer is a layer that is or is capable of being an electrocatalyst. The term electrocatalyst may refer to a catalyst for catalyzing oxidation and reduction reactions at the anode and the cathode. For example, an electrocatalyst as disclosed herein, refers to a catalyst for catalyzing the oxidation of an alkene to generate an epoxide.

"Ionic communication" refers to the arrangement of two or more materials or items such that ions can be transported to, past, through, and/or from one material or item to another. Generally, ions can pass through ionically conducting materials such as ionically conducting liquids, such as water, or through solid ionic conductors. Preferably, but not necessarily exclusively, as used herein, transport or conduction of ions refers to transport or conduction of ions in an aqueous solution. For example, in some embodiments two materials or items are in ionic communication with one another if a path of ion flow is provided directly between the two materials or items. In some embodiments, two materials or items are in ionic communication with one another if an ion flow path is provided indirectly between the two materials or items, such as by including one or more other materials or items, such as an ion exchange membrane, or ion flow paths between the two materials or items. In one embodiment, two materials or items are not necessarily in ionic communication with one another unless ions from the first material or item are drawn to, past and/or through the second material or item, such as along an ion flow path.

The term "alkene" or "olefin" is given its ordinary meaning in the art and refers to an unsaturated aliphatic hydrocarbon, including straight-chain and branched-chain groups. In a preferred embodiment, the alkene has one double bond. In another embodiment, the alkene has more than one double bond, for example, the alkene has 2 or more double bonds. In an embodiment, an alkene includes short chain alkenes having 2-10 carbon atoms. Alkenes may also include medium chain alkenes having more than 10 carbon atoms, particularly those having 10-30 carbon atoms. In another embodiment, the alkene is a long chain alkene having up to 100 carbon atoms. Non-limiting examples of alkenes include propylene, ethylene, 1-butylene, cis or trans 2-butylene, and so on. The term "alkene" also may refer to substituted alkene groups, such as alkenes substituted with at least one alkyl, hydroxyalkyl, or dihydroxyalkyl group, as well as oxygen, sulfur, and/or alkenes containing one or more heteroatoms such as nitrogen or chlorine, for example chloropropylene.

The term "cycloalkene" refers, in one embodiment, to a ring structure comprising carbon to a ring structure comprising carbon atoms as ring atoms, which are partially unsaturated, that is having at least one double bond, substituted or unsubstituted. Non-limiting examples of cycloalkenes include cyclohexene, cyclopropene, cyclopentene, cyclobutene, cycloheptene, cyclooctene, cyclooctadiene (COD), etc.

The term "epoxide" denotes a compound characterized by the presence of at least one cyclic ether group, namely one wherein an ether oxygen atom is attached to two adjacent carbon atoms thereby forming a cyclic structure. For example, in its simplest form, an epoxide is ethylene oxide which has the structure of a three-membered ring cyclic ether consisting of one oxygen atom and two carbon atoms. For another example, propylene oxide is a compound having a structure in which hydrogen at position 2 in ethylene oxide is substituted with a methyl group. The term is also intended to include substituted epoxides, such as epoxides substituted with at least one alkyl, hydroxyalkyl, or dihydroxyalkyl group, as well as oxygen, sulfur, and/or epoxides containing one or more heteroatoms such as nitrogen or chlorine, for example, epichlorohydrin.

The term "porous" refers to a membrane, electrode, film, layer, coating, or any other material or item that has porosity. Thus, for instance, in a porous material, the pores are volumes within the body of the material where there is no material (e.g. voids). Pores in a material are not intended to include the space occupied by atoms, ions and/or molecules of a material including monomers, oligomers and polymers, for example, of a membrane. The term "porosity" refers to the amount of a material or item, such of a membrane, corresponding to an absence of said material or item, such as absence corresponding to pores, such as apertures, channels, voids, etc. Generally, porosity refers to absence of said material or item within the physical bounds of said material or item, such as due to the material or item having a porous internal structure. Porosity may be expressed as the percentage of the volume of a material or item, which corresponds to pores, such as apertures, channels, voids, etc., relative to the total volume occupied by the material or item. For example, porosity may be expressed as the fraction of the volume of voids over the total volume, between 0 and 1, or as a percentage between 0% and 100%.

As used herein, "equimolar" refers to a substantially equal number of moles or having a substantially equal molar concentration in a composition. For example, if an alloy of the present invention is defined as equimolar, its components are present in a substantially equimolar ratio.

The term "substantially" refers to a property that is within 20%, within 10%, within 5%, within 1%, or is equivalent to a reference property. The term "substantially equal", "substantially equivalent", "substantially unchanged", or "substantially equimolar" when used in conjunction with a reference value describing a property or condition, refers to a value that is within 20%, within 10%, optionally within 5%, optionally within 1%, optionally within 0.1%, or preferably for some applications is equivalent to the provided reference value. For example, a composition is substantially equimolar if the molar ratios of its components are within 20%, within 10%, optionally within 5%, optionally within 1% or optionally exactly equimolar with respect to one another.

The term "metal alloy" or "alloy" refers to an alloy of two or more metals. For example, a metal alloy may be characterized as a solid solution of two or more metal elements (e.g., the metal elements being in the form of atoms or ions in the solid solution), a mixture of metallic phases, or an intermetallic compound. A metal alloy can be characterized as comprising metallic bonding. In certain embodiments, a metal, rather than a metal alloy, refers to a metallic material whose chemical formula has one metal element (i.e., its compositions has substantially or essentially one metal element).

Ratios, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a temperature range of about 300 °C to about 700 °C should be interpreted to include not only the explicitly recited limits of about 300 °C to about 700 °C, but also to include sub-ranges, such as 350 °C to 650 °C, 400 °C to 600 °C, and so forth, as well as individual amounts, including fractional amounts, within the specified ranges, such as 350.2 °C, 550.6 °C, and 605.3 °C, for example.

As used herein, the term "about" means a range of values including the specified value, which a person of ordinary skill in the art would consider reasonably similar to the specified value. In embodiments, about means within a standard deviation using measurements generally acceptable in the art. In embodiments, about means a range extending to +/−10% of the specified value. In some embodiments, about means the specified value.

The term "hydrophobic" refers to molecules, substituents, or materials that are nonpolar, have little or no affinity for water, and tend to repel water.

The term "hydrophilic" refers to molecules, substituents, or materials that are polar and have an affinity to interact with polar solvents, especially water, or other polar groups. Hydrophilic molecules, substituents, or materials tend to attract water.

The term "homogeneous" as used herein with respect to electrocatalyst compositions refers to a mixing of the metal alloy components that is consistent or uniform, as measured, in structure or composition throughout. It will be understood that an alloy or metal alloy may be substantially homogeneous and that the composition's homogeneity may change over time or with use. For example, a metal alloy is homogeneous even if there is phase separation or de-mixing of the two or more metals present in the alloy. The term "homogeneous" is intended to include metal alloys in which surface segregation of the metal alloys disclosed herein has occurred, for example, due to one or more metals moving to the surface of the alloy over time.

The term "metal valency" refers to the valency of a metallic element. For example, metal valency may refer to the valency of one or more metallic elements in the oxygen atom transfer electrocatalyst of the present invention.

The term "improved solubility" refers to any increase in the solubility of an alkene or cycloalkene. Preferably, the increase in solubility is 1.2 times, 1.5 times, 2 times, 3 times, 4 times, 5 times, 10 times, 100 times, or 1000 times. An increase in solubility exceeding 3 orders of magnitude is also envisioned.

The terms "non-aqueous solvent", "nonaqueous solvent", and "organic solvent" may be used interchangeably and refer to a non-water liquid in which a solute such as an alkene may be dissolved. The term includes organic solvents, particularly nonpolar organic solvents, organic solvents having a dipole moment less than water, and organic solvents that are hydrophobic, i.e., solvents that are little or not miscible with water. The term "organic solvent" relates to carbon-based materials commonly used in the chemical industry that are known in the art and capable of dissolving or dispersing one or more materials. Generally speaking, organic solvents are more lipophilic or hydrophobic than water. An aprotic solvent refers to a compound that lacks an acidic hydrogen (e.g., lacking a C—H or N—H bond, or lacking a labile $H^+$). The nonaqueous solvent may be a polar aprotic solvent. Exemplary non-aqueous solvents include, but are not limited to, hexane, pentane, nonane, decane, dodecane, tetradecane, octadecane, 1-octadecene, heptane, acetonitrile, acetone, butane, butanone, carbon tetrachloride, chlorobenzene, chloroform, cyclohexane, 1,2-dichloroethane, dichloromethane, diethylene glycol, 1,2-dimethylformamide, 1,2-dimethoxyethane, propylene carbonate, dimethylsulfoxide, 1,4-dioxane, ethanol, ethyl acetate, ethylene glycol, glycerin, hexamethylphosphoramide, hexamethylphosphorous triamide, nitromethane, petroleum ether, propanol, pyridine, triethyl amine, xylene, mesitylene, diethylether, tetrahydrofuran, benzene, toluene, propylene carbonate and any mixture of two or more of these.

"Substrate" refers to a material, layer or other structure having a surface, such as a receiving surface, that is capable of supporting a deposited material, such as an electrocatalyst layer. Substrates may optionally have a receiving surface. The receiving surface may optionally have one or more features, such as pores and is capable of supporting an electrocatalyst or an electrocatalytic coating.

In some embodiments, the term "aqueous" refers to a solution where the solvent is water such that other species of the solution, or solutes, are substantially solvated by water. In some embodiments, the term "aqueous" may generally refer to a solution comprising water. For example, the term "aqueous" may refer to a solution comprising 0.1 M water, 0.2 M water, 0.3 M water, 0.4 M water, 0.5 M water, 1.0 M water, 5 M water, 10 M water, 15 M water, 20 M water, and so on.

"Ionic communication" refers to the arrangement of two or more materials or items such that ions can be transported to, passed through, and/or from one material or item to another. Generally, ions can pass through ionically conducting materials such as ionically conducting liquids, such as water, through solid ionic conductors, or through ionically conductive membranes. Preferably, but not necessarily exclusively, as used herein, transport or conduction of ions refers to transport or conduction of ions in an aqueous solution. For example, in some embodiments two materials or items are in ionic communication with one another if a path of ion flow is provided directly between the two materials or items. In some embodiments, two materials or items are in ionic communication with one another if an ion flow path is provided indirectly between the two materials or items, such as by including one or more other materials or items, such as an ion exchange membrane, or ion flow paths between the two materials or items.

The term "electrochemical cell" refers to devices and/or device components that perform electrochemistry. Electrochemistry refers to conversion of chemical energy into electrical energy or electrical energy into chemical energy. Chemical energy can correspond to a chemical change or chemical reaction. Electrochemistry can thus refer to a chemical change (e.g., a chemical reaction of one or more chemical species into one or more other species) generating electrical energy and/or electrical energy being converted into or used to induce a chemical change. Electrical energy refers to electric potential energy, corresponding to a combination of electric current and electric potential in an electrical circuit. Electrochemical cells have two or more electrodes (e.g., positive and negative electrodes; e.g., anode and cathode) and one or more electrolytes. An electrolyte may include species that are oxidized and/or species that are reduced during charging or discharging of the electrochemical cell. Reactions occurring at the electrode, such as sorption and desorption of a chemical species or such as an oxidation or reduction reaction, contribute to charge transfer processes in the electrochemical cell. Electrochemical cells include, but are not limited to, electrolytic cells such as electrolysers and fuel cells. Electrochemical oxidation may occur at the positive electrode or anode, for example, and electrochemical reduction may occur at the negative electrode or cathode, for example. Electrochemical oxidation refers to a chemical oxidation reaction accompanied by a transfer of electrical energy (e.g., electrical energy input driving the oxidation reaction) occurring in the context of an electrochemical cell. Similarly, electrochemical reduction refers to a chemical reduction reaction accompanied by a transfer of electrical energy occurring in the context an electrochemical cell. The term "electrochemically," "electrochemical," "electrocatalytic," or "electrocatalytically" may describe a reaction, process, or a step thereof, as part of which chemical energy is converted into electrical energy or electrical energy is converted into chemical energy. For example, a product may be electrochemically formed when electrical energy is provided to help the chemical conversion of a reactant(s) to the product proceed. The term "non-electrochemical" refers to a reaction or process that does not include electrochemistry and/or does not require electrochemistry in order to be performed.

As used herein, the term "bulk," refers to a portion or part of a material that is extended in space in three-dimensions. The bulk refers to the portion or part of a material which is exclusive of its surface, as defined below.

As used herein, the term "surface" refers to a material, or portion of a material, that is near or at an interface between two different phases, chemicals, or states of matter. A surface is the area of contact between two different phases or states of matter (e.g., solid-gas, liquid-gas, or solid-liquid). For example, the term "surface" refers to a portion or part of a material, for example a oxygen atom transfer electrocatalyst, that is to a depth no greater than substantially 2.5 nm.

The term "selectivity" is defined as the ratio of the amount of a specific reaction product relative to the amount of all products of a reaction. In the context of selectivity for the catalytic production of an epoxide, the term "selectivity" is defined as the ratio of the amount of epoxide and its hydrolysis product glycol relative to the amount of all products of a reaction. For example, the selectivity for an epoxide, for example propylene oxide, in the present application may be greater than 10%, greater than 20%, greater than 30%, greater than 40%, greater than 50%, greater than 60%, greater than 70%, greater than 80%, preferably greater than 90%, and more preferably greater than 95%.

The term "faradaic efficiency" refers to the fraction of the electrons applied to the cell that participate in reactions producing a product. For example, Faradaic efficiencies may be calculated as following: Faradaic efficiency (%)=[moles of product×nF]/Q; wherein Q is the amount of charge passed, n is the number of electrons required for the production of one molecule of a product, and F is Faraday's constant. For example, n=2 for propylene oxide, propylene glycol and acetone, n=4 for oxygen; and n=6 for carbon dioxide. For example, the faradaic efficiency for an epoxide, for example propylene oxide may be greater than 10%, greater than 20%, greater than 50%, preferably greater than 60%, preferably greater than 70%, preferably greater than 80%, and more preferably greater than 90%.

In an embodiment, a composition or compound of the invention, such as an alloy or precursor to an alloy, is isolated or substantially purified. In an embodiment, an isolated or purified compound is at least partially isolated or substantially purified as would be understood in the art. In an embodiment, a substantially purified composition, compound or formulation of the invention has a chemical purity of 95%, optionally for some applications 99%, optionally for some applications 99.9%, optionally for some applications 99.99%, and optionally for some applications 99.999% pure.

DETAILED DESCRIPTION OF THE INVENTION

In the following description, numerous specific details of the devices, device components and methods of the present invention are set forth in order to provide a thorough explanation of the precise nature of the invention. It will be apparent, however, to those of skill in the art that the invention can be practiced without these specific details.

Alkene epoxidation is a representative oxygen-atom transfer reaction that has considerable industrial demand. Despite their industrial importance, alkene epoxidation remains an area with significant room for development. For example, an efficient and sustainable way to produce highly traded propylene oxide (PO) is one of the most pressing challenges facing the chemical industry. Currently, PO production relies on highly energy-intensive and hazardous oxidants, such as chlorine and peroxides.

Electrochemistry offers a promising approach for using water as a sustainable source of oxygen atoms at ambient temperature and pressure. It is possible to directly transfer reactive intermediates typically seen in water oxidation to the alkene before the intermediates are fully oxidized into molecular oxygen. While this method provides an environmentally friendly and safe route to make epoxides, it suffers from low faradaic efficiency yield, thus, improvement is needed for this method to be industrially relevant. Therefore, the development of high-performance electrocatalysts for direct alkene epoxidation is of interest.

For the operation of electrochemical direct epoxidation the selection of an appropriate electrolyte that is compatible with the catalyst is a pertinent consideration. Water is a suitable solvent for the electrolyte as it is required as a reactant and also dissolves electrolyte ions, reducing the ohmic resistance of the overall electrolyte. However, alkene substrates like propylene and ethylene are sparingly soluble in water. A strategy to combat this issue has been to mix water with an organic solvent, thereby enhancing the solubility of the alkene. However, the use of organic solvent can increase the catalyst's overpotential and the ohmic resistance throughout the electrolyte. Alternatively, the use of gas-diffusion electrodes (GDEs) enables us to overcome transport limitations by reducing the distance that reactant gas molecules have to diffuse through the electrolyte to reach the catalyst. Creating partially wetted gas diffusion channels within the catalysts improves the performance of the systems and methods disclosed herein.

We developed an oxidized palladium-platinum alloy catalyst ($PdPtO_x$) for the electrochemical direct alkene epoxidation, which enables efficient oxygen-atom transfer from water to propylene without using mediators. Our catalyst demonstrates a remarkable propylene epoxidation Faradaic efficiency of 66±5% at 50 $mA/cm^2$ under ambient temperature and pressures, outperforming previously reported electrocatalysts for the direct propylene epoxidation. Notably, the selectivity of PO over other propylene derived products (propylene glycol, acetone, and $CO_2$) reaches about 95%. We designed this new electrocatalyst by embedding platinum into the palladium oxide crystal structure to stabilize oxidized platinum species.

Incorporation of an ionomer, for example, Nafion on $PdPtO_x$ electrode helped to improve epoxidation Faradaic efficiency higher than 50% in aqueous electrolytes. $PdPtO_x$ catalyst unexpectedly showed about 60% FE toward propylene epoxidation at 1.65 V vs. SHE when the catalyst was incorporated into a carbon paper-based GDE with, for example, a Nafion ionomer. We demonstrated continuous propylene oxide production with Faradaic efficiency averaging>50% for 2 hours at 50 mA/cm$^2$ with <3 V of total cell voltage.

The incorporation of various hydrophobic ionomers, for example, a partially fluorinated anion exchange membrane (trade name: Fumasep FAP-450), an imidazolim-functoinalized polystyrene (trade name: Sustainion X37-50), a quaternary ammonium ion anion exchange membrane (trade name: Selemion AMV), a poly(aryl piperidinium) resin (trade name: PiperION), a sulfonated poly(ether-ether ketone) (trade name: PEEK), a sulfonated polylmide (trade name: SPI), or a polybenzimidazole (trade name: PBI) onto the catalyst layer and tuning the ratio of ionomer can also be used to improve the performance of catalyst-supported GDEs that use gaseous feedstocks.

The epoxidation reaction at the anode may also be coupled to a wide range of useful cathodic reactions, for example, reactions such as $CO_2$ reduction, hydrocarbon hydrogenations, or $H_2$ evolution.

The electrochemical direct propylene epoxidation pathway using water as a clean and easily accessible oxygen source presents a compelling alternative to the current PO production routes. Commercial efforts on developing this direct epoxidation route are expected to sharply rise in the years to come based on laboratory advances being made. Our research group currently holds the record for the fastest rates and selectivity of electrochemical direct propylene epoxidation at ambient conditions, making our technology appealing for further development. The use of aqueous electrolytes for this reaction enabled by the highly selective catalyst and the incorporation of hydrophobic ionomer opens up opportunities for scale-up as the aqueous system can be readily adapted to commercial water-electrolyzer units.

The invention can be further understood by the following non-limiting examples.

Example 1: Direct Propylene Epoxidation Via Water Activation Over Pd—Pt Electrocatalysts Direct electrochemical propylene epoxidation using water oxidation intermediates presents a sustainable alternative to existing routes that involve hazardous chlorine or peroxide reagents. Here we report an oxidized palladium-platinum alloy catalyst ($PdPtO_x$) which reaches a Faradaic efficiency of 66±5% toward propylene epoxidation at 50 mA/cm$^2$ at ambient temperature and pressure. Embedding platinum into the palladium oxide crystal structure stabilized oxidized platinum species, resulting in improved catalyst performance. The reaction kinetics suggest that epoxidation on $PdPtO_x$ proceeds through electrophilic attack by metal-bound peroxo (OO*) intermediates. This work demonstrates an effective strategy for selective electrochemical oxygen-atom transfer from water, without mediators, for diverse oxygenation reactions, for example, epoxidation of alkenes.

Propylene oxide (PO) is an important chemical building block used in the production of many commodity chemicals such as polyurethanes and polyesters (1). Currently, PO production relies on highly reactive, corrosive, or explosive chemical oxidants such as molecular chlorine ($Cl_2$) or peroxides (2). While direct oxidation of propylene using molecular oxygen has been explored as an alternative solution, achieving high selectivity for PO is challenging due to the allylic hydrogen stripping in propylene and consequent further oxidation (2). We developed a selective direct propylene epoxidation pathway using water as a cleaner and easily accessible oxygen source as an alternative to the current epoxidation methods.

Electrochemistry offers a promising approach for using water as a sustainable source of oxygen atoms at ambient temperature and pressure. In water electrolysis, typically oxygen and hydrogen are generated, but alternatively, commodity chemicals can be synthesized via oxidative processes at the anode of an electrochemical cell combined with, for example, hydrogen evolution at the cathode. Referring to FIG. 1A, for example, the electrochemical chlorohydrin process is shown. The electrochemical chlorohydrin process involves chloride oxidation conducted at the anode to generate $Cl_2$, which acts as a redox mediator in alkene epoxidation (FIG. 1A, bottom) (3-5). This electrified version of the chlorohydrin process was demonstrated to be effective at industrially relevant current densities and selectivity (4). However, this method produces byproducts such as hypochlorite, chlorinated organic compounds, and brine streams that pose serious environmental challenges unless 100% selectivity and recycling of the chloride electrolytes can be achieved. Rather than relying on $Cl_2$ as a redox mediator, it is possible to directly transfer reactive intermediates typically seen in water oxidation to an alkene before the intermediates are fully oxidized into molecular oxygen ($O_2$) (FIG. 1A, top) (6-8). This direct electrochemical alkene epoxidation approach does not involve hazardous oxidizing agents, such as $Cl_2$, making it an attractive avenue for high-demand propylene epoxidation.

Catalytic Performance of $PdPtO_x$/C and Design Principle

Figure 1B:
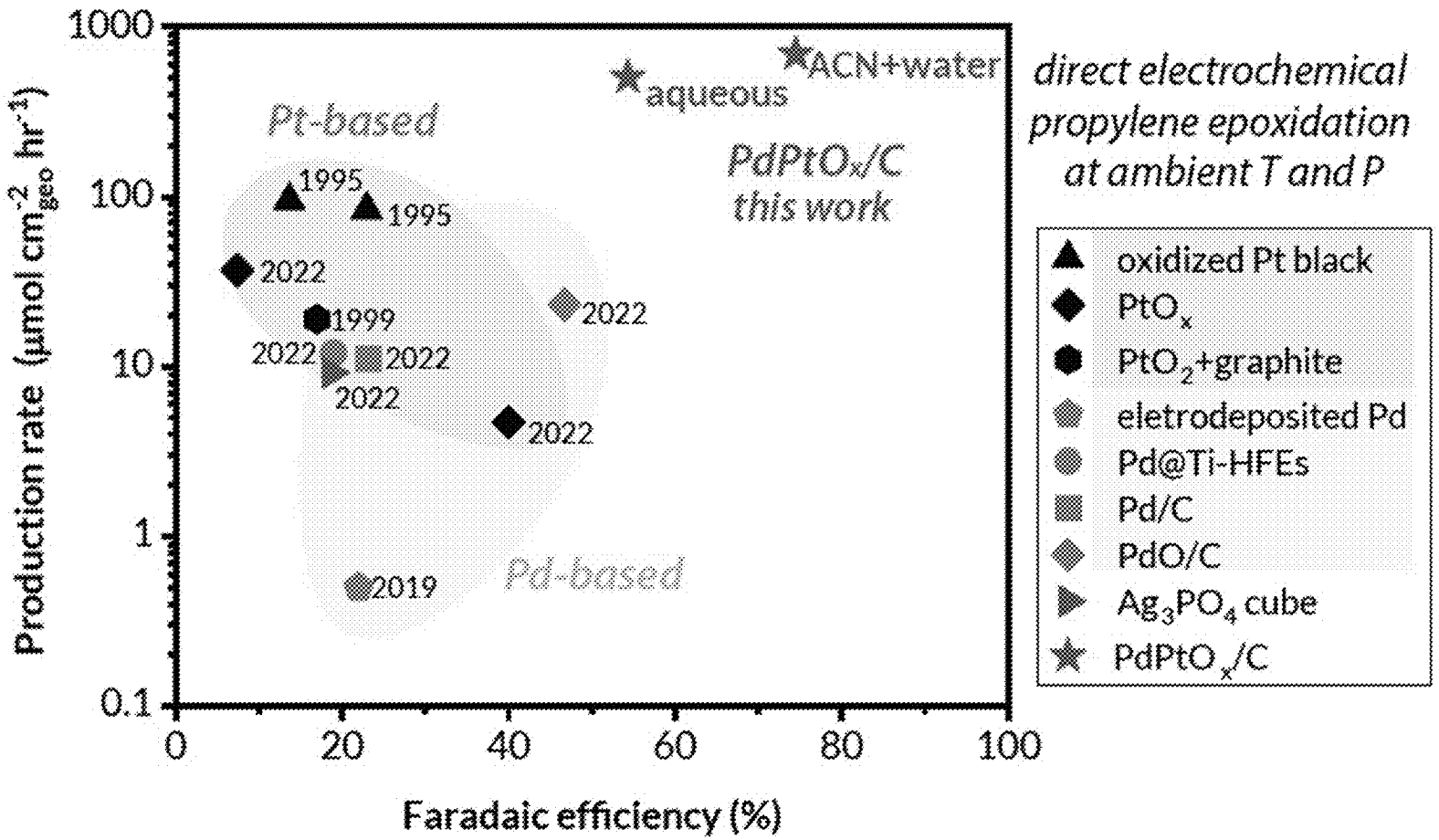

Referring now to FIG. 1B and Table 1, previously studied catalysts for electrochemical propylene epoxidation can be clustered into palladium-(Pd) (9-12), platinum-(Pt) (13-15), and silver-(Ag) (16,17) derived groups. Studies on Pd catalysts have shown that epoxidation occurs on the surface oxide layer at anodic potentials above 1.1 V vs. RHE, while allylic oxidation producing acrolein and acrylic acid occurs on the metallic surface at lower potentials (9,12). The performance enhancement of oxidized Pt catalysts was correlated with an increase in surface presence of Pt(II) and Pt(IV) species, while pure $PtO_2$ was less active (14). Moreover, a theoretical study has identified weak oxygen-binding metal oxides as promising catalyst candidates for propylene epoxidation, and cautioned that the metallic phase of strong binding metals, such as Pt and Pd, may facilitate the production of unwanted side products through dehydrogenation (18). These findings suggest that the catalytic performance may be further optimized by adjusting the oxidation states of the metal. However, preparing Pt oxide catalysts with high concentrations of oxidized Pt species is challenging due to their instability. On the other hand, stable Pd oxide catalysts can be obtained through high-temperature annealing, but they generally exhibit lower rates of epoxidation.

TABLE 1

Compilation of previous reports on direct propylene epoxidation using water as the oxygen source at ambient temperature and pressure.

Figure 9A:
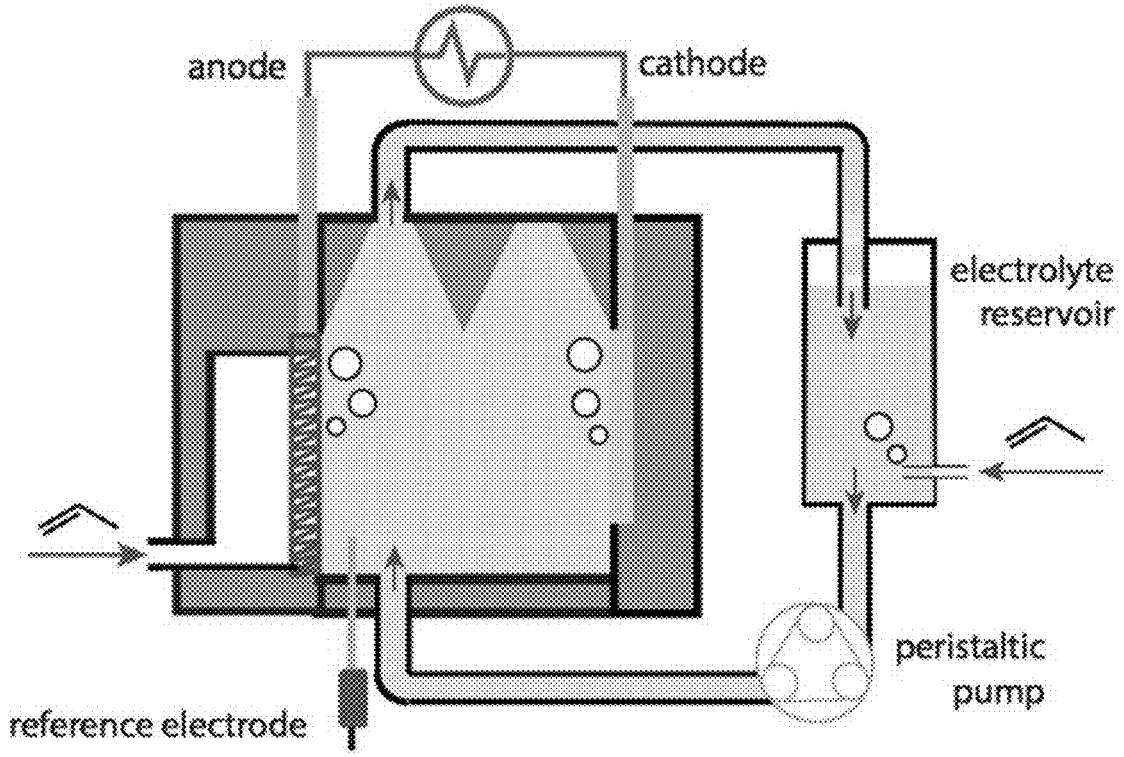
FIGS. 9A-9D: Electrochemical cell setup with circulating liquid electrolytes.
Figure 9B:
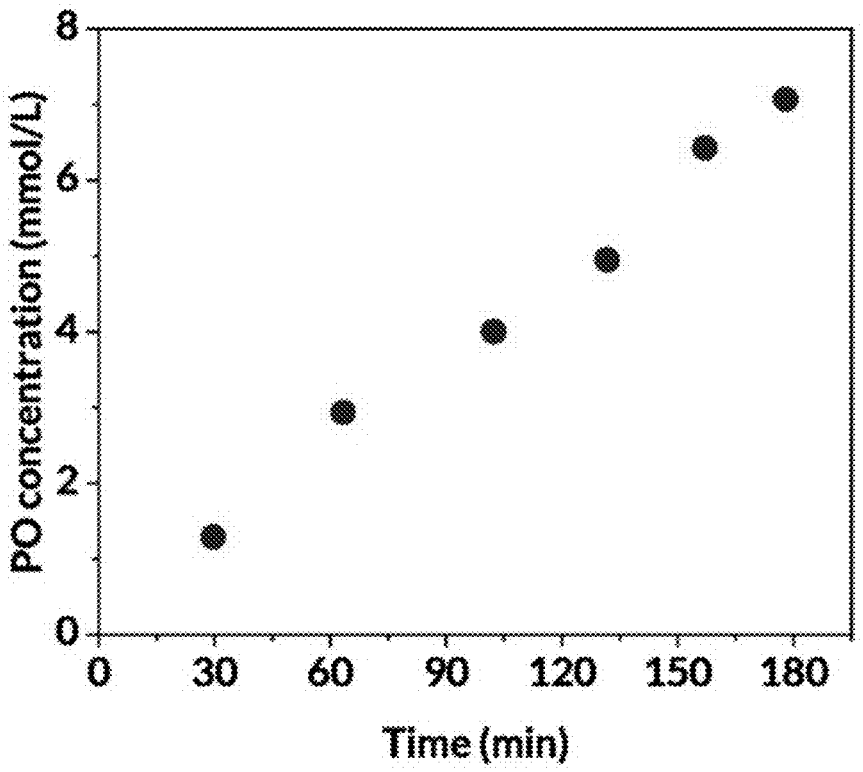
Figure 9D:
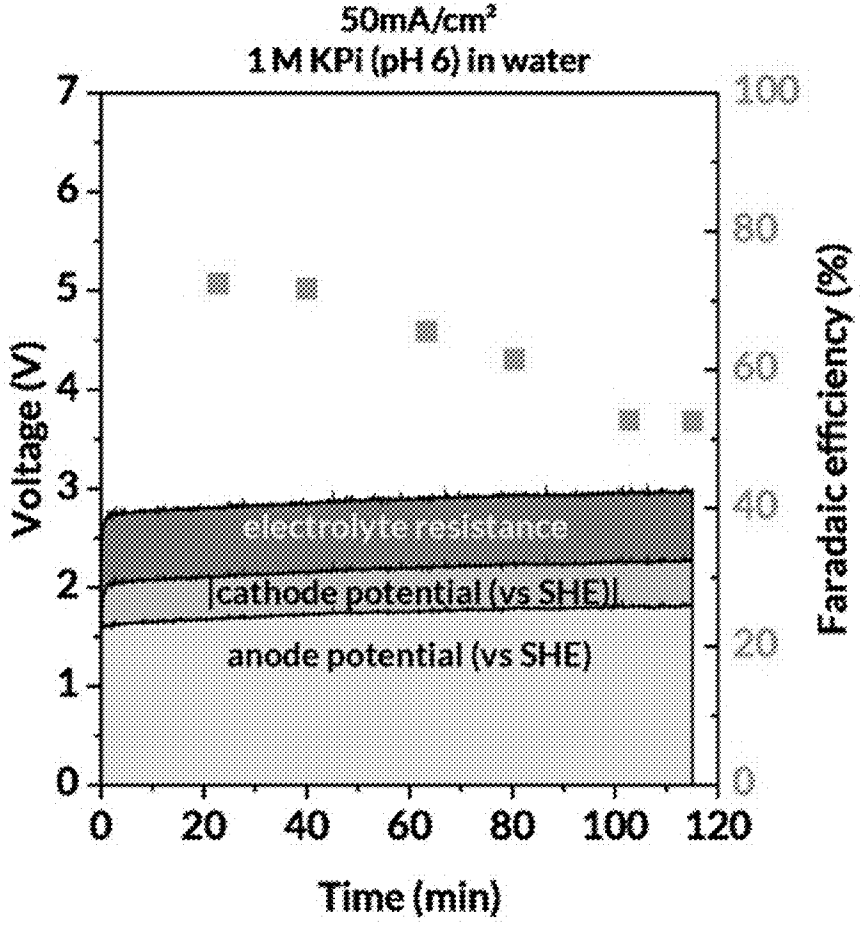
Figure 9C:
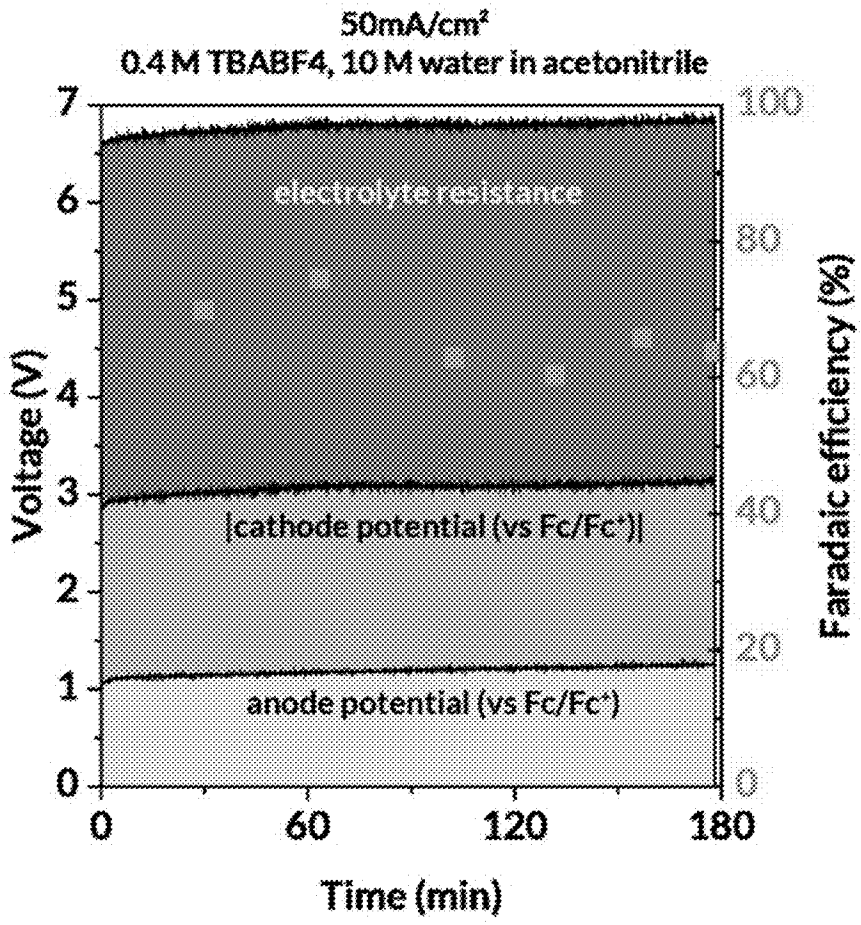
Figure 10A:
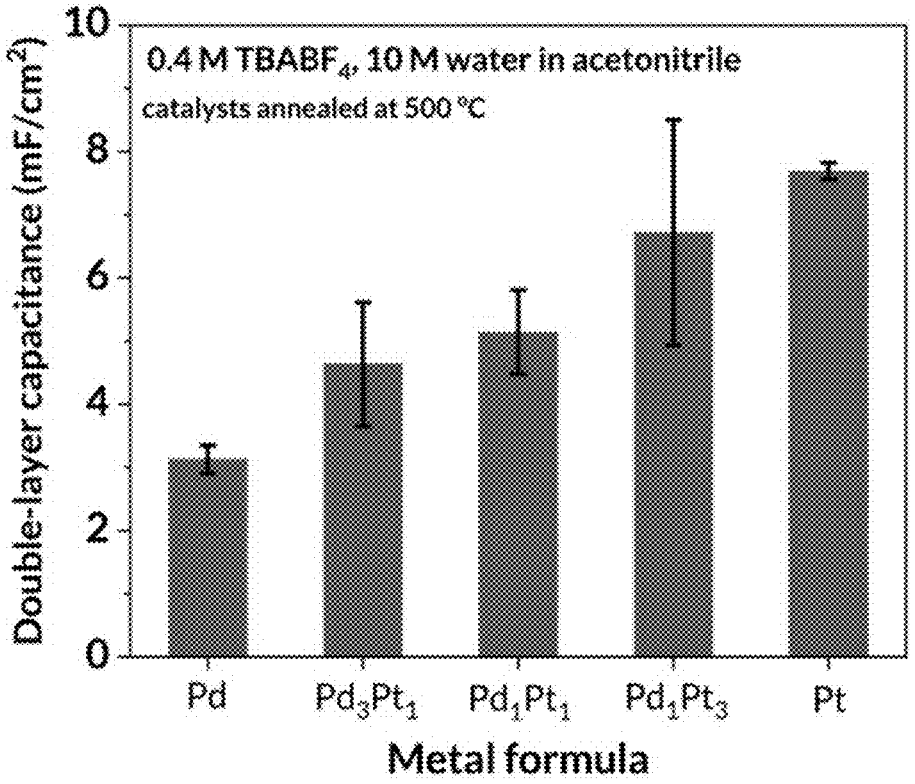
FIG. 10A: Double-layer capacitance measurement in 10 M water in acetonitrile and 0.4 M $TBABF_4$ with different compositions of Pd—Pt-on-carbon catalysts.
Figure 10B:
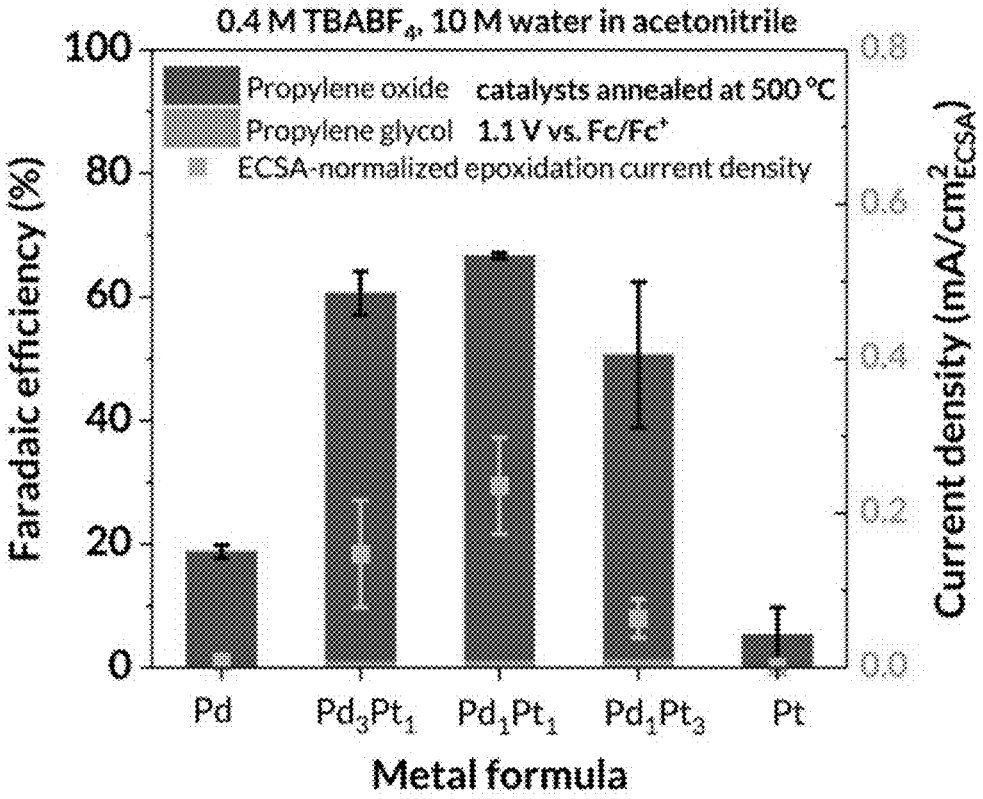
FIG. 10B: Faradaic efficiency and ECSA-normalized propylene epoxidation current densities with different compositions of Pd—Pt-on-carbon catalysts in 10M water in acetonitrile and 0.4 M $TBABF_4$.
Figure 10C:
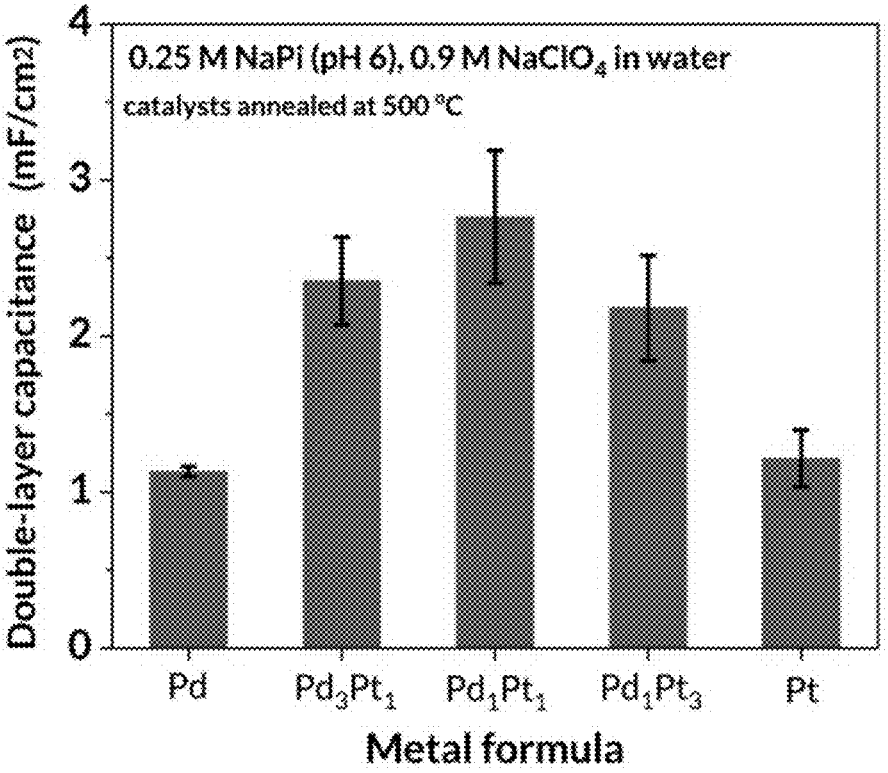
FIG. 10C: double-layer capacitance measurement in 0.25 M NaPi (pH 6) and 0.9 M $NaClO_4$ with different compositions of Pd—Pt-on-carbon catalysts.
Figure 10D:
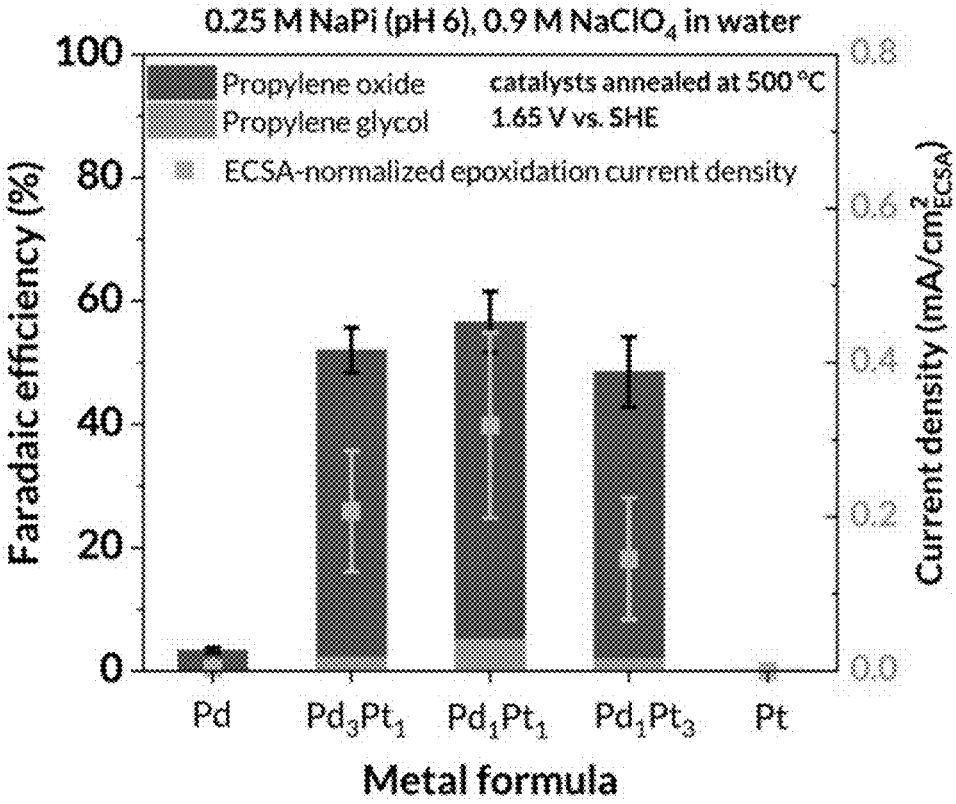
FIG. 10D: Faradaic efficiency and ECSA-normalized propylene epoxidation current densities with different compositions of Pd—Pt-on-carbon catalysts in 0.25 M NaPi (pH 6) and 0.9 M $NaClO_4$. Potentials in this figure were 100% iR-compensated (i=current, R=resistance). Specific capacitance of 0.04 $mF/cm^2$ was assumed for calculating ECSA. Vertical error bars represent standard deviations from the mean of multiple replicates (n≥3) of the same experiment.
Figure 11A:
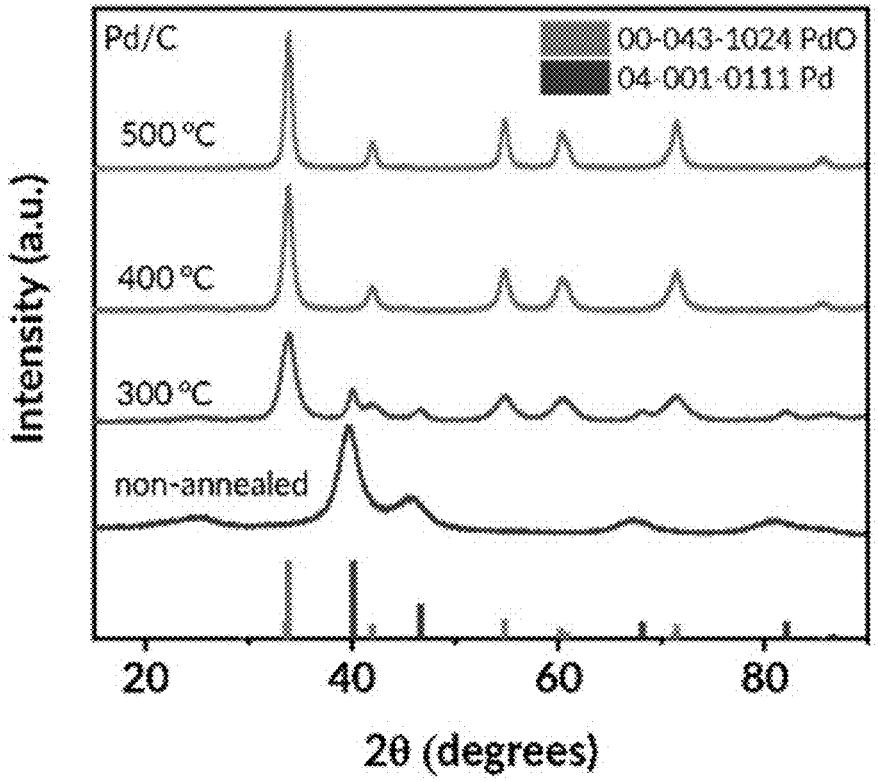
FIGS. 11A-11C: XRD patterns of (FIG. 11A) Pd/C, (FIG. 11B) Pt/C, and (FIG. 11C) PdPt/C catalysts.
Figure 11B:
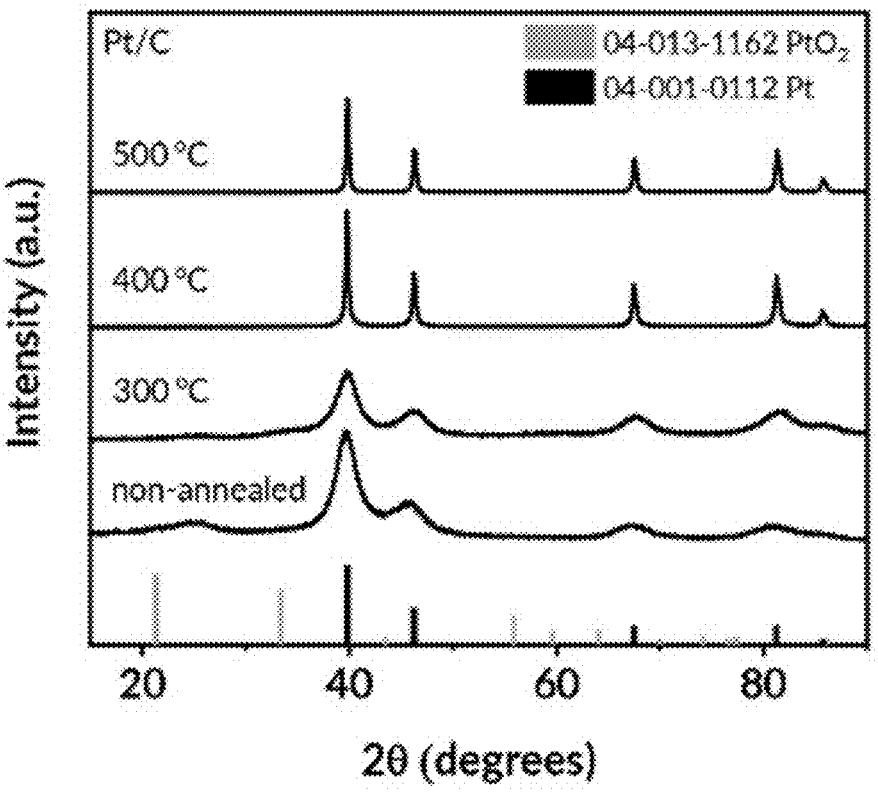
Figure 11C:
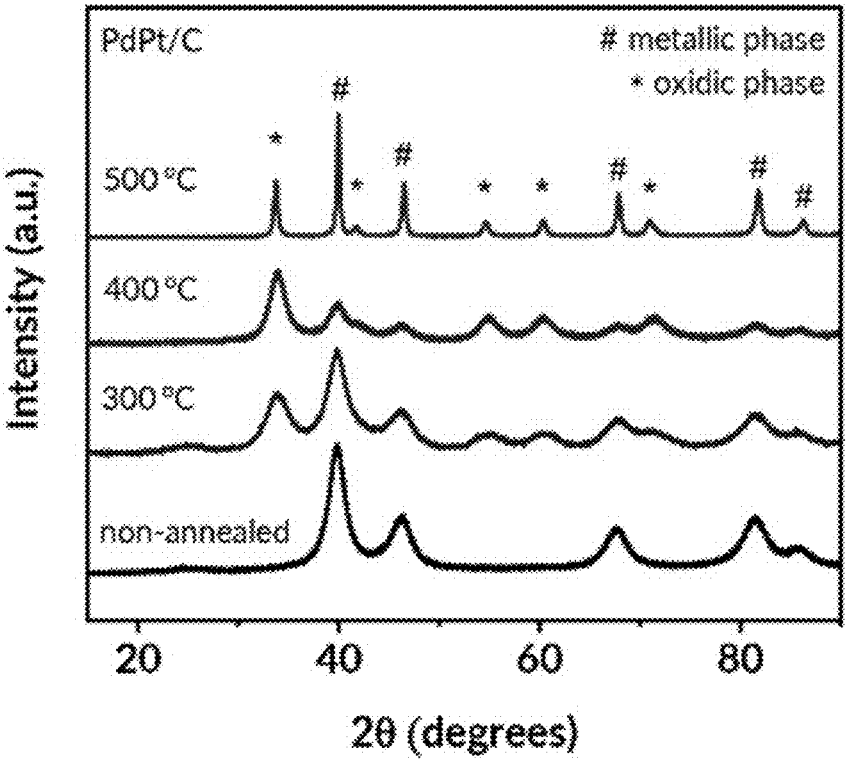
Figure 12A:
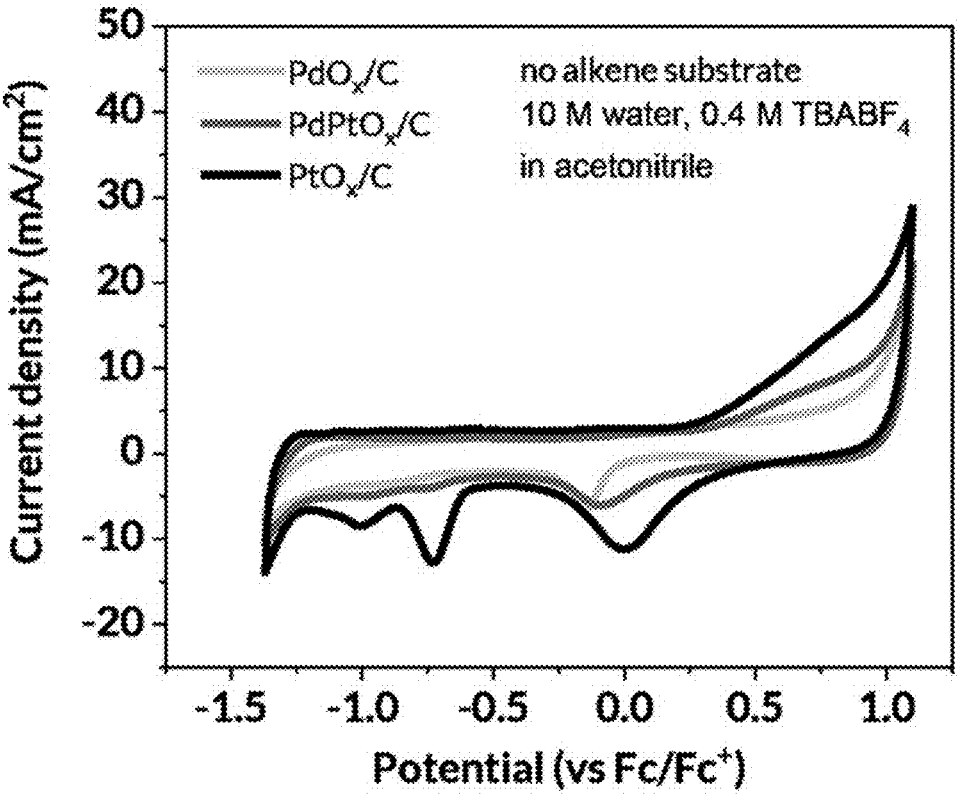
FIG. 12: Cyclic voltammetry traces of the different catalysts in FIG. 12A: 10 M water in acetonitrile with 0.4 M $TBABF_4$ and no alkene substrate.
FIG. 12B: water and no alkene substrate and water and propylene.
FIG. 12C: water and no alkene substrate and water and propylene.
FIG. 12D: water and no alkene substrate and water and propylene. The scans were recorded at 50 mV/see scan rate with 85% automatic iR-compensation (i=current, R=resistance), and the second scan from each CV is shown.
Figure 12B:
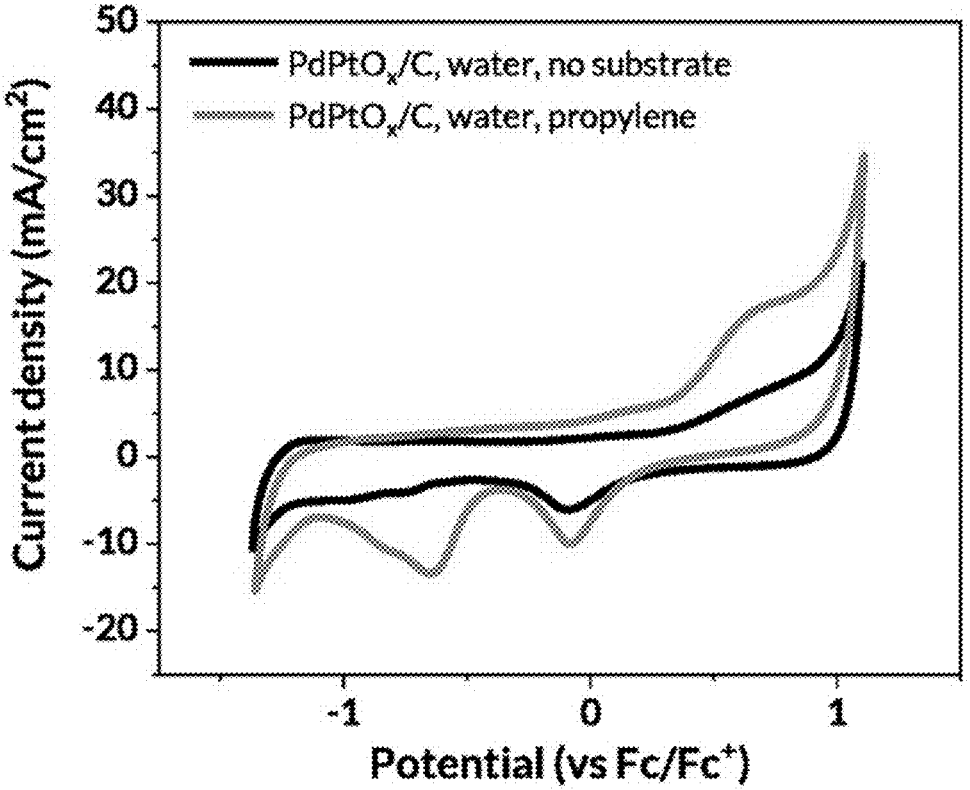
Figure 12C:
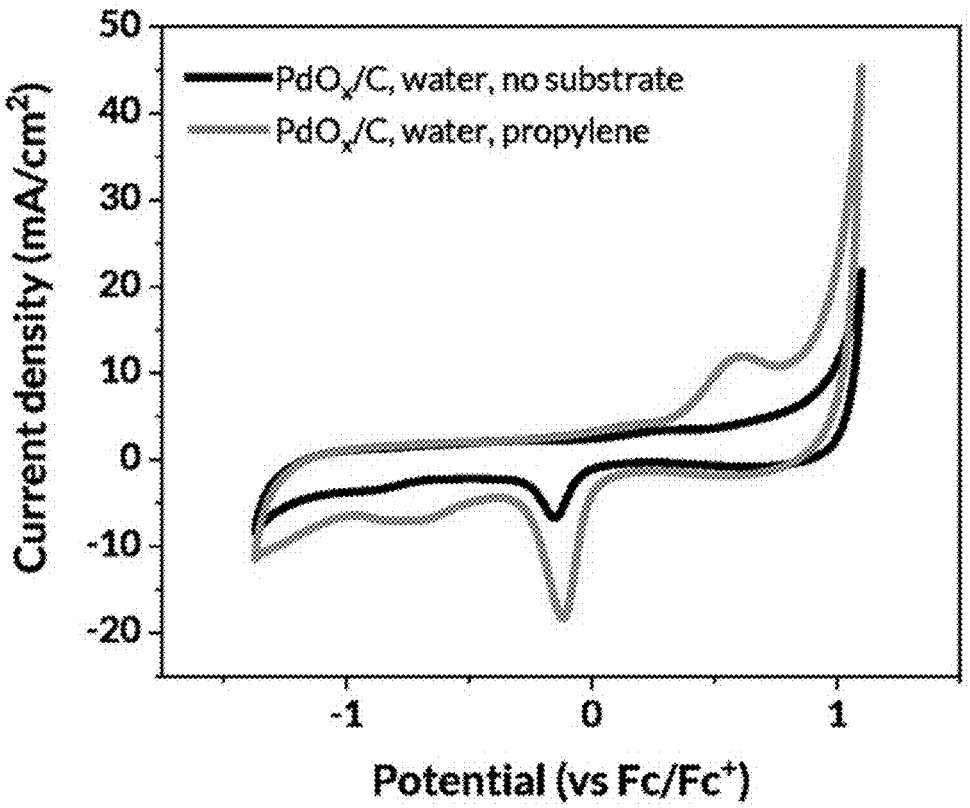
Figure 12D:
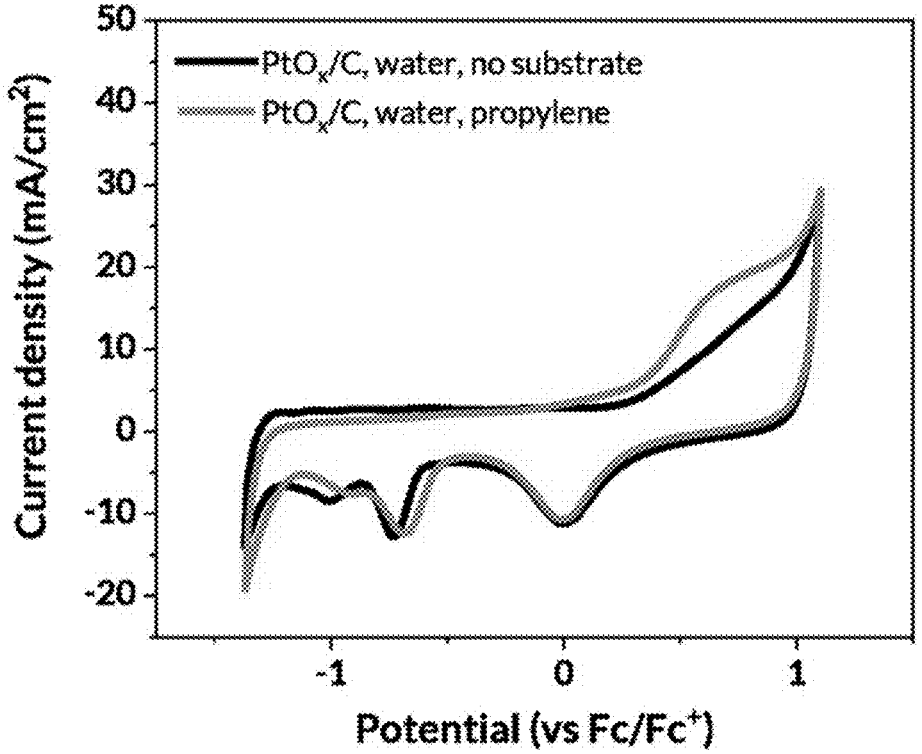

| Entry | Anode material | Electrolyte | Conditions* | Highest epoxide production rate (μmol/cm$^2$/hr)† | Epoxidation FE at the highest rate | Ref. |
|---|---|---|---|---|---|---|
| 1 | Pt black (calcined at 400 °C air) | Aqueous 1M $H_3PO_4$ between the electrodes, $CH_2Cl_2$ solvent at the anode | 30 °C | 84 (23%, 1.32 V applied) 95 (13.7%, 1.38 V vs. NHE applied) | ~23% | (13) |
| 2 | $Ag_3PO_4$ cube | 0.1 M phosphate (pH 7) buffer | 2.4 V vs. RHE | 9.2 | 18.7% | (17) |
| 3 | Ag | 8.7 mM NaOH | | <0.02 | >0 | (16) |
| 4 | $PtO_x$ | Nafion membrane-electrode assembly (0.5M $H_2SO_4$), $CH_2Cl_2$ solvent at the anode | 1.6 V vs. SHE | 37 | 7.4% | (14) |
| 5 | $PtO_x(N_2H_4)$ | | | 4.7 | 40% | |
| 6 | $PtO_2$ + graphite | 1M $H_3PO_4$ | 30 °C, ambient pressure | 19 | 17% | (15) |
| 7 | Electrode posited Pd on glassy carbon | 0.1M $HClO_4$ | 1.2 V vs. RHE | <0.5 0.0037 μmol/cm$^2_{ECSA}$/hr | 22% (PG) | (10) |
| 8 | Pd-functionalized titanium hollow fiber | 0.1M $HClO_4$ | 1.2 V vs. RHE | 0.061 μmol/cm$^2_{ECSA}$/hr | 19% (PG) | (11) |
| 9 | Pd/C | 0.1M $HClO_4$ | 1.4 V vs. RHE | 11.2 | 23.2% (PG) | (9) |
| 10 | PdO/C | | | 23.3 | 46.7% (PG) | |
| 11 | Stainless steel screen | pH 13.8 KOH (0.63M) | 40 °C, Constant cell current at 24 mA/cm$^2$ | 353 | 79% | (38) |
| 12 | $PdPtO_x$/C | 0.4M $TBABF_4$, 10M water in acetonitrile | Constant cell current at 50 mA/cm$^2$, 1 h | 695 | 74.5% | This work (FIG. 9C) |
| 13 | | | 1.1 V vs. $Fc/Fc^+$ | 473 | 66.0 ± 0.8% | This work (FIG. 1D) |
| 14 | | 0.25M sodium phosphate buffer (pH 6), 0.9M $NaClO_4$ | 1.65 V vs. SHE | 411 | 57 ± 5% | This work (FIG. 1E) |
| 15 | | 0.1M $HClO_4$ | Constant cell current at 24 mA/cm$^2$ | 539 | 68.7% (PG) | This work (comparison to Entry 7-10) |
| 16 | | 0.1M sodium phosphate (pH 7) buffer | 2.4 V vs. RHE | 308 | 38.4% | This work (comparison to Entry 2) |

*Experiments were done at room temperatures and ambient pressures if not otherwise noted.

Figure 1C:
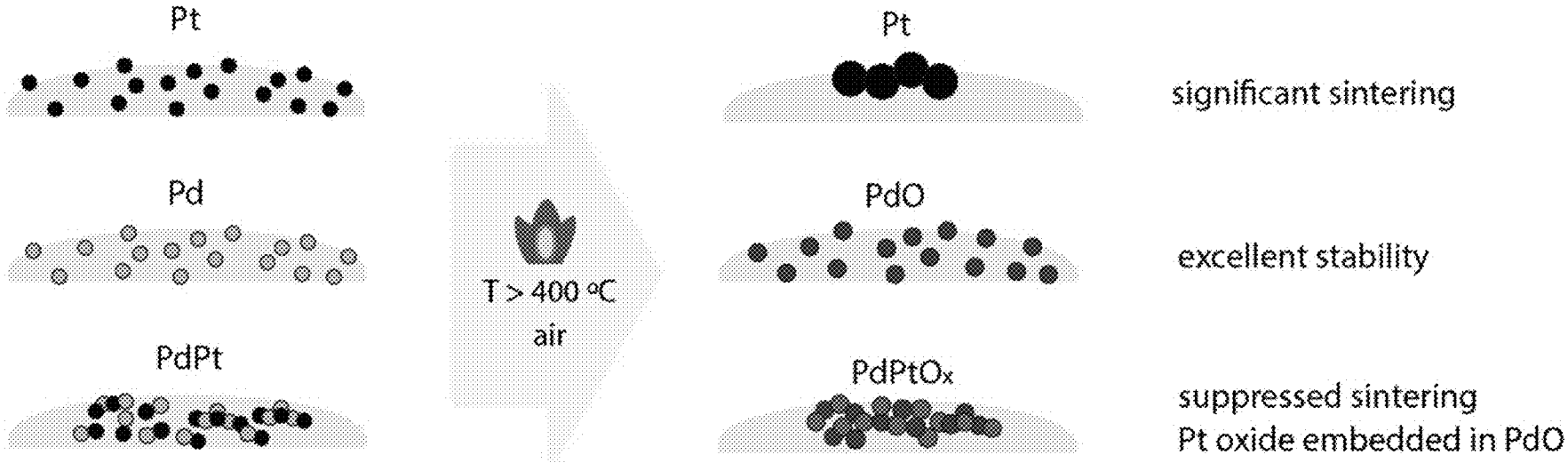
Figure 1D:
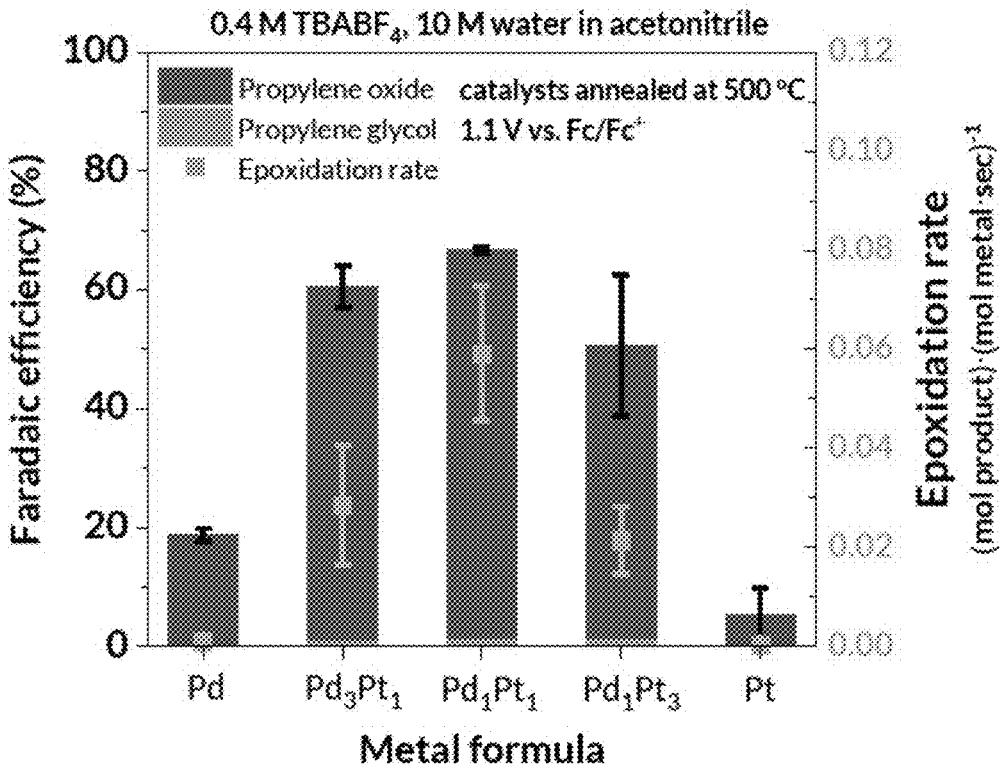
Figure 1E:
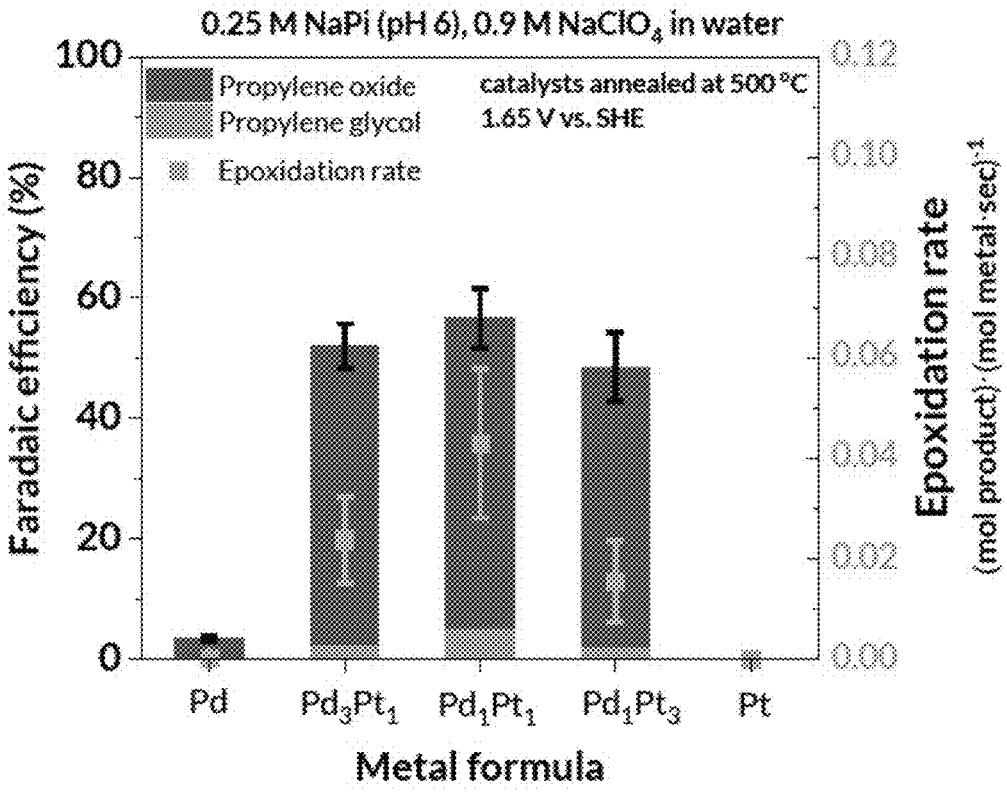

†Propylene epoxidation rate was compared in the unit of μmol/cm$^2$/hr, and the area indicates the geometric surface area of the electrode. Relevant information needed for the rate conversions was found in each paper's methods and supplementary material:

Referring now to FIG. 1C we alloyed Pt with Pd to leverage complementing properties of the two elements, enabling the attainment of optimal oxidation states and structures for an epoxidation catalyst. Under aerobic conditions, Pt nanoparticles tend to sinter into a metallic form when annealed above 400 °C. (19) because volatile $PtO_2$ species mediate the sintering process by facilitating Ostwald ripening (20,21). In contrast, stable PdO nanoparticles can be produced through annealing of Pd nanoparticles without significant sintering (19,22). PdO can trap mobile $PtO_2$ species, which results in less sintering of Pd—Pt alloy nanoparticles compared to Pt nanoparticles (20,23). In addition, Pd and Pt share substantially similar crystal structures and atomic sizes, allowing us to obtain a homogeneous distribution of Pd and Pt components in their alloys.

Figure 6:
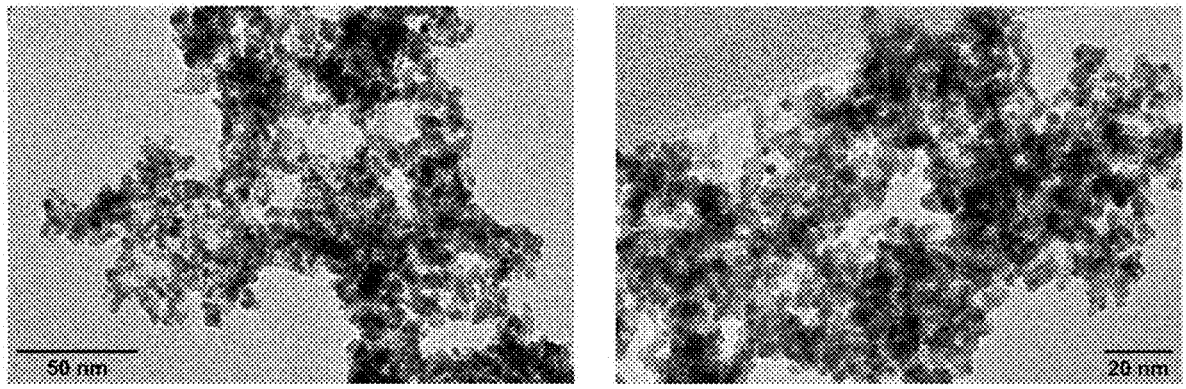
FIG. 6: Representative TEM image of $PdPtO_x/C$ annealed at 400 °C.
Figure 7:
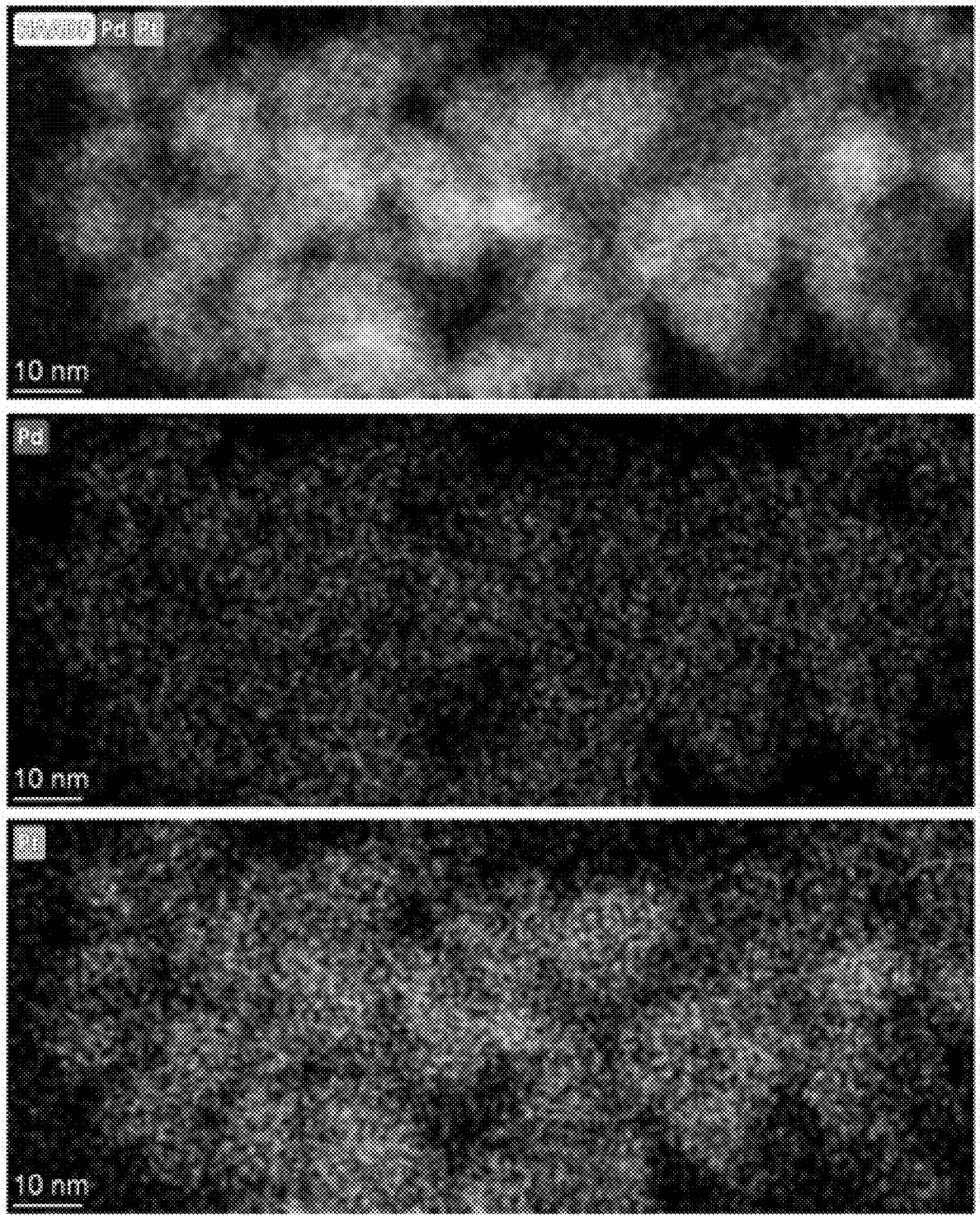
FIG. 7: High-resolution energy dispersive spectroscopy mapping of $PdPtO_x/C$ annealed at 500 °C.
Figure 7:
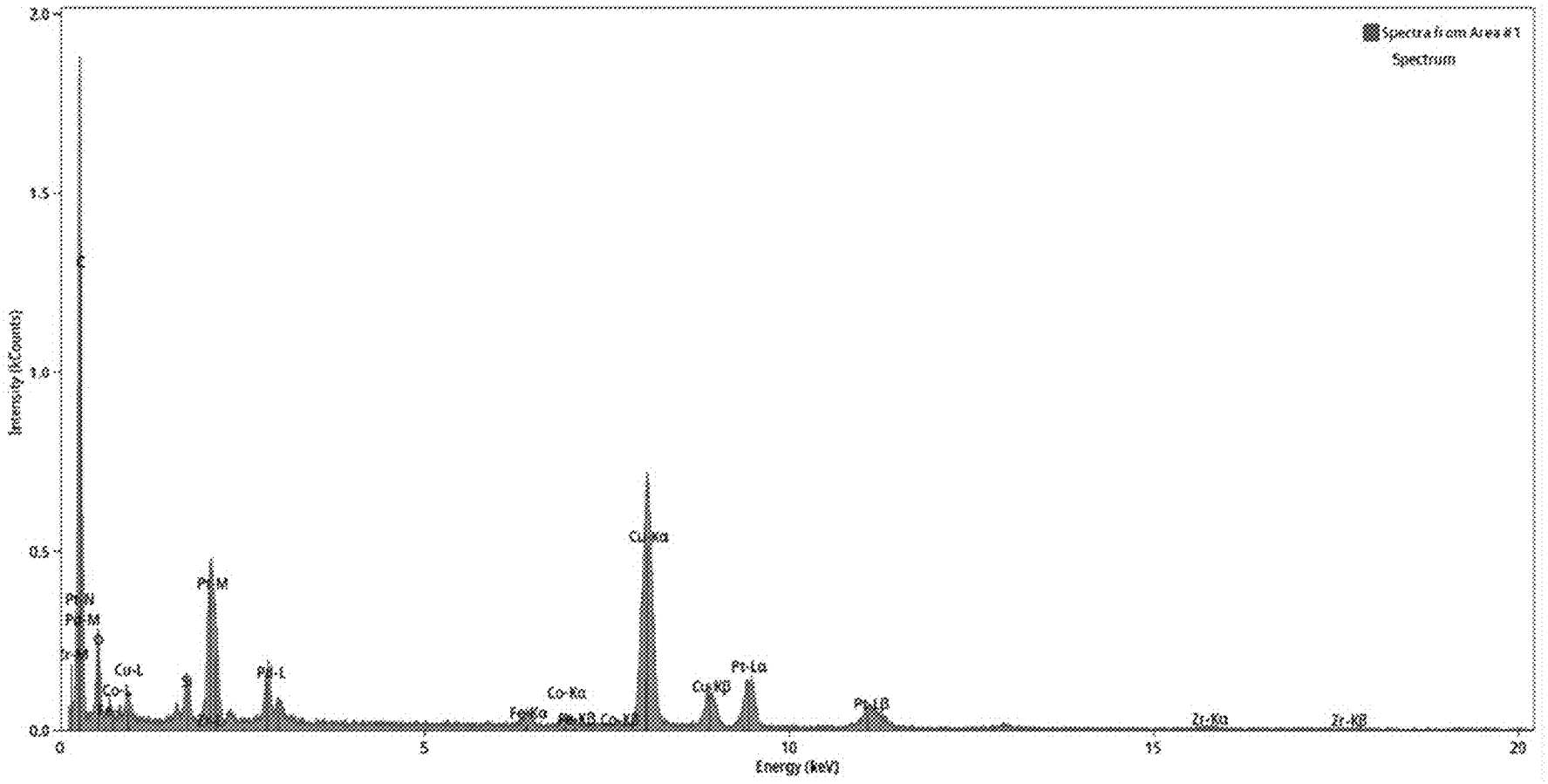
Figure 8:
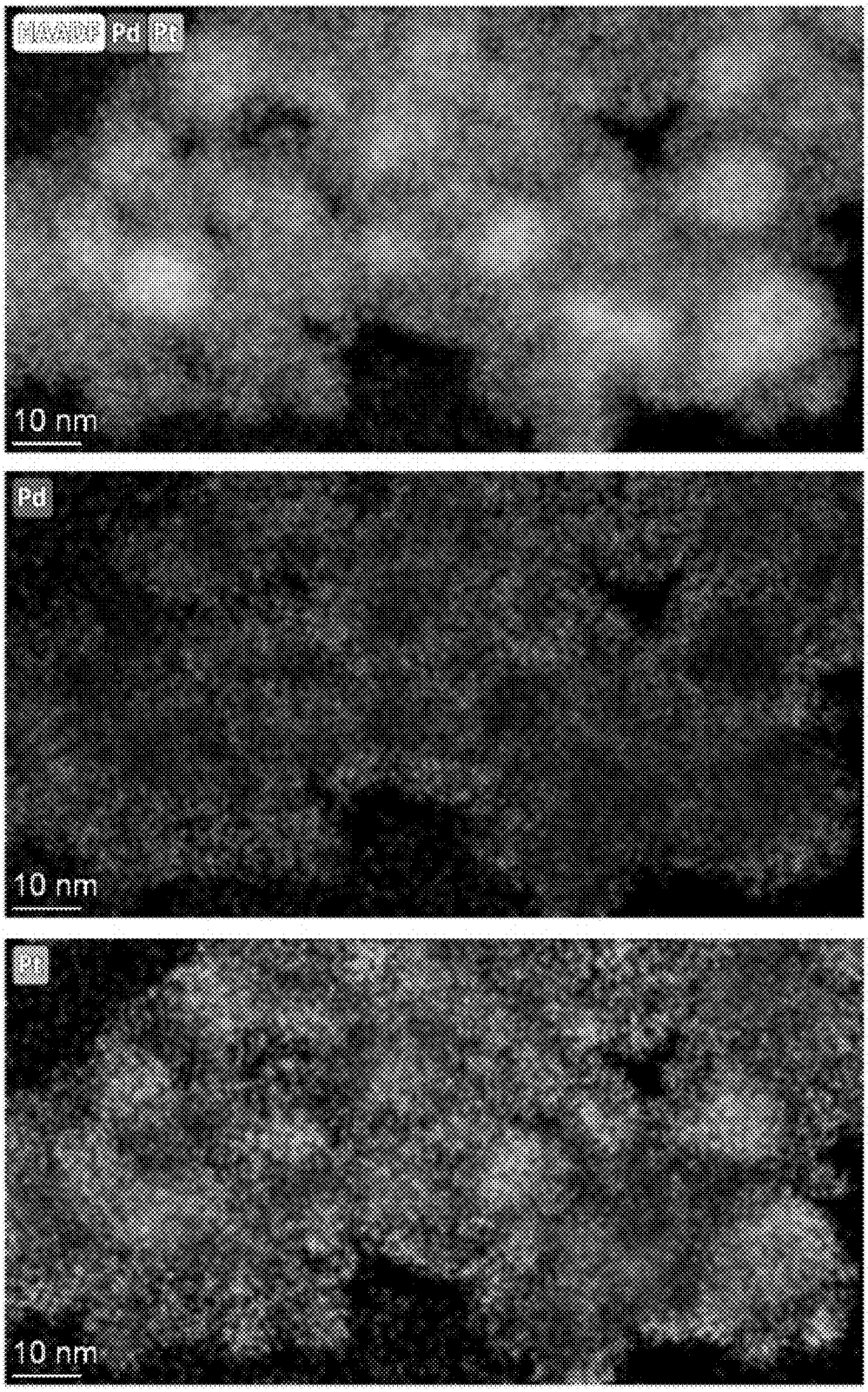
FIG. 8: High-resolution energy dispersive spectroscopy mapping of $Pd_1Pt_3O_x/C$ and $Pd_3Pt_1O_x/C$ annealed at 500 °C.
Figure 8:
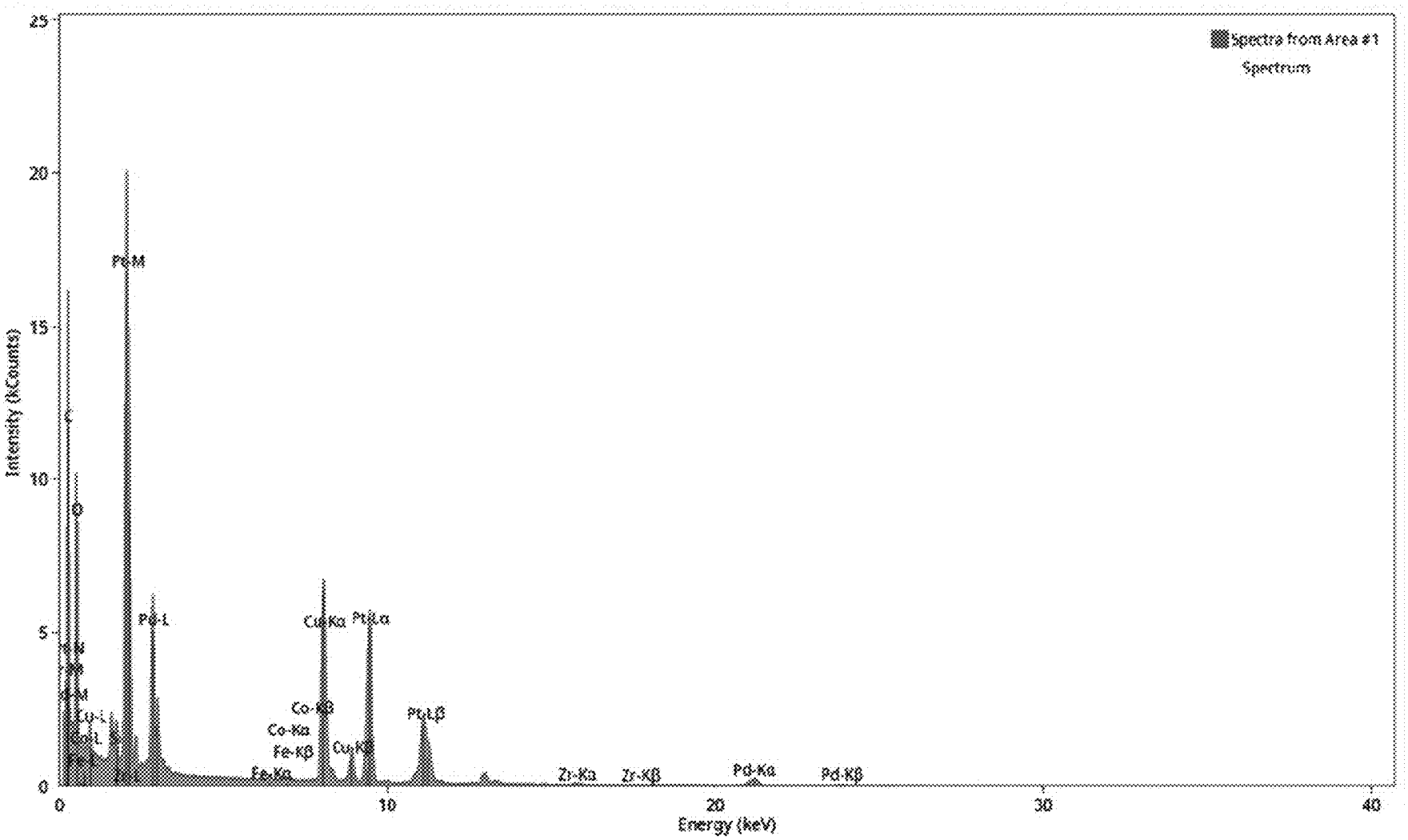
Figure 8:
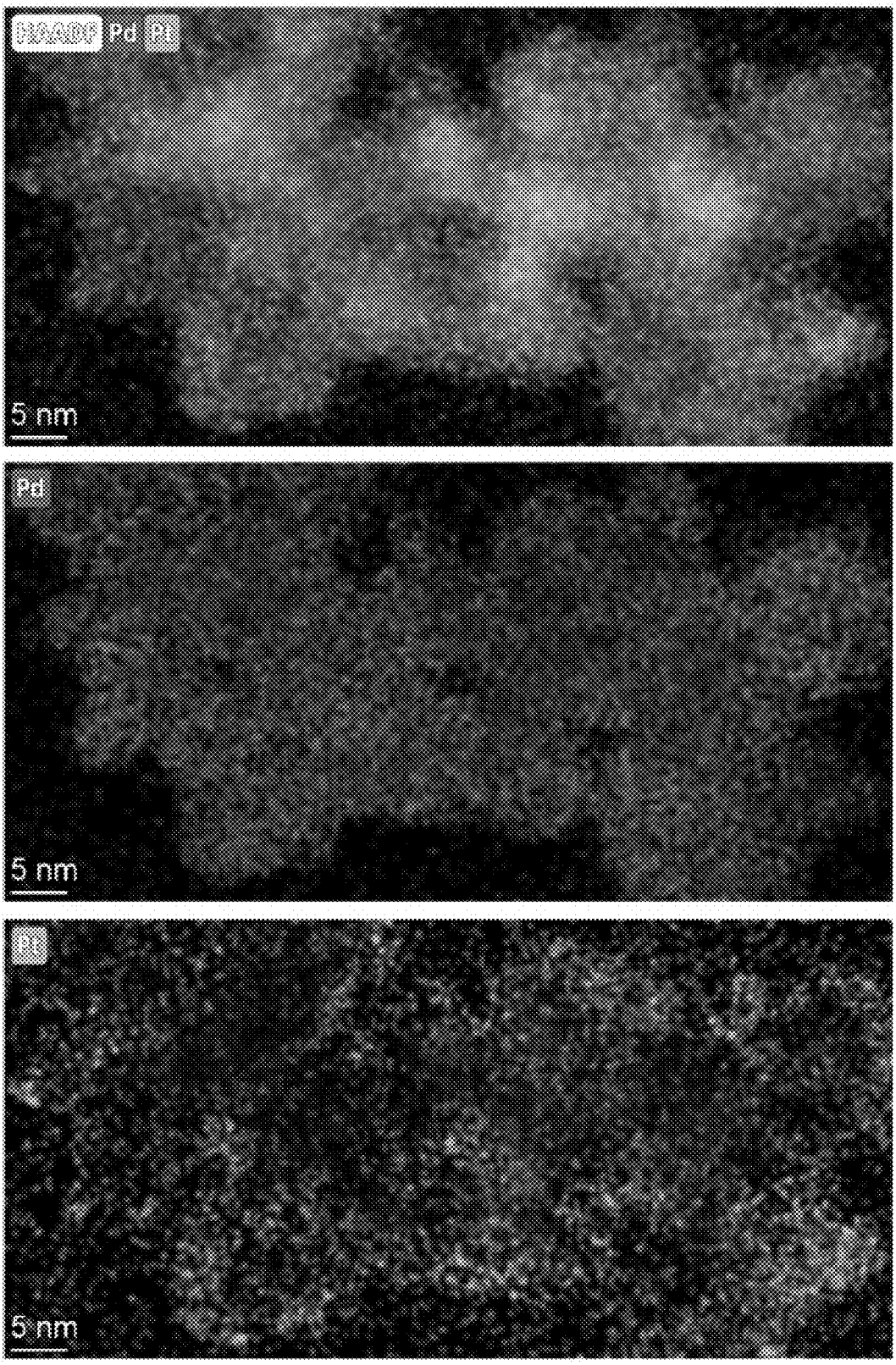
Figure 8:
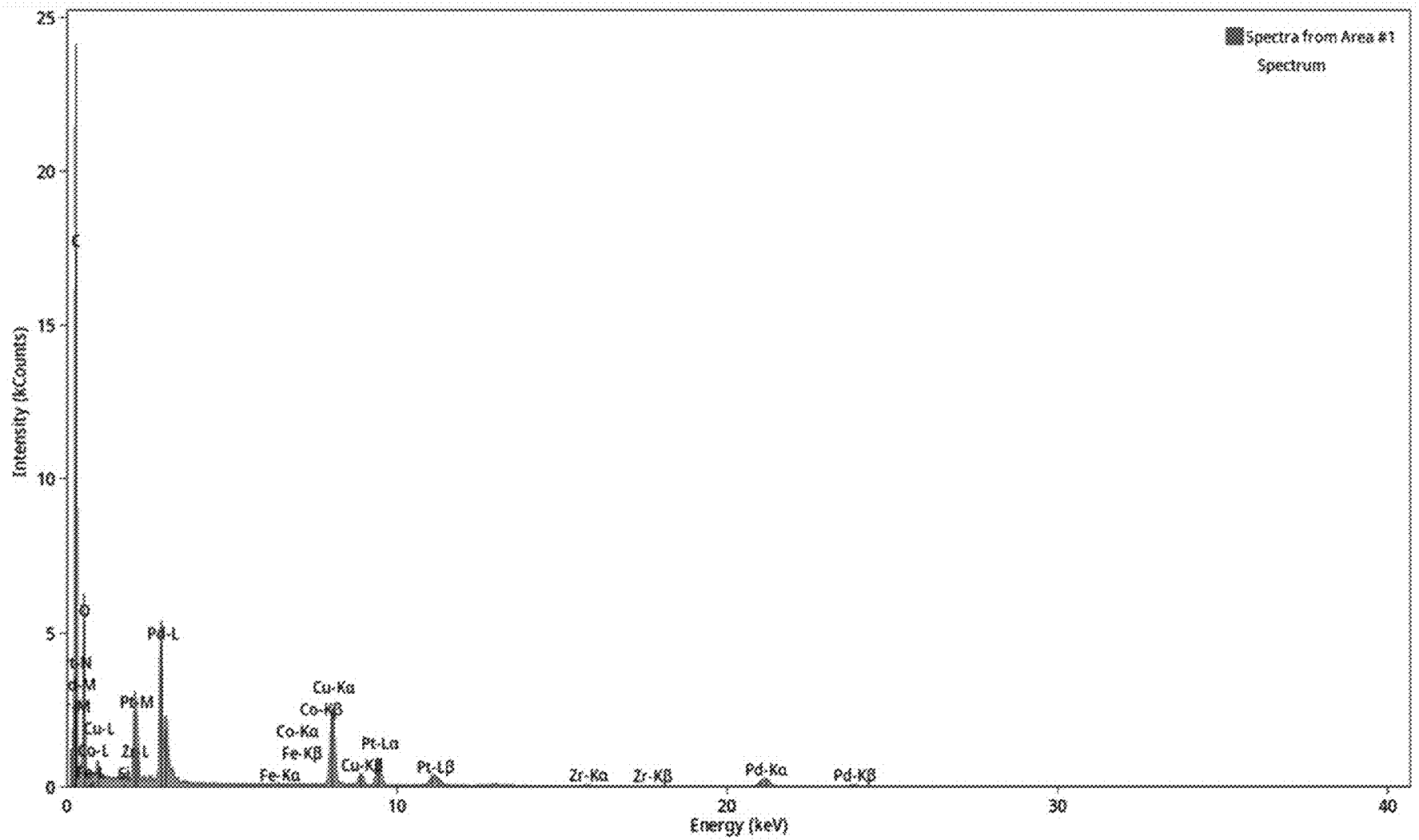

We designed a Pd—Pt alloy catalyst containing both Pd and Pt oxide by embedding and stabilizing Pt oxide species in Pd oxide. A series of alloys with varying ratios of Pd and Pt were synthesized using a co-reduction method (24) on an amorphous carbon substrate and subsequently annealed under static air before being tested for their activity in propylene epoxidation (FIGS. 6-8). Our catalyst is compatible with a blended electrolyte comprised of acetonitrile and water (FIG. 1D) that can accommodate a broad spectrum of alkene substrates including gaseous and liquid alkenes, as well as aqueous electrolytes (FIG. 1E) that can minimize overall cell voltage for gaseous alkene epoxidation (FIGS. 9A-9D). The alloy catalyst with an equimolar composition of Pd and Pt annealed at 500 °C. ($PdPtO_x$) was most active toward propylene epoxidation and surprisingly outperformed previously reported catalysts for direct anodic epoxidation under ambient conditions (FIG. 1B and Table 1). Furthermore, alloys with metal compositions of $Pd_3Pt_1$ and $Pd_1Pt_3$ exhibited epoxidation activities on par with $PdPtO_x$/C; when Pd and Pt are integrated at the nanometer scale (FIGS. 7 and 8), unexpectedly Pd—Pt alloy catalysts can achieve enhanced epoxidation rates and Faradaic efficiencies relative to either Pd or Pt alone (FIGS. 1D-1E, FIGS. 10A-10D).

Although alloying metals may sometimes lead to enhanced properties, such enhancements are not predictable due to complex nanoscale interactions. When two or more metals are alloyed, the combined catalytic effects may be, for example, merely additive, averaged out, or may even be diminished due to negative interactions, such as, for example, site blocking. Conversely, our Pd—Pt alloy catalyst exhibits the unexpected result of at least three times higher Faradaic efficiency and orders of magnitude increased reaction rates for alkene epoxidation relative to either Pd or Pt alone suggesting an unexpected enhancement effect between Pd and Pt. The Pd—Pt alloy's distinct geometric and electronic properties, for example, may have enabled catalytic reactivity that Pd and Pt alone are unable to achieve.

Referring now to FIGS. 9A-9D, in an electrolytic cell equipped with circulating liquid electrolytes, we demonstrated continuous propylene oxide production with Faradaic efficiency averaging 66±5% (propylene glycol; 1.3±0.3%) for 3 hours at a constant current density of 50 mA/cm$^2$. Additionally, $PdPtO_x$ catalyzed cyclooctene epoxidation with a Faradaic efficiency of about 90%, a notable improvement over the results observed in our previous studies using Ir—$MnO_x$ (~50%) and $MnO_x$ (~30%) catalysts (Table 2) (7,8).

TABLE 2

Comparison of catalyst performances for direct electrocatalytic cyclooctene epoxidation using water as the oxygen source.

| | Anode material | electrolyte | conditions | Highest epoxide production rate (mA/cm$^2$) | Epoxidation FE at highest rate | Ref. |
|---|---|---|---|---|---|---|
| 1 | $MnO_x$ | 0.1M $TBABF_4$, 5-10M $H_2O$, and 200 mM cyclooctene in acetonitrile | 1.45 V vs. $Fc/Fc^+$ | ~2.5 | ~30% | (8) |
| 2 | $Ir_{single}$-$MnO_x$ | 0.11M $TBABF_4$, 10M water in acetonitrile | 1.45 V vs. $Fc/Fc^+$ | 10.5 ± 2.8 | 46 ± 4% | (7) |
| 3 | $RuO_2/N_{0.12}C$ | 0.025M cyclooctene, 0.05M $LiClO_4$, Ar-saturated ethanol/water (1:3) | 1.2 V vs. Ag/AgCl | ~3.2 | ~80% | (39) |
| 4 | $PdPtO_x$/C (annealed at 400 °C) | 0.11M $TBABF_4$, 10M water in acetonitrile | 1.05 V vs. $Fc/Fc^+$ | 15.8 ± 0.5 | 92 ± 4% | This work |
| 5 | | | Constant cell current at 40 mA/cm$^2$ | 34.1 | 85.2% | |

Catalyst Characterizations

We examined the bulk and surface properties of our annealed PdPt/C, Pd/C, and Pt/C catalysts ($PdPtO_x$/C, $PdO_x$/C, and $PtO_x$/C, respectively) to shed light on the enhanced performance of $PdPtO_x$/C compared to $PdO_x$/C and $PtO_x$/C.

X-ray diffraction (XRD) patterns showed that although $PdO_x$/C and $PtO_x$/C only exhibited oxide and metallic phases, respectively, the $PdPtO_x$/C contained both phases (FIG. 2A and FIGS. 11A-11C). The oxide phase of $PdPtO_x$/C resembles that of $PdO_x$/C, as the (101) peak in $PdPtO_x$/C at 33.7° occurs at a similar angle as the $PdO_x$/C peak at 33.9°. Similarly, the metallic phase of $PdPtO_x$/C parallels that of $PtO_x$/C, with the (111) peak shifted from 39.8° in $PtO_x$/C to 40.0° in $PdPtO_x$/C. Furthermore, the broader peaks in the $PdPtO_x$/C XRD pattern indicate that the $PdPtO_x$/C has smaller crystallites than $PtO_x$/C (Table 3), which is consistent with our hypothesis that the sintering of PdPt/C is less severe than that of Pt/C upon annealing.

TABLE 3

XRD-determined crystallite sizes in Pd/C, Pt/C, and PdPt/C catalysts.

| | Pd/C | | Pt/C | | PdPt/C | |
|---|---|---|---|---|---|---|
| (unit: nm) | metal | oxide | metal | oxide | metal | oxide |
| non-annealed | 3.4 ± 1.1 | — | 3.2 ± 1.3 | — | 3.2 ± 0.6 | — |
| 300 °C | 7.9 ± 1.1 | 4.5 ± 0.5 | 2.7 ± 0.3 | — | 3.007 ± 0.004 | 2.60 ± 0.03 |
| 400 °C | — | 8.7 ± 0.4 | 23.9 ± 2.9 | — | 5.7 ± 0.7 | 4.0 ± 1.1 |
| 500 °C | — | 12.2 ± 1.0 | 29.1 ± 3.9 | — | 16.9 ± 4.2 | 14.1 ± 4.9 |

Figure 2A:
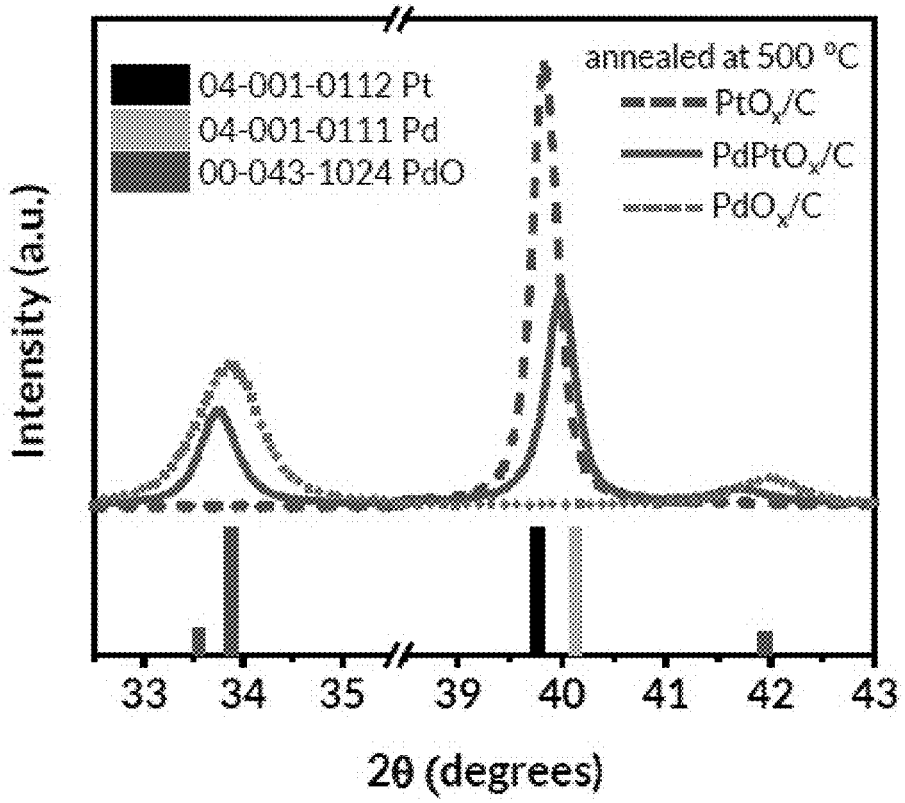
FIGS. 2A-2F: Ex-situ characterizations of annealed PdPt/C, Pd/C, and Pt/C catalysts.
Figure 2B:
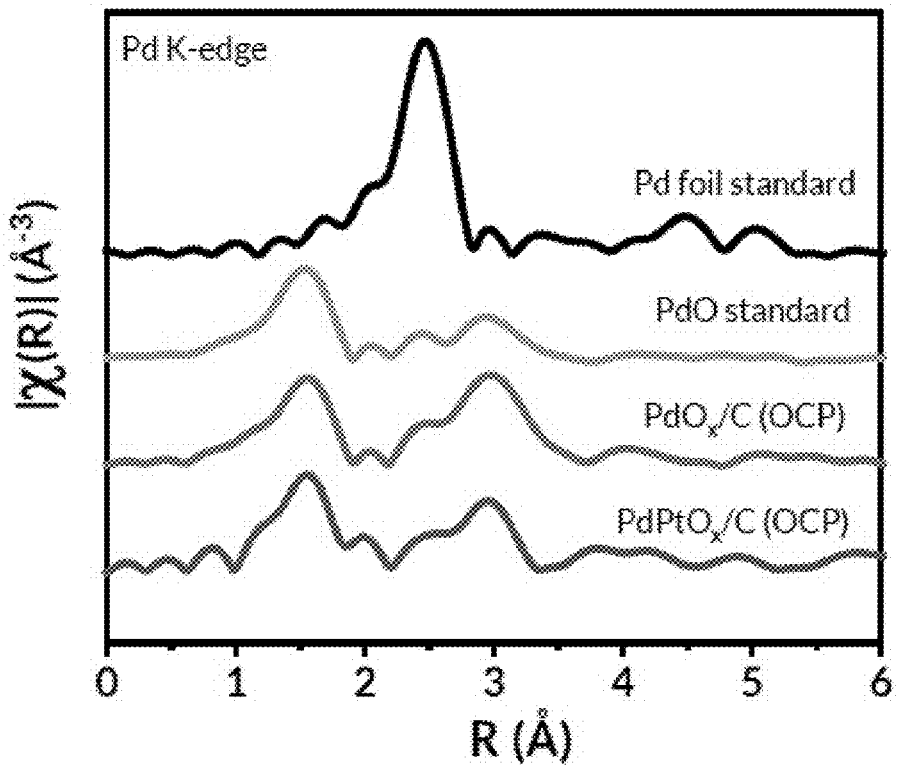
Figure 2C:
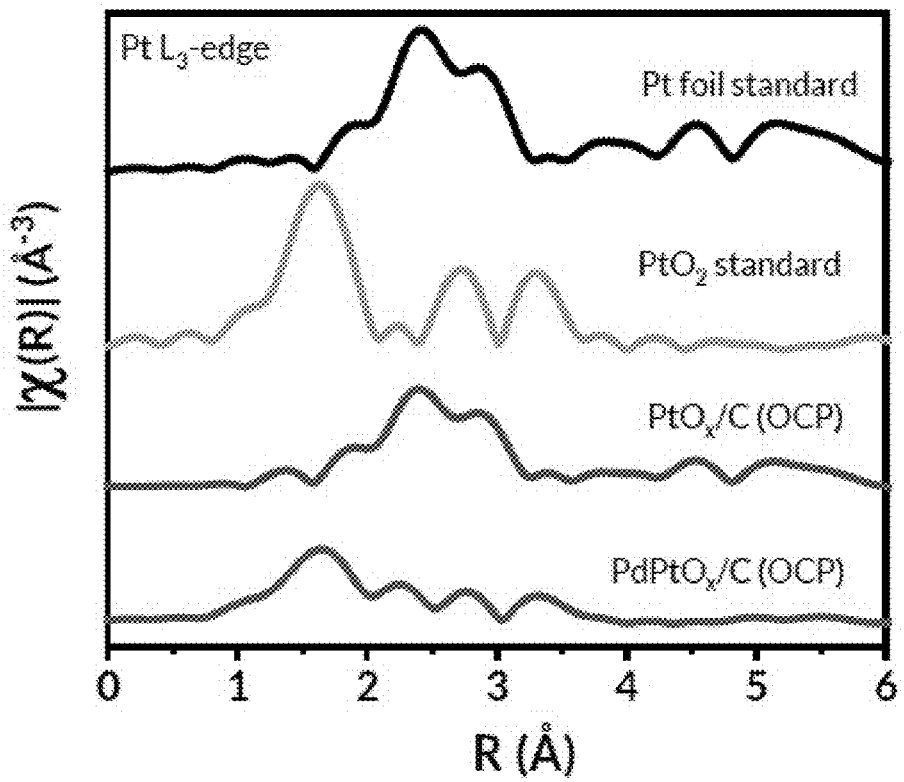
Figure 2D:
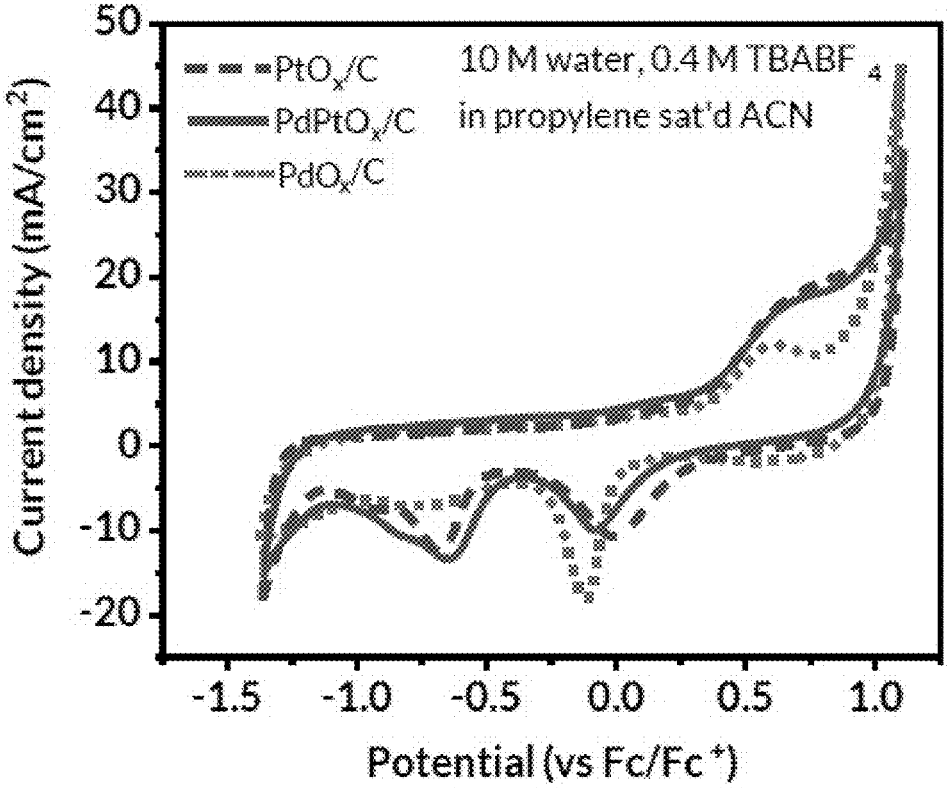

Extended X-ray absorption fine structure (EXAFS) measurements revealed that, within fitting errors, Pd and Pt coordinate with the same number of oxygens in $PdPtO_x/C$; the Pd—O and Pt—O coordination numbers were estimated to be 3.7±0.4 and 2.8±0.6, respectively (FIGS. 2B-2C and Tables 4-6). The local coordination environments of Pd in $PdPtO_x/C$ and $PdO_x/C$ were similar to that of PdO, while $PtO_x/C$ resembled the Pt foil standard and did not show any contribution from the Pt—O scattering path. In contrast, the local environment of Pt in $PdPtO_x/C$ was different from that in Pt foil or $PtO_2$ standard, and the first-shell scattering path of $PdPtO_x/C$ was fit with a combination of Pt—O and Pt—Pd/Pt scattering paths. These EXAFS data suggest that blending Pt in the PdO structure induced a local coordination environment of Pt resembling that of PtO, which is unstable alone.

TABLE 4

EXAFS fitting of Pd and Pt foil standards.

| | Bond type | N | $S_o^2$ | $\sigma^2$ | $\Delta E_0$ (eV) | $R_{eff}$ (Å) | ΔR (Å) | R-factor |
|---|---|---|---|---|---|---|---|---|
| Pd foil standard | Pd—Pd | 12 | 0.74(3) | 0.0053(3) | −5.6(4) | 2.7505 | −0.009(2) | 0.004 |
| Pt foil standard | Pt—Pt | 12 | 0.79(6) | 0.0041(5) | 7.7(6) | 2.7689 | −0.007(4) | 0.008 |

TABLE 5

EXAFS fitting of catalysts at Pd K-edge.

| | Bond type | N | $S_o^2$ | $\sigma^2$ | $\Delta E_0$ (eV)* | R (Å) | R-factor |
|---|---|---|---|---|---|---|---|
| $PdO_x/C$ | Pd—O | 3.7(4) | 0.74 | 0.0001(10) | 0.7(16) | 2.014(9) | 0.01 |
| (open-circuit) | Pd—(di-μ-O—)Pd | 4.5(18) | | 0.004(2) | | 3.063(2) | |
| | Pd—(mono-μ-O—)Pd | 5.4(21) | | 0.003(2) | | 3.44(1) | |
| $PdO_x/C$ | Pd—O | 3.7(4) | 0.74 | 0.0004(10) | 1.9(14) | 2.017(8) | 0.01 |
| (1.15 V vs. | Pd—(di-μ-O—)Pd | 5.0(16) | | 0.004(2) | | 3.06(1) | |
| $Fc/Fc^+$) | Pd—(mono-μ-O—)Pd | 5.4(21) | | 0.004(2) | | 3.45(1) | |
| $PdPtO_x/C$ | Pd—O | 3.1(5) | 0.74 | −0.002(2) | −2.4(25) | 1.98(1) | 0.02 |
| (open-circuit) | Pd—Pd | 0.62(55) | | | | 2.83(4) | |
| Fit 1 | Pd—Pt | 1.2(10) | | | | 2.92(8) | |
| | Pd—(di-μ-O—)Pd | 1.2(11) | | | | 3.03(5) | |
| | Pd—(mono-μ-O—)Pd | 1.7(6) | | | | 3.45(2) | |
| $PdPtO_x/C$ | Pd—O | 3.2(5) | 0.74 | −0.002(1) | 0.0(22) | 2.00(1) | 0.04 |
| (open-circuit) | Pd—(di-μ-O—)Pd | 1.7(5) | | | | 3.06(1) | |
| Fit2 | Pd—(mono-μ-O—)Pd | 1.4(5) | | | | 3.46(2) | |
| $PdPtO_x/C$ | Pd—O | 3.3(7) | 0.74 | −0.001(2) | −1.7(28) | 1.99(2) | 0.02 |
| (1.15 V vs. | Pd—Pd | 0.39(62) | | | | 2.85(8) | |
| $Fc/Fc^+$) | Pd—Pt | 0.7(11) | | | | 2.9(2) | |
| Fit 1 | Pd—(di-μ-O—)Pd | 1.5(12) | | | | 3.04(5) | |
| | Pd—(mono-μ-O—)Pd | 1.9(8) | | | | 3.45(3) | |
| $PdPtO_x/C$ | Pd—O | 3.5(4) | 0.74 | −0.001(1) | −0.6(18) | 2.00(1) | 0.03 |
| (1.15 V vs. | Pd—(di-μ-O—)Pd | 1.7(4) | | | | 3.05(1) | |
| $Fc/Fc^+$) | Pd—(mono-μ-O—)Pd | 1.8(5) | | | | 3.45(2) | |
| Fit 2 | | | | | | | |

*Assigning incorrect atomic species for backscatter might have caused negative Debye-Waller factors for $PdPtO_x/C$ samples.

TABLE 6

EXAFS fitting of catalysts at Pt $L_3$-edge.

| | Bond type | N | $S_o^2$ | $\sigma^2$ | $\Delta E_0$ (eV) | R (A) | R-factor |
|---|---|---|---|---|---|---|---|
| $PtO_x/C$ (open-circuit) | Pt—Pt | 9.5(8) | 0.79 | 0.0049(7) | 6.5(7) | 2.752(5) | 0.006 |
| $PtO_x/C$ (1.15 V vs. $Fc/Fc^+$) | Pt—Pt | 9.8(16) | 0.79 | 0.006(1) | 6.0(13) | 2.751(9) | 0.02 |
| $PdPtO_x/C$ | Pt—O | 2.8(6) | 0.79 | 0.004(3) | 11(3) | 2.01(2) | 0.01 |
| (open-circuit) | Pt—Pt | 2.2(12) | | | | 2.78(4) | |
| | Pt—Pd | 0.94(78) | | | | 2.82(5) | |
| $PdPtO_x/C$ | Pt—O | 2.8(5) | 0.79 | 0.005(3) | 11(2) | 2.01(2) | 0.007 |
| (1.15 V vs. | Pt—Pt | 2.5(11) | | | | 2.79(3) | |
| $Fc/Fc^+$) | Pt—Pd | 1.3(7) | | | | 2.83(4) | |

The mixing of Pd and Pt on the surface, matching the bulk composition, was confirmed through cyclic voltammetry (CV) and X-ray photoelectron spectroscopy (XPS) analyses. A single peak of surface oxide reduction (at ~0 V vs. $Fc/Fc^+$) was observed in the CV of the $PdPtO_x/C$ electrode, suggesting that Pd and Pt coexist on the catalyst surface (FIG. 2D and FIGS. 12A-12D). Furthermore, near-surface compositions derived from XPS survey spectra also indicate that Pd and Pt are present in a substantially equimolar ratio near the surface (Table 7), matching the bulk composition determined using inductively coupled plasma-optical emission spectrometry (Table 8).

TABLE 7

Near-surface compositions of PdPt/C catalysts derived from XPS survey spectra.

| | C | O | Pd | Pt |
|---|---|---|---|---|
| | weight % | | | |
| PdPt/C | 52.47 | 7.42 | 12.84 | 27.28 |
| $PdPtO_x/C$ (400 °C) | 10.63 | 19.61 | 25.94 | 42.37 |
| $PdPtO_x/C$ (500 °C) | 7.54 | 20.79 | 25.5 | 46.16 |
| | atomic % | | | |
| PdPt/C | 85.78 | 9.1 | 2.37 | 2.75 |
| $PdPtO_x/C$ (400 °C) | 32.55 | 47.50 | 9.48 | 8.65 |
| $PdPtO_x/C$ (500 °C) | 26.11 | 54.07 | 9.97 | 9.84 |

TABLE 8

Quantification of catalyst compositions using ICP-OES

| | Metal weight percent | Pt molar composition in metal |
|---|---|---|
| Pt/C | 44.0% | 1.00 |
| $Pd_1Pt_3/C$ | 48.6% | 0.75 |
| $Pd_1Pt_1/C$ | 34.8% | 0.49 |
| $Pd_3Pt_1/C$ | 37.8% | 0.24 |
| Pd/C | 35.7% | 0.00 |

Figure 2E:
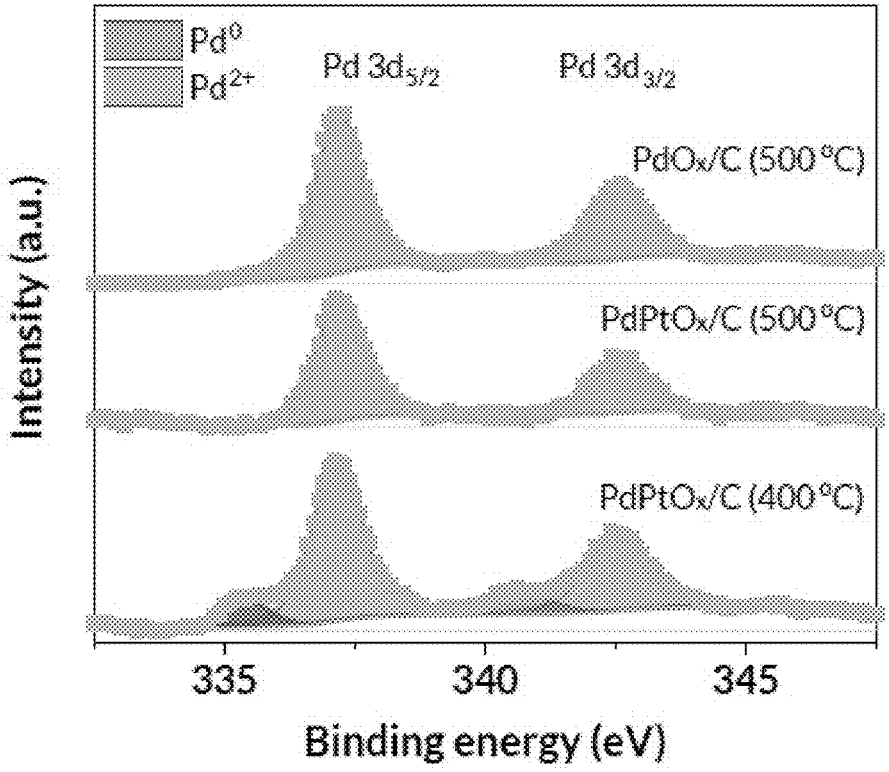
Figure 2F:
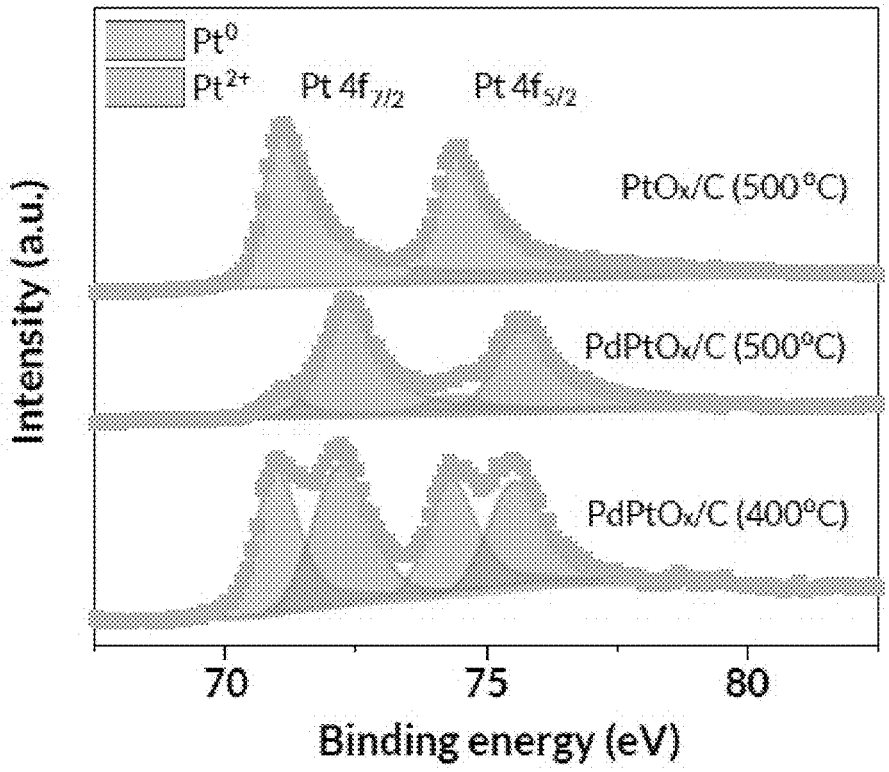
Figure 13:
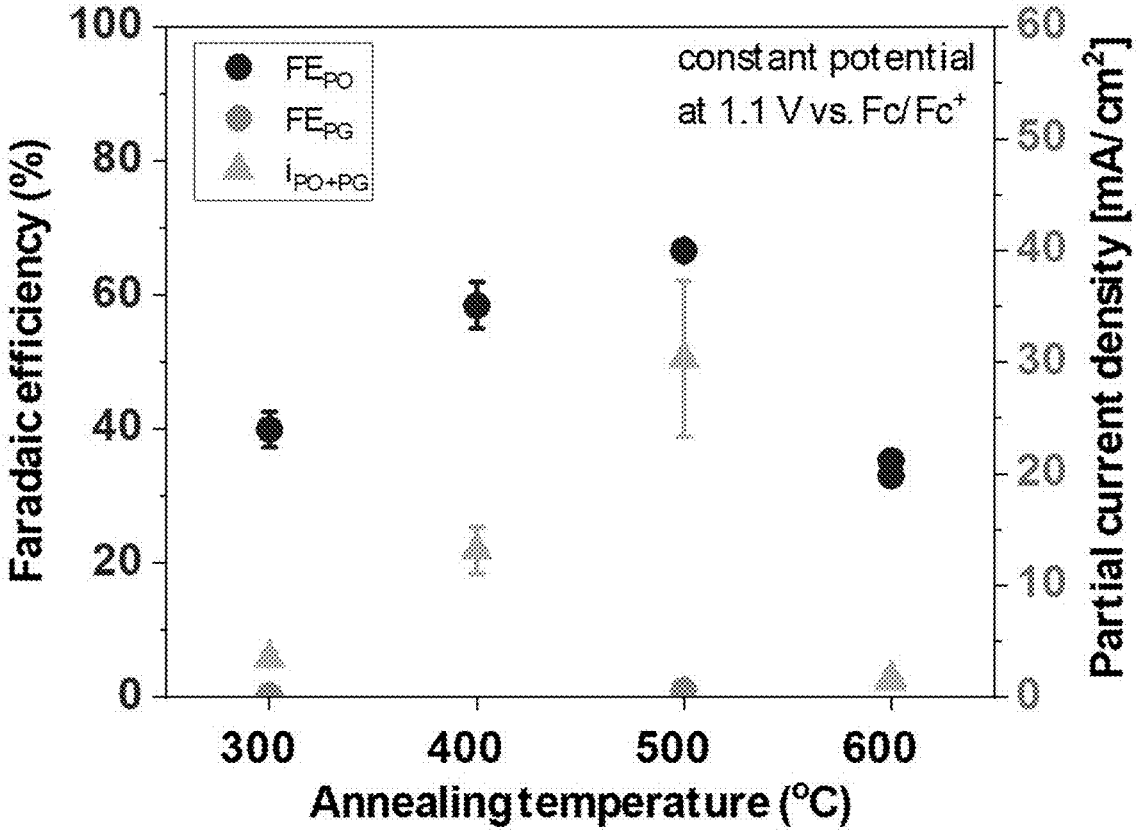
FIG. 13: Comparison of annealed PdPt/C catalyst performances at a constant potential of 1.1 V vs. $Fc/Fc^+$ (100% iR-compensated). Vertical error bars represent standard deviations from the mean of multiple replicates (n=3) of the same experiment.
Figure 14:
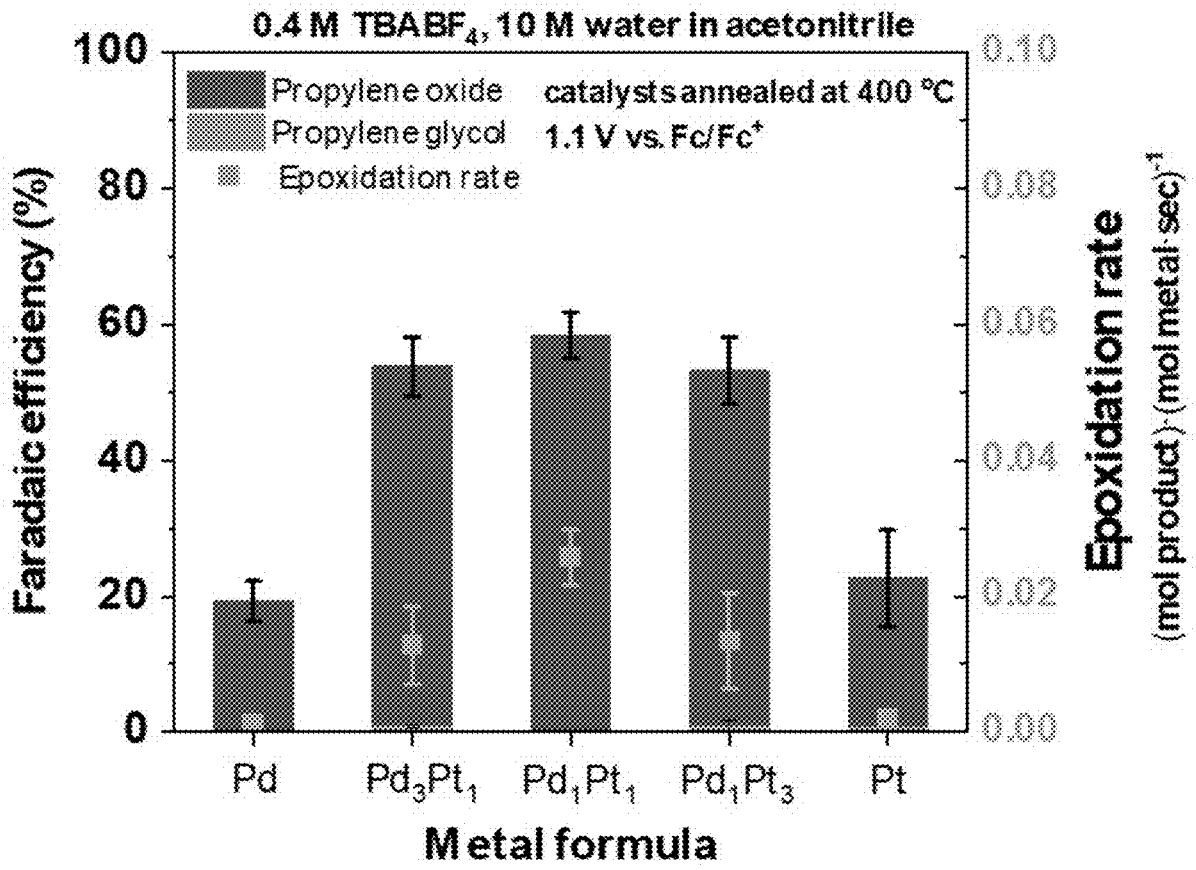
FIG. 14: Direct anodic propylene epoxidation performance with different compositions of Pd—Pt alloy catalysts annealed at 400 °C. This plot is analogous to FIG. 1D; note the different annealing temperatures and resulting differences in performances. 100% iR-compensated potential was applied. Vertical error bars represent standard deviations from the mean of multiple replicates (n≥3) of the same experiment.
Figure 15B:
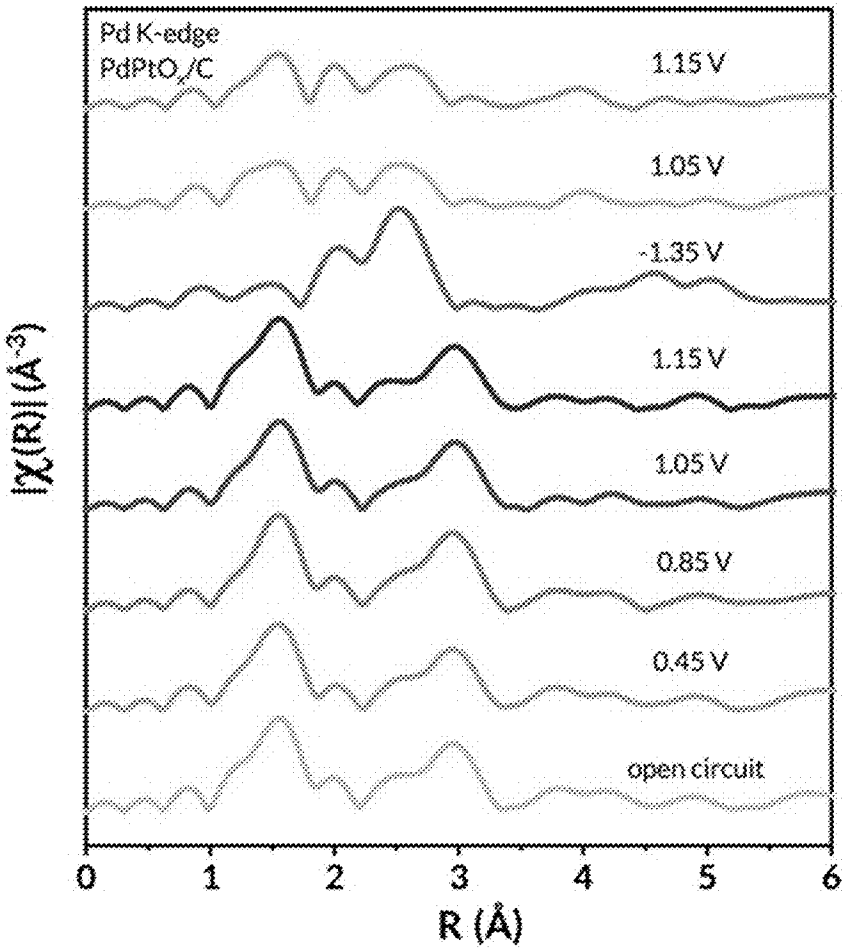
FIG. 15B: PdPtOx/C.
Figure 15A:
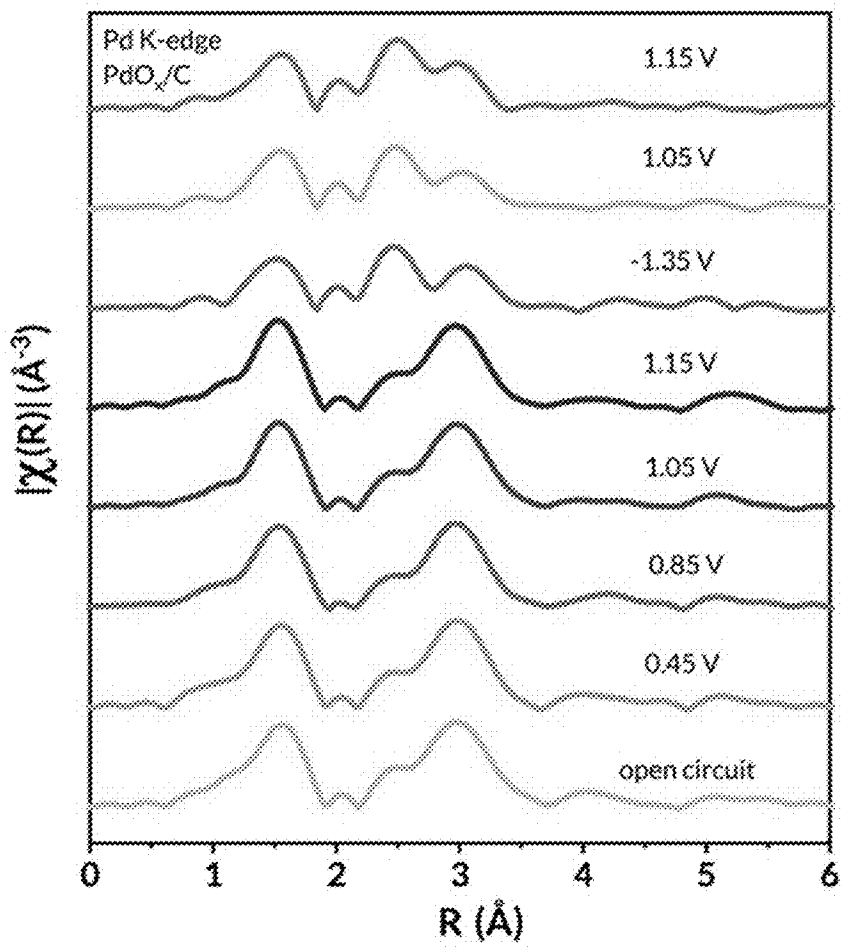
FIG. 15: Operando XAS at Pd K-edge for FIG. 15A: PdOx/C
FIG. 15C: Normalized absorption coefficient (μ(E)) of Pd, PdO, and PdOx/C as a function of X-ray energy projected to the samples.
FIG. 15D: Normalized absorption coefficient (μ(E)) of Pd, PdO, PdPtOx/C as a function of X-ray energy projected to the samples. The shifts and shapes of the absorption spectra reflect oxidation states of Pd. Potentials in this figure were 100% iR-compensated (i=current, R=resistance).
Figure 15C:
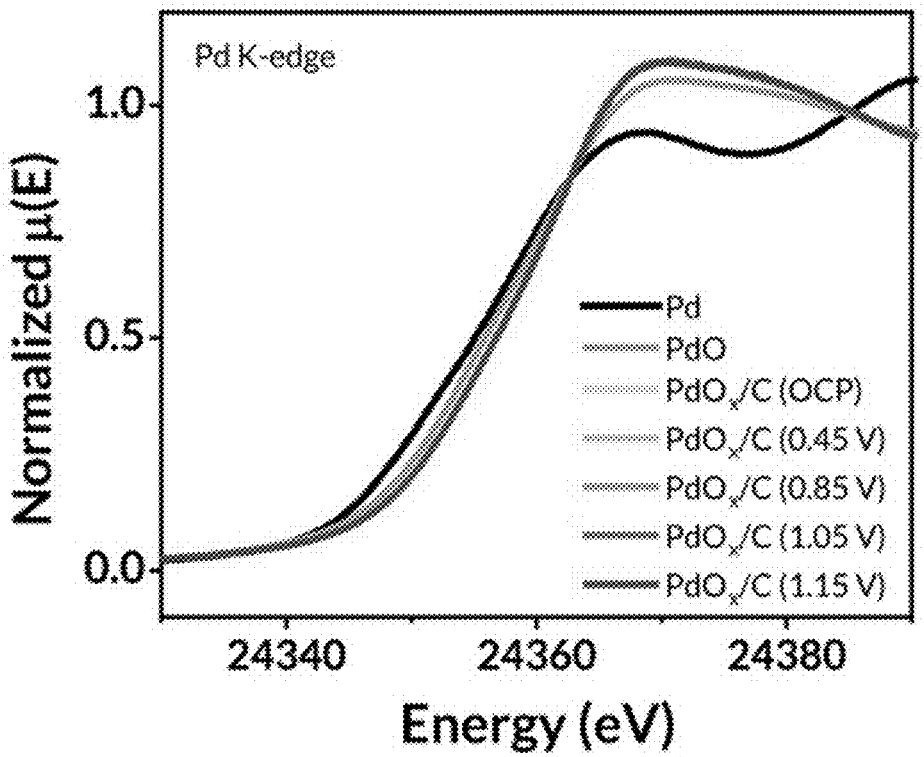
Figure 15D:
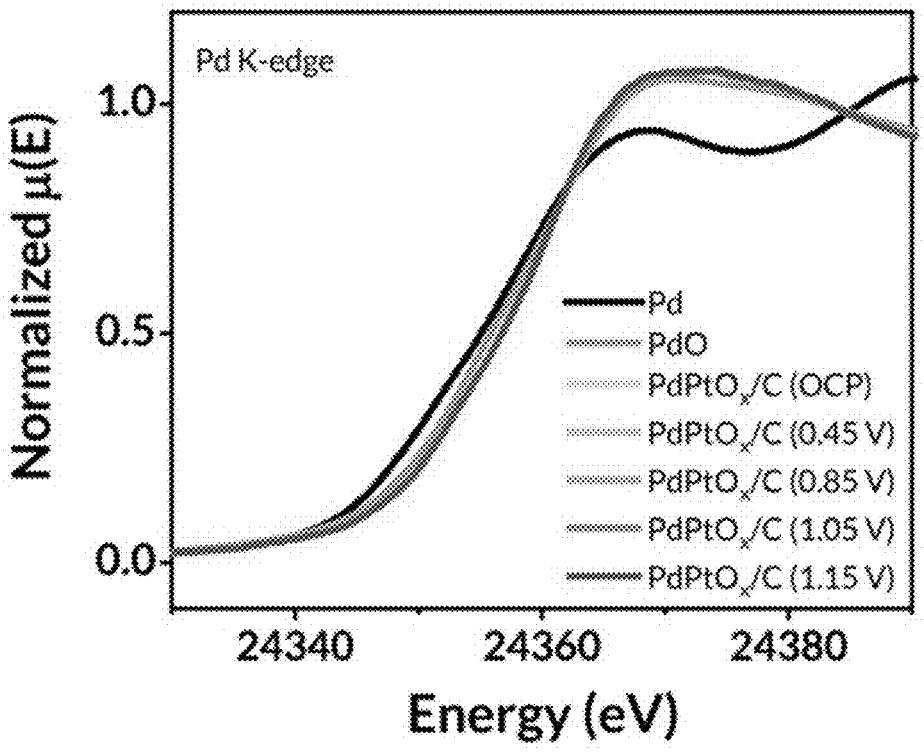
Figure 16B:
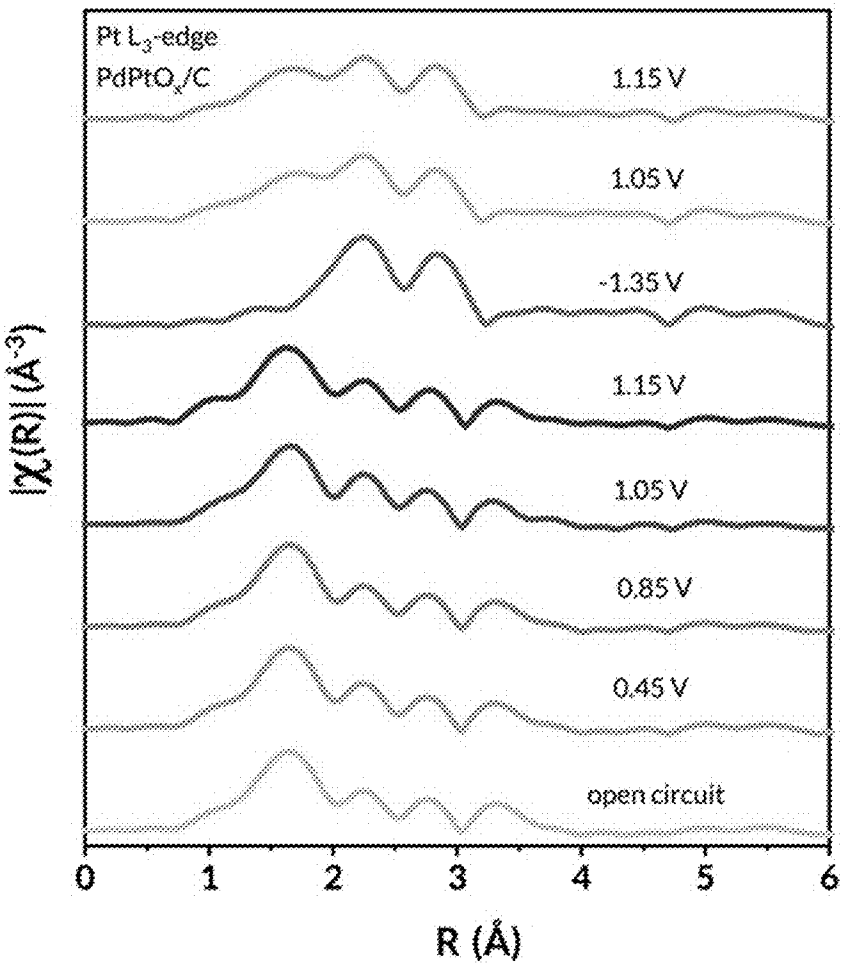
FIG. 16B: $PdPtO_x/C$.
Figure 16A:
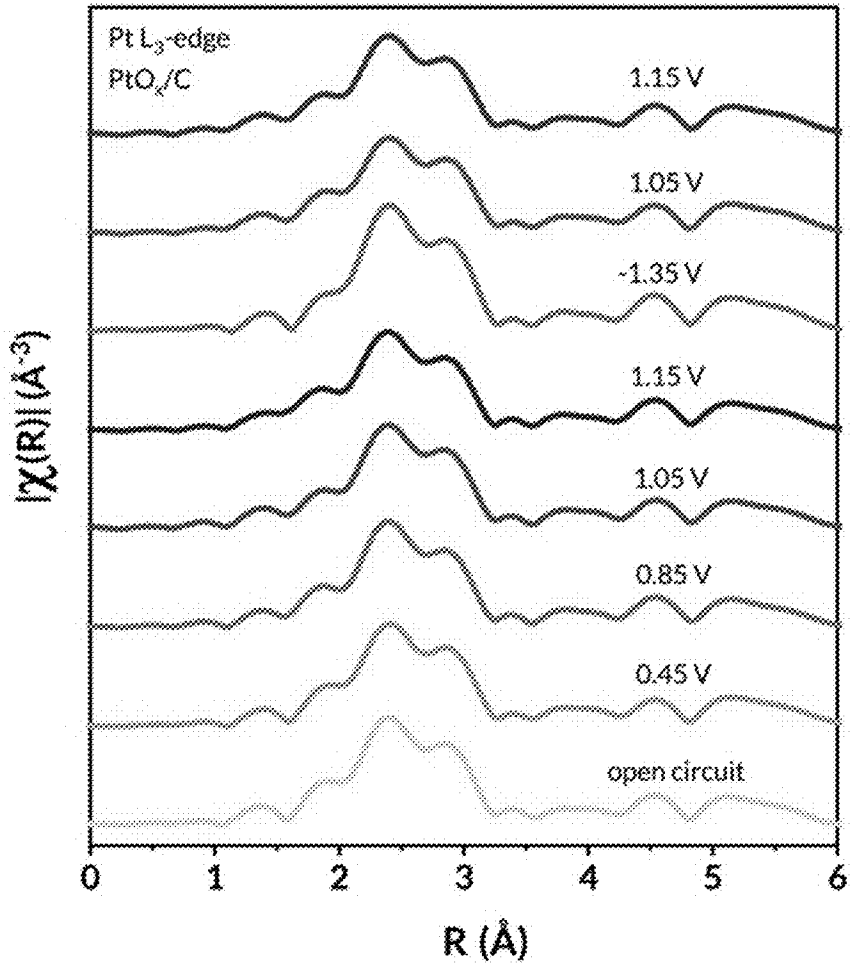
FIG. 16: Operando XAS at Pt $L_3$-edge for FIG. 16A: $PtO_x/C$
FIG. 16C: normalized absorption coefficient (u (E)) of Pt foil, $PtO_2$, and $PtO_x/C$ as a function of X-ray energy projected to the samples.
FIG. 16D: normalized absorption coefficient (μ(E)) of Pt foil, $PtO_2$, and $PdPtO_x/C$ as a function of X-ray energy projected to the samples. The shifts and shapes of the absorption spectra reflect oxidation states of Pt. Potentials in this figure were 100% iR-compensated (i=current, R=resistance).
Figure 16C:
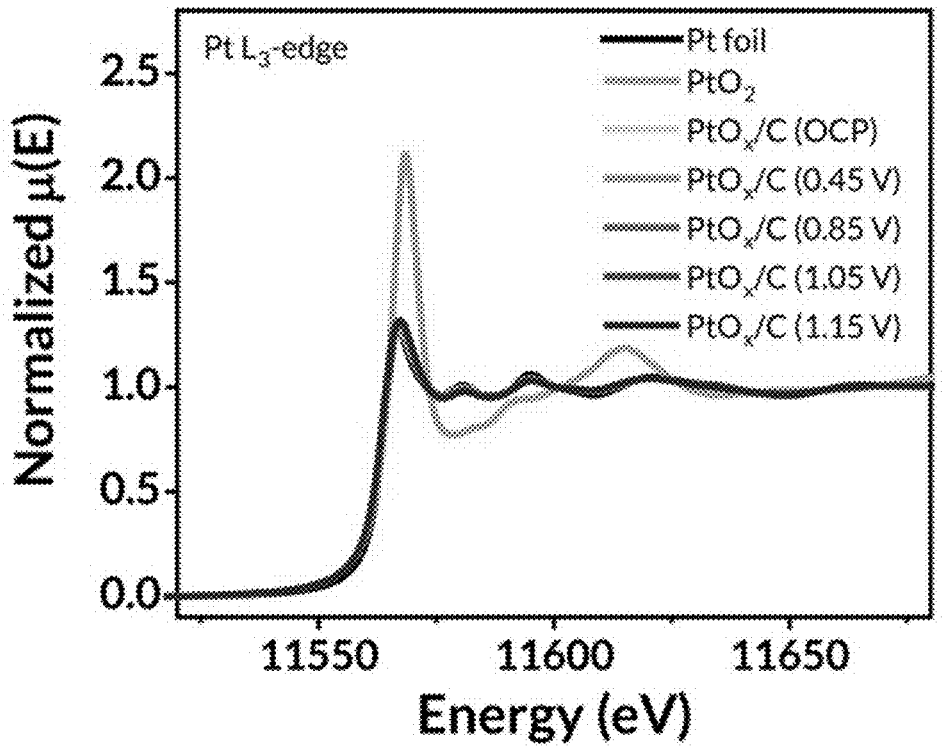
Figure 16D:
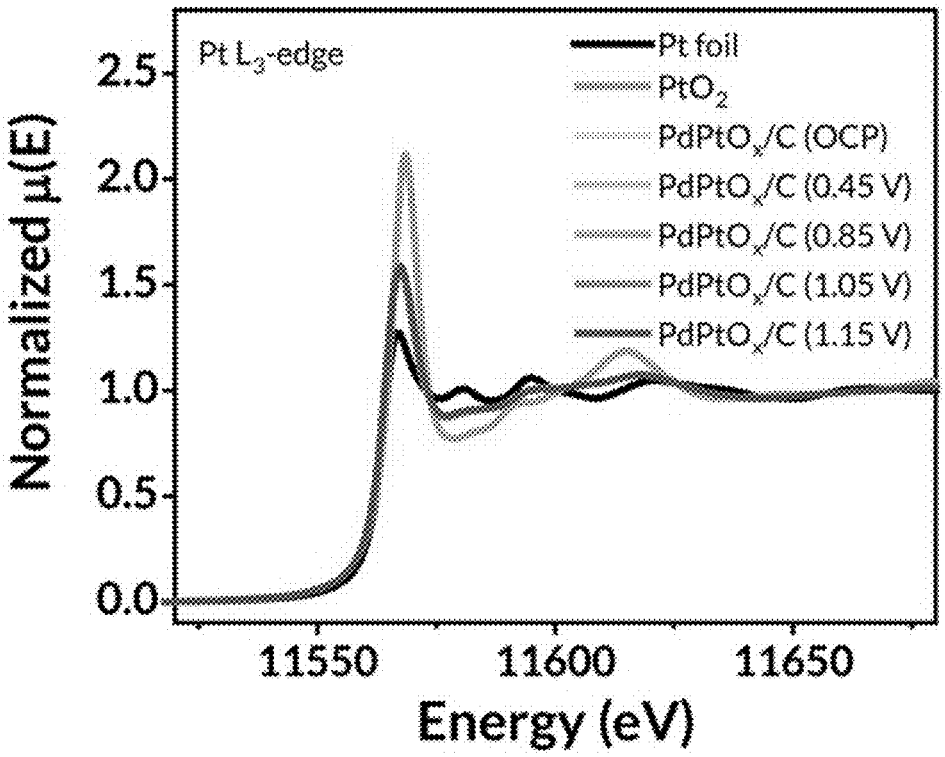
Figure 17B:
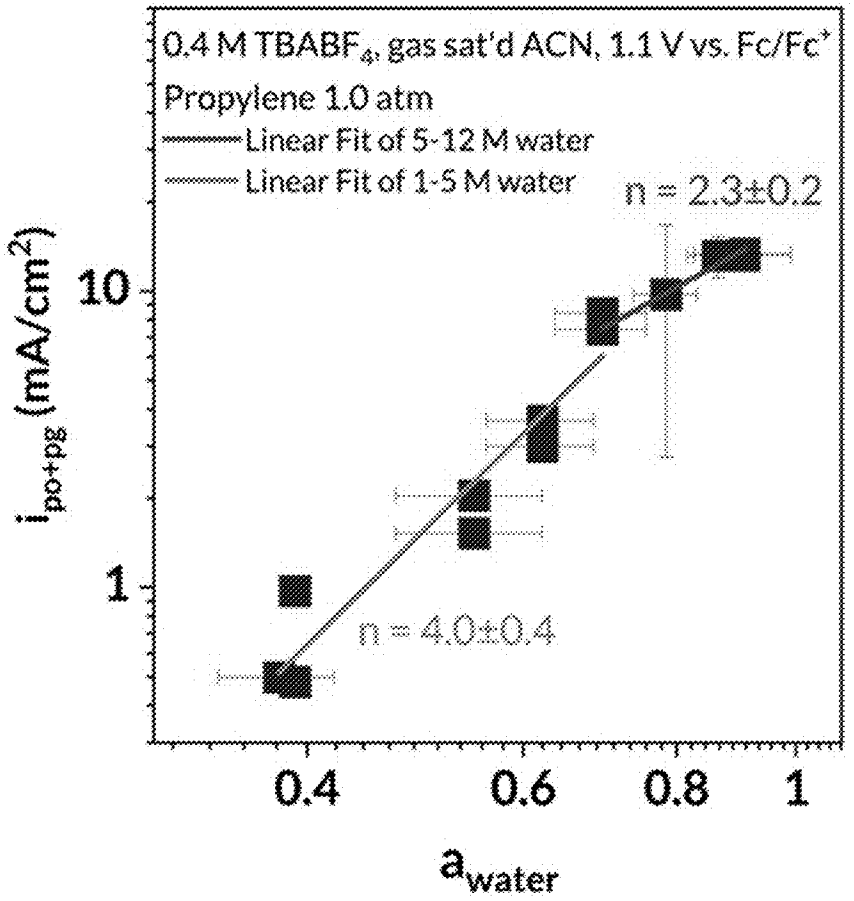
FIGS. 17A-17D: Water dependences of propylene epoxidation current density.
Figure 17A:
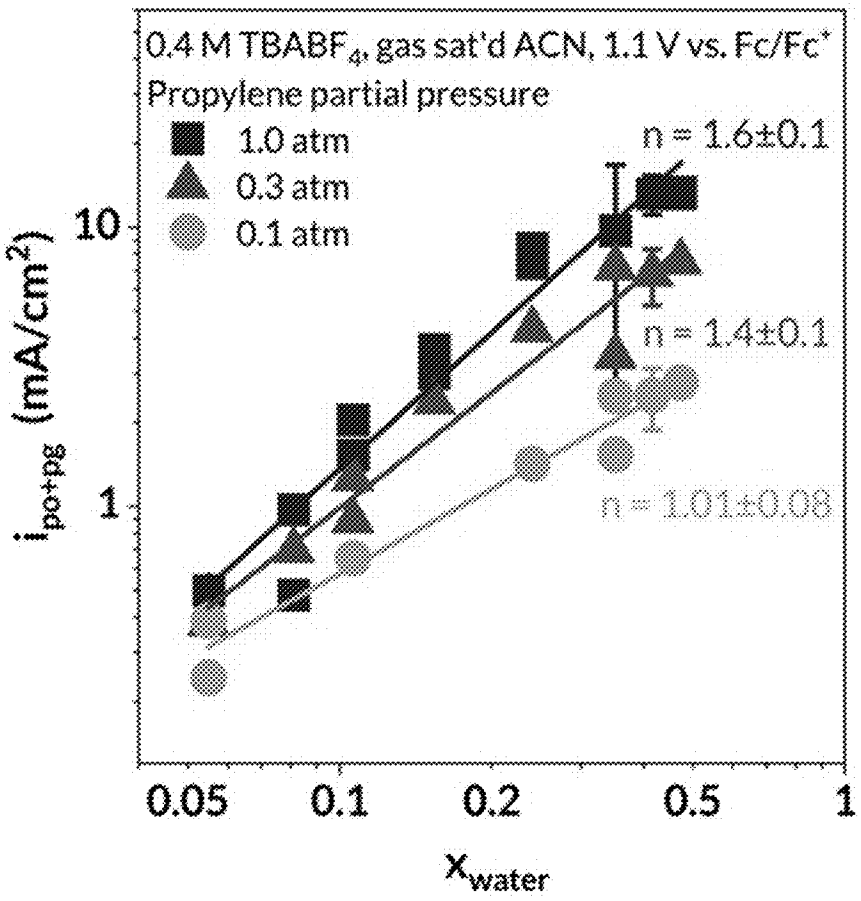
Figure 17D:
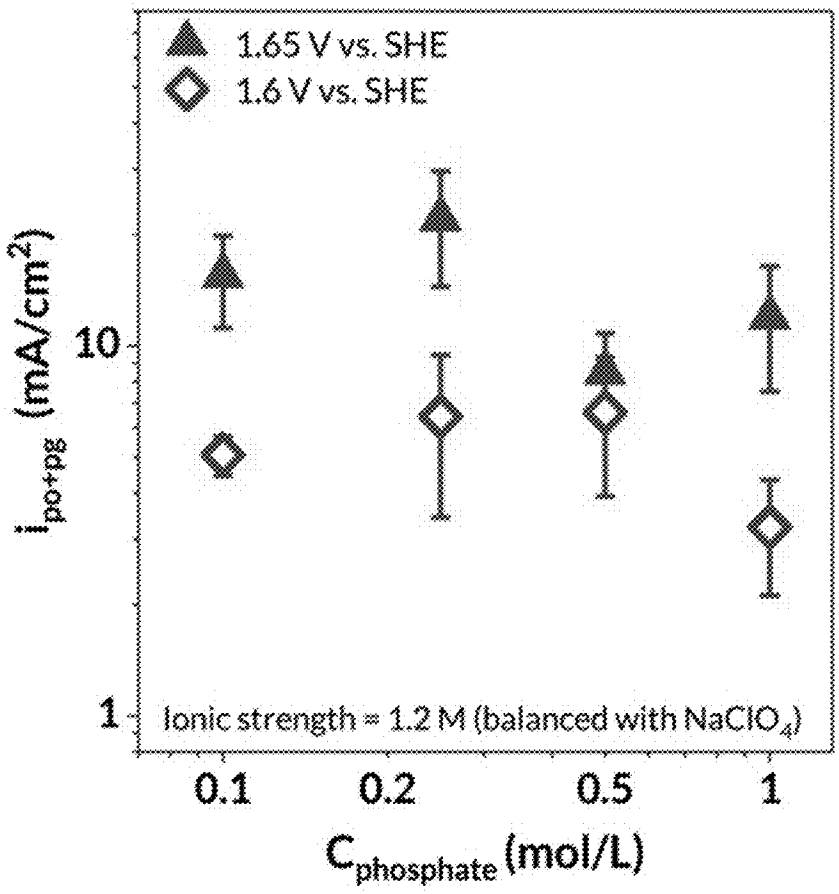
Figure 17C:
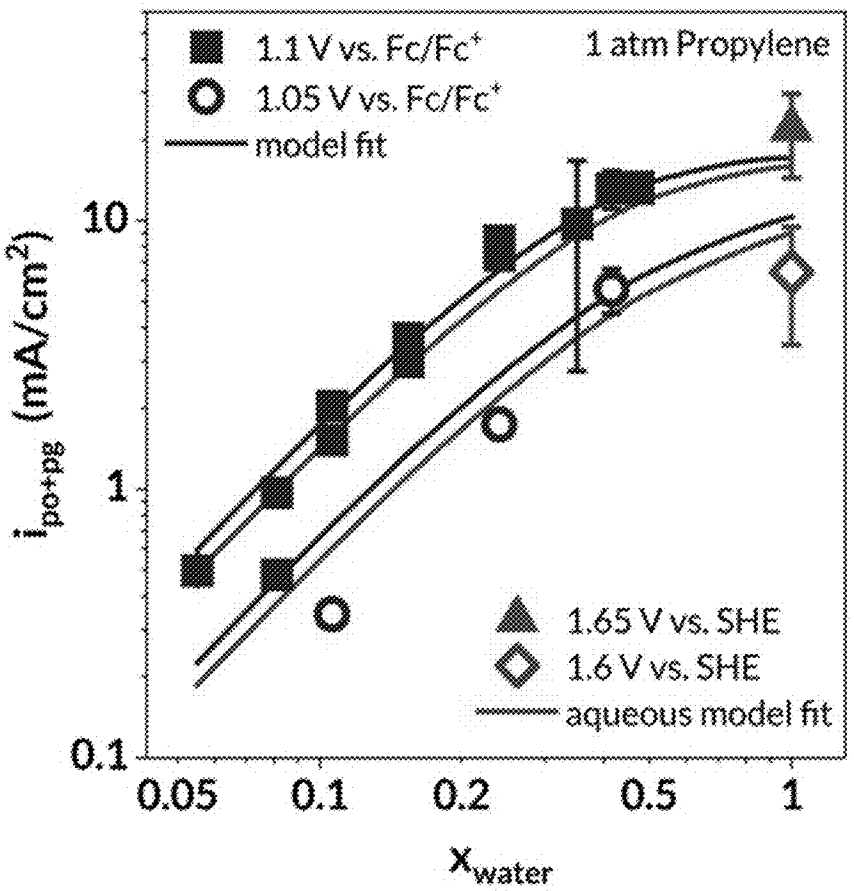

XPS analysis showed that alloying Pt with Pd stabilizes oxidized Pt on the catalyst surface. Pt(0) species were dominant in the $PtO_x/C$, while a higher content of Pt(II) species was observed in $PdPtO_x/C$ (FIG. 2F). The ratio of Pt(II):Pt(0) increased from 1.0 to 6.4 as the catalyst treatment temperature was increased from 400 °C to 500 °C. (Table 9). A small amount of Pd(0) was present in $PdPtO_x/C$ annealed at 400 °C, while Pd(II) was exclusively observed in the catalyst annealed at 500 °C. (FIG. 2E). The epoxidation rate and selectivity also improved with the treatment temperature for PdPt/C (FIGS. 13-14), indicating that the higher ratio of oxidized Pd and Pt species is contributing to the enhancement in the catalyst performance.

TABLE 9

Surface concentrations of metal species evaluated by XPS analysis.

| | Pt(0) | Pt(II) | Pd(0) | Pd(II) |
|---|---|---|---|---|
| $PdPtO_x/C$ (400 °C) | surface concentration (%) | | surface concentration (%) | |
| | 49.28 | 50.72 | 16.09 | 83.91 |
| | $4f_{7/2}$ peak position (eV) | | $3d_{5/2}$ peak position (eV) | |
| | 70.9 | 72.1 | 335.5 | 337.2 |

TABLE 9-continued

Surface concentrations of metal species evaluated by XPS analysis.

| | Pt(0) | Pt(II) | Pd(0) | Pd(II) |
|---|---|---|---|---|
| $PdPtO_x/C$ (500 °C) | surface concentration (%) | | surface concentration (%) | |
| | 13.5 | 86.5 | 0 | 100 |
| | $4f_{7/2}$ peak position (eV) | | $3d_{5/2}$ peak position (eV) | |
| | 71.1 | 72.3 | — | 337.2 |
| $PdPtO_x/C$ (500 °C) Post-electrolysis (FIG. S19) | surface concentration (%) | | surface concentration (%) | |
| | 10.27 | 89.73 | 0 | 100 |
| | $4f_{7/2}$ peak position (eV) | | $3d_{5/2}$ peak position (eV) | |
| | 71.1 | 72.3 | — | 337.1 |
| $PdO_x/C$ (500 °C) | | | surface concentration (%) | |
| | | | 0 | 100 |
| | | | $3d_{5/2}$ peak position (eV) | |
| | | | — | 337.2 |
| $PtO_x/C$* (500 °C) | surface concentration (%) | | | |
| | 100 | 0 | | |
| | $4f_{7/2}$ peak position (eV) | | | |
| | 71.0 | — | | |

*We tried to fit the $PtO_x$ spectrum with both Pt(0) and Pt(II) species, but the best fit was achieved with the $4f_{7/2}$ peaks at 71.0 eV and 71.4 eV. However, since 71.4 eV does not align with the expected Pt(II) position, we opted to only fit the spectrum with the Pt(0) $4f_{7/2}$ and $4f_{5/2}$ peaks. When we attempted to fit the spectrum with a fixed Pt(II) $4f_{7/2}$ peak position between 71.1-71.3 eV, the $4f_{7/2}$ peak became smaller compared to the $4f_{5/2}$ peak, so we discarded that fit.

Figure 3A:
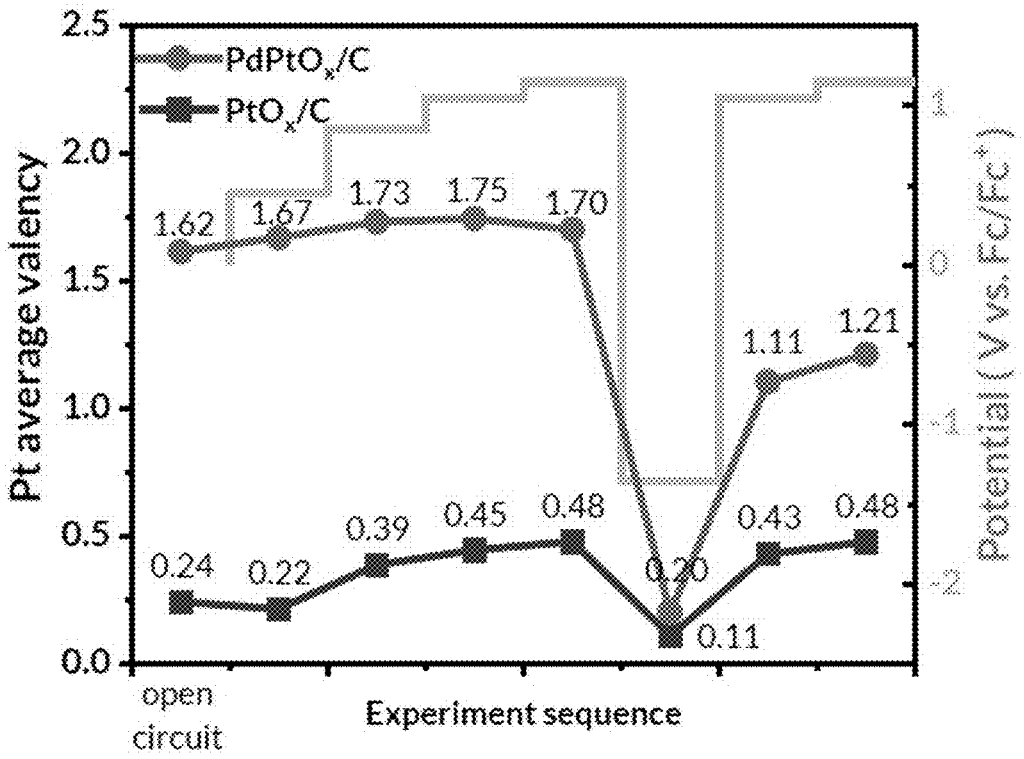
FIGS. 3A-3B: Operando X-ray absorption spectroscopy.
Figure 3B:
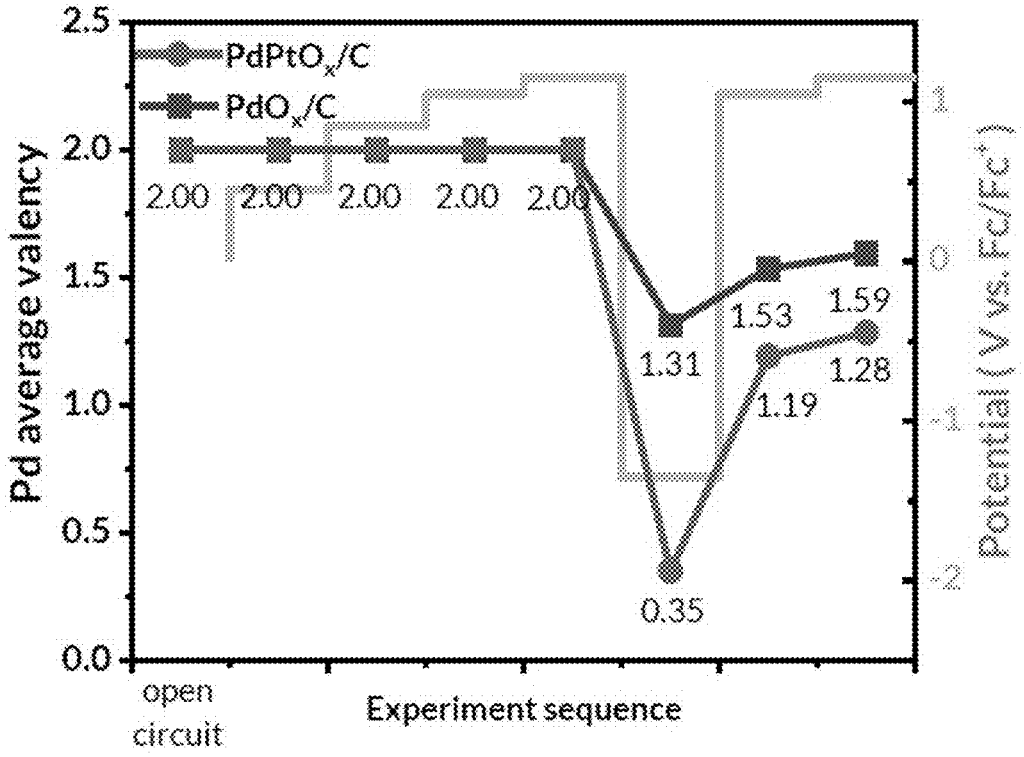

Operando x-ray absorption spectroscopy (XAS) experiments probing the Pd K-edge and Pt $L_3$-edges during epoxidation highlighted again that achieving more oxidized Pt may have an important role in improving catalytic activity toward propylene epoxidation. Progressively more oxidative potentials were applied from 0.45 V to 1.15 V vs. $Fc/Fc^+$, and then a reductive potential of −1.35 V followed by oxidative potentials back to 1.15 V were applied during the measurements. The average metal valency at each condition was estimated from linear combination fitting of x-ray absorption near edge structure (XANES) spectra using reference spectra from standard materials. The results indicate that Pd oxide stabilizes oxidized Pt species in Pd—Pt alloys, leading to a higher average oxidation state of Pt in $PdPtO_x/C$ (+2), compared to that in $PtO_x/C(0)$. This difference is maintained under anodic potentials (0.45-1.15 V vs. $Fc/Fc^+$, FIG. 3A). Unlike the stark contrast in Pt valency between $PdPtO_x/C$ and $PtO_x/C$, the Pd valency stayed the same (+2) in both $PdPtO_x/C$ and $PdO_x/C$ (FIG. 3B). These observations suggest that the more oxidized Pt species contribute to the enhancement in the production rate and selectivity of PO.

Furthermore, EXAFS fitting of catalysts under operating conditions showed that coordination numbers and scattering path lengths of Pd and Pt did not change during electrolysis (Tables 5-6). Applying a cathodic potential followed by an anodic potential demonstrated that the edge energies and the coordination environment of Pd and Pt respond to applied potentials in a partially, albeit not fully, reversible fashion (FIGS. 3A-3B, FIGS. 15A-15D, 16A-16D).

In summary, the results from XRD, CV, and the elemental analysis collectively suggest that Pd and Pt are mixed in both the bulk and surface of the $PdPtO_x/C$ catalyst. XANES and XPS results revealed that a larger quantity of oxidized Pt species is stabilized in $PdPtO_x/C$ compared to $PtO_x/C$. XAS data suggest that Pd stabilizes Pt at a similar oxidation state (around +2) and crystal structure as PdO, which together improve catalytic performance.

Electrochemical Kinetic Study and Proposed Reaction Mechanism

Understanding the mechanism of direct propylene epoxidation on $PdPtO_x/C$ can help us develop other catalysts and process conditions for producing epoxides. The reaction mechanism was investigated using a multi-faceted approach including kinetic rate measurements, deuterium kinetic isotope effect measurements, probe substrate analysis, and substrate-based descriptor assessment.

Electrochemical kinetic rate measurements were conducted to examine electrolyte species dependences for direct anodic epoxidation on $PdPtO_x/C$ (FIGS. 4A-4E, FIGS. 17A-17D, FIG. 18). The reaction rates, represented by the partial current density toward epoxidation, were measured using chronoamperometry in conjunction with product quantification by 1H-NMR (see, Supplementary materials and methods for details).

Figure 19:
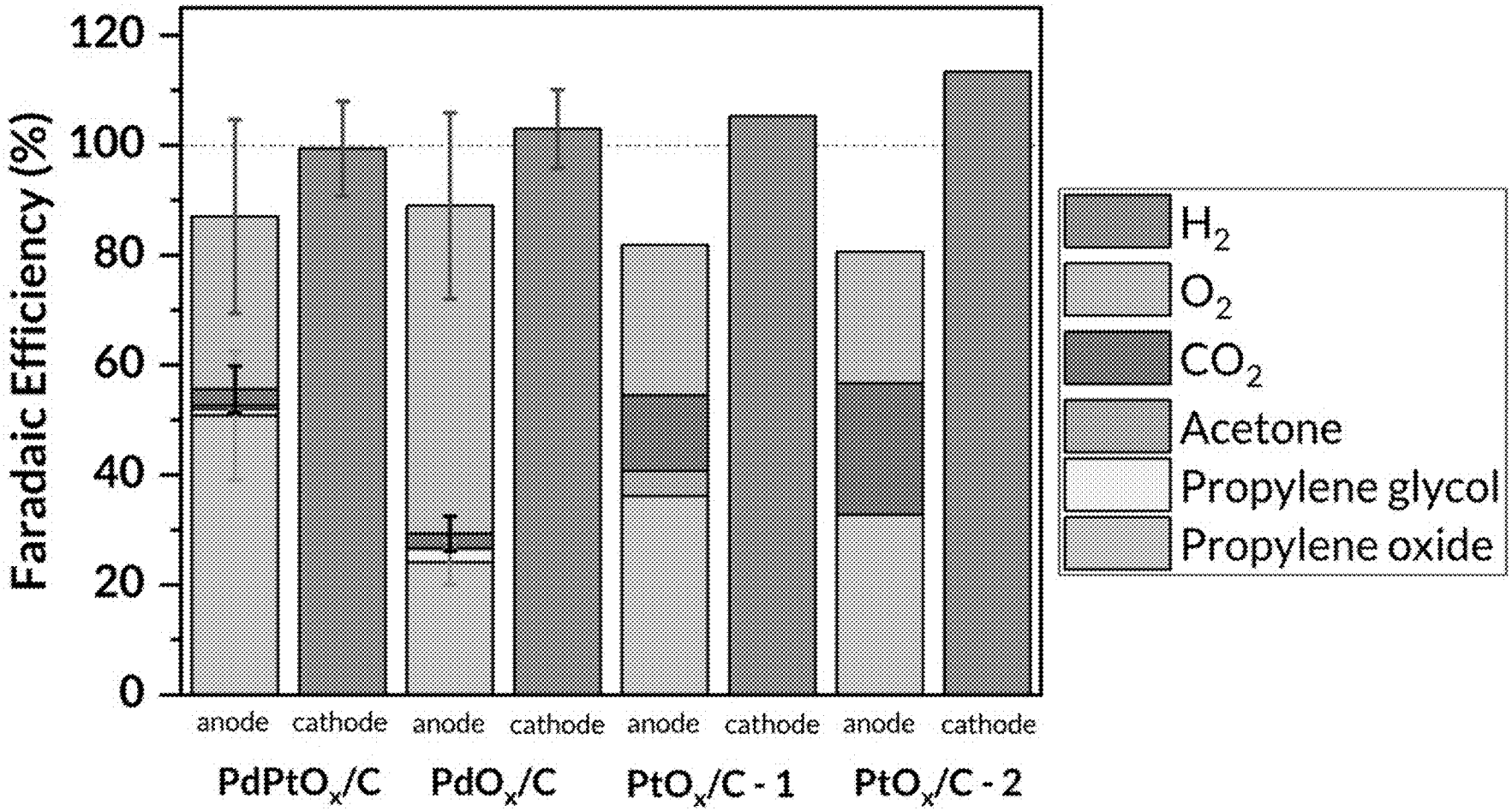
FIG. 19: Product distributions with different catalysts annealed at 400 °C, constant current at 40 mA/cm$^2$. 10 sccm of propylene was introduced to the electrolyte containing 0.4 M $TBABF_4$ and 10 M water in acetonitrile. The vertical error bars represent standard deviations from the mean of multiple replicates (n=3) of the same experiment. For $PtO_x/C$, both of duplicate data ($PtO_x/C$–1 and $PtO_x/C$–2) are presented.

We hypothesized that the direct alkene epoxidation pathway at the anode may involve multiple coupled proton-electron transfer steps from water to the electrode, followed by oxygen-atom transfer from intermediates typically seen in water oxidation to propylene. $O_2$ was observed to be the major byproduct with the $PdPtO_x/C$ catalyst, while a small amount of $CO_2$ was also observed (FIG. 19). It is worth noting that the selectivity of PO over other propylene-derived products (propylene glycol, acetone, and $CO_2$) reaches about 92%. Therefore, in our proposed mechanism, only the competition between epoxidation and oxygen evolution was considered.

Figure 4A:
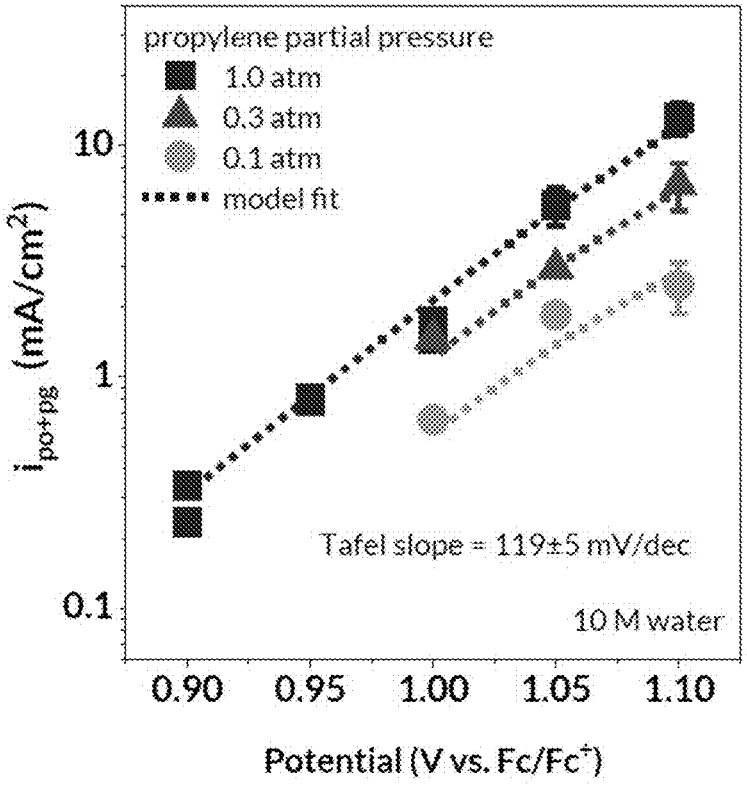
FIGS. 4A-4E: Kinetic data on direct anodic epoxidation with $PdPtO_x/C$ catalysts.
Figure 4B:
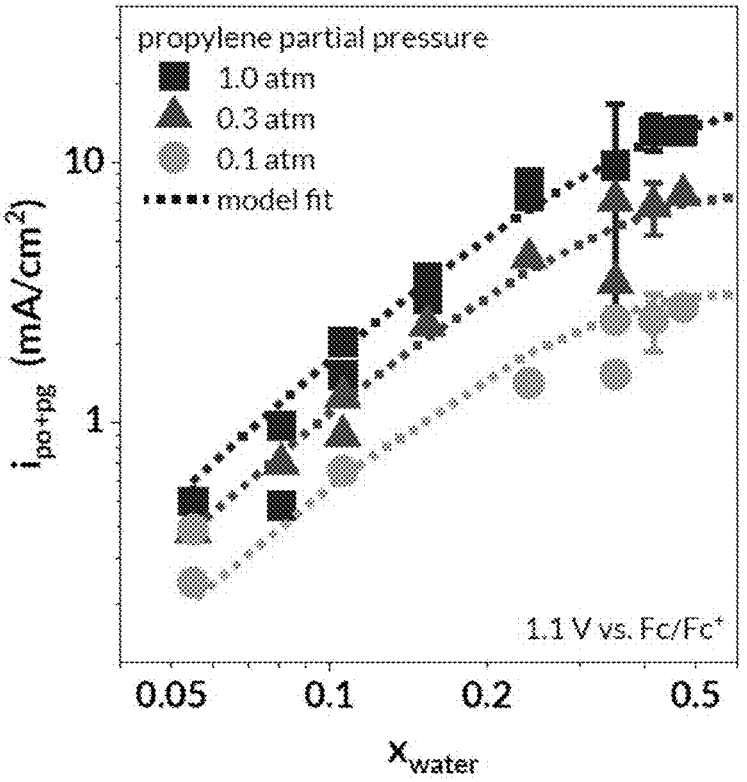

In cases where the surface coverage is primarily determined by a single reactive intermediate and a rate-limiting step is evident, the measured Tafel slope of 119±5 mV/dec implies that the rate-limiting step involves a single electron transfer, and that no pre-equilibrated electron transfer steps occur between the abundant reactive intermediate and the rate-limiting step (FIG. 4A). Nevertheless, non-integer and non-linear reaction orders were observed in the water and propylene dependencies, signaling the presence of more intricate kinetic control.

Figure 4C:
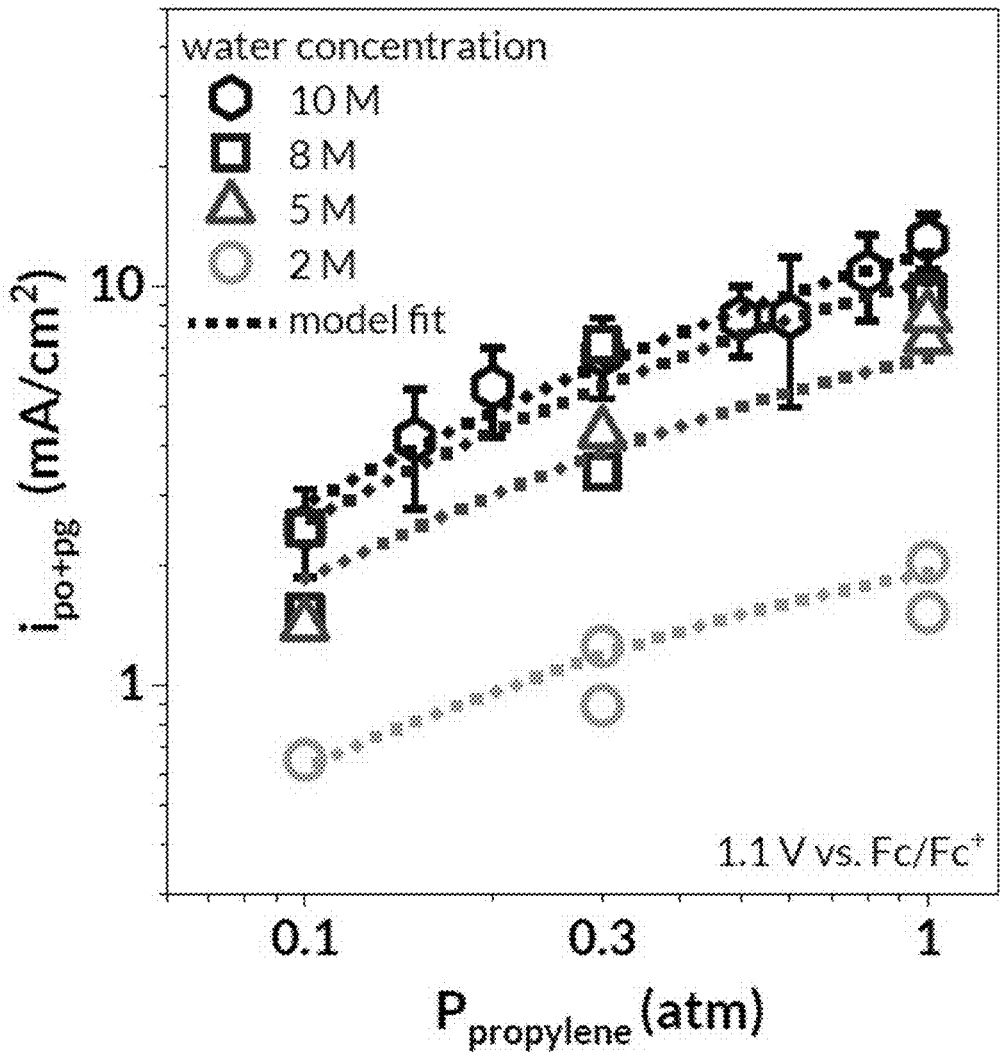
Figure 18:
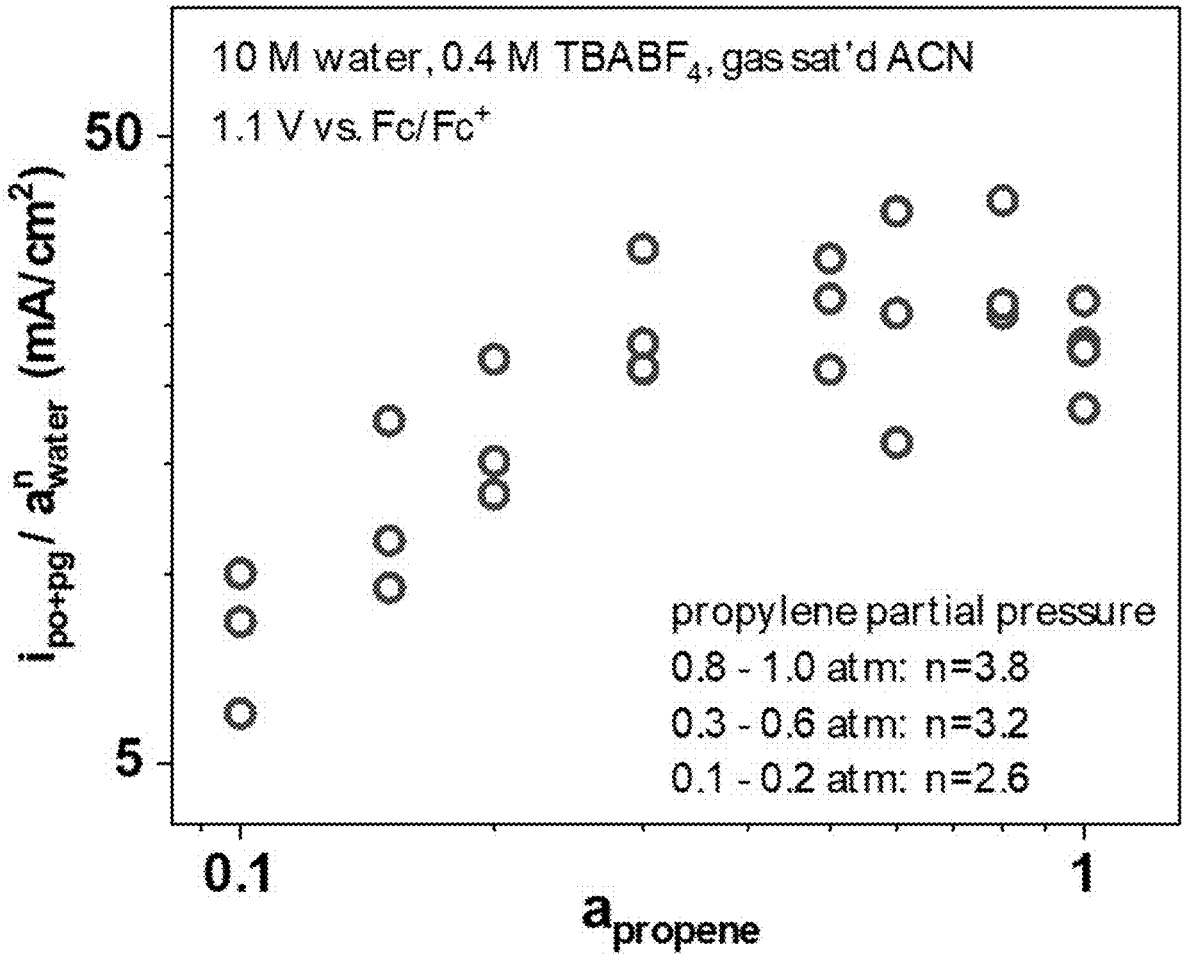
FIG. 18: Propylene dependence on propylene epoxidation current density. Adjustments were made to the current density to account for variations in water activity (FIGS. 22A-22B) and water activity dependences at different propylene pressures.

At 1 atm propylene condition, the observed dependence of rates on water molar content exhibited ~$2^{nd}$ order behavior at lower water ratio, which decreased to ~$1^{st}$ order at higher water ratio (FIG. 4B and FIGS. 17A-17D). At lower propylene pressures, the water dependence showed more linear ~$1^{st}$ order dependence in the whole water concentration range. For propylene, the rate showed $1^{st}$ order dependence on propylene activity at lower propylene pressures, but the dependence decreased at elevated propylene pressures (FIG. 4C and FIG. 18).

To address the complexity arising from non-integer reaction orders and variations in orders with reactant concentrations, we implemented a multiparameter kinetic model and fitted it to the kinetic data collected over a wide range of experimental conditions. We initially hypothesized that surface-adsorbed hydroperoxo (OOH*), peroxo (OO*), or oxo (O*) species might serve as the reactive oxygen species for epoxidation. We then proposed various elementary steps and corresponding rates for each hypothesis (see Example 2A for details). Given that acetonitrile is a less effective proton acceptor than water, we suggested elementary steps where two distinct water molecules play explicit roles in the reaction, one as a reactant and the other as a proton acceptor. Then, we employed kinetic modeling to deduce which intermediate would most likely react with propylene. This approach was viable as the reaction of different species (OOH*, OO*, and O*) with propylene generates distinct surface intermediates following epoxidation (OH*, O*, and *, respectively). In contrast, the evolution of $O_2$ invariably leaves vacant (*) surface sites. The goodness-of-fit of model was evaluated by the root-mean-square-error (RMSE) between the experimental data and the simulated data from the model, with the lowest value indicating the best-fit model.

Figure 4D:
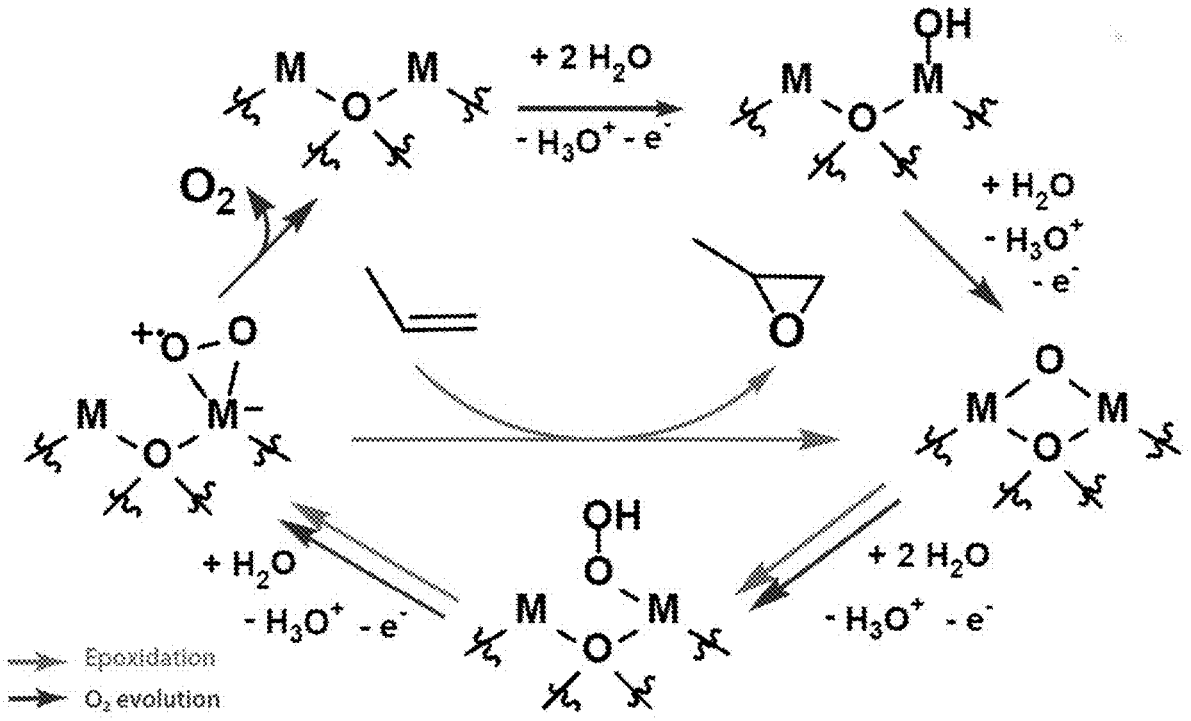
Figure 4E:
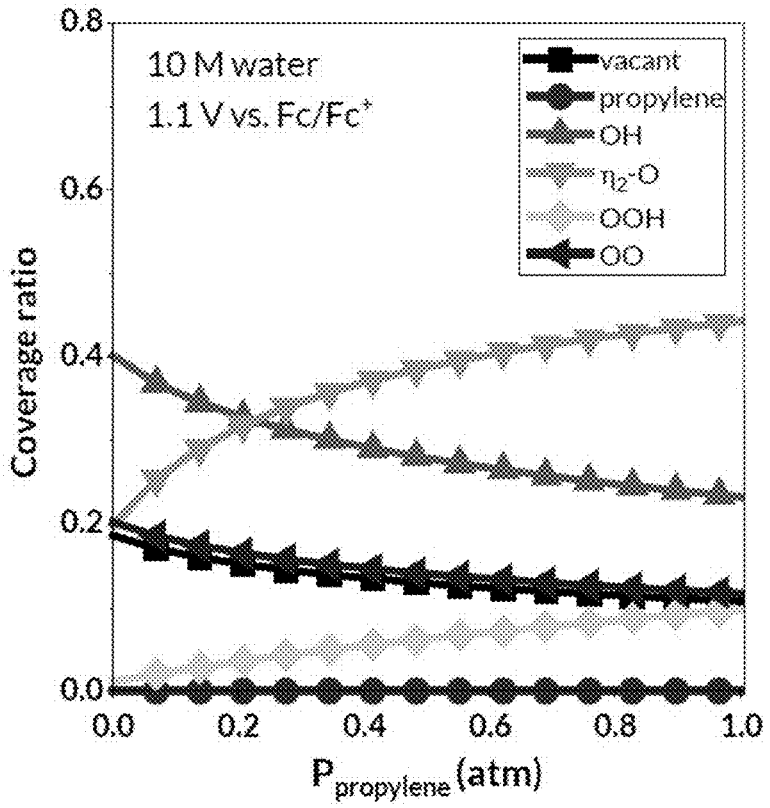

Our experimental data best matched the mechanism suggesting OO* as the key intermediate for epoxidation, with an RMSE of 0.48 mA/cm$^2$. Diverse derivatives of this mechanism involving the OO* epoxidation intermediate are plausible, dependent on whether a dual or single site is presumed for OO* and O* intermediates. We selected the model with the lowest RMSE as our representative mechanism (FIG. 4D), and the model provides a quantitative explanation of the data illustrated in FIGS. 4A-4C. We also simulated surface coverage using the model (FIG. 4E, see Example 2A for details). At higher propylene pressures where O* and OH* are abundant, the overall epoxidation rate would be largely determined by the rate of water oxidation to form OOH*. However, the comparable prevalence of different surface oxygen intermediates underscores the necessity for a comprehensive kinetic model that does not assume a single dominant reactive intermediate and a rate-limiting step.

Figure 20:
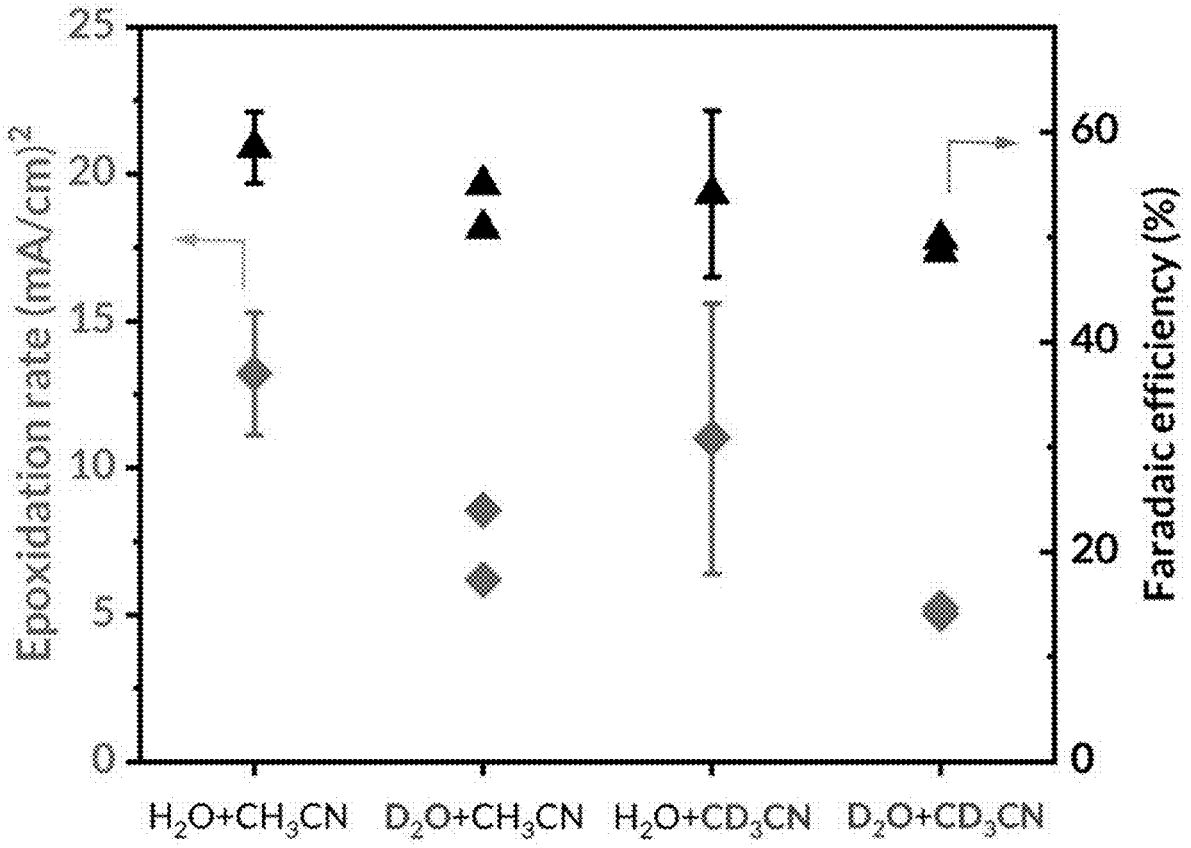
FIG. 20: Deuterium kinetic isotope effects on epoxidation rate catalyzed by $PdPtO_x/C$. 100% iR-compensated (i=current, R=resistance) potentials were applied. The vertical error bars represent standard deviations from the mean of multiple replicates (n=4) of the same experiment. See Supplementary Text S1 for extended explanations.
Figure 21:
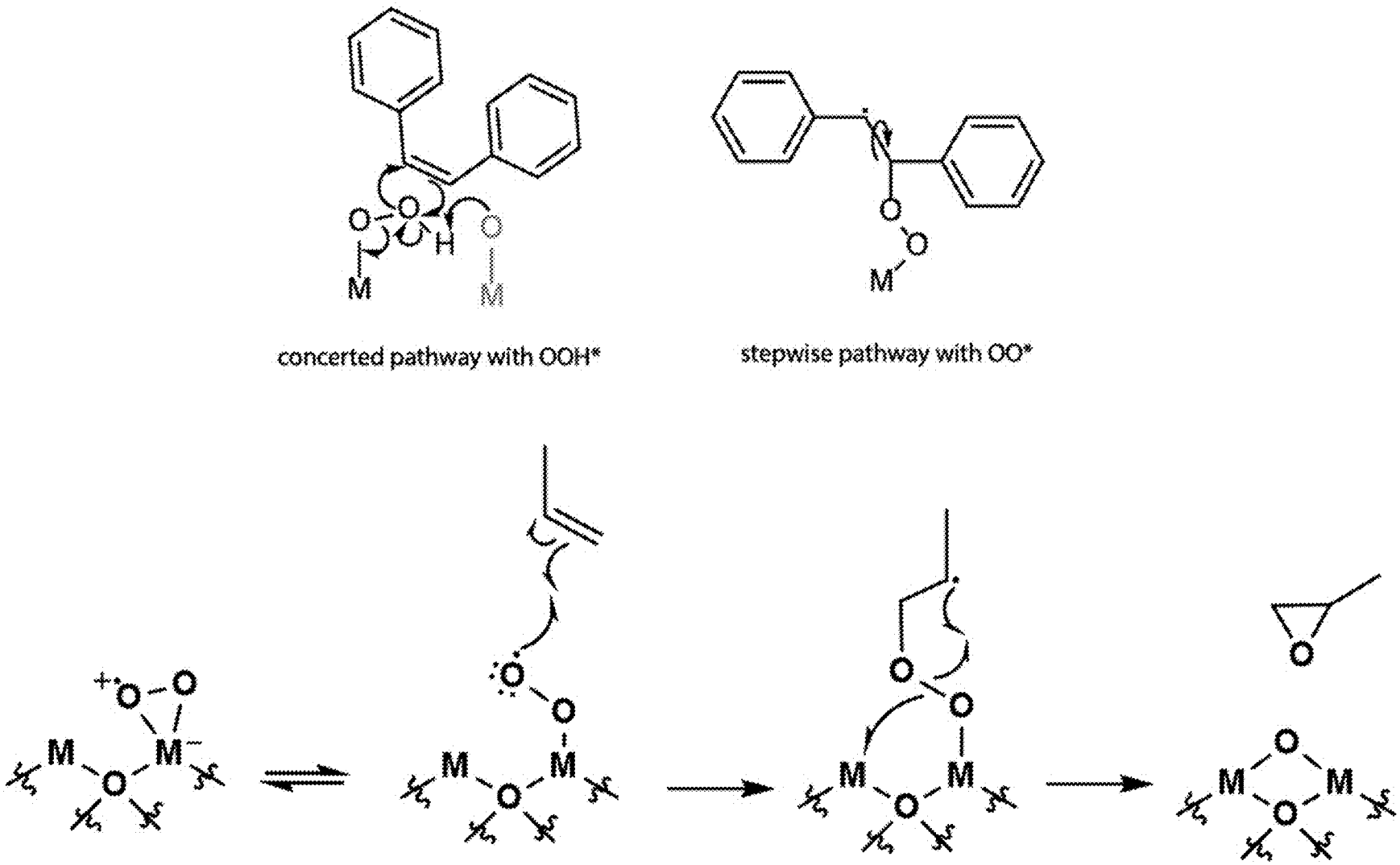
FIG. 21: Comparison of concerted and stepwise pathways for stilbene epoxidation and a proposed stepwise epoxidation pathway involving radical OO* intermediate.

Kinetic isotope labeling and stilbene control experiments further support our hypothesis asserting OO* as the key intermediate in epoxidation. The use of deuterated water lowered the epoxidation rate ($k_H/k_D$=1.8±0.5; FIG. 20 and Table 10) while the Faradaic efficiency remained similar. The difference observed in the epoxidation rate is consistent with the kinetically-relevant water oxidation steps involving O—H cleavages in our proposed mechanism. Moreover, our mechanism identifies OO* as the branching intermediate for both epoxide and $O_2$ evolution (FIG. 4D), providing an explanation for the marginal selectivity difference, since neither of these pathways from OO* involves O—H cleavage. In addition, cis-stilbene was used as a probe substrate to help determine whether epoxidation proceeds through a concerted mechanism with OOH* or a stepwise pathway with OO* (25,26). Cis-stilbene (96%) epoxidation with $PdPtO_x/C$ produced 23% cis-stilbene oxide and 77% trans-stilbene oxide, which suggests that alkene epoxidation over $PdPtO_x/C$ occurs through a stepwise mechanism (FIG. 21) with OO* reactive intermediates.

TABLE 10

Deuterium kinetic isotope effects on epoxidation rate catalyzed by $PdPtO_x/C$*

| | $FE_{PO}$ | $i_{PO+PG}$ (mA/cm$^2$) | $k_H/k_D$ |
|---|---|---|---|
| 10M $H_2O$, $CH_3CN$ | 58.5 ± 3.4% | 13.2 ± 2.1 | |
| 10M $D_2O$, $CH_3CN$ | 52.9 ± 3.0% | 7.4 ± 1.7 | 1.8 ± 0.5 |
| 10M $H_2O$, $CD_3CN$ | 54.1 ± 7.9% | 11.0 ± 4.6 | 1.2 ± 0.5 |
| 10M $D_2O$, $CD_3CN$ | 49.2 ± 0.8% | 5.1 ± 0.2 | 2.6 ± 0.4 |

*This table shares data with FIG. 20.

Example 2A: Supplementary Information for Propylene Epoxidation Mechanism

We enumerated a series of mechanisms invoking OOH* (Case 1), OO* (Case 2a-e), or O* (Case 3) as the key epoxidation intermediates:

| index | Key features | Fitted number of parameters | RMSE |
|---|---|---|---|
| Case 1 | OOH* catalyzes epoxidation, single site mechanism | 6 | 5.8864e−01 |
| Case 2a | OO* catalyzes epoxidation, single site mechanism | 7 | 4.9425e−01 |

-continued

| index | Key features | Fitted number of parameters | RMSE |
|---|---|---|---|
| Case 2b | OO* catalyzes epoxidation<br>OOH* + O* → OO* + OH*<br>rearrangement included | 8 | 5.1518e–01 |
| Case 2c | OO* catalyzes epoxidation,<br>dual site mechanism<br>$\eta_2$-O* and $\eta_2$-OO* intermediates | 7 | 4.9870e–01 |
| Case 2d | OO* catalyzes epoxidation<br>$\eta_2$-O* and $\eta_1$-OO intermediates | 7 | 4.8398e–01 |
| Case 2e | OO* catalyzes epoxidation<br>$\eta_1$-O* and $\eta_2$-OO* intermediates | 7 | 5.2258e–01 |
| Case 3 | O* catalyzes epoxidation<br>single site mechanism | 7 | 6.0747e–01 |

RMSE is the root mean square error obtained from the difference between experimental and simulated results. Lower RMSE means less deviation of the simulated results from the experimental results. Based on the RMSE, mechanisms in which OO* catalyzes epoxidation best explain the experimental data, compared to the ones invoking OOH* or O* as the key epoxidation intermediate. However, considering the errors within the experimental replicates are mostly in 0.1 mA/cm$^2$ range, the difference in RMSE within Case 2a-e may not be significant enough to determine which case is most accurate. In our main text, we chose Case 2d as a representative mechanism, while Cases 2a-e could also be plausible mechanisms.

Figure 22A:
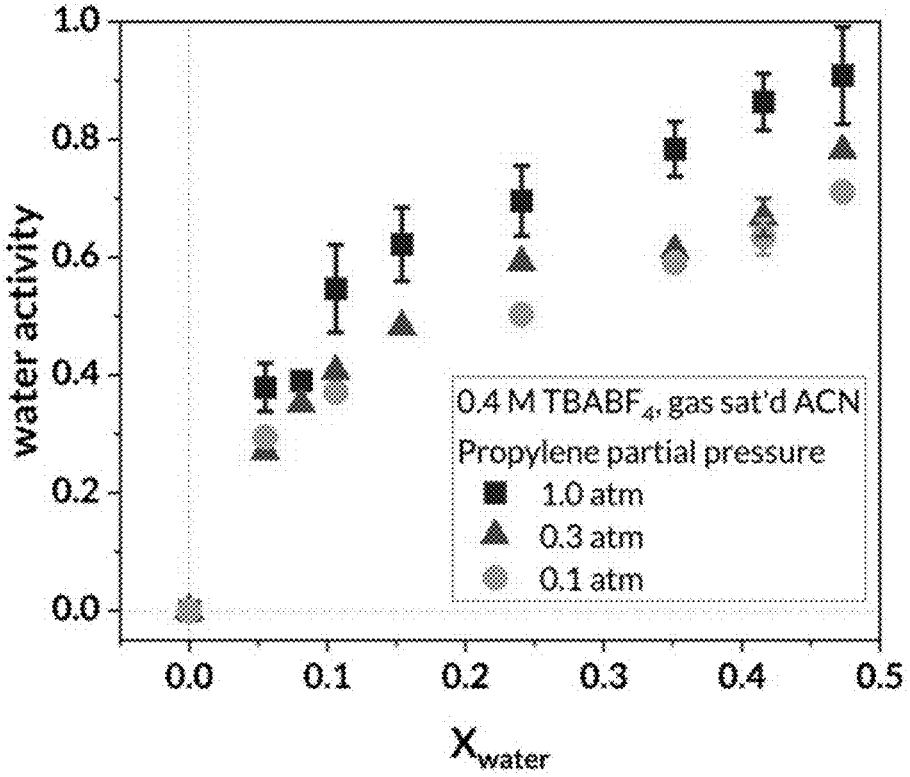
FIG. 22A: water activity measurements as a function of water mole fraction in a 0.4 M $TBABF_4$, propylene-saturated acetonitrile solution.
Figure 22B:
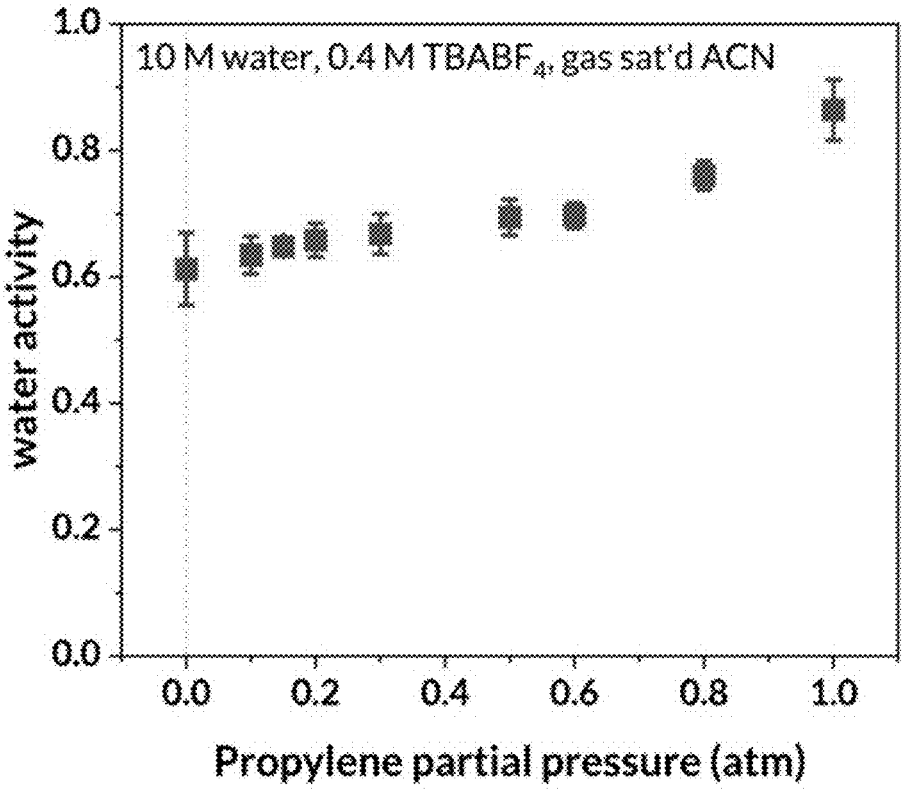
FIG. 22B: water activity measurements as a function of propylene partial pressure in a 10 M water, 0.4 M $TBABF_4$ acetonitrile solution using headspace-gas chromatography-TCD. Vertical error bars represent standard deviations from the mean of multiple replicates (n>3) of the same experiment.

We formulated rate expressions based on reactant concentrations, incorporating the activity coefficients of reactants and transition states for each elementary step into the rate constants. While we successfully measured water activities under various electrolyte conditions using the headspace-GC technique (FIGS. 22A-22B), the activity coefficients for other surface reactants, solvated propylene, and transition states remain undetermined. Consequently, formulating rate expressions based on water activity implies an assumption that other activity coefficients are either unity or offset each other, which is a speculative presumption without adequate backing. Instead of selectively neglecting some of the activity coefficients, we lumped all of the activity coefficient terms as a Gibbs excess energy contribution to the rate constant and performed parameter estimation using concentrations as variables.

Figure 25A:
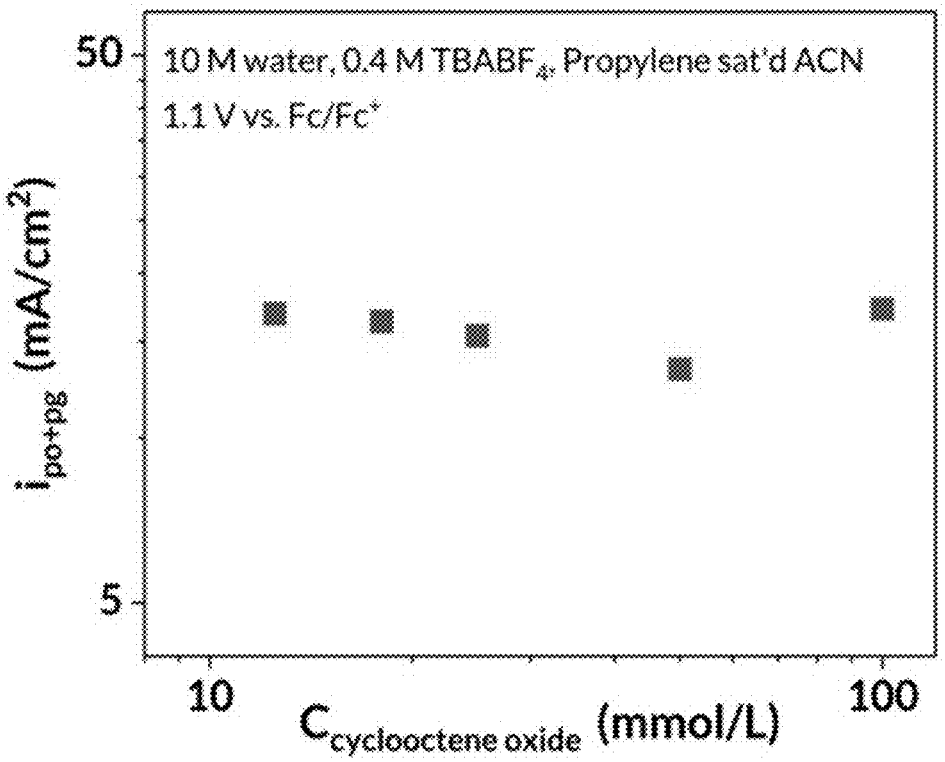
FIGS. 25A-25B: Effects of epoxide and oxygen concentrations on propylene epoxidation rate.
Figure 25B:
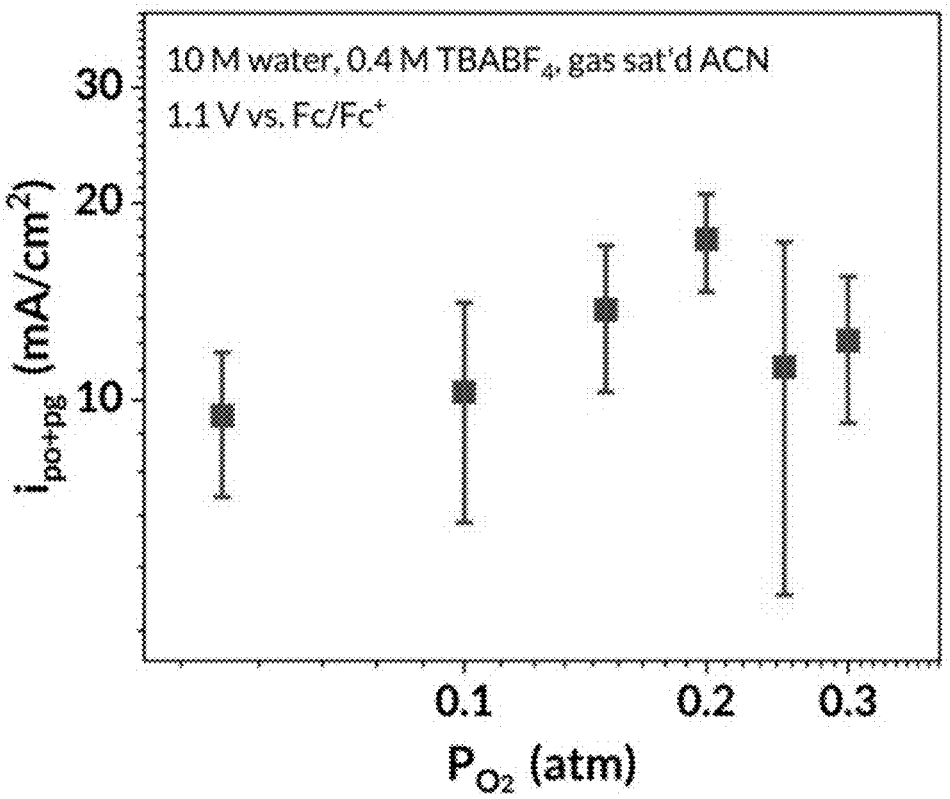
Figure 26:
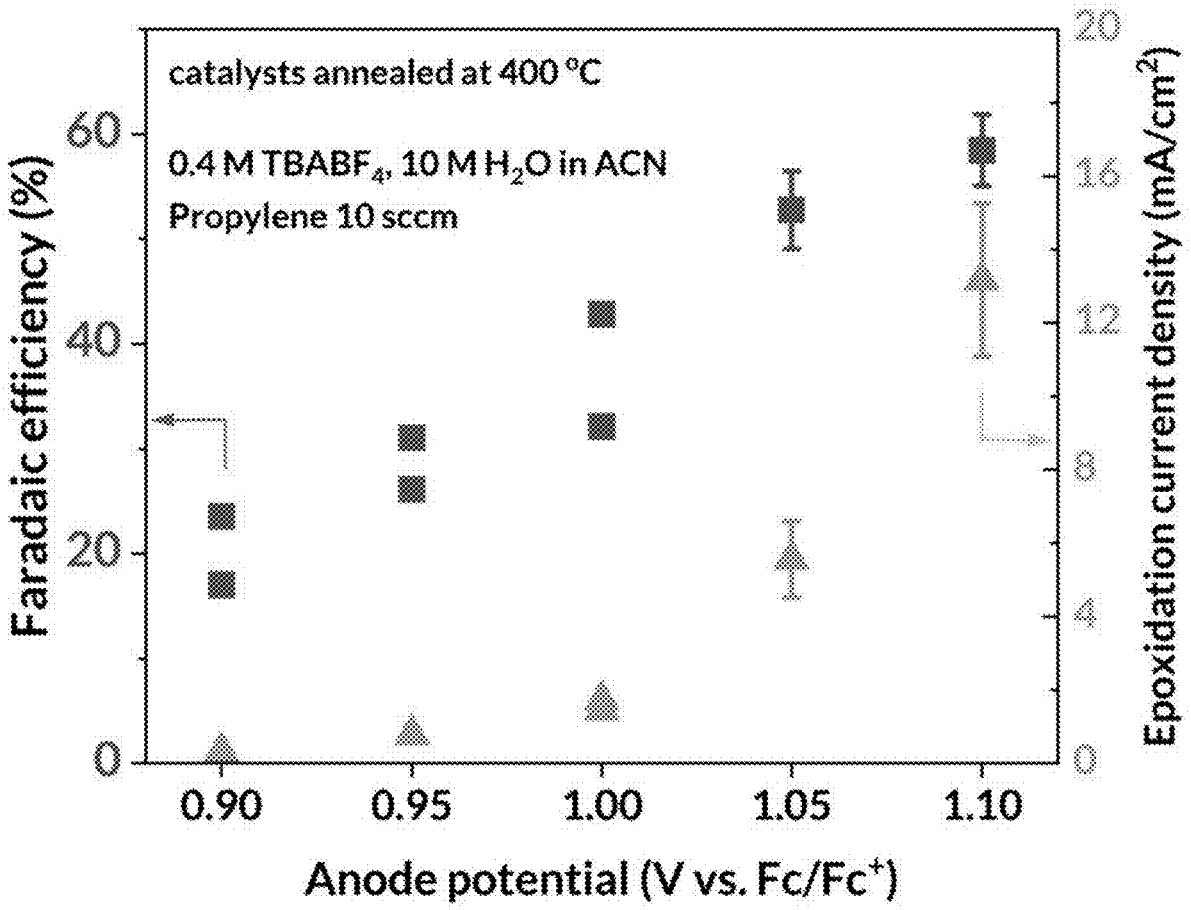
FIG. 26: Epoxidation Faradaic efficiencies and rates at different potentials (100% iR-compensated). This plot shares the data used for the Tafel plot (FIG. 4A). Vertical error bars represent standard deviations from the mean of multiple replicates (n≥3) of the same experiment.

A series of elementary steps for epoxidation and oxygen evolution were proposed based on Eley-Rideal kinetics for each case, and the overall rate equation for epoxidation was formulated by invoking a pseudo-steady-state hypothesis (PSSH) on intermediate species. Molar ratio of water is expressed as $x_w$, unitless propylene pressure normalized by 1 atm is expressed as $p_{olefin}$ in the rate expressions. Irreversible epoxide and $O_2$ desorption steps were assumed, given that the epoxidation rate showed no dependency on the concentrations of either the epoxide or $O_2$ (FIGS. 25A-25B).

Case 1: OOH* Catalyzes Epoxidation, Single Site Mechanism

A series of elementary steps and rate equations for each step are proposed as below:

$$\text{olefin} + {}^* \longleftrightarrow \text{olefin}^* \tag{1}$$

$$^* + H_2O + H_2O \longrightarrow OH^* + H_3O^+ + e^- \tag{2}$$

$$OH^* + H_2O \longrightarrow O^* + H_3O^+ + e^- \tag{3}$$

-continued $$O^* + H_2O + H_2O \longrightarrow OOH^* + H_3O^+ + e^- \tag{4}$$

$$OOH^* + \text{olefin} \longrightarrow OH^* + \text{epoxide} \tag{5}$$

$$OOH^* + H_2O \longrightarrow O_2 + {}^* + H_3O^+ + e^- \tag{6}$$

$$K_1 \frac{\gamma_{olefin}\gamma_*}{\gamma_{olefin^*}} p_{olefin}\theta_* = K_1' p_{olefin}\theta_* = \theta_{olefin} \tag{R1.1}$$

$$r_2 = k_2 \frac{\gamma_w^2\gamma_*}{\gamma_2^{\ddagger}}\theta_* x_w^2 e^{\alpha_2 f\phi} = k_2''\theta_* x_w^2 e^{\alpha_2 f\phi} = k_2''\theta_* x_w^2 \tag{R1.2}$$

$$r_3 = k_3 \frac{\gamma_w\gamma_{OH}}{\gamma_3^{\ddagger}}\theta_{OH} x_w e^{\alpha_3 f\phi} = k_3'\theta_{OH} x_w e^{\alpha_3 f\phi} = k_3'' x_w \theta_{OH} \tag{R1.3}$$

$$r_4 = k_4 \frac{\gamma_w^2\gamma_O}{\gamma_4^{\ddagger}}\theta_O x_w^2 e^{\alpha_4 f\phi} = k_4'\theta_O x_w^2 e^{\alpha_4 f\phi} = k_4''\theta_O x_w^2 \tag{R1.4}$$

$$r_5 = k_5 \frac{\gamma_{olefin}\gamma_{OOH}}{\gamma_5^{\ddagger}}\theta_{OOH} p_{olefin} = k_5'\theta_{OOH} p_{olefin} \tag{R1.5}$$

$$r_6 = k_6 \frac{\gamma_w\gamma_{OOH}}{\gamma_6^{\ddagger}}\theta_{OOH} x_w e^{\alpha_6 f\phi} = k_6'\theta_{OOH} x_w e^{\alpha_6 f\phi} = k_6'' x_w \theta_{OOH} x_w \tag{R1.6}$$

Potential-dependent exponential terms and activity coefficients are imbedded into the rate constant for simplicity of derivation. Quasi-equilibrium between the vacant site and the propylene-adsorbed site was invoked, and PSSH was applied for each water oxidation species.

We apply the PSSH to the various water oxidation intermediates:

$$\frac{d\Gamma_{OH}}{dt} = r_2 - r_3 + r_5 = 0,\ \frac{d\Gamma_O}{dt} = r_3 - r_4 = 0,$$

$$\frac{d\Gamma_{OOH}}{dt} = r_4 - r_5 - r_6 = 0$$

Further rearrangement after substituting in equations R1.2-R1.6 yields:

$$\theta_{OOH} = \frac{k_2'' x_w}{k_6''}\theta_*$$

$$\theta_{OH} = \frac{k_2'' x_w + (k_2''k_5'/k_6'')p_{olefin}}{k_3''}\theta_*$$

$$\theta_O = \frac{k_3''}{k_4'' x_w}\theta_{OH} = \frac{k_2'' x_w + (k_2''k_5'/k_6'')p_{olefin}}{k_4'' x_w}\theta_*$$

Assuming quasi-equilibrium between the vacant site and the propylene-adsorbed site (R1.1), now all of the sites can be expressed in terms of the density of vacant sites:

$$1 = \theta_* + \theta_{olefin} + \theta_{OH} + \theta_O + \theta_{OOH}$$

$$1 = \theta_*\left(1 + K_1' p_{olefin} + \frac{k_2'' x_w + (k_2''k_5'/k_6'')p_{olefin}}{k_3''} + \frac{k_2'' x_w + (k_2''k_5'/k_6'')p_{olefin}}{k_4'' x_w} + \frac{k_2'' x_w}{k_6''}\right)$$

Then, the epoxidation rate can be expressed as below:

$$r_{epoxidation} = r_5 = k_5'\theta_{OOH}\,p_{olefin} = \frac{\frac{k_2''k_5'}{k_6''}x_w p_{olefin}}{\left(1 + K_1' p_{olefin} + \frac{k_2''x_w + (k_2''k_5'/k_6'')p_{olefin}}{k_3''} + \frac{k_2''x_w + (k_2''k_5'/k_6'')p_{olefin}}{k_4''x_w} + \frac{k_2''x_w}{k_6''}\right)}$$

Rate constants were estimated by fitting the experimental data to the rate equation, and the coverages of various surface sites at different water concentrations, propylene pressures, and applied potentials (vs. $Fc/Fc^+$) are simulated as shown in FIGS. 31A-31I.

Case 2a: OO* Catalyzes Epoxidation, Single Site Mechanism

A series of elementary steps and rate equations for each step are proposed as below:

$$\text{olefin} + {}^* \longleftrightarrow \text{olefin}^* \tag{1}$$

$$^* + H_2O + H_2O \longrightarrow OH^* + H_3O^+ + e^- \tag{2}$$

$$OH^* + H_2O \longrightarrow O^* + H_3O^+ + e^- \tag{3}$$

$$O^* + H_2O + H_2O \longrightarrow OOH^* + H_3O^+ + e^- \tag{4}$$

$$OOH^* + H_2O \longrightarrow OO^* + H_3O^+ + e^- \tag{5}$$

$$OO^* + \text{olefin} \longrightarrow O^* + \text{epoxide} \tag{6}$$

$$OO^* \longrightarrow O_2 + {}^* \tag{7}$$

$$K_1\frac{\gamma_{olefin}\gamma_*}{\gamma_{olefin^*}}p_{olefin}\theta_* = K_1' p_{olefin}\theta_* = \theta_{olefin} \tag{R2a.1}$$

$$r_2 = k_2\frac{\gamma_w^2\gamma_*}{\gamma_2^\ddagger}\theta_* x_w^2 e^{\alpha_2 f\phi} = k_2'\theta_* x_w^2 e^{\alpha_2 f\phi} = k_2''\theta_* x_w^2 \tag{R2a.2}$$

$$r_3 = k_3\frac{\gamma_w\gamma_{OH}}{\gamma_3^\ddagger}\theta_{OH}x_w e^{\alpha_3 f\phi} = k_3'\theta_{OH}x_w e^{\alpha_3 f\phi} = k_3''\theta_{OH}x_w \tag{R2a.3}$$

$$r_4 = k_4\frac{\gamma_w^2\gamma_O}{\gamma_4^\ddagger}\theta_O x_w^2 e^{\alpha_4 f\phi} = k_4'\theta_O x_w^2 e^{\alpha_4 f\phi} = k_4''\theta_O x_w^2 \tag{R2a.4}$$

$$r_5 = k_5\frac{\gamma_w\gamma_{OOH}}{\gamma_5^\ddagger}\theta_{OOH}x_w e^{\alpha_5 f\phi} = k_5'\theta_{OOH}x_w e^{\alpha_5 f\phi} = k_5''\theta_{OOH}x_w \tag{R2a.5}$$

$$r_6 = k_6\frac{\gamma_{olefin}\gamma_{OOH}}{\gamma_6^\ddagger}p_{olefin}\theta_{OO} = k_6' p_{olefin}\theta_{OO} \tag{R2a.6}$$

$$r_7 = k_7\frac{\gamma_{OO}}{\gamma_7^\ddagger}\theta_{OO} = k_7'\theta_{OO} \tag{R2a.7}$$

We apply the PSSH to the water oxidation intermediates:

$$\frac{d\Gamma_{OH}}{dt} = r_2 - r_3 = 0,\ \frac{d\Gamma_O}{dt} = r_3 - r_4 + r_6 = 0,$$

$$\frac{d\Gamma_{OOH}}{dt} = r_4 - r_5 = 0,\ \frac{d\Gamma_{OO}}{dt} = r_5 - r_6 - r_7 = 0$$

Further rearrangement after substituting in equations R2a.2-7 yields:

$$k_2\frac{\gamma_w^2\gamma_*}{\gamma_2^\ddagger}e^{\alpha_2 f\phi}\theta_* x_w^2 = k_3\frac{\gamma_w\gamma_{OH}}{\gamma_3^\ddagger}e^{\alpha_3 f\phi}\theta_{OH}x_w$$

$$\theta_{OH} = \frac{k_2}{k_3}\frac{\gamma_w\gamma_3^\ddagger\gamma_*}{\gamma_2^\ddagger\gamma_{OH}}e^{(\alpha_2-\alpha_3)f\phi}x_w\theta_*$$

$$k_4\frac{\gamma_w^2\gamma_O}{\gamma_4^\ddagger}e^{\alpha_4 f\phi}\theta_O x_w^2 = k_5\frac{\gamma_w\gamma_{OOH}}{\gamma_5^\ddagger}e^{\alpha_5 f\phi}\theta_{OOH}x_w$$

$$\theta_{OOH} = \frac{k_4\frac{\gamma_w\gamma_O}{\gamma_4^\ddagger}x_w}{k_5\frac{\gamma_{OOH}}{r_5^\ddagger}}e^{(\alpha_4-\alpha_5)f\phi}\theta_O$$

$$k_5\frac{\gamma_w\gamma_{OOH}}{\gamma_5^\ddagger}e^{\alpha_5 f\phi}\theta_{OOH}x_w = k_6\frac{\gamma_{olefin}\gamma_{OO}}{\gamma_6^\ddagger}p_{olefin}\theta_{OO} + k_7\frac{\gamma_{OO}}{\gamma_7^\ddagger}\theta_{OO}$$

$$\theta_{OO} = \frac{k_5\frac{\gamma_w\gamma_{OOH}}{\gamma_5^\ddagger}e^{\alpha_5 f\phi}x_w}{k_6\frac{\gamma_{olefin}\gamma_{OO}}{\gamma_6^\ddagger}p_{olefin} + k_7\frac{\gamma_{OO}}{\gamma_7^\ddagger}}\theta_{OOH} = \frac{k_4\frac{\gamma_w^2\gamma_O}{\gamma_4^\ddagger}e^{\alpha_4 f\phi}x_w^2}{k_6\frac{\gamma_{olefin}\gamma_{OO}}{\gamma_6^\ddagger}p_{olefin} + k_7\frac{\gamma_{OO}}{\gamma_7^\ddagger}}\theta_O$$

$$k_3\frac{\gamma_w\gamma_{OH}}{\gamma_3^\ddagger}\theta_{OH}x_w e^{\alpha_3 f\phi} = k_7\frac{\gamma_{OO}}{\gamma_7^\ddagger}\theta_{OO} = \frac{k_7\frac{\gamma_{OO}}{\gamma_7^\ddagger}k_4\frac{\gamma_w^2\gamma_O}{\gamma_4^\ddagger}e^{\alpha_4 f\phi}x_w^2}{k_6\frac{\gamma_{olefin}\gamma_{OO}}{\gamma_6^\ddagger}p_{olefin} + k_7\frac{\gamma_{OO}}{\gamma_7^\ddagger}}\theta_O$$

$$\theta_O = k_3\frac{\gamma_w\gamma_{OH}}{\gamma_3^\ddagger}e^{\alpha_3 f\phi}\frac{k_6\frac{\gamma_{olefin}\gamma_{OO}}{\gamma_6^\ddagger}p_{olefin} + k_7\frac{\gamma_{OO}}{\gamma_7^\ddagger}}{k_7\frac{\gamma_{OO}}{\gamma_7^\ddagger}k_4\frac{\gamma_w^2\gamma_O}{\gamma_4^\ddagger}e^{\alpha_4 f\phi}x_w}\theta_{OH} = \frac{k_6\frac{\gamma_{olefin}\gamma_{OO}}{\gamma_6^\ddagger}p_{olefin} + k_7\frac{\gamma_{OO}}{\gamma_7^\ddagger}}{k_7\frac{\gamma_{OO}}{\gamma_7^\ddagger}k_4\frac{\gamma_O}{\gamma_4^\ddagger}\frac{\gamma_2^\ddagger}{k_2\gamma_*}e^{(\alpha_4-\alpha_2)f\phi}}\theta_*$$

$$\theta_{OOH} = \frac{k_4\frac{\gamma_w\gamma_O}{\gamma_4^\ddagger}x_w}{k_5\frac{\gamma_{OOH}}{\gamma_5^\ddagger}}e^{(\alpha_4-\alpha_5)f\phi}\theta_O = \frac{k_6\frac{\gamma_{olefin}\gamma_{OO}}{\gamma_6^\ddagger}p_{olefin} + k_7\frac{\gamma_{OO}}{\gamma_7^\ddagger}}{k_5\frac{\gamma_{OOH}}{\gamma_5^\ddagger}k_7\frac{\gamma_{OO}}{\gamma_7^\ddagger}\frac{\gamma_2^\ddagger}{k_2\gamma_*}e^{(\alpha_5-\alpha_2)f\phi}}\gamma_w x_w\theta_*$$

$$\theta_{OO} = \frac{k_4\frac{\gamma_w^2\gamma_O}{\gamma_4^\ddagger}e^{\alpha_4 f\phi}x_w^2}{k_6\frac{\gamma_{olefin}\gamma_{OO}}{\gamma_6^\ddagger}p_{olefin} + k_7\frac{\gamma_{OO}}{\gamma_7^\ddagger}}\theta_O = \frac{k_4\frac{\gamma_w^2\gamma_O}{\gamma_4^\ddagger}e^{\alpha_4 f\phi}x_w^2}{k_7\frac{\gamma_{OO}}{\gamma_7^\ddagger}k_4\frac{\gamma_O}{\gamma_4^\ddagger}\frac{\gamma_2^\ddagger}{k_2\gamma_*}e^{(\alpha_4-\alpha_2)f\phi}}\theta_* = \frac{k_2\frac{\gamma_w^2\gamma_*}{\gamma_2^\ddagger}e^{\alpha_2 f\phi}x_w^2}{k_7\frac{\gamma_{OO}}{\gamma_7^\ddagger}}\theta_*$$

With the assertion of quasi-equilibrium on step 1, all of the sites can be expressed in terms of the density of vacant sites. Also, we assume transfer coefficients $\alpha_2=\alpha_3=\alpha_4=\alpha_5=\alpha$. Then, the rate equation can be formulated as below:

$$1 = \theta_* + \theta_{olefin} + \theta_{OH} + \theta_O + \theta_{OOH} + \theta_{OO}$$

$$1 = \theta_*\left(1 + K_1\frac{\gamma_{olefin}\gamma_*}{\gamma_{olefin^*}}p_{olefin} + \frac{k_2}{k_3}\frac{\gamma_w\gamma_3^\ddagger\gamma_*}{\gamma_2^\ddagger\gamma_{OH}}x_w + \frac{k_6\frac{\gamma_{olefin}\gamma_{OO}}{\gamma_6^\ddagger}p_{olefin} + k_7\frac{\gamma_{OO}}{\gamma_7^\ddagger}}{k_7\frac{\gamma_{OO}}{\gamma_7^\ddagger}k_4\frac{\gamma_O}{\gamma_4^\ddagger}\frac{\gamma_2^\ddagger}{k_2\gamma_*}} + \right.$$

-continued $$\left.\frac{k_6\frac{\gamma_{olefin}\gamma_{OO}}{\gamma_6^{\ddagger}}p_{olefin}+k_7\frac{\gamma_{OO}}{\gamma_7^{\ddagger}}}{k_5\frac{\gamma_{OOH}}{\gamma_5^{\ddagger}}k_7\frac{\gamma_{OO}}{\gamma_7^{\ddagger}}\frac{\gamma_2^{\ddagger}}{k_2\gamma_*}}\gamma_w x_w+\frac{k_2\frac{\gamma_w^2\gamma_*}{\gamma_2^{\ddagger}}e^{\alpha f\phi}x_w^2}{k_7\frac{\gamma_{OO}}{\gamma_7^{\ddagger}}}\right)$$

$$r=r_6=k_6\frac{\gamma_{olefin}\gamma_{OO}}{\gamma_6^{\ddagger}}p_{olefin}\theta_{OO}=$$

$$\frac{k_6\frac{\gamma_{olefin}\gamma_{OO}}{\gamma_6^{\ddagger}}\frac{k_2\frac{\gamma_w^2\gamma_*}{\gamma_2^{\ddagger}}e^{\alpha f\phi}}{k_7\frac{\gamma_{OO}}{\gamma_7^{\ddagger}}}p_{olefin}x_w^2}{1+K_1\frac{\gamma_{olefin}\gamma_*}{\gamma_{olefin^*}}p_{olefin}+\frac{k_2}{k_3}\frac{\gamma_w\gamma_3^{\ddagger}\gamma_*}{\gamma_2^{\ddagger}\gamma_{OH}}x_w+\frac{k_6\frac{\gamma_{olefin}\gamma_{OO}}{\gamma_6^{\ddagger}}p_{olefin}+k_7\frac{\gamma_{OO}}{\gamma_7^{\ddagger}}}{k_7\frac{\gamma_{OO}}{\gamma_7^{\ddagger}}k_4\frac{\gamma_O}{\gamma_4^{\ddagger}}\frac{\gamma_2^{\ddagger}}{k_2\gamma_*}}+\frac{k_6\frac{\gamma_{olefin}\gamma_{OO}}{\gamma_6^{\ddagger}}p_{olefin}+k_7\frac{\gamma_{OO}}{\gamma_7^{\ddagger}}}{k_5\frac{\gamma_{OOH}}{\gamma_5^{\ddagger}}k_7\frac{\gamma_{OO}}{\gamma_7^{\ddagger}}\frac{\gamma_2^{\ddagger}}{k_2\gamma_*}}\gamma_w x_w+\frac{k_2\frac{\gamma_w^2\gamma_*}{\gamma_2^{\ddagger}}e^{\alpha f\phi}x_w^2}{k_7\frac{\gamma_{OO}}{\gamma_7^{\ddagger}}}}=$$

$$\frac{k_6'\frac{k_2''}{k_7'}p_{olefin}x_w^2}{1+K_1'p_{olefin}+\frac{k_2''}{k_3''}x_w+\frac{k_6'p_{olefin}+k_7'}{k_7'k_4''/k_2''}+\frac{k_6'p_{olefin}+k_7'}{k_5''k_7'/k_2''}x_w+\frac{k_2''x_w^2}{k_7'}}$$

In this mechanism, to illustrate the complete rate equation without lumped parameters, all activity coefficients terms were displayed up to the final derivation step. Coverages of various surface sites at different water concentrations, propylene pressures, and applied potentials (vs. $Fc/Fc^+$) are simulated as shown in FIGS. 32A-32I.

Case 2b: OO* Catalyzes Epoxidation, OOH*+O*→OO*+OH* Rearrangement Included

A series of elementary steps and rate equations for each step are proposed as below:

$$\text{olefin}+{}^*\longleftrightarrow\text{olefin}^* \tag{1}$$

$${}^*+{}^*+H_2O+H_2O\longrightarrow OH^*+{}^*+H_3O^++e^- \tag{2}$$

$$OH^*+{}^*+H_2O\longrightarrow O^*+{}^*+H_3O^++e^- \tag{3}$$

$$O^*+{}^*+H_2O+H_2O\longrightarrow OOH^*+{}^*+H_3O^++e^- \tag{4}$$

$$OOH^*+O^*\longrightarrow OO^*+OH^* \tag{5}$$

$$OO^*+{}^*+\text{olefin}\longrightarrow O^*+{}^*+\text{epoxide} \tag{6}$$

$$OOH^*+{}^*+H_2O\longrightarrow OO^*+{}^*+H_3O^++e^- \tag{7}$$

$$OO^*+{}^*\longrightarrow O_2+{}^*+{}^* \tag{8}$$

$$K_1\frac{\gamma_{olefin}\gamma_*}{\gamma_{olefin^*}}p_{olefin}\theta_*=K_1'p_{olefin}\theta_*=\theta_{olefin} \tag{R2b.1}$$

$$r_2=k_2\frac{\gamma_w^2\gamma_*^2}{\gamma_2^{\ddagger}}\theta_*^2x_w^2e^{\alpha_2 f\phi}=k_2'x_w^2\theta_*^2e^{\alpha_2 f\phi}=k_2''x_w^2\theta_*^2 \tag{R2b.2}$$

$$r_3=k_3\frac{\gamma_w\gamma_{OH}\gamma_*}{\gamma_3^{\ddagger}}\theta_{OH}\theta_*x_we^{\alpha_3 f\phi}=k_3'x_w\theta_{OH}\theta_*e^{\alpha_3 f\phi}=k_3''x_w\theta_{OH}\theta_* \tag{R2b.3}$$

$$r_4=k_4\frac{\gamma_w^2\gamma_O\gamma_*}{\gamma_4^{\ddagger}}\theta_O\theta_*x_w^2e^{\alpha_4 f\phi}=k_4'x_w^2\theta_O\theta_*e^{\alpha_4 f\phi}=k_4''x_w^2\theta_O\theta_* \tag{R2b.4}$$

-continued $$r_5=k_5\frac{\gamma_O\gamma_{OOH}}{\gamma_5^{\ddagger}}\theta_{OOH}\theta_O=k_5'\theta_{OOH}\theta_O \tag{R2b.5}$$

$$r_6=k_6\frac{\gamma_{olefin}\gamma_{OO}\gamma_*}{\gamma_6^{\ddagger}}p_{olefin}\theta_{OO}\theta_*=k_6'p_{olefin}\theta_{OO}\theta_* \tag{R2b.6}$$

$$r_7=k_7\frac{\gamma_w\gamma_{OOH}\gamma_*}{\gamma_7^{\ddagger}}\theta_{OOH}\theta_*x_we^{\alpha_7 f\phi}=k_7'x_w\theta_{OOH}\theta_*e^{\alpha_7 f\phi}=k_7''x_w\theta_{OOH}\theta_* \tag{R2b.7}$$

$$r_8=k_8\frac{\gamma_{OO}\gamma_*}{\gamma_8^{\ddagger}}\theta_{OO}\theta_*=k_8'\theta_{OO}\theta_* \tag{R2b.8}$$

Quasi-equilibrium between the vacant site and the propylene-adsorbed site was invoked, and PSSH was applied for each water oxidation species.

We apply the PSSH to the various water oxidation intermediates:

$$\theta_{olefin}=K_1'p_{olefin}\theta_*$$

$$\theta_O=\left(\frac{k_2''}{k_4''}+\frac{k_2''k_6'}{k_4''k_8'}\right)\theta_*$$

$$\theta_{OH}=\left(\frac{k_2''}{k_3''}+\frac{\left(k_2''+\frac{k_2''k_6'}{k_8'}\right)^2}{k_3''\left(k_2''+\frac{k_2''k_6'}{k_8'}+\frac{k_4''k_7''}{k_5'}x_w\right)}\right)x_w\theta_*$$

$$\theta_{OOH}=\frac{\left(k_2''+\frac{k_2''k_6'}{k_8'}\right)x_w^2}{\left(\frac{k_2''k_5'}{k_4''}+\frac{k_2''k_5'k_6'}{k_4''k_8'}+k_7''x_w\right)}\theta_*$$

$$\theta_{OO}=\frac{k_2''}{k_8'}x_w^2\theta_*$$

With the assertion of quasi-equilibrium on step 1, all of the sites can be expressed in terms of the density of vacant sites. Then, the rate equation can be formulated as below:

$$1=\theta_*+\theta_{olefin}+\theta_{OH}+\theta_O+\theta_{OOH}+\theta_{OO}$$

$$1=\theta_*\left(1+K_1'p_{olefin}+\left(\frac{k_2''}{k_3''}+\frac{\left(k_2''+\frac{k_2''k_6'}{k_8'}\right)^2}{k_3''\left(k_2''+\frac{k_2''k_6'}{k_8'}+\frac{k_4''k_7''}{k_5'}x_w\right)}\right)x_w+\left(\frac{k_2''}{k_4''}+\frac{k_2''k_6'}{k_4''k_8'}\right)+\frac{\left(k_2''+\frac{k_2''k_6'}{k_8'}\right)x_w^2}{\left(\frac{k_2''k_5'}{k_4''}+\frac{k_2''k_5'k_6'}{k_4''k_8'}+k_7''x_w\right)}+\frac{k_2''}{k_8'}x_w^2\right)$$

$$r_{epoxidation}=r_6=k_6'p_{olefin}\theta_{OO}\theta_*=$$

$$k_2''k_6'p_{olefin}x_w^2\theta_*^2=\frac{\frac{k_2''k_6'}{k_8'}p_{olefin}x_w^2}{\left(1+K_1'p_{olefin}+\left(\frac{k_2''}{k_3''}+\frac{\left(k_2''+\frac{k_2''k_6'}{k_8'}\right)^2}{k_3''\left(k_2''+\frac{k_2''k_6'}{k_8'}+\frac{k_4''k_7''}{k_5'}x_w\right)}\right)x_w+\left(\frac{k_2''}{k_4''}+\frac{k_2''k_6'}{k_4''k_8'}\right)+\frac{\left(k_2''+\frac{k_2''k_6'}{k_8'}\right)x_w^2}{\left(\frac{k_2''k_5'}{k_4''}+\frac{k_2''k_5'k_6'}{k_4''k_8'}+k_7''x_w\right)}+\frac{k_2''}{k_8'}x_w^2\right)^2}$$

Coverages of various surface sites at different water concentrations, propylene pressures, and applied potentials (vs. $Fc/Fc^+$) are simulated as shown in FIGS. 33A-33I.

Case 2c: Assuming OO* as the Reactive Oxygen Species for Epoxidation, Bridged O* and OO*

A series of elementary steps and rate equations for each step are proposed as below:

$$\text{olefin} + {}^* \leftrightarrow \text{olefin}^* \tag{1}$$

$$^* + {}^* + H_2O + H_2O \rightarrow OH^* + {}^* + H_3O^+ + e^- \tag{2}$$

$$OH^* + {}^* + H_2O \rightarrow 2O^*_{1/2} + H_3O^+ + e^- \tag{3}$$

$$2O^*_{1/2} + H_2O + H_2O \rightarrow OOH^* + {}^* + H_3O^+ + e^- \tag{4}$$

$$OOH^* + {}^* + H_2O \rightarrow 2O^*_{-o} + H_3O^+ + e^- \tag{5}$$

$$2O^*_{-o} + \text{olefin} \rightarrow 2O^*_{1/2} + \text{epoxide} \tag{6}$$

$$2O^*_{-o} \rightarrow O_2 + {}^* + {}^* \tag{7}$$

$$K_1 \frac{\gamma_{olefin}\gamma_*}{\gamma_{olefin^*}} p_{olefin}\theta_* = K_1' p_{olefin}\theta_* = \theta_{olefin} \tag{R2c.1}$$

$$r_2 = k_2 \frac{\gamma_w^2\gamma_*^2}{\gamma_2^\ddagger}\theta_*^2 x_w^2 e^{\alpha_2 f\phi} = k_2' x_w^2\theta_*^2 e^{\alpha_2 f\phi} = k_2'' x_w^2\theta_*^2 \tag{R2c.2}$$

$$r_3 = k_3 \frac{\gamma_w\gamma_{OH}\gamma_*}{\gamma_3^\ddagger}\theta_{OH}\theta_* x_w e^{\alpha_3 f\phi} = k_3' x_w\theta_{OH}\theta_* e^{\alpha_3 f\phi} = k_3'' x_w\theta_{OH}\theta_* \tag{R2c.3}$$

$$r_4 = k_4 \frac{\gamma_w^2\gamma_{O_{1/2}}^2}{\gamma_4^\ddagger}\theta_{O_{1/2}}^2 x_w^2 e^{\alpha_4 f\phi} = k_4'\theta_{O_{1/2}}^2 x_w^2 e^{\alpha_4 f\phi} = k_4''\theta_{1/2}^2 x_w^2 \tag{R2c.4}$$

$$r_5 = k_5 \frac{\gamma_w\gamma_{OOH}\gamma_*}{\gamma_5^\ddagger}\theta_{OOH}\theta_* x_w e^{\alpha_5 f\phi} = k_5'\theta_{OOH}\theta_* x_w e^{\alpha_5 f\phi} = k_5''\theta_{OOH}\theta_* x_w \tag{R2c.5}$$

$$r_6 = k_6 \frac{\gamma_{olefin}\gamma_{O-o}^2}{\gamma_6^\ddagger} p_{olefin}\theta_{O-o}^2 = k_6' p_{olefin}\theta_{O-o}^2 \tag{R2c.6}$$

$$r_7 = k_7 \frac{\gamma_{O-o}^2}{\gamma_7^\ddagger}\theta_{O-o}^2 = k_7'\theta_{O-o}^2 \tag{R2c.7}$$

$\eta_2$—O* and is $\eta_2$—OO* are shown as $O_{1/2}$* and $O_{-o}$*, respectively. Quasi-equilibrium between the vacant site and the propylene-adsorbed site was invoked, and PSSH was applied for each water oxidation species.

We apply the PSSH to the various water oxidation intermediates:

$$\frac{d\Gamma_{OH}}{dt} = r_2 - r_3 = 0,\ \frac{d\Gamma_{\eta_2-O}}{dt} = 2r_3 + 2r_6 - 2r_4 = 0,$$

$$\frac{d\Gamma_{OOH}}{dt} = r_4 - r_5 = 0,\ \frac{d\Gamma_{\eta_2-OO}}{dt} = 2r_5 - 2r_6 - 2r_7 = 0$$

Further rearrangement after substituting in equations R2c.2-R2c.7 yields surface coverages and rate equation as below:

$$\theta_{olefin} = K_1' p_{olefin}\theta_*$$

$$\theta_{OH} = \frac{k_2''}{k_3''} x_w\theta_*$$

$$\theta_{O_{1/2}} = \sqrt{\frac{k_2''(k_6' p_{olefin} + k_7')}{k_4'' k_7'}}\,\theta_*$$

-continued $$\theta_{OOH} = \frac{k_2''(k_6' p_{olefin} + k_7')}{k_5'' k_7'} x_w\theta_*$$

$$\theta_{O-o} = \sqrt{\frac{k_2''}{k_7'}} x_w\theta_*$$

$$1 = \theta_*\left(1 + K_1' p_{olefin} + \frac{k_2''}{k_3''}x_w + \sqrt{\frac{k_2''(k_6' p_{olefin} + k_7')}{k_4'' k_7'}} + \frac{k_2''(k_6' p_{olefin} + k_7')}{k_5'' k_7'}x_w + \sqrt{\frac{k_2''}{k_7'}}x_w\right)$$

$$r_{epox} = r_6 = k_6' p_{olefin}\theta_{O-o}^2 = \frac{k_6'\frac{k_2''}{k_7'}p_{olefin}x_w^2}{\left(1 + K_1' p_{olefin} + \frac{k_2''}{k_3''}x_w + \sqrt{\frac{k_2''(k_6' p_{olefin} + k_7')}{k_4'' k_7'}} + \frac{k_2''(k_6' p_{olefin} + k_7')}{k_5'' k_7'}x_w + \sqrt{\frac{k_2''}{k_7'}}x_w\right)^2}$$

With the parameters estimated from data fitting, coverages of various surface sites at different water concentrations, propylene pressures, and applied potentials (vs. $Fc/Fc^+$) are simulated as shown in FIGS. 34A-34I.

Case 2d: Assuming OO* as the Reactive Oxygen Species for Epoxidation, Bridged O*

A series of elementary steps and rate equations for each step are proposed as below:

$$\text{olefin} + {}^* \leftrightarrow \text{olefin}^* \tag{1}$$

$$^* + {}^* + H_2O + H_2O \rightarrow OH^* + {}^* + H_3O^+ + e^- \tag{2}$$

$$OH^* + {}^* + H_2O \rightarrow 2O^*_{1/2} + H_3O^+ + e^- \tag{3}$$

$$2O^*_{1/2} + H_2O + H_2O \rightarrow OOH^* + {}^* + H_3O^+ + e^- \tag{4}$$

$$OOH^* + {}^* + H_2O \rightarrow OO^* + {}^* + H_3O^+ + e^- \tag{5}$$

$$OO^* + {}^* + \text{olefin} \rightarrow 2O^*_{1/2} + \text{epoxide} \tag{6}$$

$$OO^* + {}^* \rightarrow O_2 + {}^* + {}^* \tag{7}$$

$$K_1 \frac{\gamma_p\gamma_*}{\gamma_{p^*}} p_{olefin}\theta_* = K_1' p_{olefin}\theta_* = \theta_{olefin} \tag{R2d.1}$$

$$r_2 = k_2 \frac{\gamma_w^2\gamma_*^2}{\gamma_2^\ddagger}\theta_*^2 x_w^2 e^{\alpha_2 f\phi} = k_2''\theta_*^2 x_w^2 \tag{R2d.2}$$

$$r_3 = k_3 \frac{\gamma_{OH}\gamma_*\gamma_w}{\gamma_3^\ddagger}\theta_{OH}\theta_* x_w e^{\alpha_3 f\phi} = k_3''\theta_{OH}\theta_* x_w \tag{R2d.3}$$

$$r_4 = k_4 \frac{\gamma_w^2\gamma_{O_{1/2}}^2}{\gamma_4^\ddagger}\theta_{O_{1/2}}^2 x_w^2 e^{\alpha_4 f\phi} = k_4''\theta_{O_{1/2}}^2 x_w^2 \tag{R2d.4}$$

$$r_5 = k_5 \frac{\gamma_{OOH}\gamma_*\gamma_w}{\gamma_5^\ddagger}\theta_{OOH}\theta_* x_w e^{\alpha_5 f\phi} = k_5''\theta_{OOH}\theta_* x_w \tag{R2d.5}$$

$$r_6 = k_6 \frac{\gamma_{OO}\gamma_*\gamma_p}{\gamma_6^\ddagger} p_{olefin}\theta_{OO}\theta_* = k_6' p_{olefin}\theta_{OO}\theta_* \tag{R2d.6}$$

$$r_7 = k_7 \frac{\gamma_{OO}\gamma_*}{\gamma_7^\ddagger}\theta_{OO}\theta_* = k_7'\theta_{OO}\theta * \tag{R2d.7}$$

$\eta_2$—O* is shown as $O_{1/2}$*. Quasi-equilibrium between the vacant site and the propylene-adsorbed site was invoked, and PSSH was applied for each water oxidation species.

We apply the PSSH to the various water oxidation intermediates:

$$\frac{d\Gamma_{OH}}{dt} = r_2 - r_3 = 0,\ \frac{d\Gamma_{\eta_2-O}}{dt} = 2r_3 + 2r_6 - 2r_4 = 0,$$

$$\frac{d\Gamma_{OOH}}{dt} = r_4 - r_5 = 0,\ \frac{d\Gamma_{OO}}{dt} = r_5 - r_6 - r_7 = 0$$

Further rearrangement after substituting in equations R2d.2-R2d.7 yields surface coverages and rate equation as below:

$$\theta_{olefin} = K_1' p_{olefin}\theta_*$$

$$\theta_{OH} = \frac{k_2''}{k_3''}x_w\theta_*$$

$$\theta_{O_{1/2}} = \sqrt{\frac{k_2''(k_6' p_{olefin} + k_7')}{k_4''k_7'}}\,\theta_*$$

$$\theta_{OOH} = \frac{k_2''(k_6' p_{olefin} + k_7')}{k_7'k_5''}x_w\theta_*$$

$$\theta_{OO} = \frac{k_2''}{k_7'}x_w^2\theta_*$$

$$1 = \theta_*\left(1 + K_1' p_{olefin} + \frac{k_2''}{k_3''}x_w + \sqrt{\frac{k_2''(k_6' p_{olefin} + k_7')}{k_4''k_7'}} + \frac{k_2''(k_6' p_{olefin} + k_7')}{k_7'k_5''}x_w + \frac{k_2''}{k_7'}x_w^2\right)$$

$$r_{epox} = r_6 = k_6' p_{olefin}\theta_{OO}\theta_* = \frac{k_6'\frac{k_2''}{k_7'}p_{olefin}x_w^2}{\left(1 + K_1' p_{olefin} + \frac{k_2''}{k_3''}x_w + \sqrt{\frac{k_2''(k_6' p_{olefin} + k_7')}{k_4''k_7'}} + \frac{k_2''(k_6' p_{olefin} + k_7')}{k_5''k_7'}x_w + \frac{k_2''}{k_7'}x_w^2\right)^2}$$

With the parameters estimated from data fitting, coverages of various surface sites at different water concentrations, propylene pressures, and applied potentials (vs. $Fc/Fc^+$) are simulated as shown in FIGS. 35A-35I.

Case 2e: Assuming OO* as the Reactive Oxygen Species for Epoxidation, Bridged OO*

A series of elementary steps and rate equations for each step are proposed as below:

$$\text{olefin} + {}^* \leftrightarrow \text{olefin}^* \quad (1)$$

$${}^* + {}^* + H_2O + H_2O \rightarrow OH^* + {}^* + H_3O^+ + e^- \quad (2)$$

$$OH^* + {}^* + H_2O \rightarrow O^* + {}^* + H_3O^+ + e^- \quad (3)$$

$$O^* + {}^* + H_2O + H_2O \rightarrow OOH^* + {}^* + H_3O^+ + e^- \quad (4)$$

$$OOH^* + {}^* + H_2O \rightarrow 2O^*_{-O} + H_3O^+ + e^- \quad (5)$$

$$2O^*_{-O} + \text{olefin} \rightarrow O^* + {}^* + \text{epoxide} \quad (6)$$

$$2O^*_{-O} \rightarrow O_2 + {}^* + {}^* \quad (7)$$

$$K_1\frac{\gamma_p\gamma_*}{\gamma_{p^*}}p_{olefin}\theta_* = K_1' p_{olefin}\theta_* = \theta_{olefin} \quad \text{(R2e.1)}$$

$$r_2 = k_2\frac{\gamma_w^2\gamma_*^2}{\gamma_2^{\ddagger}}\theta_*^2 x_w^2 e^{\alpha_2 f\phi} = k_2''\theta_*^2 x_w^2 \quad \text{(R2e.2)}$$

$$r_3 = k_3\frac{\gamma_{OH}\gamma_*\gamma_w}{\gamma_3^{\ddagger}}\theta_{OH}\theta_* x_w e^{\alpha_3 f\phi} = k_3''\theta_{OH}\theta_* x_w \quad \text{(R2e.3)}$$

-continued $$r_4 = k_4\frac{\gamma_O\gamma_*\gamma_w^2}{\gamma_4^{\ddagger}}\theta_O\theta_* x_w^2 e^{\alpha_4 f\phi} = k_4''\theta_O\theta_* x_w^2 \quad \text{(R2e.4)}$$

$$r_5 = k_5\frac{\gamma_{OOH}\gamma_*\gamma_w}{\gamma_5^{\ddagger}}\theta_{OOH}\theta_* x_w e^{\alpha_5 f\phi} = k_5''\theta_{OOH}\theta_* x_w \quad \text{(R2e.5)}$$

$$r_6 = k_6\frac{\gamma_{olefin}\gamma_{O_{-o}}^2}{\gamma_6^{\ddagger}}p_{olefin}\theta_{O_{-o}}^2 = k_6' p_{olefin}\theta_{O_{-o}}^2 \quad \text{(R2e.6)}$$

$$r_7 = k_7\frac{\gamma_{O_{-o}}^2}{\gamma_7^{\ddagger}}\theta_{O_{-o}}^2 = k_7'\theta_{O_{-o}}^2 \quad \text{(R2e.7)}$$

$\eta_2$—OO* is shown as $O_{-0}$*. Quasi-equilibrium between the vacant site and the propylene-adsorbed site was invoked, and PSSH was applied for each water oxidation species.

We apply the PSSH to the various water oxidation intermediates:

$$\frac{d\Gamma_{OH}}{dt} = r_2 - r_3 = 0,\ \frac{d\Gamma_O}{dt} = r_3 + r_6 - r_4 = 0,$$

$$\frac{d\Gamma_{OOH}}{dt} = r_4 - r_5 = 0,\ \frac{d\Gamma_{\eta_2-OO}}{dt} = 2r_5 - 2r_6 - 2r_7 = 0$$

Further rearrangement after substituting in equations R2e.2-R2e.7 yields surface coverages and rate equation as below:

$$\theta_{olefin} = K_1' p_{olefin}\theta_*$$

$$\theta_{OH} = \frac{k_2''}{k_3''}x_w\theta_*$$

$$\theta_O = \frac{k_2''(k_6' p_{olefin} + k_7')}{k_4''k_7'}\theta_*$$

$$\theta_{OOH} = \frac{k_2''(k_6' p_{olefin} + k_7')}{k_5''k_7'}x_w\theta_*$$

$$\theta_{O_{-o}} = \sqrt{\frac{k_2''}{k_7'}}\,x_w\theta_*$$

$$1 = \theta_*\left(1 + K_1' p_{olefin} + \frac{k_2''}{k_3''}x_w + \frac{k_2''(k_6' p_{olefin} + k_7')}{k_4''k_7'} + \frac{k_2''(k_6' p_{olefin} + k_7')}{k_5''k_7'}x_w + \sqrt{\frac{k_2''}{k_7'}}\,x_w\right)$$

$$r_{epox} = r_6 = k_6' p_{olefin}\theta_{O_{-o}}^2 = \frac{k_6'\frac{k_2''}{k_7'}p_{olefin}x_w^2}{\left(1 + K_1' p_{olefin} + \frac{k_2''}{k_3''}x_w + \frac{k_2''(k_6' p_{olefin} + k_7')}{k_4''k_7'} + \frac{k_2''(k_6' p_{olefin} + k_7')}{k_5''k_7'}x_w + \sqrt{\frac{k_2''}{k_7'}}\,x_w\right)^2}$$

With the parameters estimated from data fitting, coverages of various surface sites at different water concentrations, propylene pressures, and applied potentials (vs. $Fc/Fc^+$) are simulated as shown in FIGS. 36A-36I.

Case 3: Assuming O* as the Reactive Oxygen Species for Epoxidation

A series of elementary steps and rate equations for each step are proposed as below:

$$\text{olefin} + {}^* \leftrightarrow \text{olefin}^* \tag{1}$$

$$^* + H_2O + H_2O \rightarrow OH^* + H_3O^+ + e^- \tag{2}$$

$$OH^* + H_2O \rightarrow O^* + H_3O^+ + e^- \tag{3}$$

$$O^* + \text{olefin} \rightarrow {}^* + \text{epoxide} \tag{4}$$

$$O^* + H_2O + H_2O \rightarrow OOH^* + {}^* + H_3O^+ + e^- \tag{5}$$

$$OOH^* + H_2O \rightarrow OO^* + H_3O^+ + e^- \tag{6}$$

$$OO^* \rightarrow O_2 + {}^* \tag{7}$$

$$K_1 \frac{\gamma_{olefin}\gamma_*}{\gamma_{olefin^*}} p_{olefin}\theta_* = K_1' p_{olefin}\theta_* = \theta_{olefin} \tag{R3.1}$$

$$r_2 = k_2 \frac{\gamma_w^2\gamma_*^2}{\gamma_2^{\ddagger}} \theta_*^2 x_w^2 e^{\alpha_2 f\phi} = k_2'' \theta_*^2 x_w^2 \tag{R3.2}$$

$$r_3 = k_3 \frac{\gamma_w\gamma_{OH}}{\gamma_3^{\ddagger}} \theta_{OH} x_w e^{\alpha_3 f\phi} = k_3'' \theta_{OH} x_w \tag{R3.3}$$

$$r_4 = k_4 \frac{\gamma_{olefin}\gamma_O}{\gamma_4^{\ddagger}} \theta_O p_{olefin} = k_4' p_{olefin}\theta_O \tag{R3.4}$$

$$r_5 = k_5 \frac{\gamma_w^2\gamma_O}{\gamma_5^{\ddagger}} \theta_O x_w^2 e^{\alpha_5 f\phi} = k_5'' \theta_O x_w^2 \tag{R3.5}$$

$$r_6 = k_6 \frac{\gamma_w\gamma_{OOH}}{\gamma_6^{\ddagger}} \theta_{OOH} x_w e^{\alpha_6 f\phi} = k_6'' \theta_{OOH} x_w \tag{R3.6}$$

$$r_7 = k_7 \frac{\gamma_{OO}}{\gamma_7^{\ddagger}} \theta_{OO} = k_7' \theta_{OO} \tag{R3.7}$$

We apply the PSSH to the water oxidation intermediates:

$$\frac{d\Gamma_{OH}}{dt} = r_2 - r_3 = 0, \quad \frac{d\Gamma_O}{dt} = r_3 - r_4 - r_5 = 0,$$

$$\frac{d\Gamma_{OOH}}{dt} = r_5 - r_6 = 0, \quad \frac{d\Gamma_{OO}}{dt} = r_6 - r_7 = 0$$

Further rearrangement after substituting in equations R3.2-7 yields:

$$\theta_{olefin} = K_1' p_{olefin}\theta_*$$

$$\theta_{OH} = \frac{k_2'' x_w}{k_3''}\theta_*$$

$$\theta_O = \frac{k_3'' x_w}{k_4' p_{olefin} + k_5'' x_w^2}\theta_{OH} = \frac{k_2'' x_w^2}{k_4' p_{olefin} + k_5'' x_w^2}\theta_*$$

$$\theta_{OOH} = \frac{k_5'' x_w}{k_6''}\theta_O = \frac{(k_2''k_5''/k_6'')x_w^3}{k_4' p_{olefin} + k_5'' x_w^2}\theta_*$$

$$\theta_{OO} = \frac{k_6''}{k_7'} a_{H_2O}\theta_{OOH} = \frac{(k_2''k_5''/k_7')x_w^4}{k_4' p_{olefin} + k_5'' x_w^2}\theta_*$$

With the assertion of quasi-equilibrium on step 1, all of the sites can be expressed in terms of the density of vacant sites. Then, the epoxidation rate equation can be formulated as below:

$$1 = \theta_* + \theta_{olefin} + \theta_{OH} + \theta_O + \theta_{OOH} = \theta_*\left(1 + K_1' p_{olefin} + \frac{k_2'' x_w}{k_3''} + \frac{k_2'' x_w^2}{k_4' p_{olefin} + k_5'' x_w^2} + \frac{(k_2''k_5''/k_6'')x_w^3}{k_4' p_{olefin} + k_5'' x_w^2} + \frac{(k_2''k_5''/k_7')x_w^4}{k_4' p_{olefin} + k_5'' x_w^2}\right)$$

$$r = r_4 = k_4' p_{olefin}\theta_O = \frac{k_2''k_4' p_{olefin} x_w^2}{k_4' p_{olefin} + k_5'' x_w^2}\theta_* = \frac{\dfrac{k_2''k_4' p_{olefin} x_w^2}{k_4' p_{olefin} + k_5'' x_w^2}}{\left(1 + K_1' p_{olefin} + \dfrac{k_2'' x_w}{k_3''} + \dfrac{k_2'' x_w^2}{k_4' p_{olefin} + k_5'' x_w^2} + \dfrac{(k_2''k_5''/k_6'')x_w^3}{k_4' p_{olefin} + k_5'' x_w^2} + \dfrac{(k_2''k_5''/k_7')x_w^4}{k_4' p_{olefin} + k_5'' x_w^2}\right)}$$

With the parameters estimated from data fitting, coverages of various surface sites at different water concentrations, propylene pressures, and applied potentials (vs. $Fc/Fc^+$) are simulated as shown in FIGS. 37A-37I.

Correlation Between Alkene Electrophilicity and Epoxidation Rate

Additional insights into direct anodic epoxidation on $PdPtO_x/C$ were obtained from evaluating the correlation between the electrophilicity of alkene substrates and the epoxidation rate. Previous studies on thermochemical epoxidation suggest that either electrophilic (27-29) or nucleophilic (30,31) epoxidation can be a reasonable reaction pathway for electrochemical propylene epoxidation on late-transition metal catalysts (See example 2B for additional details). By understanding the electronic nature of the oxygen transfer during the reaction, we can enhance our understanding of the mechanism and guide future catalyst development.

The global electrophilicity index (ω) can be calculated by taking the square of alkene chemical potential divided by chemical hardness, and is expressed in units of energy (32,33). A higher value of ω indicates that the molecule is more electrophilic. Furthermore, the Fukui functions can be used to determine the local reactivity of each atom in a molecule by predicting the redistribution of electron density during electrophilic, nucleophilic, and radical attacks. The local electrophilicity ($\omega^-$) at each atom center can be obtained by multiplying the global electrophilicity by the value of the Fukui function for the removal of an electron.

The average $\omega^-$ of the alkene's two carbons as a substrate-based descriptor was assessed against the epoxidation rates of a wide range of alkene substrates. A total of 11 distinct aliphatic alkenes with various structure and functional groups were selected, with $\omega^-$ values ranging from 12-44 KJ/mol. In order to ensure consistent reactant chemical potential across different substrates, the gaseous substrates were fed until saturation, and the liquid substrates were added to the electrolyte near the phase-separation point, corresponding to approximately 0.2 M substrate for a 0.11 M tetrabutylammonium tetrafluoroborate ($TBABF_4$), 10 M water in acetonitrile (Table 11). The substrates were tested at the same potential referenced to the ferrocene redox couple (1.05 V vs. $Fc/Fc^+$).

TABLE 11

Reaction conditions for studying correlation between alkene electrophilicity index and the direct anodic epoxidation rate

| Substrate | Deviation from standard condition* | Faradaic efficiency (%) epoxide | diol | ketone | $\omega^-$ average (kJ/mol) | Epoxidation current density ($mA/cm^2$) |
|---|---|---|---|---|---|---|
| 2-methyl-2-butene | 1.02 V vs. $Fc/Fc^+$† | 41.7 | 36.5 | — | 12.11 | 11.67 |
| 2-hexene | — | 79.1 | — | — | 18.08 | 11.08 |
| cyclooctene | — | 92.4 | — | — | 19.15 | 15.80 |
| cycloheptene | — | 71.9 | — | — | 19.16 | 5.68 |
| norbornene | | 15.9 | — | — | 19.93 | 0.64 |
| 1-hexene | — | 53.0 | — | — | 25.70 | 1.73 |
| 1-octene | 0.16M substrate‡ | 43.9 | — | 28.5 | 25.81 | 1.19 |
| propylene | Saturated electrolyte with 1 atm substrate flowing at 10 sccm | 54.4 | — | — | 25.97 | 5.12 |
| allyl chloride | — | 19.7 | 4.63 | — | 35.52 | 0.97 |
| ethylene | Saturated electrolyte with 1 atm substrate flowing at 10 sccm | 24.5 | — | — | 36.40 | 0.76 |
| 3,3,3-trifluoropropene | Saturated electrolyte with 1 atm substrate flowing at 10 sccm | 1.96 | — | — | 43.30 | 0.033 |

*Standard condition: 0.11M $TBABF_4$, 0.2M substrate, 10M water in acetonitrile, annealed PdPt/C on carbon paper (at 400 °C) as an anode, Pt foil as a cathode, no separator, stirred using a magnetic bar, 1.05 V vs. $Fc/Fc^+$ applied to the anode.
†Slightly lowered the potential to due to instrumental current overload at 1.05 V vs. $Fc/Fc^+$.
‡Lowered substrate concentration to avoid phase separation.

Figure 5:
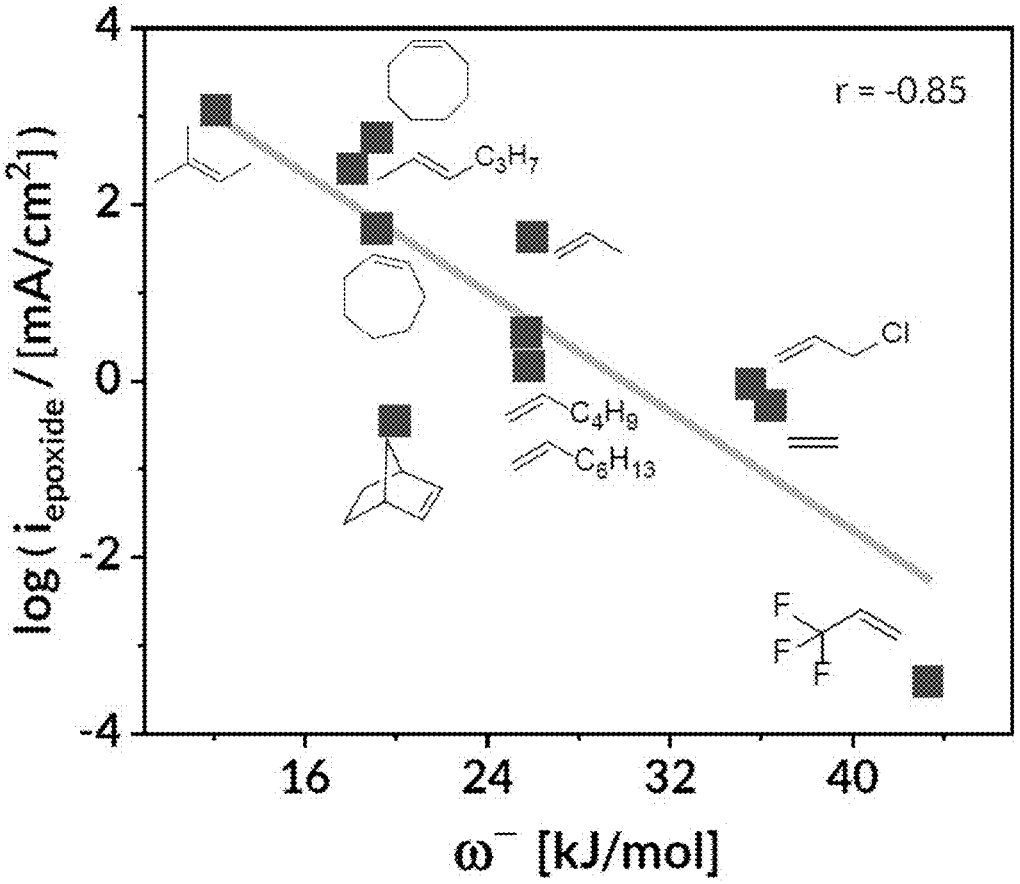
FIG. 5: Correlation between the alkene electrophilicity index and the direct anodic epoxidation rate. Pearson's r value=−0.85.

A negative correlation between the logarithm of rate and the alkene electrophilicity was observed, with more nucleophilic alkenes displaying higher reactivity towards epoxidation (FIG. 5). The results suggest that the epoxidation may proceed through an electrophilic attack by oxygen species, and that the energy barriers to this attack are lower for more nucleophilic alkenes. Furthermore, the correlation suggests that a frontier-orbital interaction between the LUMO of the oxygen species and the HOMO of the alkene modulates the reactivity.

Example 2B: Alkene Electrophilicity as a Descriptor for Direct Electrochemical Epoxidation Epoxidation using the chemical oxidant m-chloroperbenzoic acid and direct ethylene epoxidation using molecular oxygen on silver catalysts are categorized as electrophilic epoxidation, which is driven by the electrophilic attack of the oxidant on the alkene (27-29). However, the role of electrophile and nucleophile can be inverted in certain cases when the oxidant has highly nucleophilic oxygens, and when the metal withdraws electron density from the alkene (31). Alkenes can be activated as electrophiles by coordinating with an electron-deficient metal ion. In the context of homogeneous catalysis, it has been reported that a bimolecular reaction of a PtOOH species with a Pt-coordinated olefin species can give the epoxide and PtOH (32). A heterogenous analog of this reaction could occur on an electrode surface, as applying an anodic potential to an electrode makes electron-deficient platinum species, which would facilitate the electrophilic activation of light olefins toward attack by a nucleophile.

As described above, previous studies suggest that either electrophilic or nucleophilic epoxidation can be a reasonable reaction pathway for electrochemical propylene epoxidation on late-transition metal catalysts. Identification of the nucleophile and electrophile in the reaction allows for a better understanding of the reaction and can guide catalyst engineering. To probe this question, we invoked the alkene electrophilicity index as a descriptor for direct anodic epoxidation.

The global electrophilicity index (ω) can be defined as:

$$w = \frac{\mu^2}{2\eta} = \frac{(\text{chemical potential})^2}{\text{chemical hardness}}$$

The chemical potential and the chemical hardness are defined as $$\mu = \frac{\partial E}{\partial N},$$

$$\eta = \frac{\partial^2 E}{\partial N^2},$$

respectively, where E is the energy of the system, and N is the number of electrons, meaning ω has a unit of energy (33,34). A higher value of ω means the molecule is more electrophilic. The local reactivity at each atom of a molecule can be obtained using the Fukui function, which predicts the redistribution of electron density in a molecule upon electrophilic, nucleophilic, and radical attacks. Therefore, the global electrophilicity multiplied by the value of the Fukui function for the removal of an electron describes the local electrophilicity ($\omega^-$) at each atom center. A linear correlation between the average $\omega^-$ of the two carbons in the alkene and the logarithm of epoxidation current density was expected as $\omega^-$ has a unit of energy (FIG. 5).

Electrolyte Choice and the Effect of Solvent Medium on the Reaction Kinetics

Electrolyte and catalyst compatibility are important for the operation of direct epoxidation via water. Water-acetonitrile blended electrolytes were employed to investigate the epoxidation of various alkene substrates, since the acetonitrile co-solvent enhances the solubility of hydrophobic alkene substrates in the water-rich phase. However, the use of an organic solvent can lead to an increase in the ohmic resistance throughout the electrolyte (FIGS. 9A-9D). The use of water alone as the solvent for the electrolyte, without an organic co-solvent, would be ideal as water is required as a reactant and able to effectively solvate electrolyte ions, minimizing the ohmic resistance of the overall electrolyte. For gaseous substrates that are sparingly soluble in water, like propylene, a porous electrode, for example, gas-diffusion electrodes (GDEs) were utilized to reduce the distance that reactant gases must diffuse through the electrolyte to reach the catalyst, and therefore aqueous electrolytes were sufficient for epoxide production. Indeed, the $PdPtO_x/C$ catalyst showed about 60% FE toward propylene epoxidation at 1.65 V vs. SHE in a sodium phosphate aqueous electrolyte when incorporated into a carbon-paper GDE with Nafion binder (FIG. 1E and FIGS. 9A-9D). Adding the ionomer onto the electrode helped to achieve epoxidation performance commensurate with water-acetonitrile electrolytes, as the hydrophobic backbone of the ionomer generates partially wetted channels that are effective for transport of the reactant gases to the catalyst.

Figure 23:
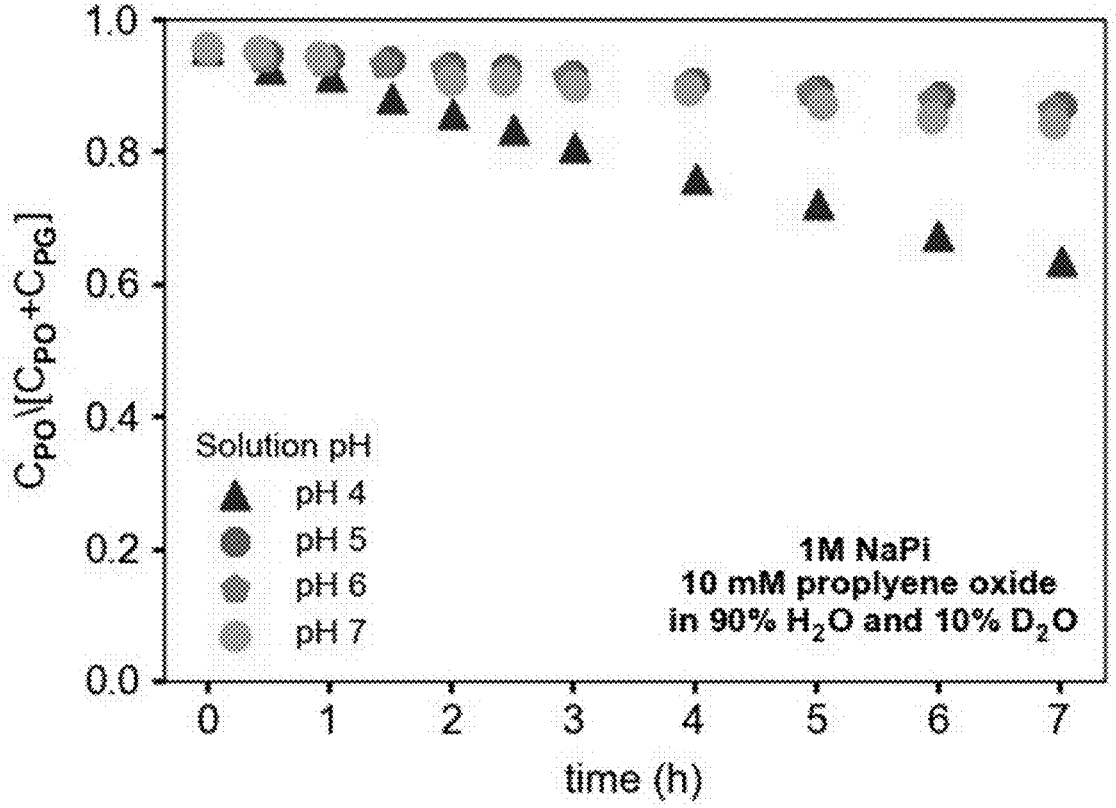
FIG. 23: Conversion of propylene oxide (PO) to propylene glycol (PG) in aqueous electrolytes with varying pHs. PO consumption and PG formation were monitored and quantified by $^1$H-NMR.
Figure 24:
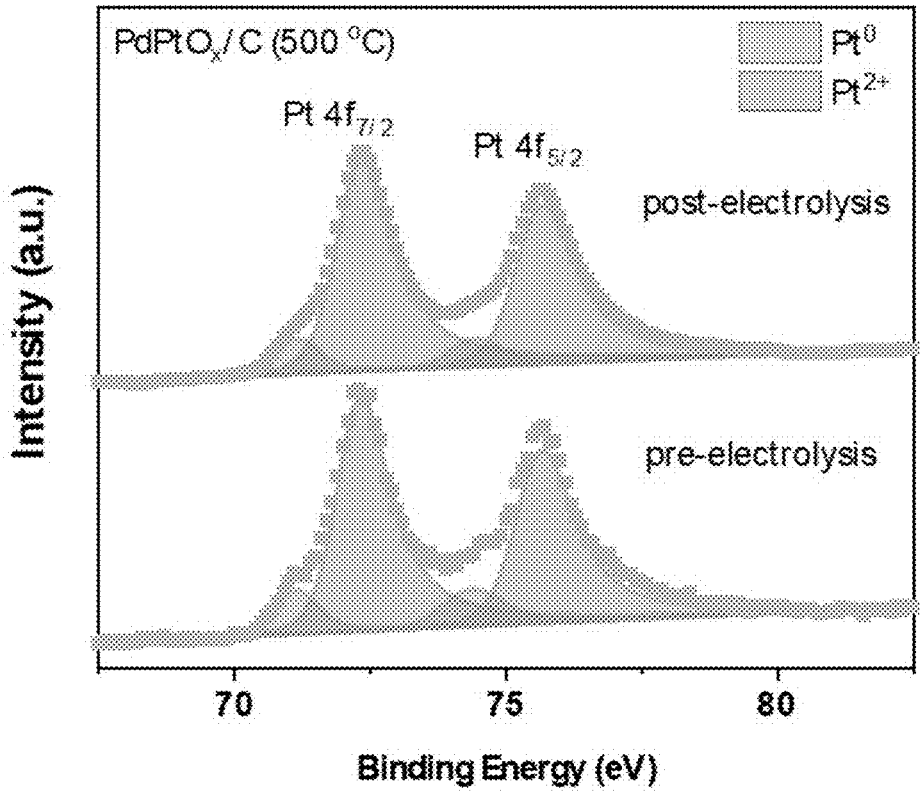
FIG. 24: High-resolution Pt 4f XPS spectra of $PdPtO_x/C$ sample before and after electrolysis.

The microenvironment of electrolytes also affects the conversion of epoxides into glycols. A noticeable amount of propylene glycol (PG) was observed in the aqueous propylene epoxidation (about 10% FE), higher than observed in the blended water-acetonitrile electrolyte. Furthermore, using 0.1 M $HClO_4$ or a substantially acidic electrolyte results in increased PG formation, (Table 1). As epoxides are known to undergo acid-catalyzed hydrolysis to afford glycols, it is important to find a pH regime where hydrolysis is minimized to ensure high selectivity toward the product of interest in aqueous electrolytes. The reaction rates of PO to PG in aqueous electrolytes with pH 4 to 7 were measured using $^1$H-NMR; the hydrolysis of PO to generate PG was found to be significantly faster in the pH 4 buffer solution with almost 40% consumption of PO after 7 hours whereas the hydrolysis in less acidic solutions, at pH 5-7, was largely suppressed with less than around 10% PO to PG conversion (FIG. 23). Thus, maintaining a near-neutral pH in the aqueous electrolyte is essential to optimize PO production.

The practical industrial operation of this system may be carried out with the use of a membrane-electrode assembly (MEA), resembling a water electrolyzer with humidified propylene gas fed to the anode. The MEA is advantageous for minimizing ohmic loss and separating PO from liquid electrolytes. Based on our analysis with respect to the influence of pH on the PO hydrolysis rate suggests that minimizing the interfacial pH gradient at the anode is an important parameter for maximizing PO production over PG in MEAs operated at high current densities.

As long as the issues of mass-transport limitation and hydrolysis of PO are addressed, mechanistic insights on propylene epoxidation obtained in water-acetonitrile electrolyte may be extended to aqueous systems. The investigation on water activity in water-acetonitrile electrolyte suggests that aqueous electrolyte may be viewed as an extreme case of the water-acetonitrile electrolyte with the water mole ratio approaching unity. In the water-acetonitrile electrolyte system, positive deviation from Raoult's law (FIGS. 22A-22B) indicates that the water in this electrolyte prefers self-interactions over mixing, meaning that the activity coefficient of water in this case is greater than unity ($\gamma_{water}>1$), and that it approaches unity with increasing water concentration. The comparison between the rate order with respect to water activity and water concentration provides information about the activity coefficient of the transition state ($\gamma\ddagger$) as well (See Example 2C for more details). At lower water concentrations (1-5 M), the propylene epoxidation rate showed about $4^{th}$ order dependence on water activity while about $2^{nd}$ order dependence on water mole ratio was observed. The $2^{nd}$ order dependence is consistent with our hypothesis that the predominant rate determining step leading to the formation of OOH* involves a first water molecule that is a reactant and a second water molecule that is a proton acceptor. The abnormally high apparent $4^{th}$ order dependence on water activity suggests that the stabilization of the transition state may be achieved by augmenting the water content. However, about $2^{nd}$ order dependences in both water activity and concentration were observed at higher water concentrations (5-12 M). This can be rationalized if $\gamma\ddagger$ scales with $\gamma_{water}$ at low water concentrations but remains relatively unchanged at higher water concentrations. This hypothesis aligns with our chemical intuition: once a sufficient quantity of water is present around the transition state, adding more water does not significantly alter the near-transition-state chemical environment. Therefore, once the water concentration exceeds 5 M in acetonitrile, the chemical environment at the active site should be akin to that of an aqueous electrolyte. In this case, the transition from water-acetonitrile electrolyte to aqueous electrolyte is a simple extrapolation of water mole ratio to one, without a discontinuous change in the solvent properties. This interpretation is supported by the measured reaction rates in aqueous electrolytes that is consistent with the predictions from the mechanistic model derived from kinetic studies in water-acetonitrile electrolytes (FIGS. 17A-17D).

Collectively, the results from multiple orthogonal analyses provide a comprehensive understanding of the mechanism of electrochemical epoxidation on $PdPtO_x/C$. Our findings are consistent with a mechanistic hypothesis that OO* is the key species involved in the electrophilic epoxidation of propylene. The PdO crystal structure embedding Pt(II) species was found to be effective for catalyzing direct anodic epoxidation, suggesting that other materials with similar structures and stronger inductive effects on Pt may also produce effective catalysts by promoting more electrophilic epoxidation pathways. Additionally, we discovered through fundamental kinetic analysis that the identity of reactive oxygen species may vary between catalysts. For instance, the proposed reactive oxygen species for epoxidation on $PdPtO_x/C$ and $MnO_x$-based catalysts are OO* and O*, respectively. Developing species that stabilize OO* may enhance epoxidation on noble metals while avoiding oxygen evolution. Our work contributes toward advancing the sustainable synthesis of epoxides, which currently have significant energy and environmental footprints. The molecular-level understanding of direct anodic epoxidation obtained from this study may have implications to other electrocatalytic oxygen-atom transfer reactions driven by reactive water oxidation intermediates.

Example 2C: Investigation on Water Activity in Water-Acetonitrile Electrolyte and the Dependence of Epoxidation Rate on Water Activity At lower water concentrations (1-5 M), the observed dependence of propylene epoxidation rates on water activity exhibited about $4^{th}$ order behavior, which decreased to about $2^{nd}$ order at higher water concentrations (5-12 M; fig. S12). The $4^{th}$ order dependence on water activity at lower water concentrations may be attributed to disparate non-ideal behaviors of the transition state and reactant molecules. From a qualitative perspective, the stabilization of the transition state in kinetically relevant steps involving water may be achieved by augmenting the system's water content. In the water-acetonitrile electrolyte system, positive deviation from Raoult's law is observed, indicating the species engage in self-interactions that are more favorable than interactions with the other component of the mixture. $4^{th}$-order dependence in water activity with $2^{nd}$-order dependence in water concentration suggests a more prominent positive deviation from Raoult's law for the transition state ($\gamma\ddagger > \gamma_{water} > 1$). This trend indicates that the transition state has less favorable interaction with its solvating environment compared to water.

To demonstrate this mathematically, we could assume that a $\eta_2$—O* is the dominant species, with the epoxidation rate greatly exceeding OER. This is an extreme version of our proposed mechanism (FIG. 4D; case 2d in the Example 2A). Under such extreme circumstances, the rate expression is simplified to $$r = k_4 \frac{\gamma_{O_{1/2}}^2}{\gamma_4^{\ddagger}} \gamma_w^2 x_w^2.$$

The observed rate dependence can be logically explained if $\gamma\ddagger$ is proportional to the square of $\gamma_{water}$. If we consider $\gamma_{O1/2}$ as a constant given that $\eta_2$—O* is less influenced by solvation compared to water and the transition state, the rate equation simplifies to $$r = k_4 \frac{\gamma_{O_{1/2}}^2}{\gamma_4^{\ddagger}} \gamma_w^2 x_w^2 = k_4 x_w^2 = k_4 \frac{1}{\gamma_w^2} a_w^2.$$

Here, plotting the rate against activity will give higher apparent order dependence than actual since $\gamma_{water}$ decreases (closer to 1) as water activity increases (gets closer to pure water).

In contrast, the 5-12 M region shows ~$2^{nd}$ order dependences on water activity as well as on water concentration. This can be rationalized if $\gamma\ddagger$ remains relatively unchanged at higher water concentrations. This hypothesis aligns with our chemical intuition: once a sufficient quantity of water is present around the transition state, adding more water does not significantly alter the near-transition-state chemical environment, which makes the $\gamma\ddagger$ relatively constant after reaching a certain water concentration. Therefore, it is reasonable to think of aqueous electrolyte as an extreme case of water-acetonitrile blended electrolyte where water mole ratio approaches one.

Materials and Methods

Materials

Catalyst preparation: Palladium(II) chloride ($PdCl_2$, Sigma Aldrich), chloroplatinic acid hexahydrate ($H_2PtCl_6 \cdot 6H_2O$, Sigma Aldrich), sodium citrate dihydrate (Sigma Aldrich), Vulcan XC-72R (Fuel cell store, SKU: 590106-1), sodium borohydride ($NaBH_4$, Sigma Aldrich), hydrochloric acid (HCl, ACS reagent, 37%, Sigma Aldrich), ethanol (Anhydrous, KOPTEC USP), 5% Nafion 117 solution (Sigma Aldrich) were purchased and used without additional treatment.

Electrochemical Study:

Electrolyte/Calibration/Reference Material/Quantification

Tetrabutylammonium tetrafluoroborate ($TBABF_4$, 98+%, TCI America), acetonitrile (ACN, anhydrous, 99.8+%, Alfa Aesar), cis-cyclooctene oxide (99%, Sigma Aldrich), cyclooctanone (98%, Sigma Aldrich), 1,3,5-trimethoxybenzene (TMB, 99%, Sigma Aldrich), maleic acid (99%, Oakwood Chemical), deuterated chloroform ($CDCl_3$, 99.8 atom % D, Sigma Aldrich), deuterated acetonitrile ($CD_3CN$, 99 atom % D, Oakwood Chemical), deuterium oxide ($D_2O$, 99.9 atom % D, Oakwood Chemical), ferrocene (Fc, 99%, Alfa Aesar), nitric acid ($HNO_3$, 70% trace metal grade, Fisher Chemical), hydrochloric acid (HCl, 36.5-38%, VWR BDH Chemicals) were purchased and used without additional treatment. Argon UHP grade 5.0 gas (Airgas, AR UHP300) was used to dilute the propylene stream for the rate-order dependence study.

Olefin Substrates

Cis-cyclooctene (cyclooctene, 95%, Alfa Aesar), cycloheptene (95%, Acros organics), 1-hexene (99+%, Sigma Aldrich), 1-octene (98%, Sigma Aldrich), cis-2-hexene (95%, Sigma Aldrich), 3,3,3-trifluoropropene (99%, Oakwood Chemical), allyl chloride (99%, Sigma Aldrich), norbornene (99%, Thermo Scientific), 2-methyl-2-butene (95+%, Sigma Aldrich), propylene (Industrial grade, Airgas), and ethylene (UHP grade 3.0, Airgas) were purchased and used without additional treatment.

X-ray absorption spectroscopy reference materials: Platinum foil (Pt, 0.025 mm thick, 99.99% trace metals basis, Beantown Chemical), platinum(IV) oxide ($PtO_2$, ≥80.0 wt % Pt, Sigma Aldrich), palladium foil (Pd, 0.1 mm thick, 99.9% trace metals basis, Beantown Chemical), palladium(II) oxide (PdO, 99.9% Pd, Strem Chemicals) were purchased and mixed with poly(ethylene glycol) (average mol wt 10000, Sigma Aldrich) and pressed into pellets for transmission-mode measurements.

Methods

Catalyst Preparation

PdPt/C Synthesis

Figure 27:
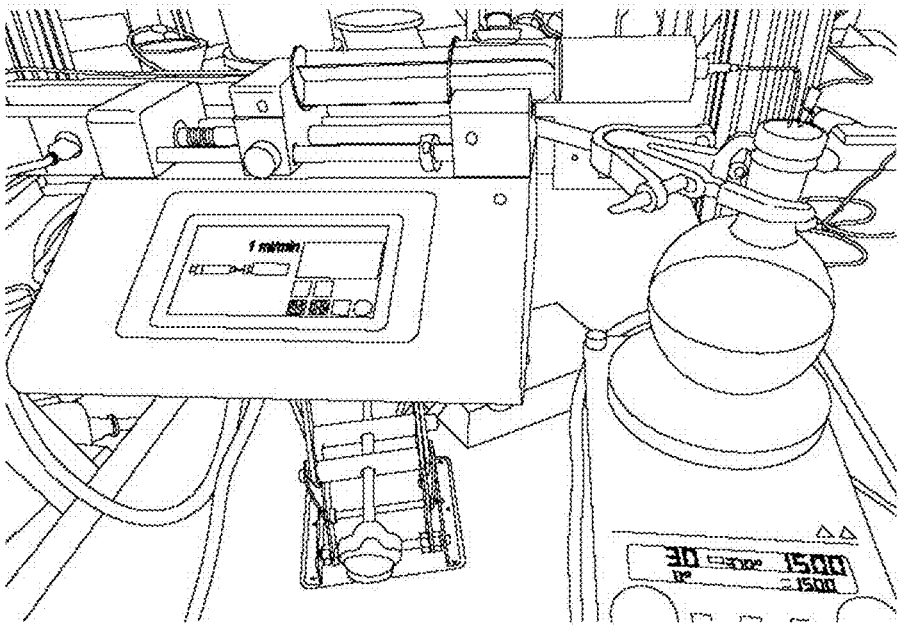
FIG. 27: A setup of a syringe pump adding NaBH4 solution to the flask.
Figure 28A:
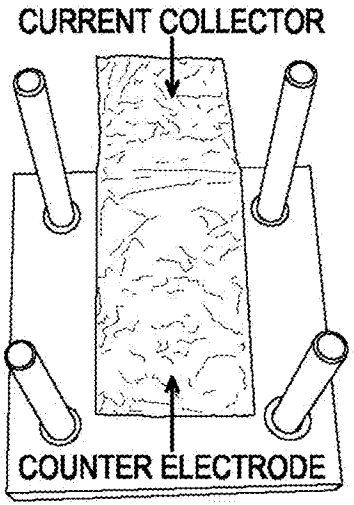
FIGS. 28A-28F: Assembly and setup of the electrochemical cell used for the kinetic rate measurements. When liquid substrates were used, a backplate was used instead of a gas chamber. For operando XAS, a backplate with a window covered with a Kapton polyimide film for the X-ray entrance was used instead.
Figure 28B:
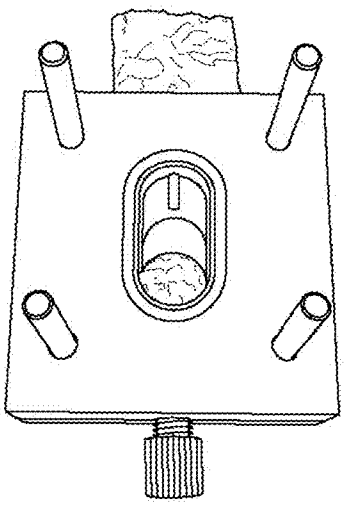
Figure 28C:
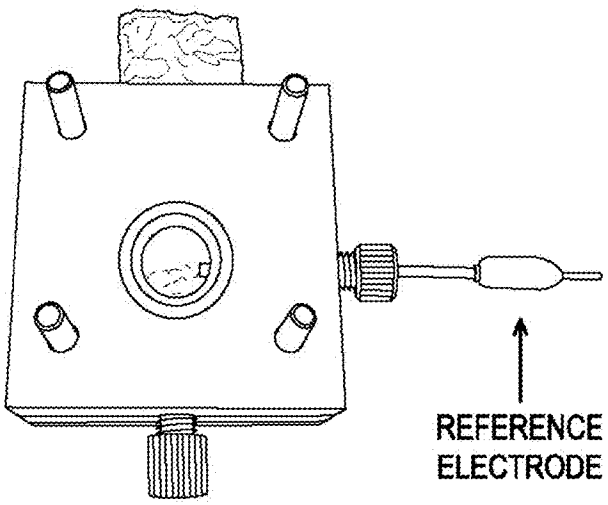
Figure 28D:
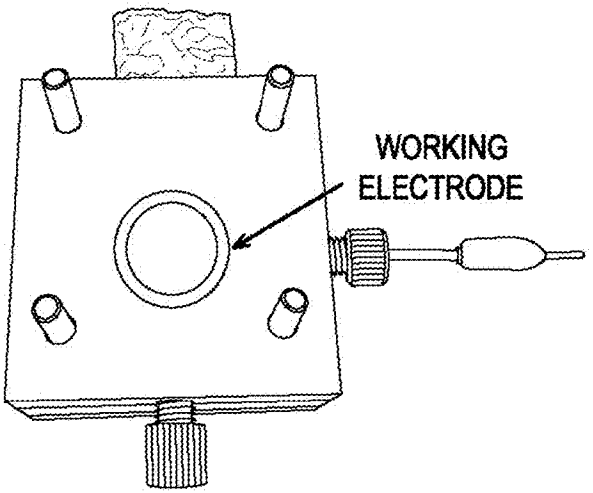
Figure 28E:
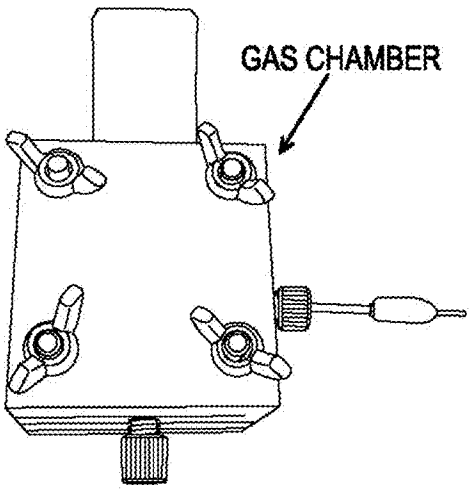
Figure 28F:
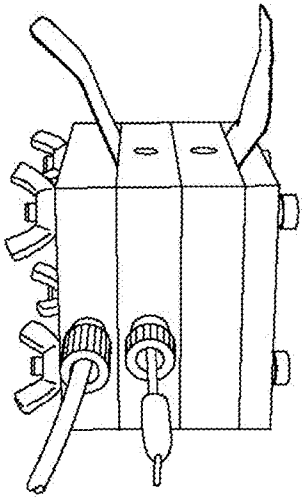

Pd precursor solution was prepared by adding 0.25 mmol $PdCl_2$ in 5 mL of 0.1 M HCl aqueous solution, and the solution was left to sit overnight to ensure $PdCl_2$ was completely dissolved. Pt precursor solution was prepared by dissolving 0.25 mmol $H_2PtCl_6 \cdot 6H_2O$ in 5 mL Milli-Q water. When precursor solutions were ready, 4 mmol sodium citrate dihydrate was dissolved into 200 ml water in a 500 mL round-bottom flask. Pd and Pt precursor solutions were added to the sodium citrate solution while it was vigorously stirred (>1000 rpm) using a magnetic stir bar (egg-shaped, 38.1 mm length×15.9 mm diameter, PTFE). Then, 113.1 mg of Vulcan XC-72R carbon black powder was added to the solution to achieve 40 wt % metal on carbon. The amount of carbon black was adjusted for making catalysts with different metal-to-carbon ratios. The flask was plugged with a rubber septum and then sonicated for 30 min. The chunks of carbon black were still observed after sonication. Then, the solution mixture was vigorously stirred at 1500 rpm, and freshly prepared 50 mL of 0.1 M $NaBH_4$ solution was added dropwise (1 mL/min) into the mixture using a syringe pump at room temperature (FIG. 27). A needle was placed on the rubber septum to avoid pressure build-up inside the flask due to the evolution of $H_2$ from $NaBH_4$. After stirring the suspension for 8 h including the $NaBH_4$ injection time, the black precipitates were vacuum-filtered with a copious amount of MilliQ water (>1 L). The filter paper with the washed precipitate cake was placed on a glass petri dish, covered with a piece of aluminum foil with holes, and dried overnight in a vacuum oven at 40 °C. The dried PdPt/C powder was collected from the filter paper and stored in a borosilicate vial until it was used to make catalyst ink. The recipe for alloys with other ratios of Pd and Pt are summarized in Table 12.

TABLE 12

Recipe for Pd—Pt alloys on carbon.

| | $PdCl_2$ (mmol) | 0.1M HCl(aq) (mL) | $H_2PtCl_6 \cdot 6H_2O$ (mmol) | MilliQ water (mL) | Vulcan XC-72R (mg) |
|---|---|---|---|---|---|
| Pd/C | 0.5 | 10 | | | 79.8 |
| $Pd_3Pt_1$/C | 0.375 | 7.5 | 0.125 | 2.5 | 96.4 |
| PdPt/C | 0.25 | 5 | 0.25 | 5 | 113.1 |
| $Pd_1Pt_3$/C | 0.125 | 2.5 | 0.375 | 7.5 | 129.7 |
| Pt/C | | | 0.5 | 10 | 146.3 |

Carbon Paper Electrode Preparation

Hydrophobic carbon paper electrodes (Toray Carbon Paper 120, 5% wet-proofed, Fuel Cell Store) were punched in 14 mm-diameter disks. When the electrode was assembled into the electrochemical cell, only 1 $cm^2$ of the electrode was exposed to the electrolyte. The punched hydrophobic electrodes were annealed in a muffle furnace with a temperature ramp rate of 5 °C/min from room temperature to 600 °C, and dwelled for 1 hour to increase the wettability of the electrodes by the catalyst ink. The electrodes were naturally cooled to room temperature after the annealing. The resulting hydrophilic carbon paper electrodes were used as a substrate for catalyst drop-casting.

Catalyst Ink and Catalyst-Fixed Electrode Preparation

A known amount of metal-on-carbon catalyst powder was dispersed in a water-ethanol solution (water:ethanol=3:1 volumetric ratio) with the help of sonication. The amount of the catalyst powder was adjusted for the desired ink concentration. 50 μL of the ink were drop-casted twice on one side of a 14 mm-diameter hydrophilic carbon paper electrode in a drying oven at 80 °C. The electrode was dried in a closed oven between each drop-casting. The total volume of drop-casted ink was always fixed to 100 μL, so the ink concentration was varied to achieve the desired catalyst loading. A typical concentration of the catalyst ink was 10 mg powder/mL (4 mg metal/mL).

The electrode was then transferred to a muffle furnace. Ramp rates for a furnace were set to be 10 °C/min from room temperature to 400 °C or 500 °C and dwelled for 3 hours under stagnant air (kinetic studies and X-ray absorption spectroscopy: 400 °C, FIG. 1 data: 500 °C). During the annealing process, a significant amount of the carbon support was combusted, resulting in a final carbon weight percent of 10.63% and 7.54% for catalysts annealed at 400 °C and 500 °C, respectively (Table 7). The oxidized metal-on-carbon electrode was naturally cooled to room temperature in the furnace and used for electrochemical experiments. The prepared electrodes were used within one day after annealing.

For electrodes used in aqueous electrolytes, 50 μL of 2 wt % Nafion solution was drop-casted onto an electrode after annealing. Subsequently, the electrode was dried in an oven at 80 °C for 3 hours. The 2 wt % Nafion solution was formulated by diluting a purchased commercial 5 wt % Nafion solution with water.

Catalyst Characterization

ICP-OES Analysis

Pd and Pt loadings in the $PdPtO_x$/C catalysts were determined using an inductively coupled plasma-optical emission spectrometer (ICP-OES; Agilent 5100 VDV) coupled with ICP Expert software. A few milligrams of the powder catalyst were mixed with 4 mL of 70% $HNO_3$ added to 1 mL of 37% HCl (inverted acid ratio of aqua regia formula) and digested overnight. The sample was then diluted into a 2% $HNO_3$ solution and filtered with a 0.22 μm polypropylene syringe filter (ThermoFisher Scientific, CH2213-PP). Pd(1000 ppm, 5% v/v $HNO_3$(aq), RICCA Chemical Company) and Pt (1000 ppm, 5% v/v $HNO_3$(aq), Inorganic Ventures) standards were also diluted into 2% $HNO_3$ solution to make the final concentrations of 0-100 ppm. Pd and Pt concentrations in the samples were quantified using the calibration curves generated from the standards.

X-Ray Photoelectron Spectroscopy (XPS)

The electrodes were cut into small pieces and affixed to an XPS sample holder using conductive Cu tape. For the post-electrolysis samples, the electrodes were rinsed with acetonitrile several times and dried under ambient air overnight before attaching them to the tape. Then, the holder with samples was transferred to the XPS sample introduction chamber. XPS spectra were collected using a Physical Electronics Versaprobe II X-ray Photoelectron Spectrometer and the data were analyzed with Casa XPS software.

Powder X-Ray Diffraction (XRD) Analysis

The X-ray diffraction patterns of the synthesized catalysts were obtained using an X-ray powder diffractometer (PANalytical X'Pert PRO) with Cu Kα radiation (λ=1.54056 Å). For the powder XRD analysis, the synthesized catalysts were annealed in powder form in a ceramic bowl using the same annealing method employed for electrodes. The crystallite sizes (L) were determined using Scherrer equation:

$$L = \frac{K\lambda}{B\cos\theta}.$$

Scherrer constant (K) of 0.94, full-width-at-half-maximum (B) determined by fitting the diffraction pattern peaks to Gaussian function and subtracting instrumental broadening, λ=1.54056 Å for Cu Kα radiation, and Bragg angle (θ) were used for the analysis. L was determined for each peak and the average and standard deviation of multiple peaks were reported (Table 3).

X-Ray Absorption Spectroscopy (XAS)

Operando XAS spectra at Pd K-edge and Pt $L_3$-edge were collected in X-ray fluorescence mode at beamline 7-BM and 8-ID of the National Synchrotron Light Source II. The same set of electrochemical cells used for the kinetic studies was used, except for a backplate with a window for the X-ray entrance. A Kapton polyimide film was placed between the window and electrode to prevent electrolyte leakage. Electrode samples were prepared on-site and used within one day after annealing. All XAS data were processed using the Athena software for background removal and normalization. The EXAFS data were further modeled and analyzed using the Artemis software. The amplitude reduction factor ($S_0^2$) for each metal edge was determined by fitting the reference material with known coordination numbers (Table 4). The $S_0^2$ values were used in other simulations to estimate the coordination numbers of the samples.

TEM Analysis

High-resolution elemental mapping of Pd—Pt alloy catalysts was obtained using energy-dispersive X-ray spectroscopy (FIGS. 7 and 8) with an aberration-corrected scanning transmission electron microscope (Titan Themis Z G3 Cs-corrected S/TEM, Thermo Fisher Scientific). To prepare the samples, catalyst particles on carbon paper electrodes were scraped off using a plastic spatula and then dispersed in ethanol via sonication. The resulting solution was sufficiently diluted such that there was no noticeable color in the ethanol solution. For analysis, 13 μL of this diluted solution was drop-casted onto a carbon film-supported copper grid. The sample was then dried in an oven set at 80 °C overnight.

Electrochemical Methods

Electrochemical Cell Setup and Electrolysis Methods

Electrochemical experiments were conducted with a sandwich-type electrochemical cell (FIGS. 28A-28F). Platinum foil (Pt, 0.025 mm thick, 99.99% trace metals basis, Beantown Chemical) and metal-on-carbon loaded carbon paper were used as the counter and working electrode, respectively. An Ag/AgCl electrode (LF-2, 3.4 M KCl leak-free 2.0 mm diameter, Innovative Instruments) was used as the pseudo-reference electrode, and aluminum foil or plate was used as the current collector.

Hydrophobic carbon paper was placed behind the nanoparticle-loaded carbon paper to prevent leakage of the solvent. For kinetic rate measurements and operando XAS, acetonitrile with 0.4 M $TBABF_4$ was used as the solvent with varying pressures/concentrations of propylene and water. The partial pressure of propylene was varied between 0 and 1 atm by diluting the propylene stream with argon to make the total gas flow of 10 standard cubic centimeters per minute (sccm). The electrolyte solution was pre-saturated with the gas before 3.6 mL of the solution was added to the cell for each experiment.

The electrochemical measurements were conducted with VMP3 Multi-channel potentiostat from BioLogic. The resistance value at open circuit potential (OCP) was measured by electrochemical impedance spectroscopy techniques before the start of any electrolysis, and the potentials in the following experiments were 100% IR-compensated. In most of the experiments for kinetic study, 10 coulombs were passed unless noted otherwise.

All cell parts including the counter electrode were washed with acetone and MilliQ water after every experiment and sonicated for at least 20 minutes in 10-20% nitric acid aqueous solution to remove any metal contaminants. The cell parts were washed with MilliQ water again after the sonication and dried in 80 °C oven for at least 20 minutes before use.

Reference Electrode Calibration

Figure 29:
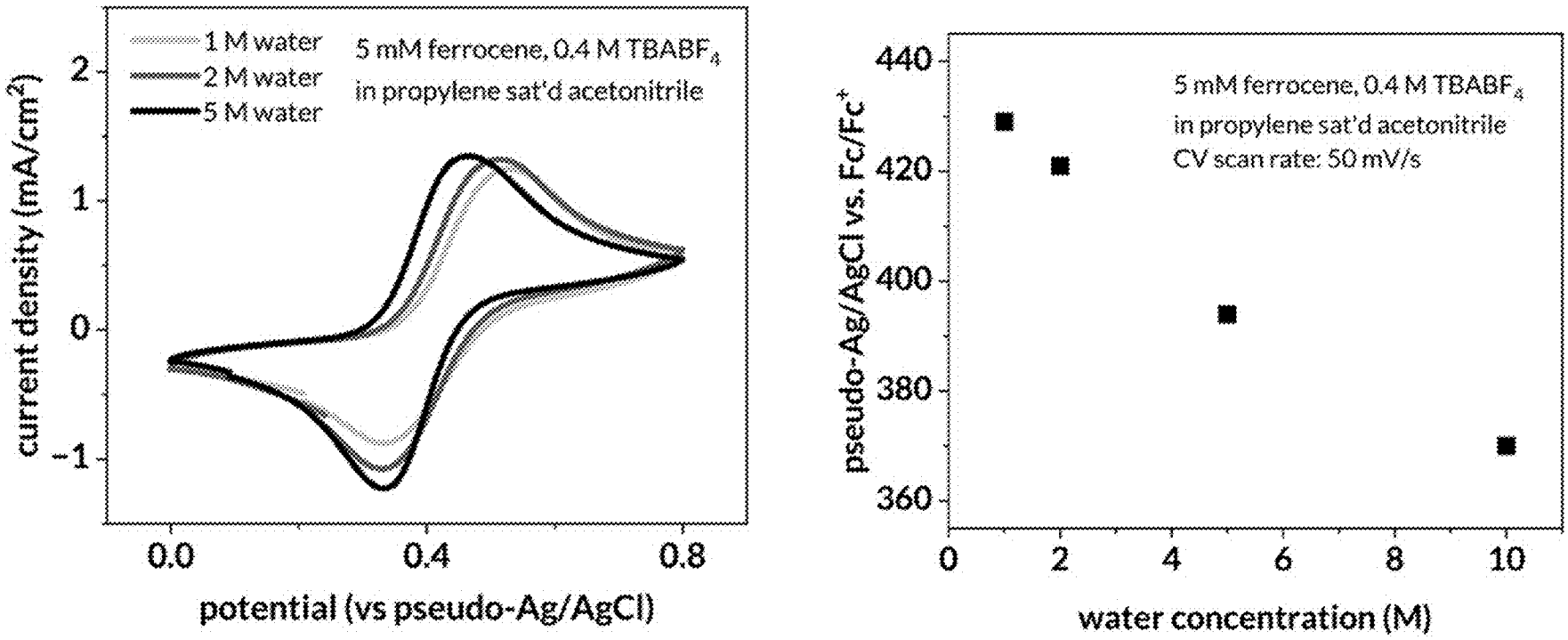
FIG. 29: Ferrocene redox calibration in water-acetonitrile electrolyte.

All of the anodic potentials reported for the water-acetonitrile electrolyte are referenced to the redox potential of ferrocene ($Fc/Fc^+$). There is no physical device that can act as a ferrocene redox reference electrode, so a leak-free Ag/AgCl pseudo-reference was used in actual experiments, and this pseudo-reference was calibrated against the redox potential of ferrocene. The redox potential was determined by averaging the potential at the cathodic and anodic peaks shown in cyclic voltammetry (CV) scans (FIG. 29). Calibration solutions were roughly 5 mM in ferrocene and reflected electrolyte conditions other than that. For the reference calibration, glassy carbon was used as the anode, and the calibrations were performed in a dedicated set of PEEK cell parts to avoid ferrocene contamination in other electrochemical experiments. The CV started from open circuit potential and swept to 0 V vs. Ag/AgCl pseudo-reference, followed by three consecutive scans from 0-0.8 V vs. Ag/AgCl pseudo-reference, and the CV ended after sweeping back to the open circuit potential. The second scan from each CV was used to determine the redox peaks. It should be noted that the pseudo-Ag/AgCl electrode is meant to be stable at Ag/AgCl potential in saturated KCl, but its actual potential showed within 50 mV of deviation when measured against rigorously maintained "master" Ag/AgCl electrode in saturated KCl.

Double-Layer Capacitance Measurement

We used double-layer capacitance (DLC) measurement to estimate the electrochemically active surface area (ECSA) across our electrodes:

$$\text{Electrochemically active surface area } \left(ECSA\left[\text{cm}^2/\text{cm}^2_{geo}\right]\right) = \frac{\text{double-layer capacitance } \left(Cd\left[\text{mF}/\text{cm}^2_{geo}\right]\right)}{\text{specific capacitance } \left(Cs\left[\text{mF}/\text{cm}^2\right]\right)}.$$

Figure 30A:
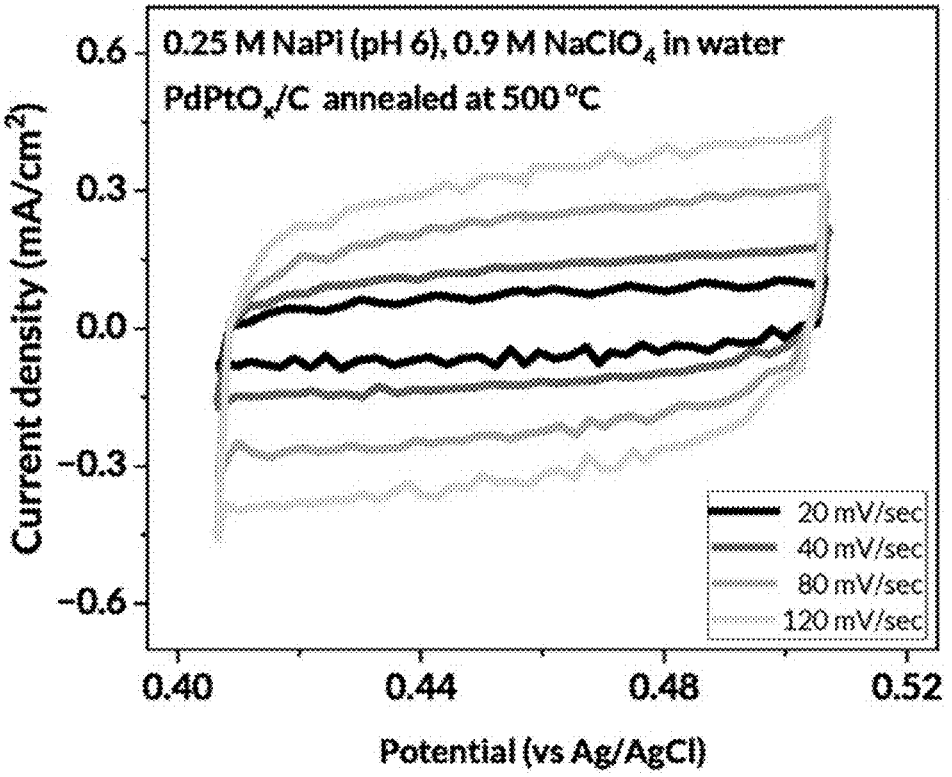
FIGS. 30A-30B: A representative double-layer capacitance measurement.
Figure 30B:
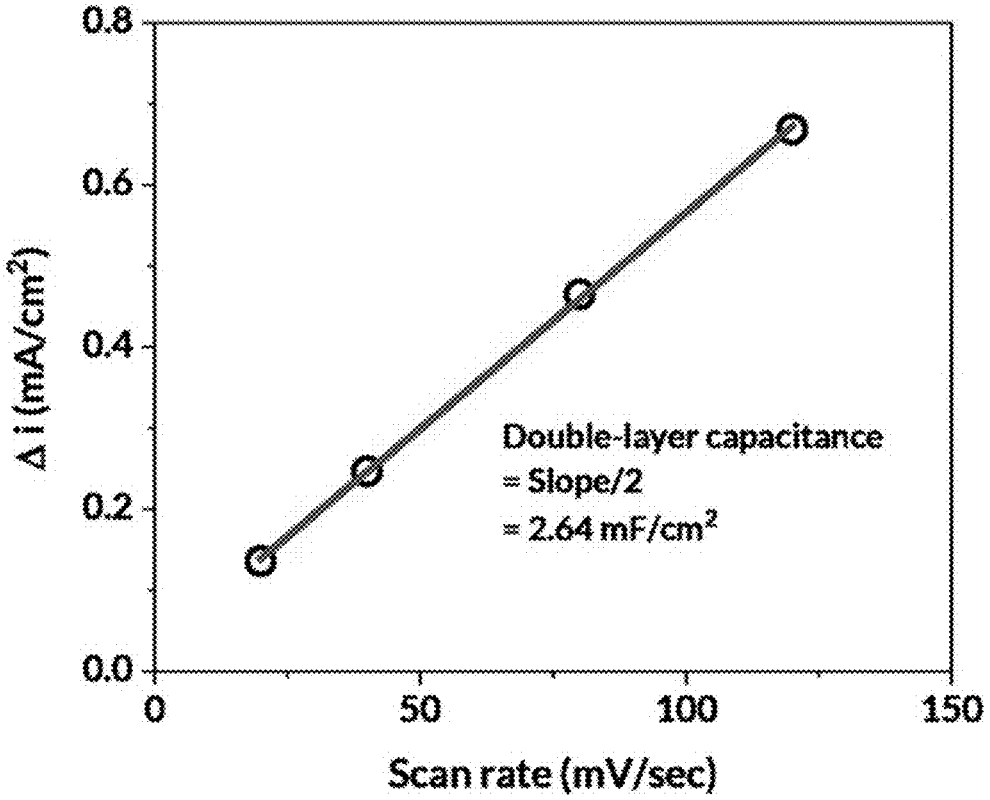
Figures 31A, 31B, 31C:
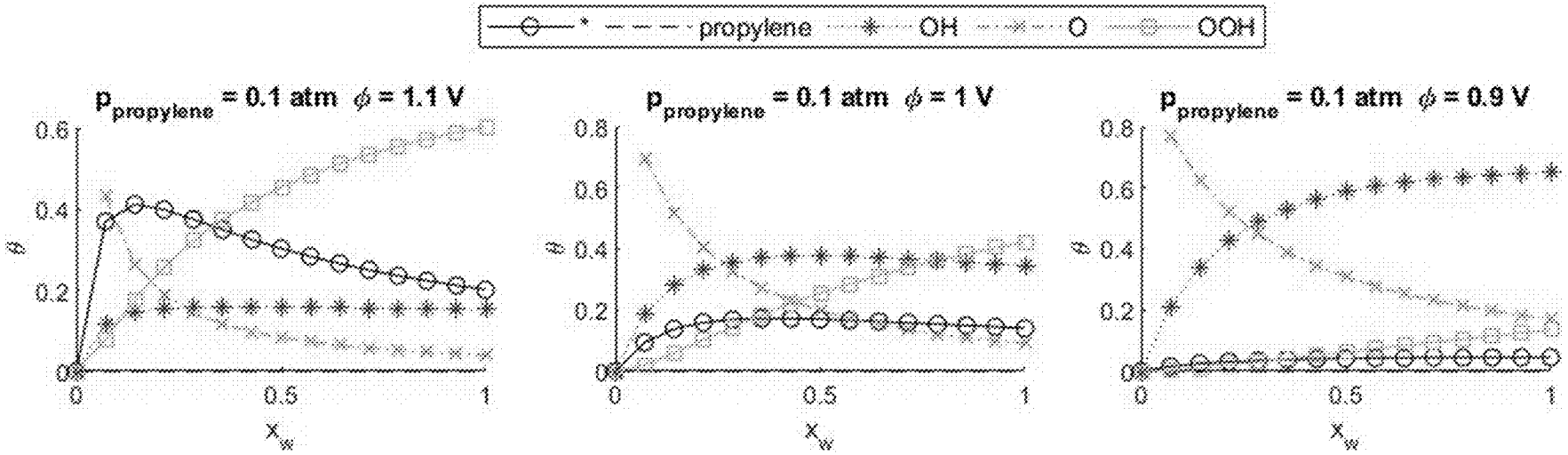
FIGS. 31A-31I: Case 1: OOH catalyzes epoxidation, single site mechanism.
Figures 31D, 31E, 31F:
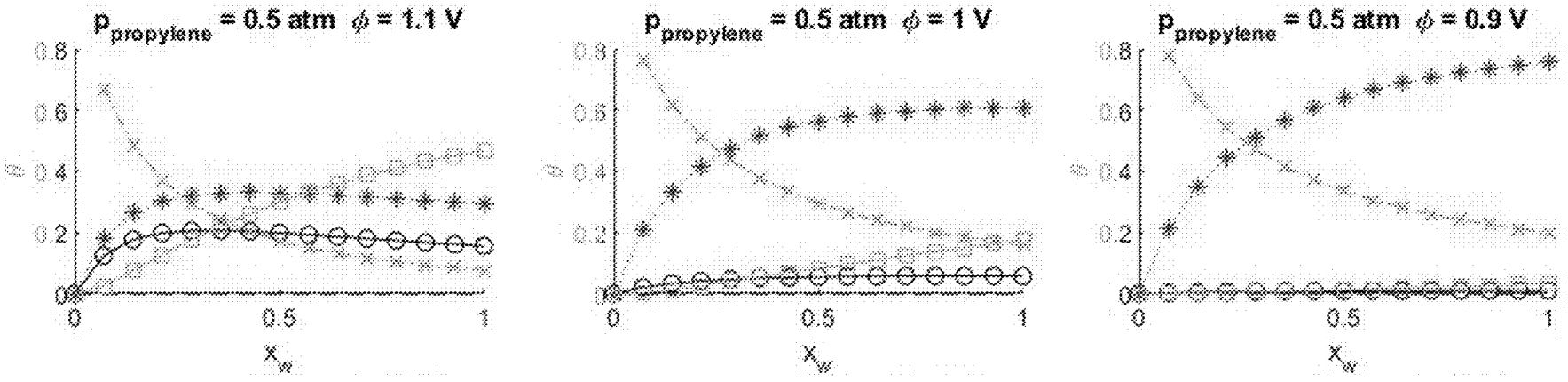
Figures 31G, 31H, 31I:
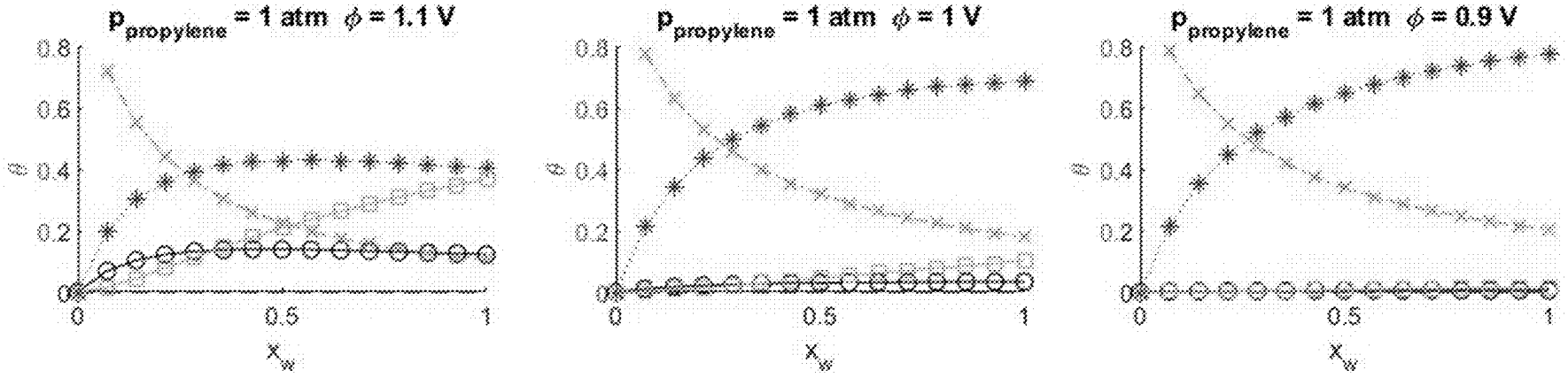
Figures 32A, 32B, 32C:
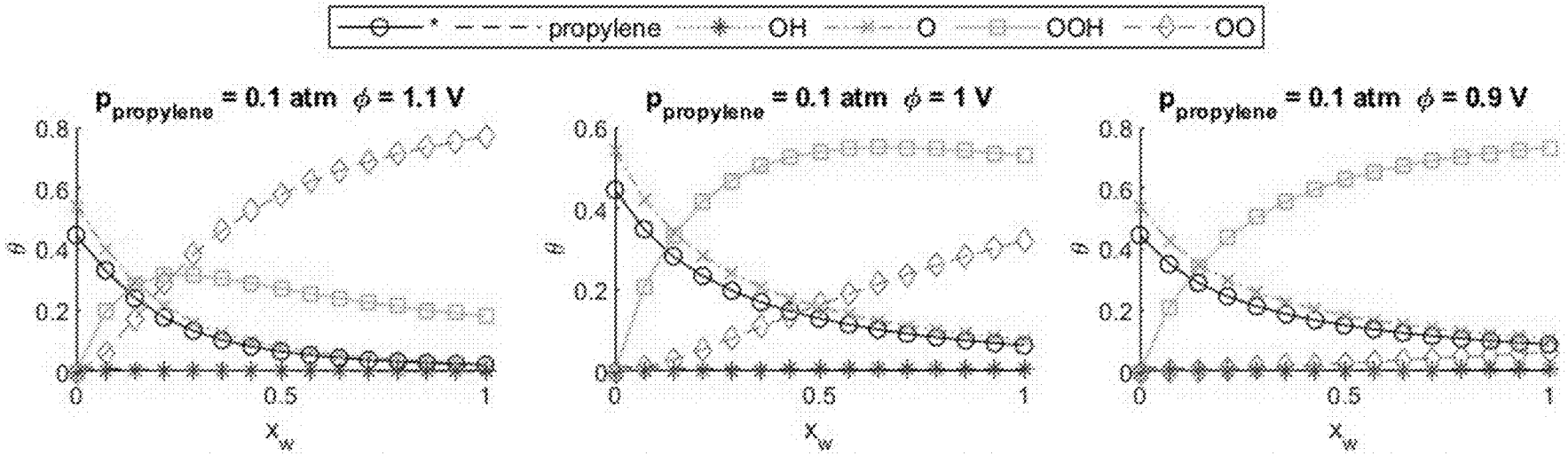
Figures 32G, 32H, 32I:
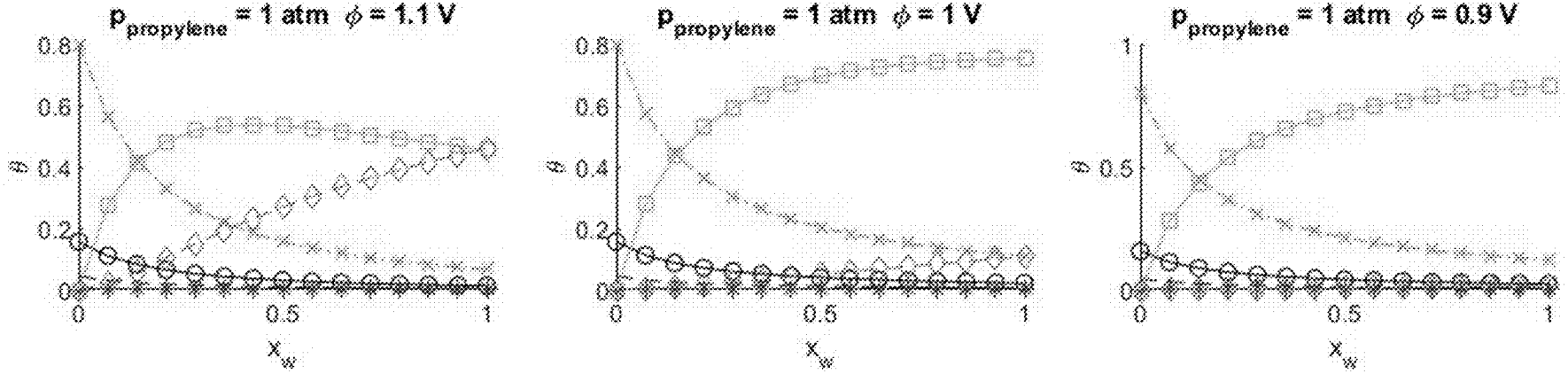
Figures 33A, 33B, 33C:
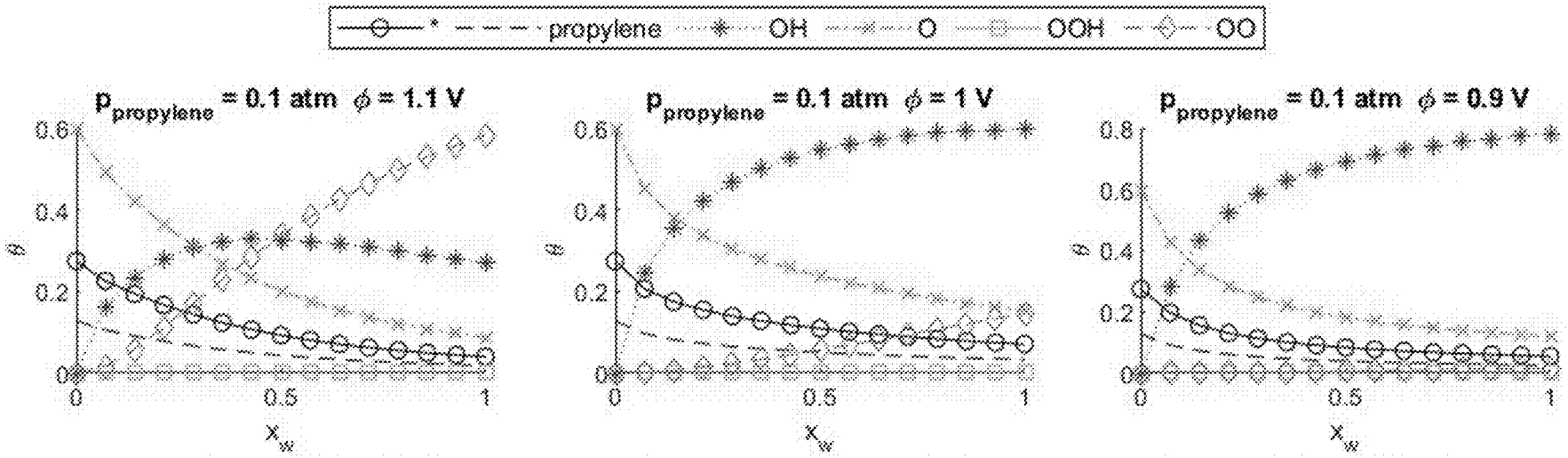
FIGS. 33A-33I: Case 2b: OO catalyzes epoxidation, OOH+O→OO+OH assumed.
Figure 33F:
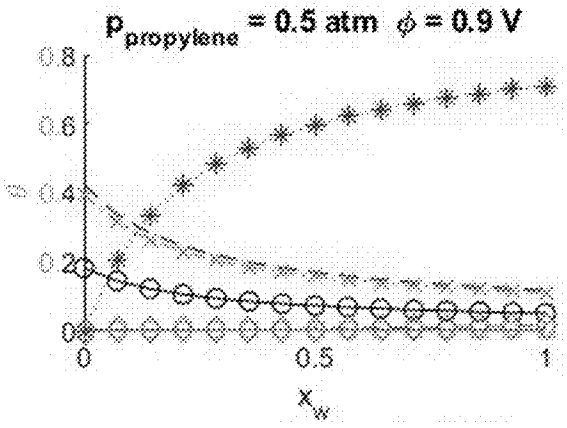
Figure 33E:
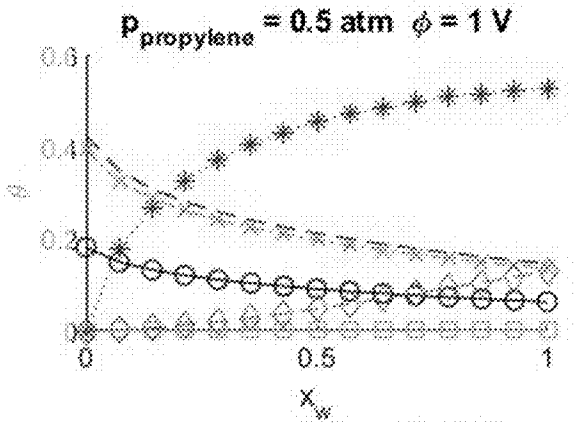
Figure 33D:
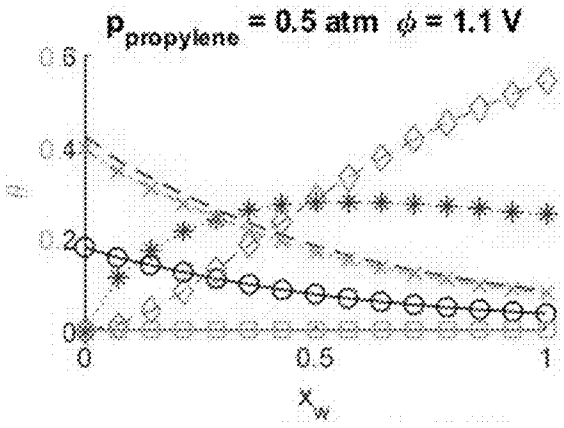
Figure 33I:
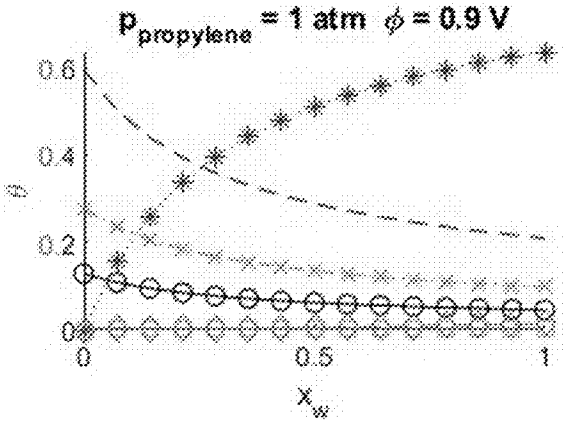
Figure 33H:
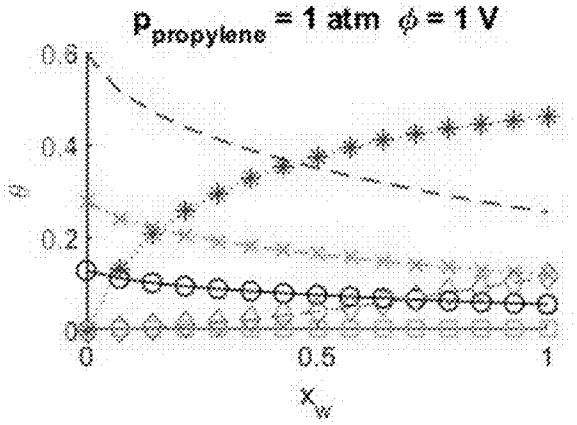
Figure 33G:
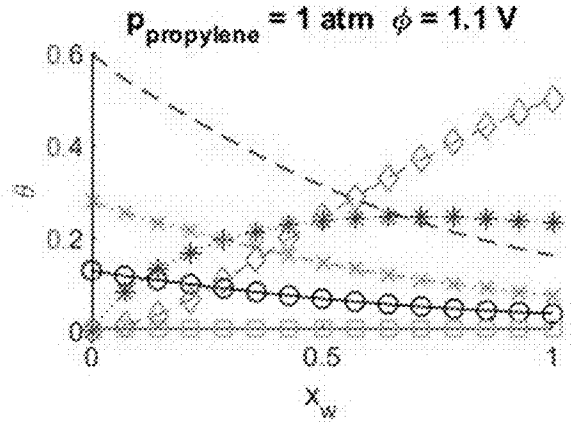
Figures 34A, 34B, 34C:
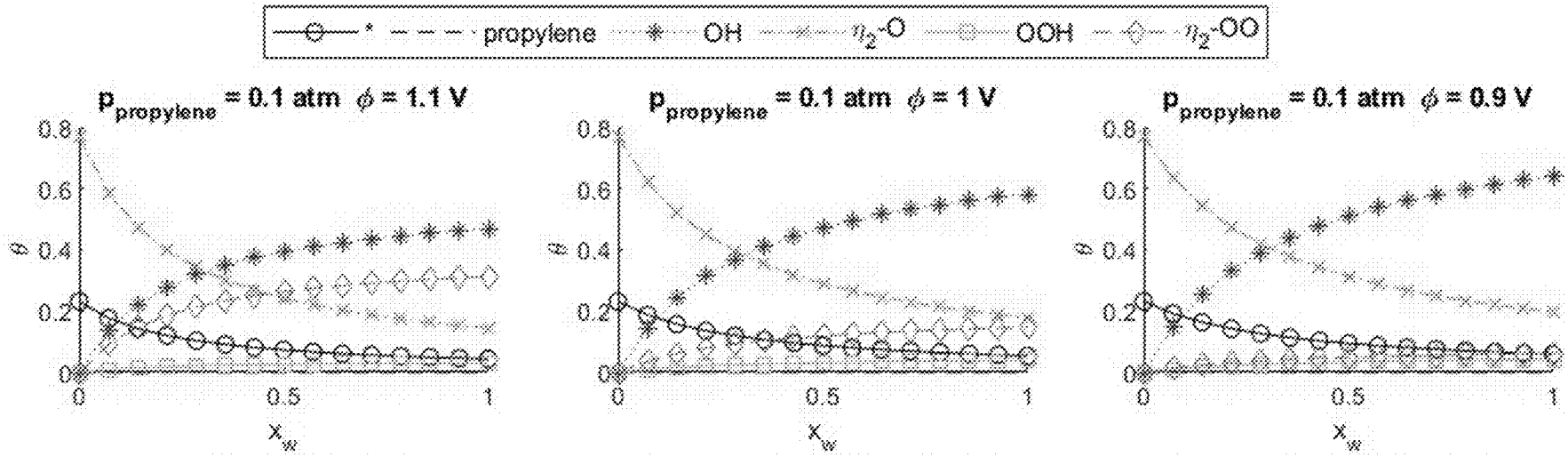
FIGS. 34A-34I: Case 2c: OO catalyzes epoxidation, $\eta_2$—O and $\eta_2$—OO intermediates.
Figures 34D, 34E, 34F:
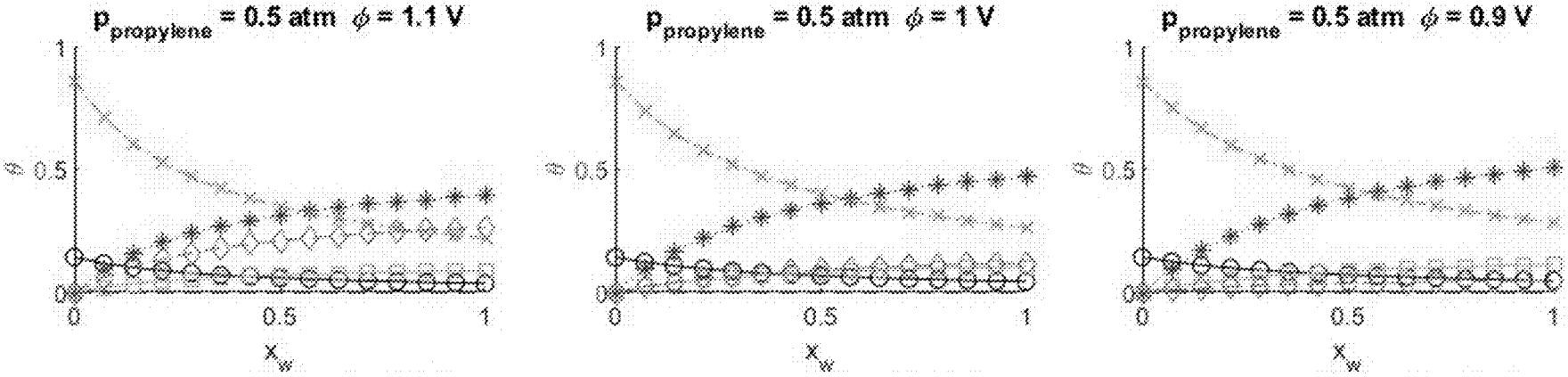
Figure 34I:
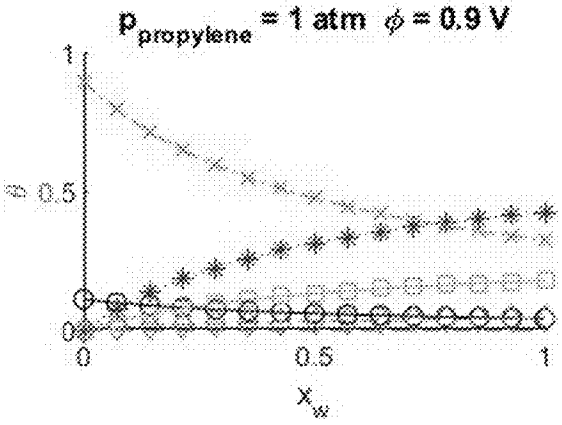
Figure 34H:
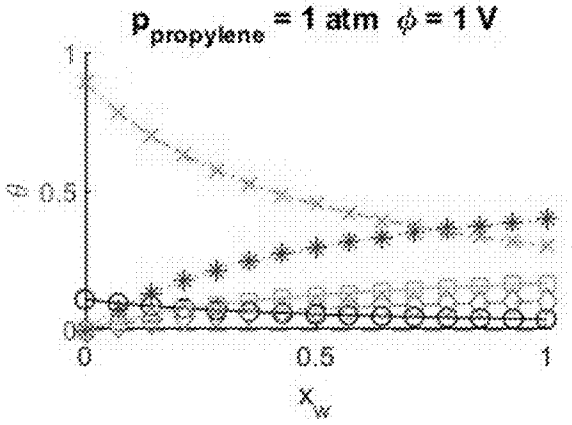
Figure 34G:
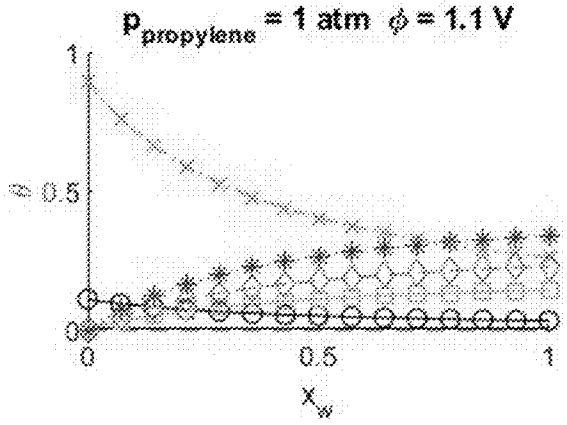
Figures 35A, 35B, 35C:
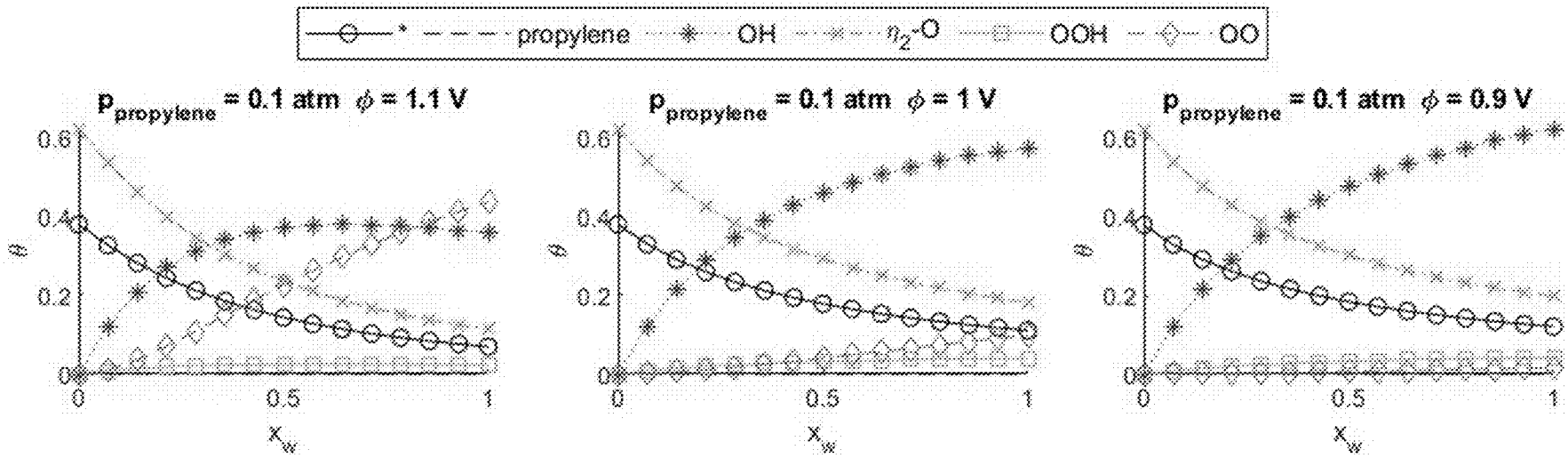
FIGS. 35A-35I: Case 2d: OO catalyzes epoxidation, $\eta_2$—O intermediate.
Figure 35F:
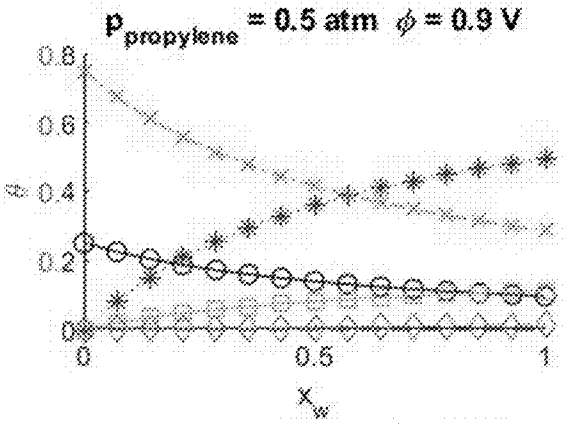
Figure 35E:
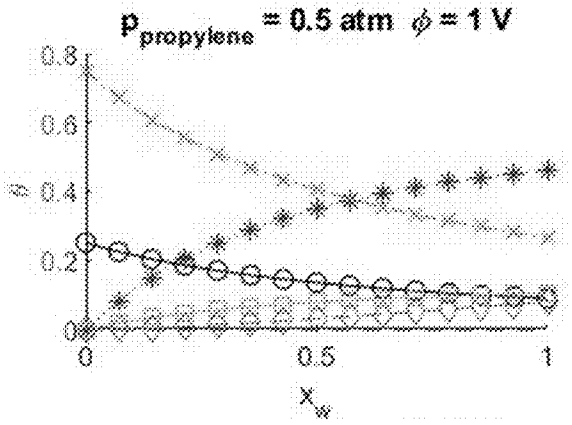
Figure 35D:
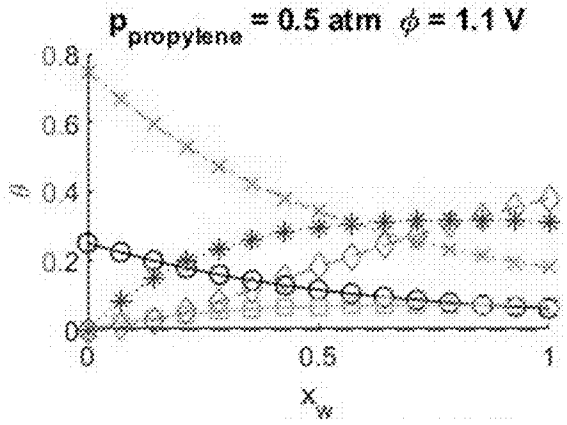
Figure 35I:
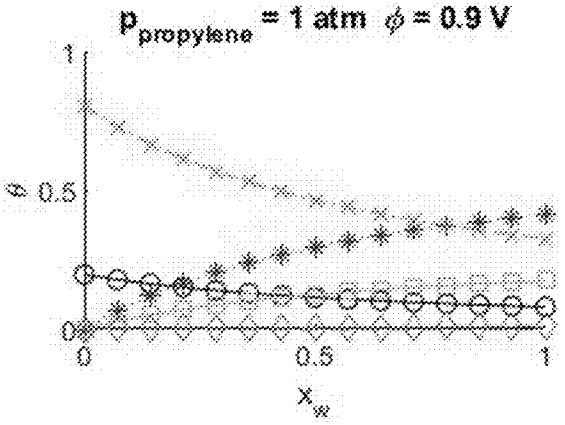
Figure 35H:
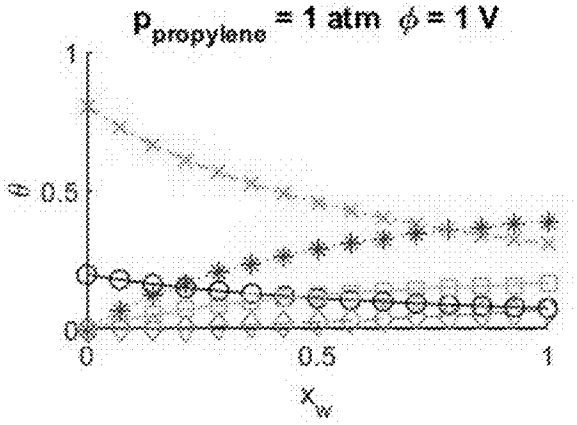
Figure 35G:
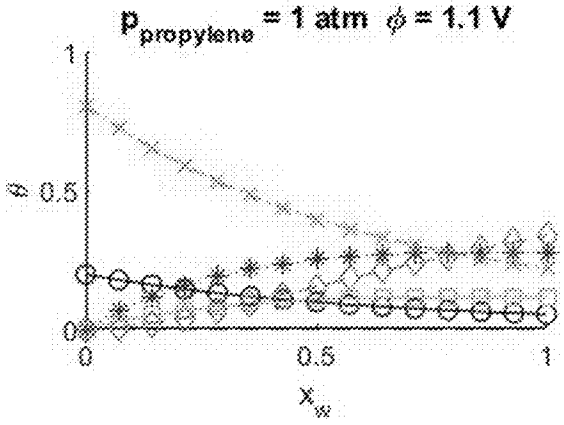
Figures 36A, 36B, 36C:
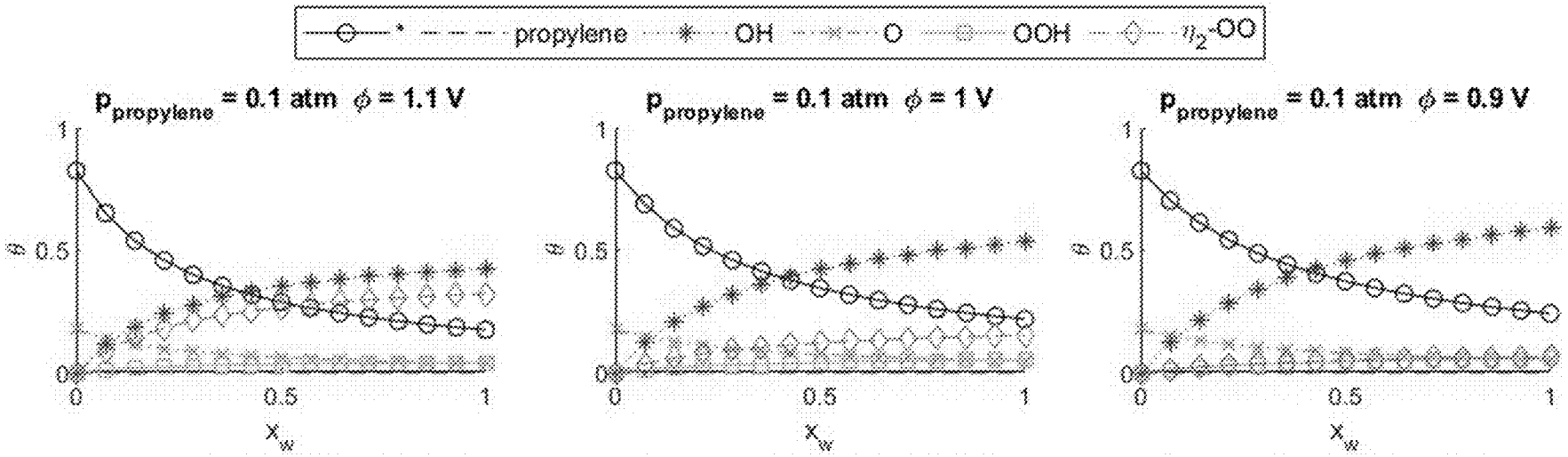
Figures 36D, 36E, 36F:
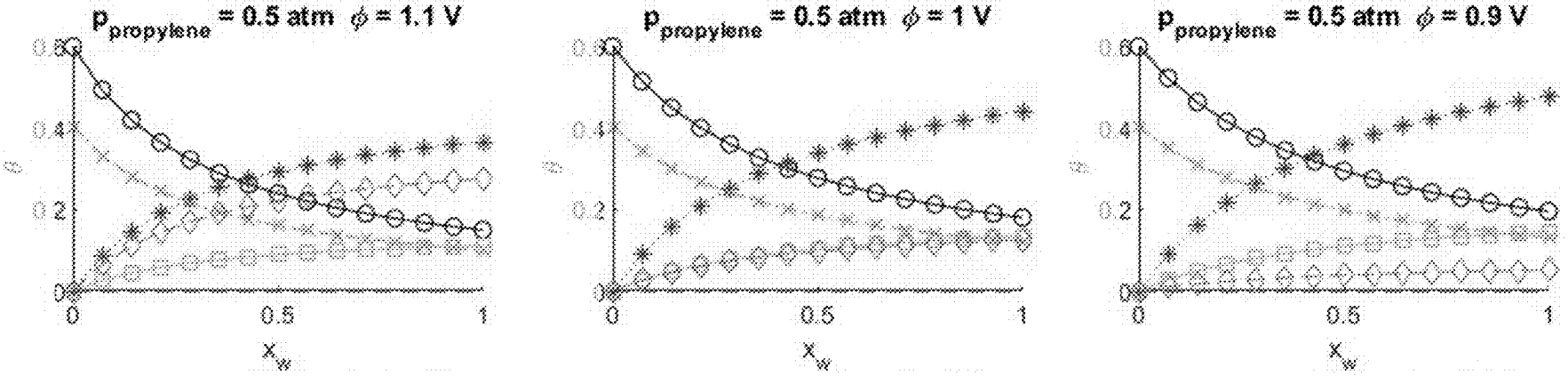
Figures 37A, 37B, 37C:
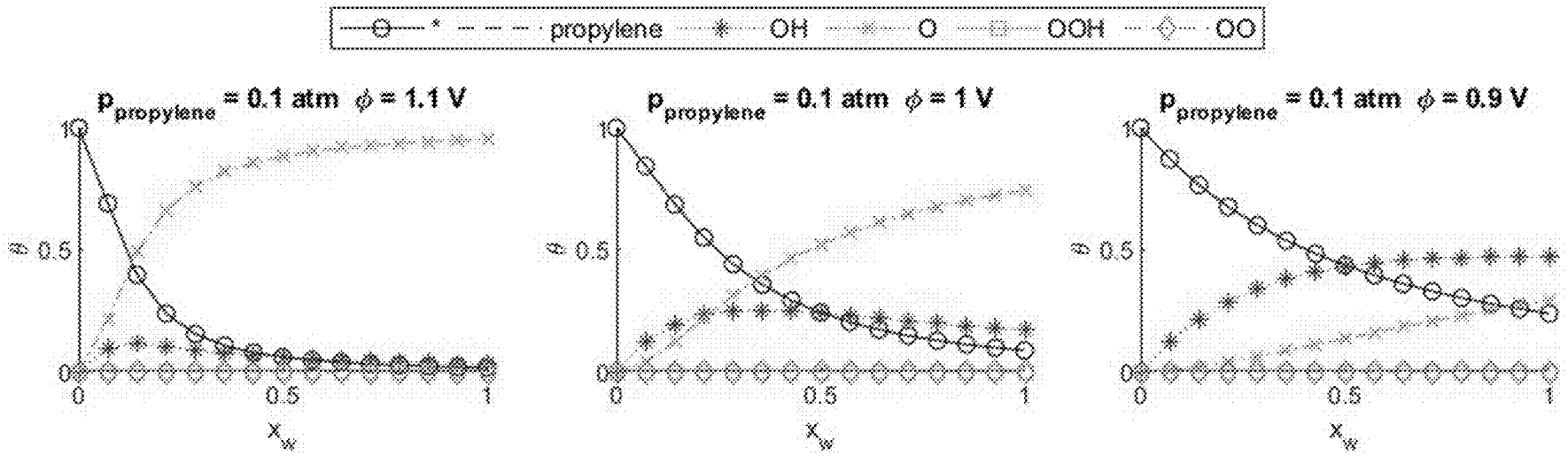
Figures 37D, 37E, 37F:
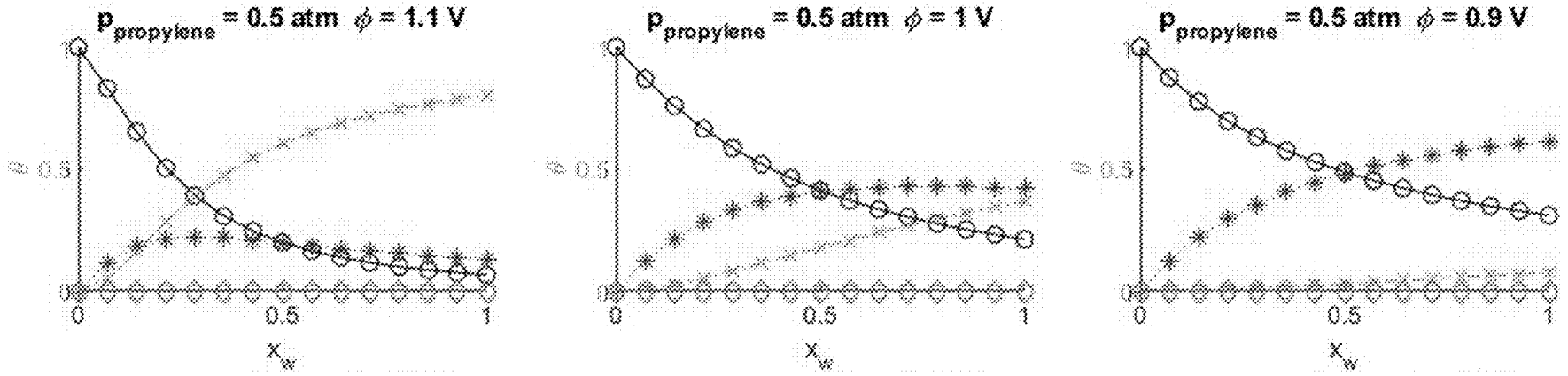
Figure 38:
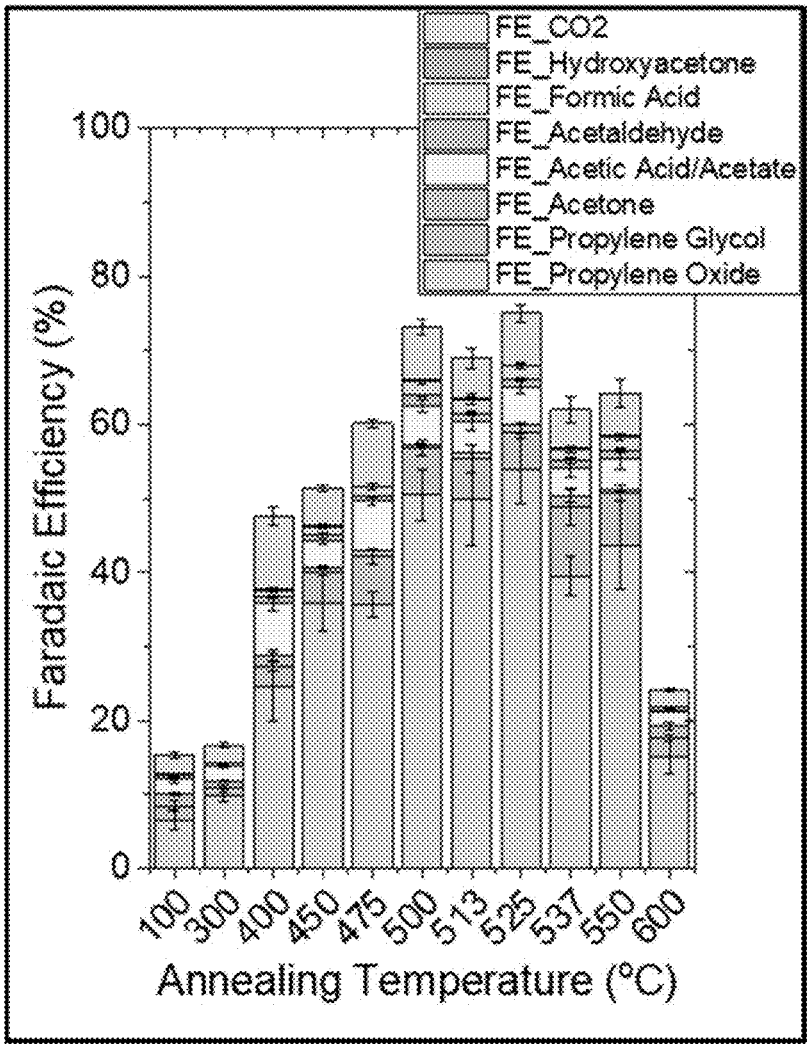
FIG. 38: Faradaic efficiency of $Pd_{0.5}Pt_{0.5}O_x$ (x ranges from 0 to 2) as a function of annealing temperature for $CO_2$, hydroxyacetone, formic acid, acetaldehyde, acetic acid, acetone, propylene glycol, and propylene oxide. Constant current density of 50 $mA/cm^2$ was applied to the 1 M sodium phosphate (pH 5) electrolyte saturated with propylene at ambient pressure.

CV scans spanning±50 mV of the OCP for each DLC measurement were recorded at scan rates of 20, 40, 80, and 120 mV/s. The resulting capacitive CV traces (FIGS. 30A-30B) were used to calculate the capacitive current, by taking the difference between anodic and cathodic currents averaged across ±10 mV of the OCP. These capacitive currents at each scan rate were plotted versus the scan rate, and the slope of the linear regression line was divided by 2 to obtain the DLC of the electrode. Since the entire surface of the carbon paper exposed to the electrolyte was covered with the catalysts, we assumed that the bare carbon paper did not contribute to the DLC. It is a common practice to assume a constant specific capacitance across various metals, which makes DLC directly correlated to ECSA. However, it is important to note that the constant specific capacitance used for converting DLC to ECSA varies across different reports, ranging from 0.01 to 0.1 $mF/cm^2$ (35,36). Therefore, we opted to present DLC values along with ECSA-normalized current densities, assuming a specific capacitance value of 0.04 $mF/cm^2$ (FIGS. 10A-10D).

Product Analysis

Reaction Workup and Quantification of Liquid Products

After the electrolysis, post-electrolysis electrolytes were collected into a 5 mL volumetric flask using a glass pipette. The collected electrolyte was often less than 3.6 mL, so about 1.8 mL of additional acetonitrile was added to the electrolyte chamber, rinsed the chamber, and then added to the post-electrolysis electrolyte in the volumetric flask until the total volume of collected electrolyte becomes 5 mL. For propylene oxide or ethylene oxide quantification, securing a product peak at $^1$H-NMR without overlapping other electrolyte peaks was possible, so an aliquot of 5 mL electrolyte solution was directly used for the NMR study. NMR samples were prepared by combining 500 μL of the electrolyte solution with 200 μL of 5 mM internal standard 1,3,5-trimethoxybenzene solution in $CD_3CN$. The 1H probe was automatically tuned, the lock was achieved on the $CD_3CN$ in the sample, and gradient shimming and auto-gain were used. Solvent suppression was done for the largest three peaks in the spectra to get a better signal-to-noise ratio for the peaks of our interest. 32 scans were collected per sample, and the relaxation delay was set to 6 seconds. Products were quantified by comparing the areas of the peaks of interest to those of the internal standard. Auto phase correction and baseline correction with the Whittaker Smoother method from the MestReNova software were performed on the spectra before the integration of each peak. If a flat baseline was not achieved by the automatic correction, a manual correction was used to get a reliable baseline for the peak integration. For aqueous electrolytes, NMR samples were prepared by combining 600 μL of the electrolyte solution with 100 μL of 10 mM internal standard maleic acid solution in $D_2O$. The $^1$H probe was automatically tuned, the lock was achieved on the $D_2O$ in the sample, and gradient shimming and auto-gain were used. Solvent suppression was done for the water peak, 16 scans were collected per sample, and the relaxation delay was set to 6 seconds.

For other epoxides including cyclooctene oxide, extraction with hexane was required to exclude $TBABF_4$ that can overlap with the products on $^1$H-NMR spectra. We sampled 3 mL out of the collected 5 mL electrolyte into a 50 mL polypropylene centrifuge tube. Then, a known amount of internal standard 1,3,5-trimethoxybenzene were added to the electrolyte. MilliQ water was filled to ~20 mL and ~5 mL of hexane was added to the electrolyte. Olefin substrate, its oxidation products, and the internal standard moved to the hexane layer after extraction with the help of centrifugation at 3000 rpm for 30 seconds. Hexane extraction was performed three more times (~20 mL of hexane was used in total), and the combined hexane solution was quantified using $^1$H-NMR. The $^1$H-NMR spectra were measured on a Bruker Avance Neo spectrometer operating at 500.34 MHz with solvent suppression of the three largest peaks from hexane. Samples were prepared by combining 50 μL of the extracted hexane layer with a 600 μL $CDCl_3$. The $^1$H probe was automatically tuned, the lock was achieved on the $CDCl^3$ in the sample, and gradient shimming and auto-gain were used. Solvent suppression was done for the largest three peaks in the spectra to get a better signal-to-noise ratio for the peaks of our interest. 32 scans were collected per sample, and relaxation delay was set to 6 seconds. Products were quantified by comparing the areas of the peaks of interest to those of the internal standard. Auto phase correction and baseline correction with Whittaker Smoother method from the MestReNova software was performed on the spectra before the integration of each peak.

Quantification of Gas Products

An on-line gas chromatograph (GC; SRI Instruments, MG #5, Model 8610C) with auto-sampling capabilities was used to quantify the gaseous anodic side products $CO_2$, $O_2$, and the cathodic reaction product $H_2$ evolved during the electrolysis. Only several representative experiments were done with on-line gas product quantification to verify closure in Faradaic efficiency. After filling the electrolyte, the electrolytic cell was closed and the gas outlet was connected to the GC. Propylene was flowed into the cell through the anode for roughly 10 minutes before the measurement to allow air to flush out of the gas lines. The GC sample was taken every 13 minutes (12.5 minutes of sequence+0.5 minutes of break). A blank sample was taken in the beginning, and then the electrolysis started after 4 minutes passed. GC sample was taken every 13 minutes (12.5 minutes of sequence+0.5 minutes of break) thereafter. The gas products were quantified by averaging data points except for the blank sample.

After a sample was collected, argon gas was used as the carrier gas and sent onto a 6' Hayesep D pre-column. After light gases pass the pre-column, we started backward flowing in the pre-column and the eluted forward flow was sent to a 6' MS-5A column. After hydrogen and oxygen are eluted from the MS-5A column, another sample was collected and injected into a 6' Hayesep D column. The eluted gas after the main columns (MS-5A, 6' Hayesep D) was analyzed with both a thermal conductivity detector (TCD) and a flame ionization detector (FID). The column temperatures were held at 90 °C throughout the measurements. The gas-phase ppm determined from GC was converted into the partial current for a given product and Faradaic efficiencies were calculated from the partial current divided by the average current.

$$\text{Partial current [mA]} = (\text{ppm}) \times \frac{\frac{\text{moles product}}{\text{total moles}}}{10^6\ \text{ppm}} \times \frac{1\ \text{total moles}}{24.5\ \text{L at RTP}} \times \frac{1\ \text{L}}{10^3\ \text{cm}^3} \times \frac{(\text{flow rate in sccm})\ \text{cm}^3}{\text{min}} \times \frac{1\ \text{min}}{60\ \text{sec}} \times \frac{n\ \text{moles}\ e^-}{1\ \text{mole product}} \times \frac{96485\ C}{1\ \text{mole}\ e^-} \times \frac{1000\ \text{mA}}{\frac{1C}{\text{sec}}}$$

Calculation of Rate, Faradaic Efficiency, and Selectivity

Faradaic efficiencies were calculated as following:

$$\text{Faradic efficiency [\%]} = \frac{\text{moles of product} \times nF}{Q}.$$

Q is the amount of passed charge, n is the number of electrons required for the production of a molecule of product, and F is Faraday's constant. n=2 for propylene oxide, propylene glycol, and acetone. n=4 for oxygen, and n=6 for $CO_2$.

The epoxidation rates in current density were calculated by multiplying the total average current density by the epoxidation Faradaic efficiency:

$$\text{partial current density} = \text{total average current density} \times \text{Faradaic efficiency}.$$

The selectivity for PO was determined by dividing the molar amount of PO by the total molar amount of products derived from propylene (PO, PG, acetone, and $CO_2$).

Experimental Measurements of Water Activity

The activity of water was experimentally measured (FIGS. 22A-22B) using previously reported headspace gas sampling protocol (37). In short, 4 mL of electrolyte samples were prepared in 20 mL headspace sampling vials. The vials were filled with propylene gas streams (0.1 to 1 v/v diluted with Ar) and the electrolyte solution was pre-saturated with the gas before the vials were sealed. The electrolyte samples in sealed vials were equilibrated at room temperature for at least 12 hours. 4 mL of pure MilliQ water was used as the reference having activity of unity. Headspace GC-TCD was then used to quantify the vapor pressure of water in the various samples. The activity of water for any given sample was simply calculated as:

$$\text{water activity} = \frac{\text{water peak area of sample}}{\text{water peak area of pure water reference}}.$$

Rate Measurements of Propylene Oxide Hydrolysis in Aqueous Electrolytes

The reaction rates of PO to PG in aqueous electrolytes with pH 4 to 7 were measured using $^1$H-NMR. The 1 M buffer solutions were prepared by dissolving the theoretically determined amounts of $Na_2HPO_4$ and $NaH_2PO_4$ in water and adjusted to the desired pH value with 1 M NaOH and 1 M $H_3PO_4$ solutions. To prepare the NMR samples for the kinetic measurement, 400 μL of the buffer solution, 50 μL of 0.1 M PO in water were combined, resulting in 10 mM of PO in each sample. An automation program was set up using IconNMR to collect NMR spectra of the samples at the specific time points—30-min increment for the first 3 hours and 1-hour increment for the rest 4 hours. Water suppression was done by excitation sculpting to generate NMR spectra with minimal residual water signal and flat baseline, ensuring the accuracy of the quantification. The consumption of PO was normalized by taking the ratio between the peak area of the protons corresponding to the methyl group in PO and the sum of peak areas of that in PO and PG.

Model fitting: Seven potential mechanistic pathways were hypothesized (See Example 2A; Case 1, 2a-e, and 3), each represented by a distinct rate equation. Inputs to the rate equation model were propylene partial pressure normalized by 1 atm, calculated water molar ratio, and applied voltage (V vs. Fc/Fc$^+$). In the model, 0 V for the applied voltage was arbitrarily set to 0.85 V vs Fc/Fc$^+$. Although any reference for 0 V could have been adopted, it is judicious to select a value relevant to the experimental voltage range (0.9-1.1 V vs. Fc/Fc$^+$) to ensure optimal numerical precision. Transfer coefficients were set to 0.5 for all of the elementary electrochemical reactions. Depending on the model, 6-8 parameters were estimated by model fitting over 74 sample data.

Potential-independent rate constants and equilibrium constants of each elementary reaction were parameterized, and the parameters were estimated using a least-squares curve fitting function (Isqcurvefit) in MATLAB R2023a. The model rate equations were fit to the experimental epoxidation current density data in mA/cm$^2$ unit, which is proportional to the epoxidation rate. Since other model inputs are unitless, the estimated rate constants for each elementary step also have units of mA/cm$^2$. Initial guesses for the parameters were chosen to ensure that the resulting final rate constants across a series of elementary reactions are within the same order of magnitudes when integrated with potential-dependent terms. Lower bounds for all parameters were set to zero.

Root-mean-square error (RMSE) was obtained from the difference between experimental and simulated data. Lower RMSE means less deviation of the simulated results from the experimental results. When different initial guesses resulted in different fitting results, the best fit corresponding to the lowest RMSE was selected and reported.

Alkene electrophilicity calculation: For each alkene, three different types of calculations were performed with different numbers of electrons, which are required to calculate the ionization potential and electron affinities. First, the N=0 (number of electrons for zero-charge and multiplicity of 1) case was considered. In this case, for each alkene, the initial starting geometry was obtained by sampling 100 conformers using the RDKit library, followed by further optimization using RDKit's implementation of the MMFF94s force field. Then using Gaussian 16, a geometry optimization, frequency calculation, and population analysis (charge=0, multiplicity=1) were performed at the M062X/def2-SVPD level of theory with acetonitrile as the implicit solvent implemented by the SMD algorithm. Calculations were distributed across Intel Xeon Platinum 8260 nodes provided by the MIT Super Cloud.

Next, the N+1 case was considered. Here, we use the geometry-optimized structure from the N case and perform a single-point energy calculation where the system has one more electron than the N case. In other words, charge=−1 and multiplicity=2. Similarly, for the N−1 case, the geometry optimized structure from the N case was used to perform a single point energy calculation where the system has 1 less electron than the N case (charge=1 and multiplicity=2). For each alkene, the electron affinity and ionization potential were calculated using the free energies by:

$$IP = E_{N-1} - E_N$$

$$EA = E_{N+1} - E_N$$

These quantities were used to calculate the chemical potential and chemical hardness as follows:

$$\mu = IP - EA$$

$$\eta = -\frac{(IP + EA)}{2}$$

From these two values, we were able to calculate the global electrophilicity index w using the relation:

$$\omega = \frac{\mu^2}{2\eta}$$

Formally, the Fukui functions can be defined as the spatially dependent change in electron density as a function of the number of electrons N at a constant potential v(r):

$$f = \left(\frac{\partial \rho(r)}{\partial N}\right)_{v(r)}$$

Based on this, the Fukui function for a discrete change in the number of electrons can be defined:

$$f^- = \rho_N(r) - \rho_{N-1}(r)$$

This definition is then typically calculated using a population analysis with the following:

$$f_k^- = q_k(N) - q_k(N-1)$$

Where $q_k$ is the gross population on atom k. Gross populations were calculated using the cclib library using the Lowdin population analysis. Mulliken charge analysis was also performed, but we found Lowdin population analysis performed better. Finally, the local electrophilicity index was calculated by $$\omega^- = \omega f_k^-.$$

Supplementary Text

S1. Deuterium Kinetic Isotope Effects in Water and Acetonitrile Isotopologues

To better understand the role of water and water oxidation intermediates in the epoxidation pathway, we compared reaction rates obtained with various isotopologues of water and acetonitrile (FIG. 20 and Table 10). We tested combinations of $H_2O$+$CH_3CN$, $D_2O$+$CH_3CN$, $H_2O$+$CD_3CN$, and $D_2O$+$CD_3CN$ with fixed water (10 M) and propylene (1 atm) concentrations at 1.1 V vs. $Fc/Fc^+$. The kinetic isotope effect ($k_H/k_D$) was determined by calculating the ratio of the epoxidation rate obtained from $H_2O$+$CH_3CN$ to that obtained from deuterated conditions.

In both $CH_3CN$- and $CD_3CN$-based electrolytes, using $D_2O$ instead of $H_2O$ resulted in the primary kinetic isotope effect, suggesting that kinetically relevant steps involve O—H bond cleavage from water. In our proposed mechanism, water activation steps involving O—H bond cleavages are kinetically relevant steps. When the water identity was fixed as either $H_2O$ or $D_2O$, using $CD_3CN$ instead of $CH_3CN$ yielded epoxidation rates that were statistically indistinguishable, indicating that the cleavage of the C—H bond in acetonitrile did not occur or its cleavage product did not participate in the reaction.

REFERENCES CORRESPONDING TO EXAMPLE 1

1. M. W. Allsopp; G. Vianello, Ullmann's Encyclopedia of Industrial Chemistry-Wiley Online Library (Wiley-VCH Verlag Gmbh & Co. KGaA, Weinheim, Germany, 2012; http://doi.wiley.com/10.1002/14356007.a21_717).
2. S. J. Khatib, S. T. Oyama, Direct Oxidation of Propylene to Propylene Oxide with Molecular Oxygen: A Review. Catal. Rev. 57, 306-344 (2015).
3. J. A. M. Leduc, "Electrochemical Process for the Production of Organic Oxides, U.S. Pat. No. 3,288,692" (1966), (available at https://patentimages.storage-.googleapis.com/19/89/45/5c616161f9dc57/U.S. Pat. No. 3,288,692.pdf).
4. W. R. Leow, Y. Lum, A. Ozden, Y. Wang, D.-H. Nam, B. Chen, J. Wicks, T.-T. Zhuang, F. Li, D. Sinton, E. H. Sargent, Chloride-mediated selective electrosynthesis of ethylene and propylene oxides at high current density. Science (80-.). 368, 1228-1233 (2020).
5. M. Chung, K. Jin, J. S. Zeng, K. Manthiram, Mechanism of Chlorine-Mediated Electrochemical Ethylene Oxidation in Saline Water. ACS Catal. 10, 14015-14023 (2020).
6. J. Adrien, M. Le Duc, S. Hills, United States Patent Office ELECTROLYTIC PRODUCTION OF OLEFINE OXDES (1969).
7. M. Chung, K. Jin, J. S. Zeng, T. N. Ton, K. Manthiram, Tuning Single-Atom Dopants on Manganese Oxide for Selective Electrocatalytic Cyclooctene Epoxidation. J. Am. Chem. Soc. 144, 17416-17422 (2022).
8. K. Jin, J. H. Maalouf, N. Lazouski, N. Corbin, D. Yang, K. Manthiram, Epoxidation of Cyclooctene Using Water as the Oxygen Atom Source at Manganese Oxide Electrocatalysts. J. Am. Chem. Soc. 141, 6413-6418 (2019).
9. X. C. Liu, T. Wang, Z. M. Zhang, C. H. Yang, L. Y. Li, S. Wu, S. Xie, G. Fu, Z. Y. Zhou, S. G. Sun, Reaction Mechanism and Selectivity Tuning of Propene Oxidation at the Electrochemical Interface. J. Am. Chem. Soc. 144, 20895-20902 (2022)
10. A. Winiwarter, L. Silvioli, S. B. Scott, K. Enemark-Rasmussen, M. Sariç, D. B. Trimarco, P. C. K. Vesborg, P. G. Moses, I. E. L. Stephens, B. Seger, J. Rossmeisl, I. Chorkendorff, Towards an atomistic understanding of electrocatalytic partial hydrocarbon oxidation: propene on palladium. Energy Environ. Sci. 12, 1055-1067 (2019).
11. R. P. H. Jong, E. Dubbelman, G. Mul, Electro-oxidation of propylene by palladium functionalized titanium hollow fibre electrodes. J. Catal. 416, 18-28 (2022).
12. S. Koroidov, A. Winiwarter, O. Diaz-Morales, M. Görlin, J. Halldin Stenlid, H.-Y. Wang, M. Borner, C. M. Goodwin, M. Soldemo, L. G. M. Pettersson, J. Rossmeisl, T. Hansson, I. Chorkendorff, A. Nilsson, Chemisorbed oxygen or surface oxides steer the selectivity in Pd electrocatalytic propene oxidation observed by operando Pd L-edge X-ray absorption spectroscopy. Catal. Sci. Technol. 11, 3347-3352 (2021).
13. K. Otsuka, T. Ushiyama, I. Yamanaka, K. Ebitani, Electrocatalytic Synthesis of Propylene Oxide During Water Electrolysis. J. Catal. 157, 450-460 (1995).
14. S. Iguchi, M. Kataoka, R. Hoshino, I. Yamanaka, Direct epoxidation of propylene with water at a PtOx anode using a solid-polymer-electrolyte electrolysis cell. Catal. Sci. Technol. 12, 469-473 (2022).
15. I. Yamanaka, K. Sato, K. Otsuka, Electrolytic Synthesis of Propene Oxide from Propene and Water in the Gas Phase. Electrochem. Solid-State Lett. 2, 131-132 (1999).
16. L. L. Holbrook, H. Wise, Electrooxidation of olefins at a silver electrode. J. Catal. 38, 294-298 (1975).
17. J. Ke, J. Zhao, M. Chi, M. Wang, X. Kong, Q. Chang, W. Zhou, C. Long, J. Zeng, Z. Geng, Facet-dependent electrooxidation of propylene into propylene oxide over Ag3PO4 crystals. Nat. Commun. 2022 131. 13, 1-8 (2022).
18. H. Li, C. S. Abraham, M. Anand, A. Cao, J. K. Nørskov, Opportunities and Challenges in Electrolytic Propylene Epoxidation. J. Phys. Chem. Lett. 13, 2057-2063 (2022).
19. M. CHEN, Morphology and composition of Pt$z.sbnd; Pd alloy crystallites on SiO2 in reactive atmospheres*1. J. Catal. 56, 198-218 (1979).
20. C. Carrillo, T. R. Johns, H. Xiong, A. Delariva, S. R. Challa, R. S. Goeke, K. Artyushkova, W. Li, C. H. Kim, A. K. Datye, Trapping of mobile Pt species by PdO nanoparticles under oxidizing conditions. J. Phys. Chem. Lett. 5, 2089-2093 (2014).
21. P. N. Plessow, F. Abild-Pedersen, Sintering of Pt Nanoparticles via Volatile PtO2: Simulation and Comparison with Experiments. ACS Catal. 6, 7098-7108 (2016).
22. E. D. Goodman, A. A. Ye, A. Aitbekova, O. Mueller, A. R. Riscoe, T. Nguyen Taylor, A. S. Hoffman, A. Boubnov, K. C. Bustillo, M. Nachtegaal, S. R. Bare, M. Cargnello, Palladium oxidation leads to methane combustion activity: Effects of particle size and alloying with platinum. J. Chem. Phys. 151, 154703 (2019).

23. A. Aitbekova, C. Zhou, M. L. Stone, J. S. Lezama-Pacheco, A.-C. Yang, A. S. Hoffman, E. D. Goodman, P. Huber, J. F. Stebbins, K. C. Bustillo, P. Ercius, J. Ciston, S. R. Bare, P. N. Plessow, M. Cargnello, Templated encapsulation of platinum-based catalysts promotes high-temperature stability to 1,100 °C. Nat. Mater. 21, 1290-1297 (2022).
24. D. Gao, H. Zhou, J. Wang, S. Miao, F. Yang, G. Wang, J. Wang, X. Bao, Size-Dependent Electrocatalytic Reduction of CO2 over Pd Nanoparticles. J. Am. Chem. Soc. 137, 4288-4291 (2015).
25. D. T. Bregante, P. Priyadarshini, D. W. Flaherty, Kinetic and spectroscopic evidence for reaction pathways and intermediates for olefin epoxidation on Nb in *BEA. J. Catal. 348, 75-89 (2017).
26. C. K. Sams, K. A. Jørgensen, S. V. Lindeman, J. Songstad, Mechanistic Aspects of Vanadium-Catalysed Oxygen Transfer Reactions. Acta Chem. Scand. 49, 839-847 (1995).
27. C. Kim, T. G. Traylor, C. L. Perrin, MCPBA epoxidation of alkenes: Reinvestigation of correlation between rate and ionization potential. J. Am. Chem. Soc. 120, 9513-9516 (1998).
28. X. Yang, S. Kattel, K. Xiong, K. Mudiyanselage, S. Rykov, S. D. Senanayake, J. A. Rodriguez, P. Liu, D. J. Stacchiola, J. G. Chen, Direct Epoxidation of Propylene over Stabilized Cu+ Surface Sites on Titanium-Modified Cu20. Angew. Chemie Int. Ed. 54, 11946-11951 (2015).
29. Y. Le, F. Mehmood, S. Lee, J. Greeley, B. Lee, S. Seifert, R. E. Winansl, W. Elám, R. J. Meyer, P. C. Redfern, D. Teschner, R. Schlö'GI, M. J. Pellin, L. A. Curtiss, S. Vajda, Increased silver activity for direct propylene epoxidation via subnanometer size effects. Science (80-.). 328, 224-228 (2010).
30. A. R. Chianese, S. J. Lee, M. R. Gagné, Electrophilic Activation of Alkenes by Platinum(II): So Much More Than a Slow Version of Palladium(II). Angew. Chemie Int. Ed. 46, 4042-4059 (2007).
31. A. Zanardo, F. Pinna, G. Strukul, R. A. Michelin, Kinetic study of the epoxidation of 1-Octene with hydrogen peroxide catalyzed by platinum(II) complexes. Evidence of the involvement of two metal species in the oxygen-transfer step. Inorg. Chem. 27, 1966-1973 (1988).
32. F. De Vleeschouwer, V. Van Speybroeck, M. Waroquier, P. Geerlings, F. De Proft, Electrophilicity and nucleophilicity index for radicals. Org. Lett. 9, 2720-2724 (2007).
33. R. Pal, P. K. Chattaraj, Electrophilicity index revisited. J. Comput. Chem. 44, 278-297 (2023).
34. Tabulated dataset underlying the figures in the Dryad data repository. DOI: 10.5061/dryad.s7h44j1dd
35. Y. Yoon, B. Yan, Y. Surendranath, Suppressing Ion Transfer Enables Versatile Measurements of Electrochemical Surface Area for Intrinsic Activity Comparisons. J. Am. Chem. Soc. 140, 2397-2400 (2018).
36. C. C. L. Mccrory, S. Jung, J. C. Peters, T. F. Jaramillo, Benchmarking Heterogeneous Electrocatalysts for the Oxygen Evolution Reaction (2013), doi: 10.1021/ja407115p.
37. K. Williams, A. Limaye, T. Weiss, M. Chung, K. Manthiram, Accounting for species' thermodynamic activities changes mechanistic interpretations of electrochemical kinetic data (2022), doi: 10.26434/CHEMRXIV-2022-VK5Z9.
38. C. Tse-Chuan, C. Jang-Chyang, Anodic oxidation of propylene on a screen electrode. Chem. Eng. Sci. 35, 1581-1590 (1980).
39. X. Lin, Z. Zhou, Q. Y. Li, D. Xu, S. Y. Xia, B. L. Leng, G. Y. Zhai, S. N. Zhang, L. H. Sun, G. Zhao, J. S. Chen, X. H. Li, Direct Oxygen Transfer from H2O to Cyclooctene over Electron-Rich RuO2 Nanocrystals for Epoxidation and Hydrogen Evolution. Angew. Chemie Int. Ed. 61, e202207108 (2022).

Certain Exemplary Aspects and Embodiments

Various aspects are contemplated and disclosed herein, several of which are set forth in the paragraphs below. It is explicitly contemplated and disclosed that any aspect or portion thereof can be combined to form an aspect. Moreover, the terms "any preceding aspect" and "any one of the preceding aspects" means any aspect that appears prior to the aspect that contains such phrase (for example, the sentence "Aspect 15: The process or system of any of the preceding Aspects, wherein the oxygen atom transfer electrocatalyst is characterized by the ratio of platinum in a metal valency . . . " means that any Aspect prior to Aspect 15 is referenced, including letter versions). For example, it is contemplated and disclosed that, optionally, any method or system of any of the below aspects may be useful with or combined with any other aspect provided below. Further, for example, it is contemplated and disclosed that any embodiment or aspect described above may, optionally, be combined with any of the below listed aspects or any portion(s) thereof.

Aspect 1: A process for the electrochemical epoxidation of an alkene to generate an epoxide, the process comprising: contacting an anode comprising an oxygen atom transfer electrocatalyst with the alkene in the presence of an electrolyte comprising water; applying a voltage to the anode and a cathode to generate the epoxide; wherein the oxygen atom transfer electrocatalyst comprises an at least partially oxidized palladium-platinum alloy characterized by the formula FX1:

$$Pd_yPt_zO_x \quad \text{(FX1);}$$

wherein y is greater than 0 and less than 1; z is greater than 0 and less than 1; wherein the sum of y and z is equal to 1; and x is selected from the range of 0 to 2.

Aspect 2: A process for the electrochemical epoxidation of an alkene to generate an epoxide, the process comprising: contacting an anode comprising an oxygen atom transfer electrocatalyst with the alkene in the presence of an electrolyte comprising water; applying a voltage to the anode and a cathode to generate the epoxide; wherein the oxygen atom transfer electrocatalyst comprises an at least partially oxidized metal-platinum alloy characterized by the formula FX2:

$$M_yPt_zO_x \quad \text{(FX2);}$$

wherein M comprises one or more group 9 metals, one or more group 9 metals, one or more group 10 metals, one or more group 11 metals, or any combination thereof; wherein platinum is characterized by an average metal valency greater than or equal to 0.5; wherein y is greater than 0 and less than 1; z is greater than 0 and less than 1; wherein the sum of y and z is equal to 1; and x is selected from the range of 0 to 2.

Aspect 3: A system for generating an epoxide from an alkene and an oxygen atom transfer source, the system comprising: a cathode; an anode comprising an oxygen atom transfer electrocatalyst; an electrolyte in ionic communication with the anode and the cathode; wherein the system is configured for contacting the anode with the alkene in the presence of an electrolyte comprising water; applying a voltage to the anode and the cathode to generate the epoxide; wherein the oxygen atom transfer electrocatalyst comprises an at least partially oxidized palladium-platinum alloy characterized by the formula FX1:

$$Pd_yPt_zO_x \quad (FX1);$$

wherein y is greater than 0 and less than 1; z is greater than 0 and less than 1; wherein the sum of y and z is equal to 1; and x is selected from the range of 0 to 2.

Aspect 4: Aspects of the invention include a system for generating an epoxide from an alkene and an oxygen atom source, the system comprising: a cathode; an anode comprising an oxygen atom transfer electrocatalyst; an electrolyte in ionic communication with the anode and the cathode; wherein the system is configured for contacting the anode with the alkene in the presence of an electrolyte comprising water; applying a voltage to the anode and the cathode to generate the epoxide; wherein the oxygen atom transfer electrocatalyst comprises an at least partially oxidized metal-platinum alloy characterized by the formula FX2:

$$M_yPt_zO_x \quad (FX2);$$

wherein M comprises one or more group 8 metals, one or more group 9 metals, one or more group 10 metals, one or more group 11 metals, or a combination thereof; wherein platinum is characterized by an average metal valency greater than or equal to 0.5; wherein y is greater than 0 and less than 1; z is greater than 0 and less than 1; wherein the sum of y and z is equal to 1; and x is selected from the range of 0 to 2.

Aspect 5: The process or system of Aspect 2 or 4, wherein the group 8, group 9, group 10, and group 11 metals comprise iron, ruthenium, osmium, cobalt, iridium, nickel, palladium, copper, silver, or gold. Optionally, the group 8, group 9, group 10, or group 11 metal is selected to be substantially similar in atomic radius to palladium to enable the attainment of optimal oxidation states and structures for an epoxidation electrocatalyst. For example, in a preferred Aspect, M optionally comprises gold, iridium, nickel, ruthenium, palladium, or any combination thereof.

Aspect 6: The process or system of any of the preceding Aspects, wherein y is selected from the range of 0.25 to 0.75 and z is selected from the range of 0.25 to 0.75 such that the ratio of y to z is 1 to 3 to 3 to 1.

Aspect 7: The process or system of any of the preceding Aspects, wherein y is 0.5 and z is 0.5 so as to provide an equimolar ratio of M to Pt or Pd to Pt.

Aspect 8: The process or system of any of the preceding Aspects, wherein the oxygen atom transfer electrocatalyst comprises palladium in an average metal valency greater than or equal to +2.

Aspect 9: The process or system of any of the preceding Aspects, wherein the oxygen atom transfer electrocatalyst comprises platinum in an average metal valency greater than +0.5, greater than +1, or optionally greater than +2.

Aspect 10: The process or system of any of the preceding Aspects, wherein the oxygen atom transfer electrocatalyst is immobilized on a support substrate.

Aspect 11: The process or system of any of the preceding Aspects, wherein the support substrate comprises a porous material.

Aspect 12: The process or system of any of the preceding Aspects, wherein the support substrate comprises a gas diffusion electrode, a carbon paper electrode, a hydrophobic carbon paper electrode, a hydrophilic carbon paper electrode, a metal mesh, a metal cloth, or optionally, any combination of these.

Aspect 13: The process or system of any of the preceding Aspects, wherein the support substrate comprises titanium, stainless steel, other metal alloys, or a combination thereof.

Aspect 14: The process or system of any of the preceding Aspects, wherein the oxygen atom transfer electrocatalyst is characterized by the ratio of platinum in a metal valency of +2 to platinum in a metal valency of 0 being greater than 0.33.

Aspect 15: The process or system of any of the preceding Aspects, wherein the oxygen atom transfer electrocatalyst is characterized by the ratio of platinum in a metal valency of +2 to platinum in a metal valency of 0 being greater than 1.0.

Aspect 16: The process or system of any of the preceding Aspects, wherein the oxygen atom transfer electrocatalyst may be characterized the ratio of platinum in a metal valency of +2 to platinum in metal valency of 0 being greater than 10.0.

Aspect 17: The process or system of any of the preceding Aspects, wherein the oxygen atom transfer electrocatalyst is characterized by platinum being in a local coordination environment that is within at least 50% of the local coordination environment of platinum in pure PtO. Optionally, the oxygen atom transfer electrocatalyst may be characterized by platinum being in local coordination environment that is within at least 75% of the local coordination environment of pure PtO. Optionally, the oxygen atom transfer electrocatalyst may be characterized by platinum being a local coordination environment that is within at least 90% of the local coordination environment of pure PtO. Any range and value therebetween 50% to 100% is explicitly contemplated and disclosed herein. In a preferred aspect, the oxygen atom transfer electrocatalyst is characterized by platinum being in a local coordination environment that is within about 81-87.5% of the local coordination environment of pure PtO.

Aspect 18: The process or system of any of the preceding Aspects, wherein the oxidized platinum is characterized by a coordination number that is greater than or equal to 2. Optionally, in an aspect of any method or system disclosed herein, the oxidized platinum is characterized by coordination number that is greater than or equal to 2.5.

Aspect 19: The process or system of any of the preceding Aspects, wherein the oxygen atom transfer electrocatalyst comprises a substantially homogenous distribution of palladium and platinum. Optionally, the process or system of any of the preceding aspect, wherein the oxygen atom transfer electrocatalyst is characterized by a substantially homogeneous distribution of palladium and platinum at the surface of the oxygen atom transfer electrocatalyst. Optionally, in any of the preceding Aspects, the oxygen atom transfer electrocatalyst is characterized by a substantially homogeneous distribution of platinum and palladium in the bulk. Optionally, in any of the preceding Aspects, the oxygen atom transfer electrocatalyst is characterized by a substantially homogeneous distribution of platinum and palladium at the surface that matches the substantial homogeneity of the distribution of platinum and palladium in the bulk.

Aspect 20: The process or system of any of the preceding Aspects, wherein the oxygen atom transfer electrocatalyst comprises a substantially homogenous distribution one or more metals and platinum. Optionally, the process or system of any of the preceding aspect, wherein the oxygen atom transfer electrocatalyst is characterized by a substantially homogeneous distribution of one or more metals and platinum at the surface of the oxygen atom transfer electrocatalyst. Optionally, in any of the preceding Aspects, the oxygen atom transfer electrocatalyst is characterized by a substantially homogeneous distribution of platinum and one or more metals in the bulk. Optionally, in any of the preceding Aspects, the oxygen atom transfer electrocatalyst is characterized by a substantially homogeneous distribution of platinum and one or more metals at the surface that is substantially equivalent to the homogeneity of the distribution of platinum and one or more in the bulk.

Aspect 21: The process or system of any of the preceding Aspects, wherein the oxidized platinum species are embedded in the oxidized palladium species.

Aspect 22: The process or system of any of the preceding Aspects, wherein the oxidized platinum species are embedded in the one or more oxidized metal species.

Aspect 23: The process or system of any of the preceding Aspects, wherein the oxidized platinum species are stabilized by the oxidized palladium species relative to the oxidized platinum species in pure oxidized platinum.

Aspect 24: The process or system of any of the preceding Aspects, wherein the oxidized platinum species are stabilized by the one or more oxidized metals relative to the oxidized platinum species in pure oxidized platinum.

Aspect 25: The process or system of any of the preceding Aspects, wherein the metal valency of the platinum in the oxygen transfer electrocatalyst is stable under applied oxidative potentials selected from the range of 0.0 V to 3.0 V vs. SHE. Optionally, in any of the preceding Aspects, the metal valency of the platinum in the oxygen atom transfer electrocatalyst is stable under applied oxidative potentials in the range of 0.5 V to 2.0 V vs. SHE. Optionally, in any of the preceding Aspects, the metal valency of the platinum in the oxygen atom transfer electrocatalyst is stable under applied oxidative potentials in the range of 0.9 V to 1.65 V vs. SHE. Any range or value therebetween 0.0 V and 3.0 V is explicitly contemplated and disclosed herein.

Aspect 26: The process or system of any of the preceding Aspects, wherein the metal valency of platinum in the oxygen atom transfer electrocatalyst is stable under applied reductive potentials. Optionally, the metal valency of platinum in the oxygen atom transfer electrocatalyst is stable under cycling between oxidative and reductive potentials.

Aspect 27: The process or system of any of the preceding Aspects, wherein the oxygen atom transfer electrocatalyst comprises platinum and palladium annealed at a temperature selected from the range of 100 °C to 1,000 °C. Optionally, the oxygen atom transfer electrocatalyst comprises platinum and palladium annealed at a temperature selected from the range of 300 °C to 700 °C. Optionally, the oxygen atom transfer electrocatalyst comprises platinum and palladium annealed at a temperature selected from the range of 400 °C to 600 °C. Optionally, in an Aspect, the oxygen atom transfer electrocatalyst comprises platinum and palladium annealed at a temperature of about 500 °C. Any range or value therebetween 100 °C to 1,000 °C is explicitly contemplated and disclosed herein.

Aspect 28: The process or system of any of the preceding Aspects, wherein the oxygen atom transfer electrocatalyst comprises platinum and one or more metals annealed at a temperature selected from the range of 100 °C to 1,000 °C. Optionally, the oxygen atom transfer electrocatalyst comprises platinum and one or more metals annealed at a temperature selected from the range of 300 °C to 700 °C. Optionally, the oxygen atom transfer electrocatalyst comprises platinum and one or more metals annealed at a temperature selected from the range of 400 °C to 600 °C. Optionally, in an Aspect, the oxygen atom transfer electrocatalyst comprises platinum and one or more metals annealed at a temperature of about 500 °C. Any range or value therebetween 100 °C to 1,000 °C is explicitly contemplated and disclosed herein.

Aspect 29: The process or system of any of the preceding Aspects, wherein the oxygen atom transfer electrocatalyst comprises palladium and platinum annealed on an amorphous carbon substrate. Optionally, the oxygen atom transfer electrocatalyst comprises palladium and platinum annealed on a titanium substrate. Optionally, the oxygen atom transfer electrocatalyst comprises palladium and platinum annealed on a stainless steel substrate. Optionally, the oxygen atom transfer electrocatalyst comprises palladium and platinum annealed on any combination of carbon, titanium, or stainless steel.

Aspect 30: The process or system of any of the preceding Aspects, wherein the oxygen atom transfer electrocatalyst is annealed under static air conditions. Optionally, the oxygen atom transfer electrocatalyst is annealed under flowing air conditions.

Aspect 31: The process or system of any of the preceding Aspects, wherein the oxygen atom transfer electrocatalyst is annealed for a time selected over the range of 1 hour to 10 hours. Optionally the oxygen atom transfer electrocatalyst is annealed for a time selected over the range of 3 hours to 8 hours. Any range or value therebetween 3 hours to 10 hours is explicitly contemplated and disclosed herein.

Aspect 32: The process or system of any of the preceding Aspects, wherein the oxygen atom transfer electrocatalyst further comprises carbon.

Aspect 33: The process or system of any of the preceding Aspects, wherein the oxygen atom transfer electrocatalyst further comprises titanium.

Aspect 34: The process or system of any of the preceding Aspects, wherein the oxygen atom transfer electrocatalyst further comprises stainless steel.

Aspect 35: The process or system of any of the preceding Aspects, wherein the oxygen atom transfer electrocatalyst further comprises any combination of carbon, titanium, or stainless steel.

Aspect 36: The process or system of any of the preceding Aspects, wherein the oxygen atom transfer electrocatalyst is characterized by the formula FX3:

$$M_yPt_zO_x/C \qquad \text{FX3.}$$

Aspect 37: The process or system of any of the preceding Aspects, wherein the carbon is present in the oxygen atom transfer electrocatalyst in an amount selected from the range of 0.0% to 95.0%. Optionally, the carbon is present in the oxygen atom transfer electrocatalyst in an amount selected from the range of 5% to 75%. Optionally, the carbon is present in the oxygen atom transfer electrocatalyst in an amount selected from the range of 25% to 55%. Any range or value therebetween 0.0% to 95% is explicitly contemplated and disclosed herein.

Aspect 38: The process or system of any of the preceding Aspects, wherein the voltage applied is selected from the range of 0.0 V to 4.0 V vs. SHE. Optionally, the voltage applied is selected from the range of 1.0 V to 3.0 V vs. SHE. Optionally, the voltage applied is about 2.0 V vs. SHE. Any range or value therebetween 0.0 V to 4.0 V is explicitly contemplated and disclosed herein.

Aspect 39: The process or system of any of the preceding Aspects, wherein the epoxide is generated at a Faradaic efficiency greater than 20%, greater than 30%, greater than 40%, greater than 50%, greater than 60%, greater than 70%, greater than 80%, or optionally greater than 90%. Any range or value greater than 20% to greater than 90% is explicitly contemplated and disclosed herein.

Aspect 40: The process or system of any of the preceding Aspects, wherein the electrolyte further comprises a non-aqueous solvent. Optionally, the non-aqueous solvent comprises a polar aprotic solvent. Optionally, the non-aqueous solvent comprises acetonitrile, propylene carbonate, tetrahydrofuran, dimethylformaldehide, dimethylsulfoxide, or any combination of these.

Aspect 41: The process or system of any of the preceding Aspects, wherein the non-aqueous solvent is characterized by an ability to improve the solubility of the alkene. Optionally, the non-aqueous solvent is miscible with water.

Aspect 42: The process or system of any of the preceding Aspects, wherein the electrolyte further comprises $BF_4^-$, $PF_6^-$, $PO_4^{3-}$, or $ClO_4^-$, or any combination thereof.

Aspect 43: The process or system of any of the preceding Aspects, wherein the electrolyte further comprises tetra-n-butylammonium$^+$, $Li^+$, $Na^+$, $H^+$, $K^+$, $Rb^+$, or any combination thereof.

Aspect 44: The process or system of any of the preceding Aspects, wherein the water is present in a concentration selected over the range of 0.1 M to 20 M. Optionally, the water is present in a concentration selected over the range of 5 M to 15 M. Optionally, in an embodiment, the water is present in an amount of about 10M. Any range or value therebetween 0.1 M to 20 M is explicitly contemplated and disclosed herein.

Aspect 45: The process or system of any of the preceding Aspects, wherein the process is carried out at a pH between 3.0 and 12.0. Preferably in any method or system disclosed herein, the process is carried out at a pH of substantially 4.0 to avoid hydrolysis of the epoxide to glycol after electrocatalytic production of the epoxide and to increase selectivity of the epoxide formation.

Aspect 46: The process or system of any of the preceding Aspects, wherein water is oxygen atom transfer source for the direct epoxidation of the alkene.

Aspect 47: The process or system of any of the preceding Aspects, wherein hydrogen, optionally water, or optionally any combination of these is generated at the cathode. The process or system of any of the preceding Aspects, wherein optionally oxygen, optionally water, optionally carbon dioxide, or optionally any combination of these is reduced at the cathode. Preferably in any method or system disclosed herein, a hydrogenation reaction an organic reactant occurs at the cathode.

Aspect 48: The process or system of any of the preceding Aspects, wherein the cathode comprises optionally Pt, optionally Ni, optionally Cu, optionally Pd, optionally Au, optionally Ag, or optionally any combination of these.

Aspect 49: The process or system of any of the preceding Aspects, wherein the process is carried out at substantially ambient temperature. Optionally, the process is carried out at a temperature selected over the range of 25 °C to 100 °C. Any range or value therebetween is explicitly contemplated and disclosed herein.

Aspect 50: The process or system of any of the preceding Aspects, wherein the process is carried out at substantially ambient pressure. Optionally, the process is carried out a pressure selected over the range of 1.0 bar to 1,000 bar. Optionally, the process is carried out a pressure selected over the range of 100 bar to 900 bar. Optionally, the process is carried out a pressure selected over the range of 400 bar to 600 bar. Any range or value therebetween 1.0 bar to 1,000 bar is explicitly contemplated and disclosed herein.

Aspect 51: The process or system of any of the preceding Aspects, wherein the oxygen atom transfer electrocatalyst further comprises an ionomer. In a preferred Aspect, the ionomer establishes gas diffusion channels reducing the distance that the alkene diffuses through the electrolyte to reach the catalyst.

Aspect 52: The process or system of any of the preceding Aspects, wherein the ionomer comprises a substantially hydrophobic backbone. Optionally, in an Aspect, the ionomer comprises a cation exchange membrane. Optionally, in an Aspect, the ionomer comprises an anion exchange membrane.

Aspect 53: The process or system of any of the preceding Aspects, wherein the ionomer comprises poly(perfluorosulfonic acid), optionally a functionalized polyphenylene, optionally a partially fluorinated anion exchange membrane, optionally a poly(aryl piperidinium) resin, optionally an imidazolim-functoinalized polystyrene, optionally a sulphonated poly(ether-ether-ketone), optionally a sulfonated polylmide, optionally a polybenzimidazole, or optionally any combination of these.

Aspect 54: The process or system of any of the preceding Aspects, wherein the anode and the cathode are in contact with an ionically conductive membrane. The ionically conductive membrane may comprise an ionomer, wherein the ionomer comprises a cation exchange membrane or an anion exchange membrane. For example, the ionically conductive membrane may comprise poly(perfluorosulfonic acid), optionally a functionalized polyphenylene, optionally a partially fluorinated anion exchange membrane, optionally a poly(aryl piperidinium) resin, optionally an imidazolim-functoinalized polystyrene, optionally a sulphonated poly (ether-ether-ketone), optionally a sulfonated polylmide, optionally a polybenzimidazole, or optionally any combination of these.

Aspect 55: The process or system of any of the preceding Aspects, wherein the alkene is comprised of 2 to 100 carbon bonds. Optionally, the alkene is comprised of 2 to 30 carbon atoms. Preferably, in an Aspect, the alkene is comprised of 2 to 10 carbon atoms. Any range or value therebetween 2 to 100 carbon bonds is explicitly contemplated and disclosed herein. Optionally, in an Aspect the alkene is comprised of one carbon-carbon double bond. Optionally, in an Aspect, the alkene is comprised of more than one carbon-carbon double bond. For example, the alkene is comprised of two carbon-carbon double bonds.

Aspect 56: The process or system of any of the preceding Aspects, wherein the alkene comprises a cycloalkene. Optionally, the cycloalkene comprises 3-9 carbon atoms. Optionally, the cycloalkene comprises one carbon-carbon double bond. Optionally, the cycloalkene comprises more than carbon-carbon double bond, for example, two carbon-carbon double bonds.

Aspect 57: The process or system of any of the preceding Aspects, wherein the epoxide comprises propylene oxide, optionally ethylene oxide, or optionally epichlorohydrin. Optionally, a glycol may be generated. Preferably in any method or system disclosed herein, the selectivity for the epoxide may be greater than or equal to 20%, greater than or equal to 30%, greater than or equal to 40%, greater than or equal to 50%, greater than or equal to 60%, greater than or equal to 70%, greater than or equal to 80%, or greater than or equal to 90%. Any range or value greater than 20% to greater than 90% is explicitly contemplated and disclosed herein.

STATEMENTS REGARDING INCORPORATION BY REFERENCE AND VARIATIONS

All references throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention as defined by the appended claims. The specific embodiments provided herein are examples of useful embodiments of the present invention and it will be apparent to one skilled in the art that the present invention may be carried out using a large number of variations of the devices, device components, methods steps set forth in the present description. As will be obvious to one of skill in the art, methods and devices useful for the present methods can include a large number of optional composition and processing elements and steps.

As used herein and in the appended claims, the singular forms "a", "an", and "the" include plural reference unless the context clearly dictates otherwise. Thus, for example, reference to "a cell" includes a plurality of such cells and equivalents thereof known to those skilled in the art. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

When a group of substituents is disclosed herein, it is understood that all individual members of that group and all subgroups, including any isomers, enantiomers, and diastereomers of the group members, are disclosed separately. When a Markush group or other grouping is used herein, all individual members of the group and all combinations and subcombinations possible of the group are intended to be individually included in the disclosure. When a compound is described herein such that a particular isomer, enantiomer or diastereomer of the compound is not specified, for example, in a formula or in a chemical name, that description is intended to include each isomers and enantiomer of the compound described individual or in any combination. Additionally, unless otherwise specified, all isotopic variants of compounds disclosed herein are intended to be encompassed by the disclosure. For example, it will be understood that any one or more hydrogens in a molecule disclosed can be replaced with deuterium or tritium. Isotopic variants of a molecule are generally useful as standards in assays for the molecule and in chemical and biological research related to the molecule or its use. Methods for making such isotopic variants are known in the art. Specific names of compounds are intended to be exemplary, as it is known that one of ordinary skill in the art can name the same compounds differently.

Certain molecules disclosed herein may contain one or more ionizable groups [groups from which a proton can be removed (e.g., —COOH) or added (e.g., amines) or which can be quaternized (e.g., amines)]. All possible ionic forms of such molecules and salts thereof are intended to be included individually in the disclosure herein. With regard to salts of the compounds herein, one of ordinary skill in the art can select from among a wide variety of available counterions those that are appropriate for preparation of salts of this invention for a given application. In specific applications, the selection of a given anion or cation for preparation of a salt may result in increased or decreased solubility of that salt.

Every device, system, formulation, combination of components, or method described or exemplified herein can be used to practice the invention, unless otherwise stated.

Whenever a range is given in the specification, for example, a temperature range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art.

For example, when composition of matter are claimed, it should be understood that compounds known and available in the art prior to Applicant's invention, including compounds for which an enabling disclosure is provided in the references cited herein, are not intended to be included in the composition of matter claims herein.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements, limitation or limitations which is not specifically disclosed herein.

One of ordinary skill in the art will appreciate that starting materials, biological materials, reagents, synthetic methods, purification methods, analytical methods, assay methods, and biological methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

We claim:

1. A process for electrochemical epoxidation of an alkene to generate an epoxide, the process comprising:

contacting an anode comprising an oxygen atom transfer electrocatalyst with the alkene in the presence of an electrolyte comprising water;

applying a voltage to the anode and a cathode to generate the epoxide; wherein the oxygen atom transfer electrocatalyst comprises an at least partially oxidized palladium-platinum alloy characterized by the formula FX1:

$$Pd_yPt_zO_x \quad \text{(FX1)};$$

wherein y is greater than 0 and less than 1;

z is greater than 0 and less than 1;

wherein the sum of y and z is equal to 1; and x is selected from the range of 0 to 2.

2. The process of claim 1, wherein y is selected from the range of 0.25 to 0.75 and z is selected from the range of 0.25 to 0.75 or y is 0.5 and z is 0.5.

3. The process of claim 1, wherein the oxygen atom transfer electrocatalyst comprises palladium in an average metal valency greater than or equal to +2.

4. The process of claim 1, wherein the oxygen atom transfer electrocatalyst comprises platinum in an average metal valency greater than or equal to +0.5, greater than or equal to +1, or greater than or equal to +2.

5. The process of claim 1, wherein the oxygen atom transfer electrocatalyst is immobilized on a porous support substrate; the porous support substrate comprises a gas diffusion electrode, a carbon paper electrode, a hydrophobic carbon paper electrode, a hydrophilic carbon paper electrode, titanium, stainless steel; or any combination thereof.

6. The process of claim 1, wherein a ratio of platinum in a metal valency of +2 to platinum in a metal valency of 0 is greater than 0.33; a local coordination environment of platinum is within 81-87.5% of a local coordination environment of pure PtO; or any combination thereof.

7. The process of claim 1, wherein the oxidized platinum species is characterized by coordination number greater than or equal to 2.

8. The process of claim 1, wherein the oxygen atom transfer electrocatalyst comprises a homogeneous distribution of palladium and platinum; the oxidized platinum species are embedded in the oxidized palladium species; the oxidized platinum species are stabilized by the oxidized palladium species; or any combination thereof.

9. The process of claim 1, wherein the metal valency of platinum is stable under applied oxidative potentials in the range of 0.0 V to 3.0 V vs. SHE.

10. The process of claim 1, wherein the oxygen atom transfer electrocatalyst further comprises platinum and palladium annealed at a temperature selected from the range of 300 degrees C to 700 degrees C.

11. The process of claim 10, wherein the oxygen atom transfer electrocatalyst is annealed on an amorphous carbon substrate; is annealed under static air conditions or flowing air conditions; is annealed over the range selected from 1 hours to 5 hours; or any combination thereof.

12. The process of claim 1, wherein the voltage applied is selected from the range of 1.0 to 3.0 V vs. SHE.

13. The process of claim 1, wherein the epoxide is generated at a Faradaic efficiency greater than 20%.

14. The process of claim 1, wherein the electrolyte further comprises a non-aqueous solvent; the non-aqueous solvent is a polar aprotic solvent; the polar aprotic solvent comprises acetonitrile, propylene carbonate, tetrahydrofuran, dimethylformamide, dimethylsulfoxide, or any combination of these; the non-aqueous solvent is characterized by an ability to improve the solubility of the alkene; the non-aqueous solvent is miscible with the water; or any combination thereof.

15. The process of claim 1, wherein the electrolyte further comprises $BF_4^-$, $PF_6^-$, $PO_4^{3-}$, $ClO_4^-$, tetra-n-butylammonium+, $Li^+$, $Na^+$, $H^+$, $K^+$, $Rb^+$, or any combination thereof.

16. The process of claim 1, wherein the water is present at a concentration selected over the range of 0.1 M to 20 M; the water is an oxygen atom transfer source; the electrolyte has a pH between 3.0 and 12.0; or any combination thereof.

17. The process of claim 1, wherein hydrogen, the water, or any combination of these is generated at the cathode and oxygen, the water, carbon dioxide or any combination of these is reduced at the cathode.

18. The process of claim 1, wherein the cathode comprises Pt, Ni, Cu, Pd, Au, Ag, an alloy of any of these, or any combination of these.

19. The process of claim 1, wherein the process is carried out at a temperature selected over the range of 25 degrees C to 100 degrees C; at a pressure selected over the range of 1.0 bar to 1000.0 bar; or any combination thereof.

20. The process of claim 1, wherein the oxygen atom transfer electrocatalyst further comprises an ionomer; the ionomer establishes gas diffusion channels; the ionomer further comprises a hydrophobic backbone; the ionomer comprises an anion exchange membrane or a cation exchange membrane; the anion exchange membrane or the cation exchange membrane comprises at least one of poly (perfluorosulfonic acid), a functionalized polyphenylene, a partially fluorinated anion exchange membrane, a poly(aryl piperidinium) resin, an imidazolium functionalized polystyrene, a sulphonated poly(ether-ether-ketone), a sulfonated polyimide, a polybenzimidazole; or any combination thereof.

21. The process of claim 1, wherein the anode and the cathode are in contact with an ionically conductive membrane.

22. The process of claim 1, wherein the alkene is comprised of 2 to 100 carbon atoms; a cycloalkene; or any combination thereof.

23. The process of claim 1, wherein the epoxide comprises propylene oxide, ethylene oxide, or epichlorohydrin; the selectivity for the epoxide is greater than or equal to 90; or any combination thereof.

* * * * *